US006631761B2

(12) United States Patent
Yuan et al.

(10) Patent No.: US 6,631,761 B2
(45) Date of Patent: Oct. 14, 2003

(54) WET ELECTRIC HEATING PROCESS

(75) Inventors: Jian-Yang Yuan, Edmonton (CA); Ezra Eddy Isaacs, Edmonton (CA); Haibo Huang, Edmonton (CA); Deborah G. Vandenhoff, Bellaire, TX (US)

(73) Assignee: Alberta Science and Research Authority, Edmonton (CA)

( * ) Notice: Subject to any disclaimer, the term of this patent is extended or adjusted under 35 U.S.C. 154(b) by 0 days.

(21) Appl. No.: 10/016,626

(22) Filed: Dec. 10, 2001

(65) Prior Publication Data

US 2003/0141053 A1 Jul. 31, 2003

(51) Int. Cl.[7] ..... E21B 36/04
(52) U.S. Cl. ..... 166/248; 166/60; 392/301
(58) Field of Search ..... 166/248, 60; 392/301, 392/302

(56) References Cited

U.S. PATENT DOCUMENTS

| | | | | |
|---|---|---|---|---|
| 3,943,059 A | * | 3/1976 | Chiu | 507/236 |
| 3,946,809 A | | 3/1976 | Hagedorn | 166/248 |
| 4,010,799 A | * | 3/1977 | Kern et al. | 166/248 |

(List continued on next page.)

FOREIGN PATENT DOCUMENTS

| | | | |
|---|---|---|---|
| CA | 994694 | 8/1976 | 196/14 |
| CA | 1304287 | 6/1992 | 166/39 |
| EP | 0 387 846 | 9/1990 | E21B/36/04 |
| GB | 1 595 082 | 8/1991 | E21B/43/18 |

OTHER PUBLICATIONS

Mokrys, I.J. and Butler, R.M. *In–Situ Upgrading of Heavy Oils and Bitumen by Propane Deasphalting: The Vapex Process*, SPE Production Operations Symposium, Oklahoma City, OK (Mar. 21–23, 1993) Paper No. SPE 25452, pp. 409–424.

Sierra, R., Tripathy, B., Bridges, J.E. and Ali, S.M. Farouq. *Promising Progress in Field Application of Reservoir Electrical Heating Methods*, SPE International Thermal Operations and Heavy Oil Symposium, Margarita, Venezuela, (Mar. 12–14, 2001) Paper No. SPE 69709, pp. 1–17.

Boberg, T.C. *Thermal Methods of oil Recovery, Butler Model: Gravity Drainage Tar Sand Case*, John Wiley & Sons, 411 pgs. (1988) pp. 166–168.

Butler, R.M. *Thermal Recovery of Oil and Bitumen*, Prentice Hall, 528 pgs. (1991) pp. 258–259.

Ajax Magnethermic Canada Limited *What is Induction Heating/Melting*? www.ajaxcan.com/ajax2.html, 1997–2000.

International Search Report established by European Patent Office in connection with corresponding PCT/CA02/01838; Mar. 3, 2003.

*Primary Examiner*—David Bagnell
*Assistant Examiner*—Matthew J Smith
(74) *Attorney, Agent, or Firm*—Kurt D. Van Tassel; Deborah G. VandenHoff; Van Tassel & Associates

(57) ABSTRACT

A wet electric heating ("WEH") process involves establishing electrode zones ("e-zones") around conductors (e.g., wells) for distributing electric current and thereby generating and distributing heat accordingly through a target region in a subterranean formation having hydrocarbons. The inventive WEH process takes into account e-zone geometric shape, spacing and/or spatial orientation to provide a more diffuse distribution of increased temperature values within the target region, compared to conventional electric heating processes, during at least the first 10% of a time interval when an electric potential is applied. The most significant source of heating for diffuse distribution of increased temperature values in the inventive WEH process arises from electric energy delivered directly to and throughout the target region, namely an electric heating distribution effect, which significantly reduces reliance on thermal conduction and/or fluid convection in distributing heat relatively early in the process of generating heat by electric ohm-heating.

82 Claims, 16 Drawing Sheets

(4 of 16 Drawing Sheet(s) Filed in Color)

U.S. PATENT DOCUMENTS

| | | | | | |
|---|---|---|---|---|---|
| RE30,738 | E | | 9/1981 | Bridges et al. | 166/248 |
| 4,344,485 | A | | 8/1982 | Butler | 166/271 |
| 4,362,610 | A | * | 12/1982 | Carpenter | 204/263 |
| 4,446,036 | A | * | 5/1984 | Hsieh et al. | 507/259 |
| 4,545,435 | A | * | 10/1985 | Bridges et al. | 166/248 |
| 4,620,592 | A | | 11/1986 | Perkins | 166/245 |
| 4,645,004 | A | * | 2/1987 | Bridges et al. | 166/248 |
| 4,702,319 | A | * | 10/1987 | Bock et al. | 166/275 |
| 4,926,941 | A | | 5/1990 | Glandt et al. | 166/248 |
| 5,060,726 | A | * | 10/1991 | Glandt et al. | 166/248 |
| 5,407,009 | A | | 4/1995 | Butler et al. | 166/266 |
| 5,420,402 | A | | 5/1995 | Bridges et al. | 219/772 |
| 5,607,016 | A | | 3/1997 | Butler | 166/263 |
| 5,922,653 | A | * | 7/1999 | Ahmed et al. | 507/242 |

* cited by examiner

LEGEND:

$\Gamma_p$ is a ratio of ratio of the rate of temperature increase at the HT region to the rate of temperature increase at the mid-point between two electrodes r is the effective electrode radius d is half the distance from the centerline of one electrode to the centerline of the other electrode

WET ELECTRIC HEATING PROCESS

FIELD OF THE INVENTION

This invention relates to a process for producing hydrocarbons from a subterranean formation. More specifically, the invention relates to a method of using wet electric heating to facilitate hydrocarbon production, and more particularly, producing hydrocarbons having pre-heated viscosities of about 100 centipoise or greater.

BACKGROUND DISCUSSION

Much of the hydrocarbons produced under primary methods (i.e., non-thermal processes) has a viscosity, ranging from about 0.5 centipoise ("cp") to about 100 cp. Because of this relatively low viscosity, a significant percentage of the oil in place ("OIP") in the subterranean formation can be produced without resorting to thermal processes. Typically the percentage of the OIP that can be produced under primary methods will range from about 3% to about 30%.

However, there are significant deposits having higher viscosity hydrocarbons with pre-heated viscosities in the range from about 100 cp to about 1,000,000 cp or even greater. Typically, for a subterranean formation containing hydrocarbons with a pre-heated viscosity of about 100 cp to about 1,000 cp, roughly 3 to 10% of OIP can be recovered using conventional primary techniques. To produce beyond that percentage, of course, requires one or more processes, including among others, thermal processes (i.e., secondary recovery).

For convenience, hydrocarbons with pre-heated viscosities in the about 100 cp to about 1,000 cp range will be referred to herein as "heavy oil," while hydrocarbons with pre-heated viscosities in the range of greater than about 1,000 cp to about 1,000,000 cp or greater will be referred to herein as "super heavy oil." One of the more common types of super heavy oil is tar sands, also known as oil sands or bituminous sands.

Tar sand deposits are impregnated with dense, viscous hydrocarbons and are typically a mixture of sand, water and bitumen. Bitumen is a hydrogen-deficient oil that can be upgraded to a commercially desirable hydrogen to carbon ratio by carbon removal (i.e., coking) or hydrogen addition (i.e., hydrocracking). The sand component in a tar sands deposit is primarily quartz, which is typically about 80% to 85% by weight ("wt") of the deposit, while the remainder is bitumen and water, which comprises about 15 wt % to 20 wt % of the tar sands.

Worldwide tar sand deposits can provide an enormous resource of hydrocarbon reserves. In September, 1982, during the Proceedings of the Second International Conference on Heavy Crude and Tar Sands (Caracas, Venezuela), R. F. Meyer and P. A. Fulton estimated the total bitumen in place globally as $4.07\times10^{12}$ barrels ("bbl") (about 4 trillion bbl). Of this total bitumen in place, they estimated about $2.4\times10^{12}$ bbl in seven deposits in Alberta, Canada, about $1\times10^{12}$ bbl in four deposits in Venezuela, about $5.6\times10^{11}$ bbl (0.56 trillion bbl) in Russia and about 3.4×10110 (0.034 trillion bbl) in 53 deposits in the United States.

Of course, because of bitumen's high viscosity and the intimate mixture bitumen forms with sand and connate water, tar sand deposits and other super heavy oil deposits cannot be exploited using primary oil recovery techniques. Therefore, the super heavy oil (e.g., bitumen) has often been mined, presuming the deposit is at a sufficiently shallow depth, or otherwise produced using a non-mining, but enhanced recovery, process.

Non-mining processes that may be used include thermal and non-thermal processes. Non-thermal processes can include cold production (i.e., sand production) and solvent injection, while thermal processes can include in-situ combustion or a hot aqueous fluid injection and displacement or drive process using hot water, steam or a steam/solvent mixture. But typically a hot aqueous fluid, such as hot water or steam, is used to reduce oil viscosity and displace the oil. For example, one common heavy oil or super heavy oil recovery technique involves steam injection, followed by a steam "soaking" phase and subsequent recovery of the reduced viscosity oil, also known as huff-n-puff or cyclic steam stimulation ("CSS"). Huff-n-puff or CSS can also be combined with an electric heating process to provide additional heat and viscosity reduction.

For example, in U.S. Pat. No. 3,946,809 (Mar. 30, 1976), Hagedorn suggests that CSS should be followed by electric heating so that brine can be injected into the region where the oil was displaced under the CSS process. Specifically, Hagedorn's proposed process involves four steps: (1) CSS, which is terminated when there is interconnection of CSS heated zones between wells; (2) producing oil and water; (3) injecting high conductivity fluid into CSS heated zones; and (4) completing wells as electrodes and allowing current to flow between wells to increase the temperature of oil not heated in CSS. And more specifically, Hagedorn suggests that the volume of high conductivity fluid should be sufficient to displace substantially all water condensed from steam from the CSS heated zones. But Hagedorn warns that "the volume should not be so great, however, as to displace substantial amounts of high-electrical-resistivity connate water from the unheated portion of the reservoir" (col. 6:1–4).

As discussed in more detail below, it is well understood by those skilled in the art of thermal oil recovery processes that when steam is injected into a formation, it will rise forming a conical bowl steam zone around a vertical well. See for example, Boberg, T. C. *Thermal Methods of Oil Recovery* John Wiley & Sons, 411 pgs.; pg. 166; 1988 and Butler, R. M. *Thermal Recovery of Oil and Bitumen* Prentice Hall, 528 pgs., pg. 258–259; 1991.

So, Hagedorn suggested either prohibiting or restricting the amount of electrolytic or high conductivity fluid (e.g., brine solution) introduced into the unheated portion of a reservoir, where oil was still substantially in place, was important in practicing an electric heating process. This was understandable since it was generally believed by Hagedorn and others skilled in the art then, and up to now, that increasing the electrode zone's effective radius was, alone, the critical factor to effectively electrically heat a formation, while ignoring electrode zone spacing, geometric shape and spatial orientation effects. However, surprisingly and unexpectedly, the inventors have discovered that, by properly accounting for electrode zone spacing, geometric shape and/or spatial orientation effects in substantial accordance with the detailed description provided below, a target region in a formation heating will be more diffuse than in a conventional electric heating process, like Hagedorn's for example, that fails to properly account for spacing between electrode zones, geometry effects (e.g., electrode zone surface area and shape) and/or electrode zone spatial orientation.

For example, in a CSS configuration, such as Hagedorn used, it is important to ensure that an electrolytic or high electric conductivity fluid is in place in both the unheated, as well as any previously heated portions of the reservoir, contrary to what Hagedorn, in fact, taught. Put another way, beyond the electrode zone's size, it is also important to ensure that the spacing, geometric shape and/or spatial orientation of the electrode zone formed with the injected electrolytic fluid has a suitable combination of surface area and shape for eliminating or reducing, among other things, unwanted "edge" effects. "Edge" effects lead to undesired small volume "hot spots" (i.e., more intensely heated regions), rather than relatively more diffuse heating between electrode zones, like that generated with the inventive WEH process more fully described below.

Consequently, while Hagedorn and other proponents of electric heating processes in oil formations have focused primarily on the electrode zone's size, they have, in the meantime, overlooked and/or incorrectly assessed the effects that electrode zone spacing, geometric shape and/or spatial orientation would have on significantly improving electric heating rate and distribution. Also, another factor that has been overlooked and/or incorrectly assessed is the relative magnitude of the effective electrode zone diameter and the distance between wells.

More specifically, while a CSS steam process can produce an elliptical cross-sectional area at the top of the CSS steam zone, as illustrated in Hagedorn's FIG. 2, this elliptical cross-sectional area does not extend along the entire, much less a substantial portion of, the wellbore's length. Instead, the CSS steam zone is a conical bowl-like shape (vs. an elliptical cylinder shape), narrowing down to substantially the diameter of the wellbore itself at the bottom of the injection zone, where the electrode zone diameter is significantly smaller than the distance between wells, compared to the top of the conical bowl. Therefore, when high conductivity fluid is injected into the CSS steam zone, in the manner Hagedorn describes, so as not to displace connate water outside the CSS zone, the injected fluid will form a conical bowl-shaped electrode zone around the well. Then, when a current flows between the electrodes, a point source is created between facing edges of the top elliptical surface of the bowls. But little to no heating occurs between the electrode zones below the top surfaces of the bowls.

Moreover, hot spots at the point sources can overheat the connate water around the point sources. And when the connate water is overheated, water vaporizes to steam, thereby potentially disrupting electrical connectivity between the electrodes, depending on the proximity of the hot spot to the conductor. Thereafter, current flow may be disrupted between the electrode zones, thereby disrupting any further electric heating. Of course, this type of performance is generally unacceptable to the oil and gas industry and illustrates why the industry has remained reluctant to deploy the conventional electric heating processes known to those skilled in the art up to now.

Hagedorn's disclosure, therefore, illustrates how those skilled in the art of thermal recovery processes, more particularly, electric heating processes, have understood the potential benefit of using an electrolytic fluid to enhance an electric heating process. But likewise, Hagedorn's disclosure, among others, also illustrates how those skilled in the art have failed to appreciate and understand the importance of using a suitable combination of electrode zone surface area, shape and spatial orientation to generate significantly improved electric heating rates and distribution between electrode zones vs. the heating rates and distribution generated by conventional electric heating methods, in which the electrode zone spacing, geometric shape and/or spatial orientation have been overlooked and/or incorrectly assessed.

In addition to CSS, steam assisted gravity drainage ("SAGD") techniques, such as those disclosed by Butler in U.S. Pat. No. 4,344,485 and Edmunds in CA U.S. Pat. No. 1,304,287, each incorporated herein by reference, can also be used to recover heavy oil and super heavy oil from subterranean formations. These non-drive, non-displacement techniques rely primarily on producing a steam chamber covering a large surface area in the formation near the region where heavy oil is located, while also relying on the thermal conduction effect and, to some degree, convective heat transfer at the steam front, to ultimately heat the nearby heavy oil, thereby lowering its viscosity and increasing its flowability accordingly. In turn, the oil can flow simply under the influence of gravity, rather than by a displacement or drive process, to a second well, which is normally a horizontal production well.

During the SAGD initialization phase little to no oil is produced, but with continued steam injection a steam chamber is produced and fluid communication with a second well is established. In accordance with Butler's disclosure in U.S. Pat. No. 4,344,485, for his disclosed SAGD process he states that "to be practical, it is necessary to develop steam chambers having very large surface areas relatively quickly." (see col. 8:27–30). To achieve this result, Butler suggests developing a vertical fracture between an injection well and production well and injecting steam into the fracture to create a steam chamber with a narrow width but considerable vertical and horizontal dimensions with respect to the vertical fracture. Accordingly, thermal communication between the injection and production wells is then established as the region surrounding the fracture becomes saturated with steam. In accordance with the SAGD process Edmunds discloses in CA 1,304,287, the formation is not fractured, but rather the initialization phase first requires fluid communication between the production and injection wells to establish thermal communication for creating a steam chamber covering a relatively large surface area of the formation. Commonly this is achieved by circulating steam independently in each well. Consequently, this can make the process time consuming, while also requiring significant energy to initialize the process.

Unfortunately though, the initialization phase for a SAGD process, whether by either of these disclosures, relies mainly on thermal conduction through the formation, while convective heat transfer, if any, becomes less a contributing factor in enhancing the rate the steam chamber is developed as the viscosity of the oil in place increases. So, SAGD initialization can be time consuming and costly when using steam exclusively as the heating source, despite fracturing techniques like those suggested by Butler in U.S. Pat. No. 4,344,485.

Similarly, the Vapex process, which is closely related to the SAGD process, uses propane alone (Dry Vapex) or a propane/steam mixture (Wet Vapex) to create a communication path between an injection well and production well. In the Wet Vapex process there are two fluid containing chambers. The first chamber is a SAGD-like steam chamber, but which contains both steam and a hydrocarbon vapor near its condensation point (i.e., wet hydrocarbon vapor, hence "Wet Vapex") and a second larger chamber containing propane ($C_3$), primarily in a gaseous state. The Wet Vapex process is described more fully in the SPE paper "In-Situ Upgrading of Heavy Oils and Bitumen by Propane Deasphalting: The Vapex Process" (SPE 25452 I. J. Mokrys and R. M. Butler, presented Mar. 21–23, 1993 at the Production Operations Symposium, Oklahoma City, Okla.), which suggests, for example, that propane is injected with steam to produce both a steam/$C_3$ chamber and a lower temperature $C_3$ chamber. The steam chamber in the vicinity of the injection and production wells strips propane from the oil, while the stripped $C_3$ is recycled internally into the lower temperature $C_3$ chamber that spreads laterally into the formation where it dilutes, upgrades and extracts the oil. But before producing the steam/$C_3$ and $C_3$ chambers, the authors suggest initializing a Wet Vapex process with steam alone to create a communication path between the injection and production wells. Again, however, in field use, this steam initialization phase is time consuming. Moreover, the conventional steam initialization phase can often adversely affect the economics of the Wet Vapex or any other steam-based process that uses one or more fluid chambers for conductive heating.

In the Dry Vapex process, described in U.S. Pat. No. 5,407,009 (Butler et al., Apr. 18, 1995) and U.S. Pat. No. 5,607,016 (Butler, Mar. 4, 1997), solvent vapor is injected into an aquifer located below the hydrocarbon deposit. Solvent vapor is injected with a less soluble gas, such as natural gas or nitrogen, to mobilize hydrocarbons.

Steam is commonly used as a heat source for establishing fluid communication between wells and/or for thermal recovery processes. However, heating with steam relies on thermal conduction, which can be time-consuming. Accordingly, alternative heat sources have been proposed. One alternative to steam heating is electric heating, which has been proposed for reducing hydrocarbon viscosity. However, the prevailing view in the industry is that, absent special measures to improve uniform formation heating relatively comparable to or better than steam, electric heating is wasteful and uneconomical, and most particularly uneconomical for tar sand deposits. Also, depending on the conversion process used and the operating conditions, converting fossil fuel energy to electric power is only about 30 to 40 percent efficient.

U.S. Pat. No. 4,926,941 by Glandt et al. (May 22, 1990) proposes a process for electric heating of tar sand deposits containing thin, high conductivity layers, which are typically shales that have tar sands alluvially deposited (i.e., by flow of water) within them. Glandt et al. propose that a thin conductive layer, such as a shale, is heated to a temperature sufficient to form an adjacent thin preheated zone, in which the viscosity of the tar is reduced enough to permit steam injection into the thin preheated zone. Electric heating is then discontinued and the deposit is steam flooded. According to Glandt et al., this electric heating generates a uniformly heated plane, such as the shale layer, within the tar sand deposit. However, this technique for electric heating clearly requires a shale layer or similar type of naturally occurring thin conductive heating layer. Consequently, there are formation requirements limiting where this heating technique can be used effectively. Moreover, the requirement for a thin conductive layer makes the process poorly adaptable to non-displacement processes, such as SAGD.

Also, U.S. Pat. No. 4,620,592 by Perkins (Nov. 4, 1986) discloses an electric heating method where a formation with multiple sets of a plurality of spaced apart wells is progressively produced in a preselected direction. A first set of wells is used to both apply electric heat to the formation and inject brine. Then electric heating and brine injection are applied to a second set of wells spaced in a preselected direction from the first set of wells. Thereafter, electric heating in the first set of wells is ceased and hot aqueous fluid injection is commenced. These steps are sequentially moved to co-act with each while traversing the formation and thereby producing the formation in a more energy efficient manner. Again, however, this combined technique of electric heating with a fluid displacement is poorly adaptable to non-displacement processes, such as SAGD.

Moreover, each of the processes discussed above and other electric heating processes for hydrocarbon containing formations has not used the electric heating most efficiently. Also, as indicated by each of the above disclosures, those skilled in the art have routinely relied on using electric heating in combination with a fluid displacement or drive process to provide more uniform electric heating.

Accordingly, there is a need for an improved electric heating process that can effectively. operate without necessarily requiring a displacement or drive process to provide more diffuse electric heating of a formation, particularly a formation containing heavy oil or super heavy oil. Also, there is a need for an electric heating process that provides more diffuse electric heating in a target region between electrodes than has been disclosed to this date.

SUMMARY OF THE INVENTION

According to the invention, there is provided a method for heating a subterranean formation having hydrocarbons, the method comprising: (a) providing at least a first conductor and a second conductor, wherein (i) the first and second conductors are spaced-apart in the formation, and (ii) there is electrical connectivity between the first and second conductors; (b) establishing at least a first electrode zone and a second electrode zone, each electrode zone having electrolyte, around the first and second conductors, respectively, and thereby creating a target region, having a center point, between opposing faces of the first and second electrode zones, wherein each electrode zone has an average effective radius that is at least about 2.3% of the distance between the centerline of the first conductor and the centerline of the second conductor; and (c) establishing at least about a 50% difference in electrical conductivity between the target region and independently each of the first and second electrode zones, wherein the electrical conductivity of the first and second electrode zones are each independently greater than an initial electrical conductivity of the target region, wherein the initial electrical conductivity of the target region is the average electrical conductivity, prior to applying an electric potential difference between the first and second electrode zones, in a substantially spherical portion centered around the center point of the target region, the substantially spherical portion of the target region having a radius of about 15% of the average spacing between opposing faces of the first and second electrode zones; so that when an electric potential difference is applied between the first and second electrode zones, a substantially diffuse distribution of increased temperature values is generated within the target region during at least the first 10% of a time interval when the electric potential difference is applied.

According to the invention, there is also provided a method for heating a subterranean formation having hydrocarbons, the method comprising: (a) providing at least a first conductor and a second conductor, wherein (i) the first and second conductor are spaced-apart in the formation, and (ii) there is electrical connectivity between the first and second conductors; (b) establishing at least a first electrode zone and a second electrode zone, each electrode zone having electrolyte, around the first and second conductors, respectively, and thereby creating a target region, having a center point, between opposing faces of the first and second electrode zones, wherein each electrode zone has an average effective radius that is at least about 2.3% of the distance between the centerline of the first conductor and the centerline of the second conductor; and (c) establishing at least about a 50% difference in electrical conductivity between the target region and independently each of the first and second electrode zones, wherein the electrical conductivity of the first and second electrode zones are each independently greater than an initial electrical conductivity of the target region, wherein the initial electrical conductivity of the target region is the average electrical conductivity, prior to applying an electric potential difference between the first and second electrode zones, in a substantially spherical portion centered around the center point of the target region, the substantially spherical portion of the target region having a radius of about 15% of the average spacing between opposing faces of the first and second electrode zones; so that at about 10% of a predetermined time interval over which an electric potential difference is continuously applied between the first and second electrode zones, there is at most about 60% deviation between the maximum and minimum values for a gamma ratio, Γ, generated within the target region, wherein %Γ deviation is calculated as:

$$\%\Gamma\text{Deviation}=[(\Gamma_{max}-\Gamma_{min})/\Gamma_{max}]\times 100$$

where

%Γ Deviation is the deviation of Γ values determined in a target region divided into n imaginary layers, wherein each imaginary layer has a highest temperature $T_n$ at a point radially located a distance x from the first conductor and the thickness of the imaginary layer is determined by the length of an imaginary line parallel to and a radial distance x from the first conductor, wherein the temperature values along the imaginary line fall in a range $T_n \geqq T \geqq 0.85T_n$, as measured at about the initial 10% of the continuous electric heating time interval;

n is greater than or equal to 2;

$\Gamma_{max}$ is the highest Γ of the n respective Γ values determined in the n layers at about the initial 10% of the continuous electric heating time interval;

$\Gamma_{min}$ is the lowest Γ of the n respective Γ values determined in the n layers at about the initial 10% of the continuous electric heating time interval; and Γ is a ratio of a rate of temperature increase for the portion of the target region having the highest temperature value versus a rate of temperature increase at an effective mid-point between the first and second electrode zones.

According to the invention, there is further provided a method for heating a subterranean formation having hydrocarbons, the method comprising: (a) providing at least a first conductor and a second conductor, wherein (i) the first and second conductor are spaced-apart in the formation, and (ii) there is electrical connectivity between the first and second conductors; (b) establishing at least a first electrode zone and a second electrode zone, each electrode zone having electrolyte, around the first and second conductors, respectively, and thereby creating a target region, having a center point, between opposing faces of the first and second electrode zones, wherein each electrode zone has an average effective radius that is at least about 2.3% of the distance between the centerline of the first conductor and the centerline of the second conductor; and (c) establishing at least about a 50% difference in electrical conductivity between the target region and independently each of the first and second electrode zones, wherein the electrical conductivity of the first and second electrode zones are each independently greater than the initial electrical conductivity of the target region, wherein the initial electrical conductivity of the target region is the average electrical conductivity, prior to applying an electric potential difference between the first and second electrode zones, in a substantially spherical portion centered around the center point of the target region, the substantially spherical portion of the target region having a radius of about 15% of the average spacing between the opposing faces of the first and second electrode zones; so that at about 10% of a predetermined time interval over which an electric potential difference is continuously applied between the first and second electrode zones, there is at most about 35% deviation between the highest and lowest maximum temperatures, $T_{max}$, generated within the target region, wherein $\%T_{max}$ deviation is calculated as:

$$\%T_{max}\text{Deviation}=[(T_{max-high}-T_{max-low})/T_{max-high}]\times 100$$

where $\%T_{max}$ Deviation is the deviation of $T_{max}$ values determined in a target region divided into n imaginary layers, wherein each imaginary layer has a highest temperature $T_n$ at a point radially located a distance x from the first conductor and the thickness of the imaginary layer is determined by the length of an imaginary line parallel to and a radial distance x from the first conductor, wherein the temperature values along the imaginary line fall in a range $T_n \geqq T \geqq 0.85T_n$, as measured at about the initial 10% of a continuous electric heating time interval;

n is greater than or equal to 2;

$T_{max-high}$ is the highest $T_{max}$ of the n respective $T_{max}$ values determined in the n layers at about the initial 10% of the continuous electric heating time interval; and $T_{max-low}$ is the lowest $T_{max}$ of the n respective $T_{max}$ values determined in the n layers at about the initial 10% of the continuous electric heating time interval.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The wet electric heating ("WEH") process claimed below ("inventive WEH process") will be better understood by referring to the following detailed description of preferred embodiments and the non-limiting illustrations referenced therein, in which:

FIG. 6C also illustrates an example target region between a horizontal electrode and a vertical electrode;

FIG. 6E also illustrates an example target region between a pair of horizontal electrodes;

DETAILED DESCRIPTION

Definitions

Figure 1:
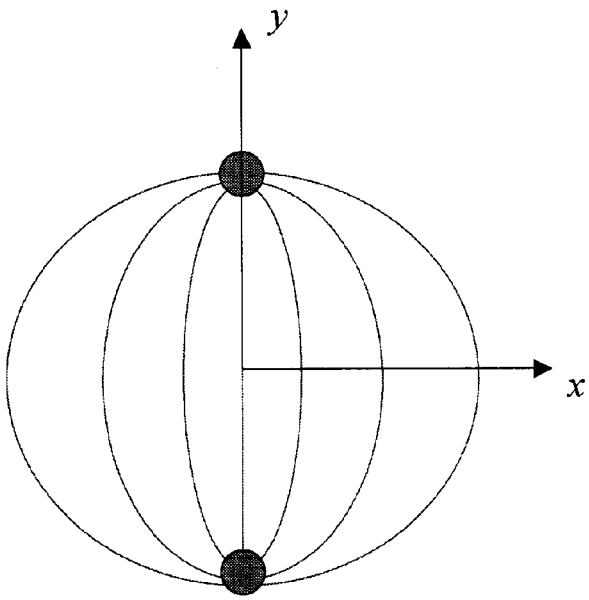
FIG. 1 illustrates electric field symmetry between electrodes.

"Electrical connectivity" means a contiguous network of conductive material between two points sufficient to support an electric current therebetween. Conductive materials include, without limitation, indigenous and non-indigenous electrolytic fluid and conductive rock.

A "conductor" is a material that offers a lower resistance to the flow of electric current than the formation in which it is disposed. Accordingly, when an electrical potential difference is applied across a conductor, a relatively larger current will preferentially flow through the conductor than through the formation.

An "electrode zone" ("e-zone") is a region, including a conductor, that has indigenous and/or supplemental electrolytic fluid with a higher electrical conductivity than the region outside the e-zone. The e-zone enlarges at least the conductor's effective radius thereby producing a larger conductor with an overall larger volume and surface area, accordingly.

"Electrode zone spacing" or "e-zone spacing" means, for each point along the length of an electrode zone, the length of an imaginary line spanning the shortest distance between opposing surfaces of two average electrode zone perimeters of the same or different type.

"Average electrode zone side perimeter" or "average e-zone side perimeter" means the outer boundary of an electrode zone circumscribing its electrode zone, established by determining, for each point along the length of an electrode zone, the average smooth line path, contained in a plane perpendicular to the e-zone's conductor, through the irregular projections and dips, if any, in the outer boundary of the electrode zone.

"Average electrode zone end perimeter" or "average e-zone end perimeter" means either the first or second outer e-zone face perpendicular to an electrode zone's conductor defined by determining the average plane through the irregular projections and dips, if any.

The "effective e-zone radius" is calculated by: (1) determining the total volume of the e-zone, irrespective of its shape, (2) determining an effective cross-sectional area of the e-zone by dividing the total volume by the total length of the e-zone along the conductor, and (3) determining the effective radius for a corresponding cylinder having a cross-sectional area equal to the effective cross-sectional area calculated in step (2).

"Electrolytic fluid" is a fluid having an electrical conductivity of at least about 0.025 Siemens/meter ("S/m").

"Indigenous electrolytic fluid" is an electrolytic fluid naturally occurring in a formation prior to establishing an e-zone.

"Supplemental electrolytic fluid" means an electrolytic fluid that is (a) injected into the formation, (b) produced in-situ in the formation by injecting a solute slurry into the formation, or (c) produced by using a combination of both types of electrolytic fluid described in (a) and (b), accordingly.

"Electrical conductivity" is a measure of the ability of a substance to conduct electrical current. It is also the reciprocal of a substance's resistivity, which is a substance's ability to oppose the flow of electric current through the substance. Thus, a conductor that provides lower opposition to electric current flow has a higher conductivity. More specifically, for example, electrical conductivity can be expressed as a ratio of current density (i.e., electric current flowing through the conductor per unit cross-sectional area) to electric field strength (i.e., force per unit charge experienced by a small charge placed at a point in an electric field). Accordingly, the higher the conductivity, the more effective the conductor is in transmitting electric current across the conductor without incurring a significant loss of electric energy to heating the conductor. SI units used to measure electrical conductivity are Siemens/meter (S/m).

"Thermal conductivity" or "TC" is a measure of a medium's ability to transmit energy in the form of heat through that medium without involving the movement of the medium itself. More specifically, for example, one specific type of thermal conductivity measurement is obtained by measuring the amount of heat flow across a surface per unit area per unit time and dividing by the negative of the temperature rate of change with distance in a direction perpendicular to the surface. This specific type of conductivity measurement is sometimes referred to as a coefficient of heat conductivity or thermal conductivity. Units used to measure thermal conductivity are J/m·day·K or W/m·K.

"Target region" is generally a region between two electrode zones having boundaries approximately bounded by at least two pairs of imaginary opposing planes.

For a pair of parallel conductors, the first pair of opposing planes bounding the target region is substantially parallel with the length of the first and second conductor, respectively, while each plane of the first pair is substantially tangent to and interconnecting the average electrode zone side perimeter at the pair of outermost points on the electrode zone side perimeter of each electrode zone (e.g., electrode zone A's outermost points $A_1$ and $A_2$ are each independently connected to electrode zone B's outermost points $B_1$ and $B_2$, respectively, by the respective tangential plane to those point pairs $A_1/B_1$ and $A_2/B_2$). And each plane of the second pair of opposing planes is, independently, substantially tangent to and interconnecting the average electrode zone end perimeter of each electrode zone. An example target region for a pair of parallel conductors is illustrated in FIG. 6E, discussed more fully below.

For a pair of non-parallel conductors, the first pair of opposing planes bounding the target region is substantially parallel with the length of the first conductor, while each plane of the first pair is substantially tangent to the average electrode zone side perimeter at the pair of outermost points on the electrode zone side perimeter of the first electrode zone (e.g., electrode zone C's outermost points $C_1$ and $C_2$) and either dissects the second electrode zone into three parts, which parts may have equal or unequal lengths (e.g., electrode zone D is orthogonal to electrode zone C) or is substantially tangent to the average electrode zone side perimeter at the pair of outermost points on the electrode zone perimeter of the second electrode zone (e.g., horizontal/vertical conductor pair, electrode zone D's outermost points $D_1$ and $D_2$). And the second pair of opposing planes is substantially parallel to the length of the second conductor, while each plane of the second pair is substantially tangent to the average electrode zone side perimeter of the second electrode zone and dissects the first electrode zone into three parts, which parts may have equal or unequal lengths. An example target region for a horizontal/vertical conductor pair is illustrated in FIG. 6C, discussed more fully below.

A "targeted formation" includes the target region plus portions of the formation adjacent to the target region also of interest to a reservoir and/or petroleum engineer and that are desirably heated to at least a predetermined threshold temperature. However, since heating the overburden of a targeted formation would produce no benefit to heating the oil in place, either directly or indirectly, overburden volume heated, if any, to the threshold temperature is excluded from the targeted formation's total volume.

By "localized heating zone," we mean a portion of a target region in which there is a collection of higher temperature values that are relatively diffusely distributed in a proportionately larger volume of the target region's total volume as compared to a more concentrated cluster of higher temperature values generated in a proportionately smaller volume of a target region (e.g., a hot spot) and/or along or proximate to a target region's conductor, whether there is an intervening electrode zone between the conductor and target region or not, (e.g., hot conductor) that would be generated if a conventional electric heating process were independently and exclusively applied to that same target region.

By "conventional electric heating process," we mean an ohm-heating process in which an electric potential difference is applied and that fails to provide for at least one of three electric heating distribution ("EHD") factors, including without limitation, (1) the extent of e-zone spacing uniformity, (2) relative geometry of the e-zones with respect to each other or (3) relative spatial orientation of the e-zones with respect to each other, as well as any combination of two or more of at least these three specified EHD factors, among other factors, if any, that may affect electric heating distribution within a target region.

By "ohm-heating" or "resistive heating," we mean heat generated by the resistance to electric current flow through a formation (i.e., a resistor) between conductors, across which an electric potential difference is applied. Heating power, P (in Watts), the rate at which electric energy is transformed into heat, is equal to the current (in amps) squared, $I^2$, multiplied by the resistance, R (in ohms), of the formation between the conductors. Therefore, in an ohm-heating process, nearly all of the electrical energy is converted to heat. Also, in an ohm-heating process, since the amount of heating power, $P=I^2\times R$, and the applied electric potential difference in Volts, $V=I\times R$, P is higher for a fixed resistance, R, when the current flow, I, or the applied voltage, V, is higher. Similarly, P is higher for a fixed current, I, when the resistance, R, or the voltage, V, is higher. The same is true for a fixed voltage, V, when the resistance, R, is lower or the current, I, is higher.

By "substantially uniform heating," we mean producing more uniform heating of a target region in a formation relative to that which would be generated by a conventional electric heating process using two spaced-apart electrode zones around the same target region, but which conventional electric heating process fails to account for at least the extent of electrode zone spacing uniformity, relative geometric shape and/or relative spatial orientation effects accounted for when practicing the inventive WEH process in substantial accordance with the detailed description provided herein. For example, the inventive WEH process can generate a unique heat distribution in a formation's target region unlike that generated by any conventional electric heating process known heretofore to those skilled in the art of thermal oil recovery processes.

"Curvature" is the reciprocal of a radius measured at a given point on a curved or angular path, a portion of which curved or angular path can be used to define a circle. Accordingly, a circle with a small radius will have a larger curvature than a circle with a large radius. Meanwhile, the curvature of an ellipse will be different for given points, depending on the location of the point on the curved path (i.e., perimeter) defining the ellipse. Accordingly, the curvature of the curved path at the point where the ellipse's major axis intersects its perimeter is larger than the curvature of the curved path at the point where the ellipse's minor axis intersects its perimeter. For a surface, the curvature is the reciprocal of the average radius of the principle curves passing through and defining the geometric structure of the surface at the point of interest. For a cylindrical surface, the curvature is the reciprocal of the radius of the cylinder, while for a spherical surface, the curvature is twice the reciprocal of the sphere's radius. And, for a flat surface, the curvature is zero, where the radii of the principle curves approach infinity. SI units used to measure curvature are $m^{-1}$.

"Fluid communication" means that mobility of either an injection fluid or hydrocarbon fluid in the subterranean formation, having some effective permeability, is sufficiently high so that such fluids can be produced at the producing wellbore under some.predetermined operating pressure.

"Permeability" is a rock property that quantifies the ability of a porous rock to transmit fluids through the rock due to a pressure gradient, which is the change in pressure along a flow path divided by the length of the flow path. Increased permeability results in greater flow rates for a given pressure gradient. Formations are typically anisotropic, i.e., for the same pressure gradient, fluid may flow easier in one direction than another direction. For example, fluid will tend to flow more easily in a horizontal plane than in a vertical plane.

"Absolute permeability" is the permeability that is determined when only one fluid is present in the rock.

"Effective permeability" is the permeability to one fluid in the presence of one or more other fluids. If two different fluid phases, such as vapor and liquid, are present, the vapor phase interferes with the liquid phase and vice versa. Two immiscible liquid phases (e.g., water and oil) can also interfere with each other. Accordingly, due to a fluid/fluid interference, effective permeability is often, but not always, less than absolute permeability.

A formation's "horizontal permeability," $K_h$, is the permeability of the formation in a substantially horizontal plane. $K_h$ may be greater in one direction than in another. For example, in Alberta, Canada, $K_h$ in the NW-SE direction is often higher than in the NE-SW direction.

A formation's "vertical permeability," $K_v$, is the permeability of the formation in a substantially vertical plane. The difference between a formation's $K_v$ and $K_h$ is often, but not always, greater than the difference between the formation's $K_h$ in different directions.

As used herein, the words "electric" and "electrical" are synonymous and are therefore used interchangeably without implying different meaning.

Overview Discussion

The inventive wet electric heating ("WEH") process enhances the heating rate and distribution in a formation for mobilizing oil in the formation, compared to conventional electric heating processes, by effectively enlarging an electrode by providing an electrolytic fluid electrode zone ("e-zone") contiguous with a conductor, reducing the curvature relative to the conductor. The e-zones take into account e-zone spacing, geometric shape and/or spatial orientation.

More specifically, these e-zone attributes can be used to help reduce the intensity of focused heating effects and/or project higher temperature regions outward from the conductor, as compared to conventional electric heating processes. And, since intense focused heating can cause water vaporization, which in turn can cause a breakdown in electrical connectivity (i.e., a break in electric circuit) that can shut down the electric heating process, either partially or completely, especially when located at the conductor, the reduction of intense focused heating effects significantly improves the heating rate and distribution of the inventive WEH process vs. conventional electric heating processes. Accordingly, for the same applied voltage, more electric energy is converted to heat for substantially uniformly heating a target region between e-zones. Also, compared to conventional electric heating processes, the most significant source of heating in the inventive WEH process arises from electric energy delivered directly to and throughout the target region, without having to rely heavily on thermal conduction.

Electric Heating vs. Thermal Conductivity Heating

Ideally, the thermal conductivity of a targeted formation (i.e., flow or distribution of heat from one point to another point in the rock) would be so large that once heated, whether by electric, steam or other source of energy, the heat generated by the selected energy source would distribute virtually instantaneously and uniformly throughout the target region of interest. In turn, this instantaneous heating would generate an ideally uniform heating effect throughout the target region in a short time interval, thereby avoiding intense "hot spots" or hot conductors that are generated typically with conventional electric heating processes. Of course, as a practical matter, a target region's thermal conductivity is normally not large enough to generate such an ideally instantaneous, uniform heating throughout the target region. Rather, it is often so low that the target region must often be directly heated by delivering the energy source directly to the region of interest without sustaining significant non-target region energy losses. Consequently, intense "hot spots" or hot conductors are usually formed to some extent with many formation heating processes, but most particularly with conventional electric heating processes.

Hence, typically the reservoir and/or petroleum engineer's challenge is to convey the energy source to the target region as efficiently as possible, while minimizing the loss of energy to the areas surrounding, but not part of the targeted formation (i.e., target region plus portions of the formation adjacent to the target region). But in any event, there is usually some heat distribution arising from the thermal conduction ("TC") effect, which is a function of two factors, namely, (1) the targeted formation's inherent thermal diffusion coefficient (i.e., thermal conductivity) and (2) the extent to which heat is not uniformly distributed (i.e., the magnitude of the temperature gradient) throughout the targeted formation. And since the thermal diffusion coefficient (i.e., thermal conductivity) will not usually vary significantly in a targeted formation and will usually be beyond an engineer's control, it is the second factor, namely, the magnitude of the temperature gradient, that most significantly affects the extent to which thermal conduction contributes to the heat distribution process.

For convenience of discussion below, we refer to this second factor as a thermal conduction gradient ("TCG") factor, which, as discussed more fully below, is one indicator of how diffuse an electrical heating process initially distributes heat in a targeted formation. Briefly, when the thermal conductivity remains substantially constant, the greater the TCG factor is, the greater the TC effect is, then accordingly, the greater the differences are between temperature values (i.e., a larger temperature gradient) within a targeted formation or target region, indicating a less diffused electric heating pattern. Likewise, a lower TCG factor indicates a relatively smaller TC effect, and hence relatively smaller differences between temperature values (i.e., a smaller temperature gradient) within a targeted formation or target region with a thermal conductivity comparable to a formation or region having a higher TCG factor. Accordingly, this indicates that electrically generated heat was initially distributed more diffusely in such a formation or region having a lower TCG factor. More specific details about the TCG factor and how it is calculated are explained below under the "Simulation Parameters Overview" discussion, while the comparative TCG factor analysis is discussed, among other things, under the examples below.

Therefore, if this heat distribution from the TC effect, more specifically the TCG factor, is accounted for, we can more accurately determine the rate at which a target region is uniformly heated by considering both (a) direct delivery of the energy source, electric energy in this instance, to the target region and (b) heat generated by that energy source, but flowing to and throughout the target region due to the TC effect.

Of course, a formation's thermal conductivity is primarily determined by the formation's properties, such as, for example, by the collective physicochemical interaction of the formation's rock, oil and/or water. Basically, some formation compositions facilitate heat flow more efficiently than other formation compositions; just as some materials transmit electric energy (e.g., copper vs. graphite) or light energy (e.g., fiber optic vs. cobalt colored glass) more efficiently than others. Accordingly, unless formation composition is altered, thermal conductivity is relatively unaffected by the type of energy source, whether electric, steam or other energy source, used to generate that heat energy.

Thus, depending on the target region's composition, in some instances, its thermal conductivity may be significant. Or, if not necessarily significant for the entire target region, there may be areas within the region where the thermal conductivity can be a contributing factor in how diffuse and/or uniformly the region of interest is heated.

So, between variations in thermal conductivity from formation to formation, as well as variations in the TCG factor, arising primarily from differences between electric heating processes, determining the extent to which the TC effect contributes to distribution of electric heat, once generated within the target region, can be difficult.

There is no single definitive method for independently and quantitatively determining the contribution the TC effect makes in the heat distribution process versus the electric field's contribution to initially generate and distribute electric heat through the target region, since the two contributions are independent, but interrelated and concomitant processes, in which the thermal conduction process ensues from the electric heating distribution effect. Accordingly, the thermal conduction process contributes only to heat distribution, not heat generation, and arises substantially from the extent to which the electric heating process generates and distributes heat in a non-diffuse manner. Put another way, the more diffusely the electric field generates and thereby distributes heat through the target region, the smaller the TC effect's contribution becomes in the heat distribution process. Consequently, generally the more diffusely the electric heat is initially distributed when generated by the electric field, then the contribution the TC effect makes in further heat distribution will be more difficult to detect, since the temperature gradient in the targeted formation or target region will be smaller. Therefore, the relative contribution the TC effect makes, beyond the electric field's effect, in distributing heat generated electrically by a conventional electrical heating vs. the inventive WEH process, can be better assessed by comparing TCG factors between simulations run on similar well configurations, while keeping the thermal conductivity between simulations constant.

But, in any event, in the case of the WEH process described herein, heating will primarily arise from electric heating, namely electric energy delivered directly to and throughout the target region. Consequently, the effectiveness with which the inventive WEH process generates a more diffuse distribution of increased temperature values throughout the target region (i.e., substantially uniform heating pattern), compared to a conventional electric heating process, depends primarily on delivering the electric energy to a formation's target region in substantial accordance with the electrolytic fluid injection procedures and e-zone spacing, geometric shape and/or spatial orientation principles generally discussed herein, in view of the non-limiting, illustrative examples provided below. Therefore, when e-zones are used in accordance with the inventive WEH process, the electric field's ability to distribute electric current and thereby generate and distribute heat accordingly through the target region (i.e., the electric heating distribution effect) is more efficient than conventional electric heating processes that rely more heavily on the thermal conduction effect.

By "primarily," we mean that at least 60% of the heating in the target region of interest is generated by directly delivering electric energy to that region within a predetermined time interval during which an electric potential difference is continuously applied between electrodes. Nonetheless, the inventive WEH process can, and typically does, work cooperatively with the target region's inherent TC effect, as well as other means for heating a formation. In turn, this cooperation will further enhance the more diffuse, and preferably substantially uniform, heating pattern that the inventive WEH process can generate in the target region vs. a conventional electric heating process.

Conductors

Generally, at least one of the conductors used in the WEH process will be a well. Preferably, both conductors in a conductor pair are wells. However, in some situations, it is desirable to select a different type of conductor for one or both conductors. Examples of other suitable conductors include, without limitation, embedded conductive cables, rods, and tubes and cable, rod and tube extensions from a well. Where a well is referenced herein, it will be understood to also mean other types of conductors. When the conductor is a well, the conductor is the metal portion of the well but excludes non-conductive packing around the well. Accordingly, the conductor diameter is the outside diameter of the well casing.

In the inventive WEH process, an e-zone is established around each conductor in a conductor pair, either by injecting an electrolytic fluid and/or by taking advantage of an indigenous source of electrolytic fluid. Because each e-zone independently has an electrical conductivity that is greater than the initial electrical conductivity of the target region, each e-zone, effectively enlarges each conductor, at least in its effective radius. For the purposes of this application, the initial electrical conductivity of the target region will be understood to mean the average electrical conductivity, prior to applying an electric potential difference between the e-zones, in a substantially spherical portion centered around the center point of the target region, the substantially spherical portion of the target region having a radius of about 15% of the average spacing between opposing faces of the e-zones (hereinafter "e-zone faces").

Curvature and Spacing of Electrode Zones

In addition to effectively enlarging the radius of a conductor, the e-zones used in the inventive WEH process reduce curvature relative to a conductor without a contiguous e-zone and/or with a discontiguous e-zone. Also, the e-zones should provide substantially uniform e-zone spacing, geometric shape relative to each other and/or spatial orientation relative to each other so that there is substantially diffuse heating in the target region.

Preferably, the spacing between e-zone faces should be substantially uniform. Preferably, the average gradient in e-zone spacing over the length of the e-zone faces is less than or equal to about 1:5 (e.g., an increase or decrease in e-zone spacing of less than 1 m per 5 m e-zone face length). More preferably, the average gradient in e-zone spacing is less than or equal to about 0.5:5. Accordingly, electric current is more uniformly distributed between electrodes, thereby generating a more diffuse heat distribution. Therefore, a greater portion of the formation between electrodes is heated by the inventive WEH process.

Preferably, the e-zone geometric shape provides shape complementarity between opposing e-zone faces. For a given voltage, the heating rate will be greatest when the electrodes are a pair of parallel plates due to a higher conductance and, therefore, current. And, for a given distance, the heating distribution will be more uniform for a pair of parallel plates because the electric field and, therefore, the current is more evenly distributed.

Another factor is the spatial orientation between e-zones. As explained more fully below in Example WEH2.0/Cyl, the spatial orientation is preferably such that the electric field is generated between the portion of each e-zone having the largest surface area and/or smallest curvature. For example, the heating between a pair of elliptical cylinder-shaped e-zones will be more uniform when the minor axes of each e-zone are aligned. But, for example, when the elliptical cylinders are diagonally opposed so that the electric field is generated between the portions of each e-zone perimeter bounding their respective major axes, i.e., the portion of the e-zones having larger curvature, the heating may not be as uniformly distributed through the target region.

When the e-zone geometric shape, spacing and/or spatial orientation are accounted for, the heating will be more uniform than for conventional electric heating processes. In an ideal WEH process, the heating rate at the mid-point between two electrodes will be greater than or equal to the rate at the highest temperature region ("HT region") within the target region.

However, in practice, when using a pair of wells as conductors, without contiguous e-zones, heating is more focused at the well, so that even though current flows between wells (i.e., conductors), little, if any, heating occurs at the effective mid-point between the electrodes. Instead, more intense heating occurs at each well because the well radius is significantly less than the distance between wells. Moreover, the curvature of each well is very large, relative to a plate. Accordingly, when an electric current flows between two wells or conductors without using contiguous e-zones, the electric current is focused at each well so that the heating rate will be much greater at the wells. And, when the heating rate is much greater at the well than between wells, focused heating occurs at the wells, creating, in effect, a hot conductor. The hot conductor ultimately results in water vaporization at the wells, thereby disrupting electrical connectivity and electric heating.

So, compared to conventional electric heating processes, the inventive WEH process enhances the rate and uniformity of heating a formation by effectively enlarging the electrode, reducing the curvature relative to the conductor and taking into account e-zone spacing, geometric shape and/or spatial orientation. More specifically, these e-zone attributes can be used to diffuse hot spots into localized heating zones and/or redistributed hot spots between multiple layers of the target region so that electrical connectivity is not disrupted. Accordingly, the heating rate and distribution of the inventive WEH process vs. conventional electric heating processes is significantly improved.

Electrode Zone

As discussed above, the heating rate and distribution for a given applied voltage is a function of e-zone size, geometric shape and/or spatial orientation, as well as the distance between electrodes. By establishing an e-zone around each conductor, the electrodes are effectively enlarged to create a larger electrode, which has a smaller curvature, as compared to a conductor, which serves as a smaller diameter electrode, without a contiguous e-zone and/or with a discontiguous e-zone. Moreover, intense focused heating is reduced, for example as compared with the process described in U.S. Pat. No. 3,946,809 ("US '809") having large volume e-zones, by providing substantially uniform spacing between e-zone faces. Accordingly, the e-zones of the inventive WEH process generate a more uniform distribution of current between e-zones, resulting in more uniform heating and diffused hot spots into localized heating zones and/or redistributed hot spots between multiple layers of the target region compared to the conventional electric heating processes known heretofore.

A number of different electrode configurations are discussed in more detail below. But the non-limiting examples presented herein demonstrate the effectiveness of the inventive WEH process compared to (1) conductor pairs without contiguous e-zones and/or with discontiguous e-zones and (2) the process described in US '809, as an example of a conventional electric heating process, which fails to account for e-zone spacing, geometric shape and/or spatial orientation effects. Generally, the volume of the formation that is heated during a given period of time is greater when there are contiguous e-zones around the conductors vs. conductors without contiguous e-zones and/or with discontiguous e-zones. And, for the same applied voltage, more electric energy is converted to heat for substantially uniformly heating a target region between e-zones. Also, more electric energy is delivered directly to and throughout the target region, without having to rely heavily on thermal conduction.

The non-limiting examples discussed below also illustrate that, when the spacing between opposing e-zone faces is not substantially uniform, such as in US '809, more intense heating occurs in one or more hot spots in a proportionately smaller volume of the formation targeted for heating. Consequently, the formation is not uniformly heated while the electric heating process is underway. But, intense focused heating is reduced and electric heating of the formation is more uniform when the e-zones provide (1) smaller and more uniform curvature along the e-zone faces, (2) curvature complementarity between opposing e-zone faces (e.g., by reducing the curvature of a portion of a first e-zone face to compensate for the higher curvature of a portion of a second e-zone face opposing and corresponding to that compensating lower curvature portion of the first e-zone face, (3) spatial orientation between opposing e-zone faces or (4) a combination thereof.

Temperature Rate Increase

One indicator of how well heating is distributed within a target region is a ratio of the rate of temperature increase at the HT region to the rate of temperature increase at the mid-point between two electrodes, whether the electrodes are bare conductors, conductors with contiguous e-zones, or a combination thereof. An overall ratio for a target region can be expressed by gamma (Γ) in Equation (1):

$$\Gamma = \frac{(T_{\max} - T_{initial})}{\left(T_{mid\text{-}piont} - T_{initial}\right)} \tag{1}$$

where:

- $T_{initial}$ is the initial average target region temperature immediately before an electric potential difference is applied;
- $T_{max}$ is the highest temperature in the target region generated at time t;
- $T_{mid\text{-}point}$ is the temperature at the effective mid-point between the two e-zones generated at time t; and
- the effective mid-point is the geometric mid-point of a target region on a plane where the equipotential surface has the smallest curvature.

The highest temperature, $T_{max}$, in a target region is located in a highest temperature region ("HT region"). In the case of conventional electric heating processes, electric heating can be focused at a hot spot, like that generated by the US '809 process, or at a hot conductor, like that generated by a bare conductor. But, in the WEH process, the highest temperature values are located in a localized heating zone, that is relatively diffusely distributed in a proportionately larger volume of the target region's total volume as compared to a more concentrated cluster of higher temperature values generated in a hot spot and/or hot conductor. Therefore, heating is more uniformly distributed within the target region. Moreover, the localized heating zone may be projected outward from the conductor and, preferably, outward from the average e-zone side and/or end perimeter closer to the target region's center point. So, as the localized heating zone's heat distribution becomes more diffuse, relative to a hot spot or hot conductor, and projected closer to the target region's center point, this relatively diffuse localized heating zone has an attendant enhancing effect on the uniformity of heat distribution within the target region. Γ provides one measure for assessing the degree of improved heating uniformity within a target region. Stated in general terms, Γ accounts for the rate of temperature increase at the mid-point between two electrodes approaches the rate of temperature increase in the HT region. Thus, Γ indicates how well electric heating generates heat around the vicinity of the target region's center point.

Specifically, at Γ=1, the rate of temperature increase at the effective mid-point between two electrodes is equal to the rate of temperature increase at the HT region, whether it is a hot spot, a hot conductor or a localized heating zone. But when Γ is greater than 1, the rate of temperature increase is proportionately greater at the HT region, in accordance with the extent Γ exceeds the value of 1. Therefore, Γ can be used as an indicator of heat distribution uniformity. However, as discussed more fully below, in some cases, the overall Γ itself may not be representative of how much electric heat is delivered throughout a target region so that a more accurate indication of heating uniformity may require calculating Γ for an appropriate number of layers within a target region.

The inventors have developed a calculatable term, $\Gamma_p$, that can be used for estimating Γ for a particular geometry that is defined by a pair of parallel cylindrical electrodes, wherein the rates of temperature increase arise substantially from electric heating.

Using the $\Gamma_p$ relationship, the inventors have demonstrated the improvements achieved by establishing a contiguous e-zone around a conductor. However, for non-parallel conductor orientations and non-uniform e-zone curvature and/or spacing, a general Γ as defined in Equation (1) can be used. In addition, in cases where a single Γ alone does not accurately represent heating non-uniformity, a series of Γ values can be calculated for an appropriate number of imaginary layers in a target region, as discussed more fully below. The Γ values can be more efficiently determined from temperature distribution data from actual field operations or based on simulation studies, as discussed more fully below.

When two cylindrical electrodes, each with an effective radius r, are placed substantially parallel to each other a distance, 2d (i.e., the distance between the centerline of a first electrode and the centerline of a second electrode, whether the electrode is a bare conductor or a conductor with a contiguous e-zone), from each other and an electric voltage, V, is applied (V/2 at one electrode and—V/2 at the other electrode), an electric field line pattern is generated as shown in FIG. 1. Assuming dielectric properties of a subterranean formation are uniform, the equipotential is calculated according to Equation (2):

$$\Phi = \frac{V}{4\ln\left[\frac{d}{r} + \sqrt{\left(\frac{d}{r}\right)^2 - 1}\right]} \ln\left[\frac{x^2 + \left(y + \sqrt{d^2 - r^2}\right)^2}{x^2 + \left(y - \sqrt{d^2 - r^2}\right)^2}\right] \tag{2}$$

where:

- Φ is the equipotential (in volts)
- r is the electrode radius (in meters)
- d is half the distance from the centerline of one electrode to the centerline of the other electrode (in meters)

V is the electric voltage across the two electrodes (in volts)

x is the distance measured from the effective mid-point between the electrodes (in meters) along the x-axis, representing a line perpendicular to the y-axis, as shown more clearly in FIG. 1, and y is the distance measured from the effective mid-point between the electrodes (in meters) along the y-axis, representing a line drawn between two electrodes, also as shown in FIG. 1.

As shown in Equation (2), the equipotential, $\Phi$, is zero on the plane y=0. The rate of temperature increase along the plane y=0 and at the perimeter of the electrodes can be estimated from Equation (2), assuming the heat capacity of the formation is substantially uniform and the thermal conductivity due to temperature gradients is significantly slower than the electric heating. According to Equation (2), the effective mid-point can be defined as a point on the y-axis through which the $\Phi=0$ equipotential plane passes.

$\Gamma_p$, the ratio between the respective rates of temperature increase at the surface of the electrode and at the effective mid-point between two electrode surfaces is a function of the effective electrode radius and the distance between the electrodes (first e-zone or conductor centerline to second e-zone or conductor centerline), as shown in Equation (3):

$$\Gamma_p = \frac{d}{4r}\sqrt{\left(\frac{d}{r}\right)^2 - 1} \tag{3}$$

Equation (3) assumes that (i) the electrodes have substantially the same radius, (ii) the electrodes are substantially parallel, (iii) electric heating dominates thermal conduction, (iv) electrode electric conductivity is at least an order of magnitude larger than the electric conductivity in the targeted formation and similar to the electric conductivity of the conductor, and (v) heating within the electrode is uniform, whether the electrodes are bare conductors, conductors with contiguous e-zones, or a combination thereof.

As provided by Equation (2), when the electrodes have substantially the same radius, the effective mid-point is halfway between the two electrodes. However, when the radius of one electrode is larger, the effective mid-point is closer to the electrode with the larger radius, because the equipotential surface with the lowest curvature moves closer to the larger electrode. The current density is lowest on the equipotential surface with the lowest curvature. However, it should be noted that the $\Phi=0$ equipotential surface, which may not be the surface with the lowest curvature, moves closer to the smaller radius electrode when two electrodes have different radii.

From Equation (2), the inventors determined $\Gamma_p$ for parallel electrodes that have the same or different radii, as defined in Equation (4):

$$\Gamma_p = \frac{D^2 - r_a^2 + r_b^2}{16D^2 r_b^2}\sqrt{D^4 - 2D^2(r_a^2 + r_b^2) + (r_a^2 - r_b^2)^2} \tag{4}$$

where

D is the distance from the centerline of one electrode to the centerline of the other electrode (in meters);

$r_a$ is the effective radius of the first electrode; and $r_b$ is the effective radius of the second electrode, where $r_a$ is greater than or equal to $r_b$.

Figure 2:
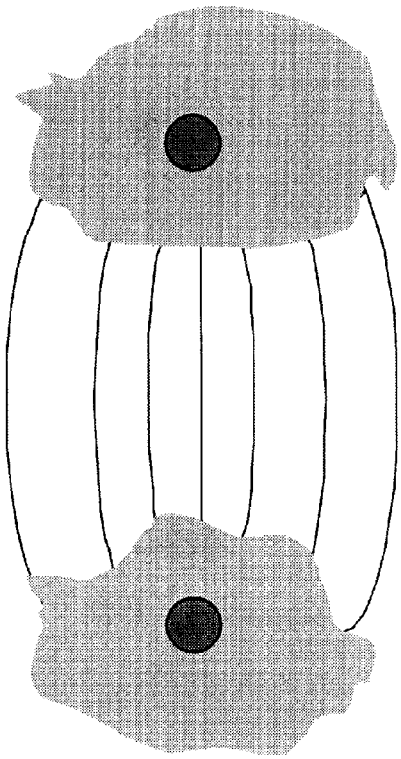
FIG. 2 illustrates electrode zones established around two conductors.

Equation (4) also assumes the criteria (ii) to (v) outlined above for Equation (3). In addition, Equations (3) and (4) assume that the electrodes are substantially circular in cross-section. However, as shown in FIG. 2 and discussed in more detail below, in practice, for example, e-zones for substantially horizontally oriented conductors may be substantially elliptical cylinder-shaped with a horizontal major axis. As discussed more fully below, the elliptical cylinder shape is due to a higher horizontal permeability and, therefore, higher electrolytic fluid permeability in a horizontal direction. Accordingly, when using Equations (3) and (4) for estimating $\Gamma_p$, the electrode radius, r, is an effective radius, calculated as discussed above under its definition.

Therefore, when the radii for both e-zones are equal, the effective mid-point is equidistant from the two e-zones. In contrast, however, when a pair of e-zones each has a different effective radius, the effective mid-point is not equidistant between the e-zones. For example, the effective mid-point between the two e-zones is closer to the larger radius e-zone because the equipotential surface with the lowest curvature moves closer to the larger electrode. Hence, the effective geometric mid-point between e-zones depends on e-zone size and may not coincide with a geographic mid-point when the effective radius for each e-zone is significantly different. And the smaller radius e-zone will heat faster at the surface than will the larger radius e-zone because of the larger curvature at the smaller radius e-zone.

Figure 3:
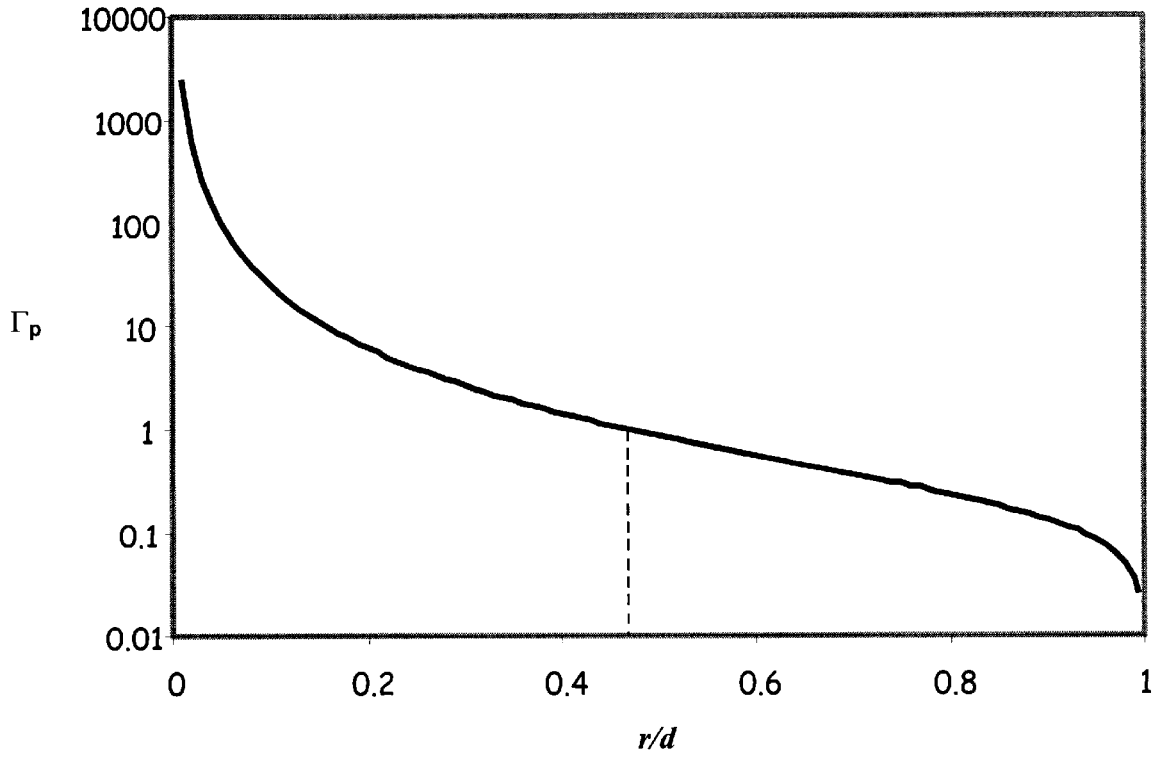
FIG. 3 is a graphical representation of the effect of electrode radius (r) and distance between electrodes (2d) on the ratio of temperature increase rates $\Gamma_p$.

Just as for $\Gamma$, heating is ideal when $\Gamma_p$ is less than or equal to about 1. However, the $\Gamma_p$ relationship does not account for projection of the HT region from the electrode, as can occur when the electrode is a conductor having a contiguous e-zone. Therefore, at $\Gamma_p=1$, the rate of temperature increase at the effective mid-point between two parallel electrodes is equal to the rate of temperature increase at each electrode perimeter. But when $\Gamma_p$ is greater than 1, the rate of temperature increase is proportionately greater at the electrode perimeter in accordance with the extent $\Gamma_p$ exceeds the value of 1. Thus, according to Equation (3) for $\Gamma_p$, as shown in FIG. 3, a relatively small effective electrode radius, r, causes the temperature to increase at the electrode perimeter much faster than it does at the effective mid-point between the electrodes.

For example, when d/r is about 2.1, representing an electrode radius that is about 23.5% of the distance between electrodes (i.e., centerline to centerline distance between electrodes is about 4.2 times the electrode radius), $\Gamma_p$, calculated in Equation (3), approaches 1.

However, when the electrode pair is a pair of wellbore pipes (i.e., wells) without contiguous e-zones, the well radius is typically much smaller than the distance between wells. For example, in a typical SAGD operation, parallel 17.8 cm (7 inch) diameter wells are spaced 5 m (500 cm) apart. Accordingly, the well radius of 8.9 cm (3.5 inch) is about 1.8% of the 500 cm distance between wells. According to Equation (3), $\Gamma_p$ in that instance is about 198. This much higher $\Gamma_p$ value means that there is significantly more heat generated at each electrode surface than in the area around the effective mid-point between the electrodes. So, although the heating between electrodes will be substantially uniform along the well for wells without contiguous e-zones (i.e., bare conductors), the heating is focused at the surface of the conductor (i.e., hot conductor). Accordingly, there is little, if any, heating in the target region between electrodes. Therefore, the targeted formation between the wells will not be heated efficiently by electric heating because the curvature for a relatively small radius conductor is so large.

But, by establishing an e-zone around a well (i.e., conductor), the effective electrode radius is increased without having to increase the actual conductor radius.

Moreover, the curvature of the electrode is reduced. For example, when an e-zone having a radius of 0.85 m (17% of the distance between wells), as measured radially out from the centerline of the well, is established around a 8.9 cm (3.5 inch) radius well, the curvature is reduced from 11.2 $m^{-1}$ to 1.2 $m^{-1}$. And, $\Gamma_p$ in the typical SAGD example provided above is reduced from 198 to about 2. Therefore, if the temperature at the e-zone faces is increased by 100° C., then the temperature at the effective mid-point between the wells generally will be increased by 50° C. over about the same time period because, according to Equation (3), $\Gamma_p$ should be constant with respect to time. However, in field applications, $\Gamma_p$ may change as a result of localized fluid movement, which can cause changes in electrical conductivity.

As provided in Equation (3), $\Gamma_p$ equals 1 when the e-zone radius is about 23.5% of the distance between wells, indicating that the heating rate at the e-zone's surface is substantially the same as the heating rate at the effective mid-point between the e-zones. And when $\Gamma_p$ is less than 1, the heating rate is faster at the effective mid-point between electrodes than it is at the electrode's surface. Preferably, $\Gamma_p$ is greater than or equal to about 0.2. More preferably, $\Gamma_p$ is in a range from about 0.5 to about 30. Even more preferably, $\Gamma_p$ is in a range from about 1 to about 25. Most preferably, $\Gamma_p$ is in a range from about 2 to about 20.

As mentioned above, $\Gamma_p$ assumes negligible TC effect and, according to Equations (3) and (4), the electrodes are assumed to be substantially parallel. Equations (3) and (4) demonstrate that an increased effective electrode radius increases heating rate and distribution by heating the mid-point between the electrodes more effectively. But, as illustrated in Comparative Example C2.0/Cone below using the process described in Hagedorn's US '809, merely increasing the effective electrode radius to increase the volume of the electrode, without regard for e-zone spacing, geometric shape and/or spatial orientation effects, does not provide substantially uniform heating in the target region. While Equations (3) and (4) do not per se provide variables for curvature and e-zone spacing effects, these e-zone attributes are indirectly considered in $\Gamma_p$ calculated by Equations (3) and (4) through the effective radius as a function of the electrode radius, the distance between electrodes or a combination thereof.

Preferably, the effective radius of each e-zone in a pair of e-zones is independently in a range from about 1.3 times to about 200 times the radius of the conductor. More preferably, the effective radius of each e-zone is independently in a range from about 1.3 times to about 100 times the radius of the conductor. Even more preferably, the effective radius of each e-zone is independently in a range from about 1.3 times to about 75 times the radius of the conductor. Most preferably, the effective radius of each e-zone is independently in a range from about 1.3 times to about 25 times the radius of the conductor.

Relative to the distance between conductors, the average effective radius of each e-zone should be at least about 2.3% of the distance between the centerline of the first conductor and the centerline of the second conductor. Preferably, the average effective radius of each e-zone is at least about 5% of the distance between the centerline of the first conductor and the centerline of the second conductor. More preferably, the average effective radius of each e-zone is at least about 10% of the distance between centerline of the first conductor and the centerline of the second conductor. Most preferably, the average effective radius of each e-zone is at least about 15% of the distance between the centerline of the first conductor and the centerline of the second conductor.

Target Region Heating

The inventive WEH process provides substantially uniform heating in a target region, as defined above, between opposing e-zone faces.

Substantially uniform heating has been qualitatively defined above. However, there are various methods that can be used to provide a more quantitative and less subjective measure of the extent to which substantially uniform heating is generated. Of course, even more quantitative assessments of heating uniformity in a target region over some time interval can have its own limitations due to abnormal heat distribution in portions of the target region resulting from anomalies in the target region, such as, for example, without limitation, fingering during fluid displacement for establishing the e-zone, and heterogeneities in the target region's physicochemical properties and lithology. Accordingly, it will be understood by those skilled in the art of thermal oil recovery processes that more quantitative indicators of substantially uniform heating, like those discussed below, can occasionally generate a value indicating no substantially uniform heating due to target region anomalies, despite the fact that substantially uniform heating in the same target region is observed from a qualitative perspective. Nonetheless, subject to occasional "abnormal" values arising from target region anomalies that may be inconsistent with the actual heat distribution generated, the proposed non-limiting expressions discussed below represent just two more quantitative, albeit approximate, approaches for more objectively assessing whether the heating in a target region is substantially more uniform relative to conventional electric heating processes.

One indicator of heating uniformity is the deviation between Γ values generated in independent layers of the target region at about 10% of the time interval over which an electric potential difference is continuously applied between a pair of e-zones before water vaporization occurs. Accordingly, Γ accounts for any TC effect arising during the first 10% of a continuous electric heating time interval.

As discussed more fully below, to determine the %Γ deviation in a target region, Γ values are calculated for an appropriate number of layers in the target region, in accordance with temperature gradient groupings identified at about 10% of the time interval over which an electric potential difference is continuously applied between a pair of e-zones (i.e., initial 10% of a continuous electric heating time interval). The layers extend to at least one conductor to include portions of the respective e-zones for that layer. The %Γ deviation is calculated using the highest Γ value, $\Gamma_{max}$, and lowest Γ value, $\Gamma_{min}$, according to Equation (5):

$$\%\Gamma\text{Deviation}=[(\Gamma_{max}-\Gamma_{min})/\Gamma_{max}]\times 100 \quad (5)$$

where

%Γ Deviation is the deviation of Γ values determined between two layers in a target region divided into n imaginary layers, wherein each imaginary layer has a highest temperature $T_n$ at a point radially located a distance x from a conductor and the thickness of the imaginary layer is determined by the length of a line parallel to that conductor wherein the temperature values along that line fall in the range $T_n \geqq T \geqq 0.85T_n$, as measured at about the initial 10% of a continuous electric heating time interval;

n is greater than or equal to 2;

$\Gamma_{max}$ is the highest Γ of the n respective Γ values determined in the n layers; and $\Gamma_{min}$ is the lowest $\Gamma$ of the n respective $\Gamma$ values determined in the n layers.

Preferably, the %$\Gamma$ deviation is at most about 60%. More preferably, the %$\Gamma$ deviation is at most about 55%. Most preferably, the %$\Gamma$ deviation is at most about 50%.

Another indicator of heating uniformity is the deviation between the maximum temperature, $T_{max}$, values in independent layers of the target region at about 10% of the time interval over which an electric potential difference is continuously applied between a pair of e-zones before water vaporization occurs. As discussed more fully below, to determine the %$T_{max}$ deviation in a target region, the target region is divided into an appropriate number of imaginary layers, again in accordance with temperature gradient groupings identified at about 10% of the time interval over which an electric potential difference is continuously applied between a pair of e-zones. The $T_{max}$ for each layer, regardless of its location within the layer, is then identified from temperature distribution data, whether actual or simulation data. The layer having the highest $T_{max}$ value of all $T_{max}$ values identified for their respective layers is $T_{max-high}$, while the layer having the lowest $T_{max}$ value of all $T_{max}$ values identified for their respective layers is $T_{max-low}$. $T_{max-high}$ and $T_{max-low}$ are then used to calculate the %$T_{max}$ deviation according to Equation (6):

$$\%T_{max}\text{Deviation}=[(T_{max-high}-T_{max-low})/T_{max-high}]\times 100 \quad (6)$$

where

%$T_{max}$ Deviation is the deviation of $T_{max}$ values determined between two layers in a target region divided into n imaginary layers, wherein each imaginary layer has a highest temperature $T_n$ at a point radially located a distance x from a conductor and the thickness of the imaginary layer is determined by the length of a line parallel to that conductor wherein the temperature values along that line fall in the range $T_n \geqq T \geqq 0.85T_n$, as measured at about the initial 10% of a continuous electric heating time interval;

n is greater than or equal to 2;

$T_{max-high}$ is the highest $T_{max}$ of the n respective $T_{max}$ values identified in the n layers; and $T_{max-low}$ is the lowest $T_{max}$ of the n respective $T_{max}$ values identified in the n layers.

Preferably, the %$T_{max}$ deviation is at most about 35%. More preferably, the %$T_{max}$ deviation is at most about 30%. Most preferably, the %$T_{max}$ deviation is at most about 25%.

The$\Gamma_{max}$,$\Gamma_{min}$, $T_{max-high}$ and $T_{max-low}$ values can ultimately be determined by analyzing temperature distribution data, either from actual field operations or based on simulation studies, generated at about 10% of the time interval over which an.electric potential difference is continuously applied between the electrodes. But, in either case, it is important to first determine the appropriate number of imaginary layers for reasonably describing the temperature gradient effect that is invariably generated to at least some degree when electric heating is used.

As discussed more fully below, the number of imaginary layers required to describe a target region's temperature gradient will depend primarily on the number of discernible temperature measurements clustered within a range defined generally as $T_n \geqq T \geqq 0.85T_n$, which temperature measurements were taken at about the initial 10% of a continuous electric heating time interval for a selected portion of the target region. Of course, a perfectly uniformly heated target region would show no $\Gamma$ or $T_{max}$ deviation and only one layer would be required since the temperature would be identical at all points throughout the target region. But, in reality, depending on the target region's properties and the conductor orientation, as well as the e-zone size, spacing, spatial orientation and geometric shape, among other factors, there can be somewhat significant temperature differences within a target region. However, differences in the ratio of the rates of temperature increase (i.e., $\Gamma$) between imaginary layers and temperature differences between imaginary layers are, on average, independently lower for a target region that is heated substantially uniformly than a region that is not.

Now, recall that each imaginary layer in a target region contacts both e-zone faces and is perpendicular to at least one pair of the opposing planes bounding the target region. Accordingly, when a pair of conductors is oriented in a parallel arrangement with respect to each other, the imaginary layers are perpendicular to the two conductors. Therefore, with two vertical parallel conductors, the imaginary layers are arranged one atop the other, while with two horizontal parallel conductors, the imaginary layers are arranged side-by-side each other. And for non-parallel orientations, the layer is perpendicular to one of the conductors. But, in any event, regardless of the conductors' orientation to each other, the number, n, and relative thickness of the imaginary layers is determined as follows:

1. Analyze temperature distribution data from a field operation or simulation study. Discard abnormal temperature values, if any, that depart significantly from the apparent qualitative temperature distribution in the target region, in accordance with generally accepted scientific and statistical analysis practices.
2. Find the first point, n=1, within the target region having the highest temperature $T_n$=1 and measure the radial distance, $x_{n=1}$, of that point from the closest conductor.
3. Analyze the temperature along an imaginary line parallel to that conductor and containing the $T_{n=1}$.
4. Determine the length of that imaginary line from step 3 by defining a start point, coinciding with $T_{n=1}$'s position and at least one end point for the imaginary line so that temperature values along the line fall in the range $T_{n=1} \geqq T \geqq 0.85T_{n=1}$.
5. Determine the thickness of layer $L_{n=1}$ containing both the start point and end point(s) of the line defined in step 4. The layers include portions of the e-zone adjacent to the target region.
6. Repeat steps 2 to 5 for imaginary layers, $L_{n=2, \ldots n}$, for the remaining portion of the target region by identifying the highest temperature value within the target region, but outside a previously defined imaginary layer and using the same conductor selected in step 2 as the reference conductor, until the entire target region has been divided into the appropriate number of layers accordingly.

As discussed above, even though a target region may be substantially uniformly heated, there may be portions of a target region exhibiting abnormal heat distribution resulting from, for example, without limitation, fingering during fluid displacement for establishing the e-zone, and heterogeneities in the target region's physicochemical properties and lithology, among other factors. Also, there may be abnormal temperature values resulting from, for example, without limitation, faulty thermocouples, data acquisition errors and data processing errors. Accordingly, abnormal temperature values that depart significantly from the apparent qualitative temperature distribution in the target region and/or within a target region layer should be discarded in accordance with generally accepted scientific and statistical analysis practices known to those skilled in the art of thermal reservoir data analysis.

Once the appropriate number of layers is selected, Γ for each layer is calculated according to Equation (7):

$$\Gamma_{Layer} = \frac{\left(T_{\max\text{-}Layer} - T_{initial}\right)}{\left(T_{Layer\ mid\text{-}point} - T_{initial}\right)} \tag{7}$$

where:

$T_{initial}$ is the initial average target region temperature immediately before an electric potential difference is applied:

$T_{max-Layer}$ is the highest temperature in the layer generated at time t;

$T_{Layer\ mid\text{-}point}$ is the temperature at the effective mid-point between the two electrode zones for that layer generated at time t; and the effective mid-point is the geometric mid-point of a layer in the plane where the equipotential surface has the smallest curvature.

The maximum and minimum Γ values are then used to calculate the %Γ deviation in the target region according to Equation (5) above.

Once the appropriate number and thickness of target region's imaginary layers is determined for a predetermined conductor orientation and e-zone spacing, geometric shape and spatial orientation, as discussed above, the temperature distribution data is analyzed to find the maximum temperature, $T_{max}$, in each layer, regardless of its location within that layer. The highest maximum temperature, $T_{max-high}$, and the lowest maximum temperature, $T_{max-low}$, are then used to calculate the $\%T_{max}$ deviation according to Equation (6) above.

FIGS. 4A–4E illustrate schematically how the method for determining layers in a target region described above is applied to a hypothetical target region example with temperature distribution. And FIG. 4F illustrates using the layers for determining the %Γ deviation and $\%T_{max}$ deviation.

Figure 4A:
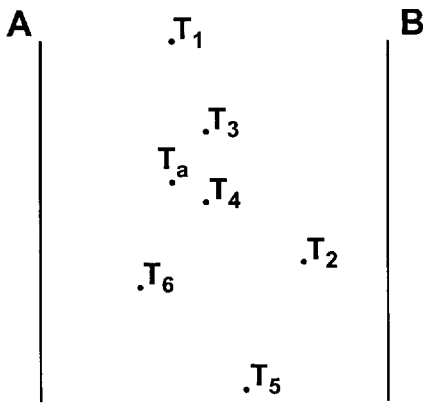
FIGS. 4A–4E illustrate schematically a method for determining layers in an example target region.

FIG. 4A is a simplified example of temperature distribution data like that which would be obtained from a field operation or simulation study. For convenience, the data is shown in one plane of the target region between a pair of conductors A and B. However, the temperature data may be collected from any point within the target region. In this case, the temperature values fall in the following order:

$$T_a >>> T_1 > T_2 > T_3 > T_4 > T_5 > T_6$$

$T_a$ is an abnormal temperature value that departs significantly from the apparent qualitative temperature distribution in the target region. Therefore, $T_a$ is discarded, in accordance with generally accepted scientific and statistical analysis practices, from further consideration in determining layer number and size. Also, $T_a$ is not considered in ultimate Γ and $T_{max}$ deviation calculations.

Figure 4B:
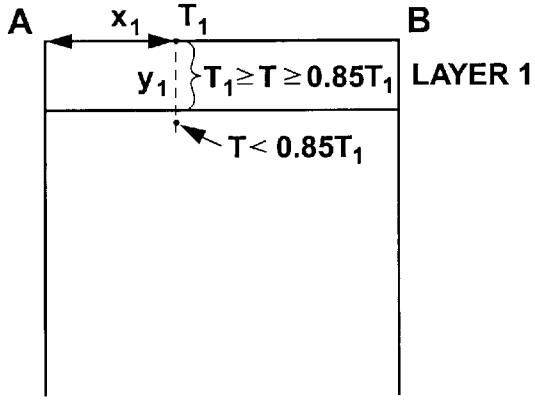

In FIG. 4B, the highest temperature value, $T_1$, is selected and the distance, $x_1$, as measured radially outward from the closest conductor A is determined. Conductor A is now the reference conductor for determining the number and relative thickness of all subsequent imaginary layers for this target region. Temperature values along an imaginary line $y_1$, parallel to conductor A, are analyzed and the length of $y_1$ is determined using $T_1$ as the start point. Temperature values along the line yl, on either side of the start point, should fall in the range $T_1 \geqq T \geqq 0.85T_1$, meanwhile, temperature values where T is less than $0.85T_1$ on the imaginary line are outside the boundary for Layer 1. In this case, because $T_1$ is at the edge of the target region, $T_1$ is both a start point and an end point, while Layer 1's thickness is equal to line $y_1$'s length.

Figure 4C:
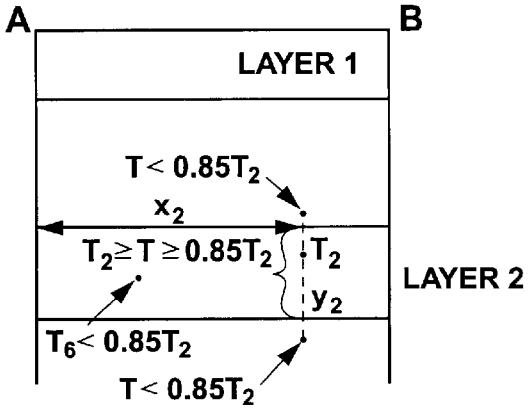

In the next step illustrated in FIG. 4C, the highest temperature, $T_2$, from the remaining portion of the target region is selected. In some cases, identification of imaginary layers may result in sequentially adjacent layers (e.g., $L_1$, $L_2$, $L_3$, $L_4$), but in other cases, depending on the temperature distribution data, maybe not (e.g., $L_1$, $L_3$, $L_2$, $L_4$). For instance, in the example illustrated in FIG. 4C, Layer 2 is not adjacent to Layer 1. Conductor A is the reference conductor for the parallel imaginary line $y_2$, a distance $x_2$ radially outward from conductor A. Temperature values along imaginary line $y_2$ are analyzed using $T_2$ as the start point, so that the temperature values along the line $y_2$ fall in the range $T_2 \geqq T \geqq 0.85T_2$. In this case, there is an end point on either side of $T_2$ defining the length of line $y_2$. Temperature values where T is less than $0.85T_2$ are outside the boundary for Layer 2. In this example, $T_6 < 0.85T_2$. But because $T_6$ is not on the imaginary line $y_2$, it is ignored for purposes of determining Layer 2's thickness. So Layer 2's thickness is equal to line $y_2$'s length. Thus, in this example, Layer 2's thickness is greater than Layer 1's thickness.

Figure 4D:
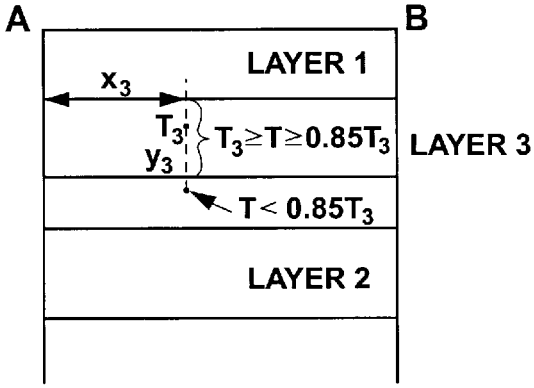
Figure 4E:
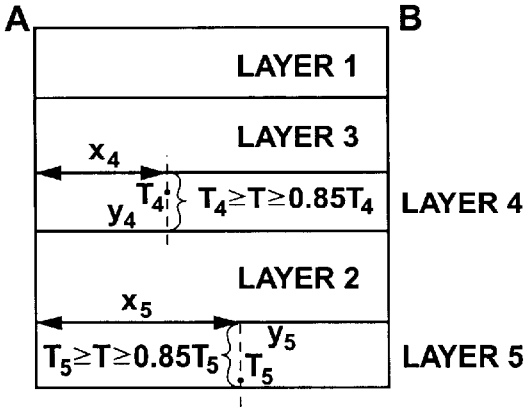
Figure 4F:
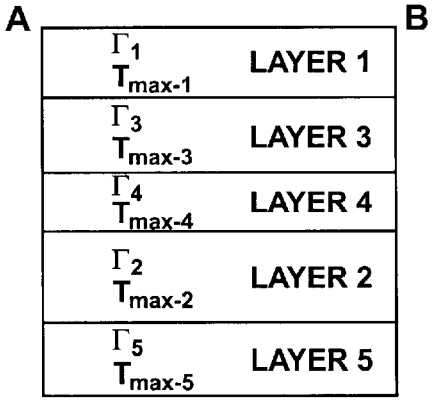
FIG. 4F illustrates schematically using the layers from FIGS. 4A–4E for determining %Γ deviation and $\%T_{max}$ deviation.

FIG. 4D illustrates how the position and thickness of Layer 3 are determined. The highest temperature, $T_3$, from the remaining portion of the target region is selected and temperature values along an imaginary line $y_3$ are analyzed. The length of line $y_3$ is determined by the temperature values along the line $y_3$ fall in the range $T_3 \geqq T \geqq 0.85T_3$. In this case, one end point is the boundary for Layer 1, but Layer 3 fails to extend to Layer 2 because there are temperature values on the imaginary line, $y_3$, where T is less than $0.85T_3$. So, in this case, line $y_3$ is truncated at its upper end by Layer 1's lower boundary and at its lower end by the last point on line $y_3$ where the T value is either greater than or equal to $0.85T_3$. Accordingly, Layer 3's thickness is equal to line $y_3$'s truncated length. The thickness of Layer 3 is the length of line $y_3$. Layers 4 and 5 are determined in a similar manner in FIG. 4E. Because all of the temperature values along the line $y_4$ fall in the range $T_4 \geqq T \geqq 0.85T_4$, Layer 4's upper and lower boundaries are defined by Layer 3's lower boundary and Layer 2's upper boundary, respectively. Likewise, the upper and lower boundaries for Layer 5 are Layer 2's lower boundary and the end of the target region, respectively because the temperature values along the line $y_5$ fall in the range $T_5 \geqq T \geqq 0.85T_5$.

Hence, the hypothetical target region example is divided into 5 imaginary layers according to the procedure described above. Now that the imaginary layers are defined, Γ and $T_{max}$ values for each respective layer can be calculated based on the temperature distribution data within each layer accordingly. However, it should be understood that the highest Γ value selected from the Γ values for each respective layer may not necessarily be obtained from the same layer that contains the highest $T_{max-n}$ value selected from the $T_{max-n}$ values determined for each respective layer.

So, Γ for each layer is calculated according to Equation (7) above, using temperature distribution data within each layer accordingly. Thus, in the hypothetical example illustrated in FIG. 4F, $\Gamma_1 > \Gamma_3 > \Gamma_2 > \Gamma_5 > \Gamma_4$. Therefore, $\Gamma_{max} = \Gamma_1$ and $\Gamma_{min} = \Gamma_4$. Accordingly, $\%\Gamma\ \text{Deviation} = [(\Gamma_1 - \Gamma_4)/\Gamma_1] \times 100$.

The $T_{max}$ for each layer is also determined using temperature distribution data within each layer accordingly. Thus, in the hypothetical example illustrated in FIG. 4F, $T_{max-1}>T_{max-2}>T_{max-3}>T_{max-4}>T_{max-5}$. Therefore, $T_{max-high}=T_{max-1}$ and $T_{max-low}=T_{max-5}$. Accordingly, $\%T_{max}$ Deviation=$[(T_{max-1}-T_{max-5})/T_{max-1}]\times 100$.

In some cases, $\Gamma_{max}$ and $T_{max-high}$ will be in the same layer. Likewise, in some cases, $\Gamma_{min}$ and $T_{max-low}$ will be in the same layer. However, because $\Gamma$ is a ratio of temperature increase rates and $T_{max}$ is a measure of absolute temperature values, $\Gamma_{max}$ and $\Gamma_{min}$ may not always be in the same layers as $T_{max-high}$ and $T_{max-low}$, respectively. In the hypothetical example illustrated in FIG. 4F, $\Gamma_{max}$ and $T_{max-high}$ are both in Layer 1. But, $\Gamma_{min}$ is in Layer 4 and $T_{max-low}$ is in Layer 5.

So, using the method described above, different conductor orientations, e-zone spacing, e-zone geometries and e-zone spatial orientations that could be deployed to heat the same or different types of formation regions can be compared in how well they respectively heat the target region by comparing their respective $\Gamma$ values, the $\%\Gamma$ deviation and the $\%T_{max}$ deviation. The heating rates and distribution can be determined from field data. But a software simulation program known to those skilled in the art of reservoir modeling could also be used to estimate and/or compare heating rates and distribution arising from combined electric heating and TC effect using different well orientations, e-zone spacing, e-zone geometries and e-zone spatial orientations in the same or different types of formation regions. One example of such a software simulation program is STARS® (version 2001) available through the Computer Modeling Group, Calgary, Alberta, Canada. One benefit of using a software simulation program such as STARS®, for example, is that the program permits the reservoir or petroleum engineer to evaluate the effect of numerous parameter changes before implementing an e-zone geometric shape, spacing and spatial orientation strategy in the field with a corresponding electrolytic fluid selection and injection strategy.

Therefore, since simulation programs have the flexibility in providing an array of estimated heating rate and distribution performances, based on an array of variable input parameters, they tend to be a preferred tool for producing an estimate expected to be closer to the actual heating performance for conductor orientations that are parallel, as well as non-parallel, to each other.

However, when using a simulation program for calculating $\%\Gamma$ and $\%T_{max}$ deviations, the operator should use data obtained before water vaporization occurs, because after that point (a) electrical connectivity may be disrupted, depending on the location of the HT region and/or (b) the formation electrical conductivity may be changed because water at or in the HT region has vaporized. For example, the operator can determine the temperature at which water will vaporize for a given simulated formation pressure so that when a portion of the simulated formation reaches that temperature, the operator is signaled that the simulation should be halted. As another example, the operator may look for steam saturation values greater than zero, again indicating that water has vaporized, signaling that the simulation should be halted. Alternatively, an operator may look for a sudden reduction of power consumption as an indication of water vaporization.

Electrical Connectivity

Regardless of the conductor orientation or the e-zone geometric shape, spacing and spatial orientation, all electric heating processes, whether conventional or the inventive WEH process, require electrical connectivity, provided by a contiguous network of conductive material, between a pair of electrodes. Conductive materials include, without limitation, indigenous and non-indigenous electrolytic fluid and conductive rock. In order to support electric current between electrodes, the formation should have an average electrical conductivity of at least about 0.0005 S/m, corresponding to an average resistivity of about 2,000 Ω·m. Preferably, the formation should have an average electrical conductivity of at least about 0.005 S/m, corresponding to an average resistivity of about 200 Ω·m. More preferably, the formation should have an average resistivity in a range from about 0.01 to about 0.05 S/m, corresponding to an average resistivity in a range from about 100 to about 20 Ω·m.

Examples of conductive indigenous electrolytic fluids include, without limitation, solutions of NaCl, KCl, $MgCl_2$, $CaCl_2$, $MgSO_4$, $CaSO_4$, $Na_2CO_3$, $K_2CO_3$, $NaC_2H_3O_2$ and Hydrocarbons may also have some degree of electrical conductivity due to, for example, without limitation, polar moieties and increased temperature.

Electrical connectivity in the formation can be determined by methods known to those skilled in the art, for example by analyzing resistivity and saturation data obtained by well logging. Well logging can also reveal whether a formation is water-wet, oil-wet or neutral-wet. Preferably, the formation is water-wet. In a case where a formation is oil-wet or neutral-wet, it is preferable to alter the wettability to a water-wet for more effective electrical connectivity. However, the inventive WEH process may still be practiced in either oil-wet or neutral-wet formations.

In order to maintain electrical connectivity for supporting an electric heating process, hot spots and hot conductors created by focused heating should be avoided. Specifically, in the case of a hot conductor or when a hot spot occurs at or near the electrode perimeter, electric current flow between electrodes will most likely be disrupted. However, hot spots or localized heating zones located further from the electrode may not disrupt electrical connectivity if current can flow around the hot spot or localized heating zone. So, the further any hot spots or localized heating zones occur from the electrode perimeter, the less likely that electrical connectivity will be disrupted.

As discussed more fully below and in the examples, the more uniform curvature and spacing, as well as spatial orientation, attributes of the inventive WEH process diffuse hot spots into localized heating zones and/or redistribute hot spots between multiple layers of the target region, thereby maintaining electrical connectivity for a longer period of time, other factors being equal.

Electrolytic Fluid

An electrode having a conductor and a contiguous e-zone may be created by (1) injecting an electrolytic fluid into a formation using one or more techniques discussed more fully below, (2) placing one or more conductors in a naturally occurring region of hig her electrical conductivity in a formation, or (3) a combination thereof.

For the $2^{nd}$ case, the existence of a naturally occurring e-zone can be determined from resistivity and saturation data from well logging.

However, the e-zone is preferably established by (a) injecting a supplemental electrolytic fluid into the formation, (b) producing a supplemental electrolytic fluid in-situ in the formation by injecting a solute slurry into the formation, or (c) using a combination of both types of electrolytic fluid described in (a) and (b), accordingly.

In any case, each e-zone should have an electrical conductivity that is greater than the initial electrical conductivity of the target region between two e-zones. The initial electrical conductivity of the target region is the average electrical conductivity, prior to applying an electric potential difference between the first and second e-zones, in a substantially spherical portion centered around the center point of the target region, wherein the substantially spherical portion of the target region has a radius of about 15% of the average spacing between opposing faces of the first and second e-zones.

As the e-zone electrical conductivity increases, the resistance across the e-zone drops. Therefore, the electrical conductivity of the e-zone should be at least about 50% greater than the target region's initial electrical conductivity prior to applying the electric potential difference between the first and second e-zones. Preferably, the electrical conductivity of an e-zone is at least about 100% greater than the target region's initial electrical conductivity. More preferably, the electrical conductivity of an e-zone is at least about 5 times greater than the target region's initial electrical conductivity. Most preferably, the electrical conductivity of an e-zone is at least about 10 times greater than the target region's initial electrical conductivity.

As mentioned above, preferably an e-zone is established by injecting a supplemental electrolytic fluid into the formation. Suitable supplemental electrolytic fluids contain an ion-producing substance. Examples of ion-producing substances include, without limitation, substantially water soluble salts, conductive substantially water soluble polymers, substantially water soluble ionic surfactants, substantially water soluble zwitterions, and combinations thereof. By "substantially water soluble," we mean that the ion-producing substances are substantially soluble in water at formation ambient conditions.

Any substantially water soluble salt may be used to produce a supplemental electrolytic fluid, prior to injection and/or in-situ in the formation. However, it will be understood that certain water soluble salts may be more desirable than others because of cost constraints, less complex handling requirements, fewer equipment maintenance issues, fewer environmental issues, if any, and lower potential risk of adverse effects on hydrocarbons and downstream processing of produced hydrocarbons, among other factors.

Examples of substantially water soluble salts include, without limitation, NaCl, KCl, $MgCl_2$, $CaCl_2$, $Na_3(PO_4)$, $K_3(PO_4)$, $NaNO_3$, $KNO_3$, $Na_2SO_4$, $K_2SO_4$, $MgSO_4$, $CaSO_4$, $Na_2CO_3$, $K_2CO_3$, $NaC_2H_3O_2$, $KC_2H_3O_2$, NaBr, KBr and combinations thereof.

Salt can be added in any amount to obtain the desired electrical conductivity. To the extent it is necessary for obtaining the desired electrical connectivity, preferably, the salt concentration in the supplemental electrolytic fluid is in a range from about 0.1 wt. % to about 30 wt. %. More preferably, the salt concentration is in a range from about 1 wt. % to about 25 wt. %. Most preferably, the salt concentration is in a range from about 4 wt. % to about 20 wt. %.

Any conductive substantially water soluble polymer may be used to produce a supplemental electrolytic fluid, prior to injection and/or in-situ in the formation. However, it will be understood that certain polymers may be more desirable than others because of cost constraints, less complex handling requirements, fewer equipment maintenance issues, fewer environmental issues, if any, and lower potential risk of adverse effects on hydrocarbons and downstream processing of produced hydrocarbons, among other factors.

Examples of conductive substantially water soluble polymers include, without limitation, styrene/maleic anhydride copolymers, polyvinylpyridium, polyvinylacetates, vinylmethyether/maleic anydride copolymers, polyacrylic acid, polyacrylamide, polyacrylonitrile, carboxymethylcellulose, poly(1,4-anhydro-β-D-mannuronic acid), poly(1,3(1,4)-D-galactose-2-sulfate), poly(1,4-D-galacturonic acid), polyethylene-polypropylene block copolymers, polyethoxylated alkylalcohols, high and low molecular weight lignosulfates, and high and low molecular weight Kraft lignins, and sulfonates, hydrolysates and salts thereof, and combinations thereof.

A conductive polymer can be added in any amount to obtain the desired electrical conductivity. To the extent it is necessary for obtaining the desired electrical connectivity, the concentration of conductive polymer is dependent on the polymer's molecular weight and its degree of ionization. However, for a conductive polymer with a molecular weight of about 10,000 with a degree of ionization of about 0.4, under formation conditions, the conductive polymer could be used in a range from about 1 wt. % to about 20 wt. %.

Any substantially water soluble ionic surfactant may be used to produce a supplemental electrolytic fluid, prior to injection and/or in-situ in the formation. However, it will be understood that certain water soluble salts may be more desirable than others because of cost constraints, less complex handling requirements, fewer equipment maintenance issues, fewer environmental issues, if any, and lower potential risk of adverse effects on hydrocarbons and downstream processing of produced hydrocarbons, among other factors.

One advantage of using ionic surfactants as a supplemental electrolytic fluid is their ability to alter the formation's wettability, for example, from an oil-wet or neutral-wet formation to a water-wet formation, where desired.

Examples of substantially water soluble ionic surfactants include, without limitation, alkali monocarboxylate, alkali polycarboxylate, alkali sulfocarboxylate, alkali phosphocarboxylate, alkali sulfocarboxylic ester, alkali phosphono ester, alkali sulfate, alkali polysulfate, alkali thiosulfate, alkali alkyl sulfonate, alkali hydroxyalkyl sulfonate, alkali sulfosuccinate diester, alkali alkaryl sulfonate, alkali oxypropylsulfate, alkali oxyethylene sulfate, aliphatic amine, alkyl ammonium halide, alkyl quinolinium, and ionic surfactants having the general formula C-A where C. represents a cation and A represents an anion, and combinations thereof. Examples of suitable cations C. include, without limitation, N-alkyl-pyridinium and 1,3-dialkylimidazolium. Examples of suitable anions A include, without limitation, bromide, iodide, chloride, fluoride, trifluoroalkylsulfonate, tetrachloroaluminate, hexafluorophosphate, tetrafluoroborate, nitrate, triflate, nonaflate, bis(trifyl)amide, trifluoroacetate, and heptafluorobutanoate. Suitable alkyl groups include from about 1 to about 18 carbon atoms.

Ionic surfactant can be added in any amount to obtain the desired electrical conductivity. To the extent it is necessary for obtaining the desired electrical connectivity, preferably, the ionic surfactant concentration in the supplemental electrolytic fluid is in a range from about 0.5 wt. % to about 10 wt. %. More preferably, the ionic surfactant concentration is in a range from about 1 wt. % to about 15 wt. %. Most preferably, the ionic surfactant concentration is in a range from about 5 wt. % to about 10 wt. %.

Any conductive substantially water soluble zwitterion may be used to produce a supplemental electrolytic fluid, prior to injection and/or in-situ in the formation. However, it will be understood that certain zwitterions may be more desirable than others because of cost constraints, less complex handling requirements, fewer equipment maintenance issues, fewer environmental issues, if any, and lower potential risk of adverse effects on hydrocarbons and downstream processing of produced hydrocarbons, among other factors.

Examples of zwitterions include, without limitation, amino acid, aminoethanoic acid and combinations thereof.

A zwitterion can be added in any amount to obtain the desired electrical conductivity. To the extent it is necessary for obtaining the desired electrical connectivity, preferably, the zwitterion concentration in the supplemental electrolytic fluid is in a range from about 1 wt. % to about 30 wt. %. More preferably, the zwitterion concentration is in a range from about 1.5 wt. % to about 15 wt. %. Most preferably, the zwitterion concentration is in a range from about 2 wt. % to about 6 wt. %.

Establishing an Electrode Zone

A variety of techniques may be used for establishing an e-zone. An e-zone is preferably established by first injecting hot water into the formation, with or without pressure, and subsequently injecting a supplemental electrolytic fluid into the formation around one or both conductors. However, as mentioned above, a naturally occurring region of higher electrical conductivity may be used as an e-zone or a portion of an e-zone by placing the conductor or a portion of the conductor in that region.

Other techniques for electrolyte injection may or may not include producing at least a portion of hydrocarbons in the vicinity of one or more wells. Suitable techniques include, without limitation, (a) short-term cyclic steam stimulation, (b) injecting a heated fluid at one well and producing at another well in a cyclic manner, (c) limited sand production, (d) injecting heated electrolytic fluid with or without solvent, (e) injecting solvent before heated electrolytic fluid injection, (f) cyclically injecting solvent and heated electrolytic fluid, (g) heating the wells while injecting non-heated electrolytic fluid, (h) alternating well-heating with injecting non-heated electrolytic fluid and (i) combinations thereof.

The geometric shape of e-zones that are generated by the above-mentioned techniques may, if desired, be modified to expand an e-zone size or change its shape. For example, as discussed in the simulation WEH examples presented below, the conical bowl-shaped e-zones generated by the conventional process described in U.S. Pat. No. 3,946,809 ("US '809" by Hagedorn) was modified to generate a generally elliptical cylinder-shaped e-zone. This modified e-zone may be established by injecting additional electrolytic fluid in a manner known to those skilled in the art. In another of the simulation WEH examples presented below, one of the US '809 conical bowl-shaped e-zones was inverted to show the effect of accounting for e-zone geometric shape. Of course, it is not possible to invert a CSS generated conical bowl once established. But, an inverted conical bowl-shaped e-zone may be established by injected a fluid that is heavier than oil, for example heavy water. Also, the same effect may be created in a horizontal well by injecting more fluid atone end of the well than at the other end. Or a series of cone shapes may be linked together to form one generally cylindrical or elliptical cylinder shaped e-zones.

The effect of electrolyte injection techniques on e-zone geometric shape and electric heating effectiveness is discussed in more detail below.

Formation Heating

Once e-zones are established around the first and second conductors, an electric field can be established between the electrodes, for example, as shown in FIG. 2. And accordingly, the formation, acting as a type of resistor, is directly heated as an electric potential difference is applied between the first and second electrodes and an electric current flows between the first and second electrodes via the targeted formation. This means the inventive WEH process is a type of ohm-heating, in which nearly all of the electric energy can be transformed into heat directly in the formation.

However, some ohm-heating applications can provide heat indirectly. For instance, a resistor can be heated and then heat can be transferred from the hot resistor and subsequently distributed to and through a targeted formation using, for example, without limitation, thermal contact means (e.g., a temperature gradient leading to thermal diffusion from warmer to cooler regions through a thermally conductive rock interface), thermal radiation means (i.e., blackbody radiation from warmer regions and absorbed by cooler regions), fluid convection means (e.g., via flow of heated gas and/or liquid) or some combination thereof.

But again, the more preferred and more efficient approach in applying the WEH process is to use it cooperatively with an electrically conductive targeted formation. In this case, the targeted formation itself is heated directly when a voltage is applied across the formation since it is operating like a resistor. Of course, the more diffusely generated the current is, the more diffusely heat is initially generated and thereby distributed in the target accordingly. And although previous conventional electric heating processes have attempted to exploit the benefit of ohm-heating, they have failed to generate and distribute electric current, and.hence heat, in a sufficiently diffuse manner in the targeted formation. Therefore, one important technical attribute of the inventive WEH process is its ability to generate and distribute electric current more diffusely in the targeted formation, and particularly the target region, so that the generated heat is more diffuse through the target region, as compared to conventional electric heating processes.

In contrast, a non-ohm electric heating process does not readily lend itself to using the targeted formation as an effective resistor. Consequently, any electric power generated in a non-ohm heating process for heating a targeted formation would typically be generated outside the formation by an electric process, such as an induction, microwave or dielectric process, and then transferred to the formation for heating purposes using means known to those skilled in the art of energy conversion and transfer processes. But a non-ohm heating process invariably incurs some initial power loss due to (1) internal ohm-heating, (2) electromagnetic radiation and (3) mechanical energy consumed, all of which diminish the total heating power ultimately available for heating the targeted formation.

Meanwhile, in an ohm-heating process nearly all of the electric energy can be transformed into heat directly in the targeted formation. And most significantly, with the WEH process, that heat will be distributed more diffusely in the targeted formation. Accordingly, as discussed above, applying the principles of Ohm's Law, in an ohm-heating process, theoretically the amount of heating power, $P=I^2\times R$, and the applied electric potential difference in Volts, $V=I^2\times R$. Consequently, P is higher for a fixed resistance, R, when the current flow, I, or the applied voltage, V, is higher. Similarly, P is higher for a fixed current, I, when the resistance, R, or the voltage, V, is higher. The same is true for a fixed voltage, V, when the resistance, R, is lower or the current, I, is higher. But again, to the extent the WEH process is used cooperatively with some heat transfer means some power loss may be incurred depending on the means employed and other operating conditions.

Also, in using the WEH process the total time interval that the electric current flows may be continuous or intermittent with varying periods when the current may be off. But generally the predetermined time interval's duration, whether continuous or intermittent, during which current flows will depend on formation conditions, the oil's viscosity before heating and the time allotted for reaching oil production, as well as the rate of oil production needed for economic benefit.

As the electric current flows between the first and second electrodes, both the formation region comprising the e-zones with indigenous and/or non-indigenous electrolytic fluid and at least a portion of the indigenous electrolytic fluid in a target region between the two opposing e-zone faces are heated. However, the heating rates may not be the same within the e-zones and in the target region between the e-zones, depending on a number of factors including, without limitation, the difference in electrical conductivity, e-zone curvature, e-zone radius, spacing between opposing e-zone faces, e-zone spatial orientation and/or conductor orientation.

As discussed above, as the effective radius of the electrode is increased, $\Gamma$ and $\Gamma_p$ are reduced, so that at least a portion of the indigenous electrolytic fluid between the electrodes is heated and focused heating at the conductor is reduced.

Also, as discussed above, if a portion of the formation is heated to a temperature beyond the water vaporization temperature, electrical connectivity between two electrodes may be disrupted, depending on the vaporization location. Generally, the closer water vaporization occurs relative to the conductor, the more likely it is that vaporization will disrupt connectivity.

So, intense heating can cause water vaporization around the electrode, thereby potentially disrupting electrical connectivity, whether in a focused area of or throughout the formation. Of course, a focused disruption of electrical connectivity diminishes the electric heating in that area, while a disruption either surrounding at least one electrode or substantially throughout the formation around the target region will terminate the electric heating in the target region altogether. Thus, in either case, focused heating can generate adverse performance ranging from being cost inefficient to being a complete wasteful use of electric energy and/or facilities. But by diffusing hot spots into localized heating zones and/or by projecting the HT region outward from the conductor, a formation is more uniformly heated, electrical connectivity is more easily maintained, and the effect of electrical connectivity disruption, if any, could be less severe and/or more manageable, despite relatively higher levels and/or longer periods that electric energy is fed to the formation compared to conventional electric heating processes.

Preferably, the pressure in the formation is sufficient to maintain the indigenous electrolytic fluid between the two electrodes in a liquid state while current is applied between the electrodes.

As the formation between the two wells is heated, hydrocarbon viscosity is reduced. And hence fluid communication between the two wells can be established.

The electric current can be alternating current (A.C.), direct current (D.C.) or a combination thereof. Preferably, the electric current is A.C., since A.C. is electrochemically more stable than D.C. While D.C. can be used, there is an increased chance for corrosion in the conductor and possibly formation damage (e.g., formation permeability may be reduced by deposited salts and minerals). Also, A.C. is typically more readily available in the field. Preferably, the A.C. frequency is in a range from about 20 hertz to about 1000 hertz.

Applied voltage can be changed during heating, as desired. For example, as illustrated in the non-limiting examples below, it may be desirable to apply a higher voltage at the beginning of the process to increase the initial heating rate and to reduce the voltage later in the process to prolong the electric heating process, thereby increasing the heated volume.

Factors Affecting Electric Heating Effectiveness

The effectiveness of electric heating in the target region between two electrodes, such as, wells with contiguous e-zones, is dependent on, among other factors, the respective geometric shape of each electrode's e-zone, the spacing between opposing e-zone faces, and the electrode's spatial orientation with respect to each other. In turn, the geometric shape of an e-zone is, in part, a function of the orientation of the well in the portion of the formation around the target region (i.e., targeted formation). However, the anisotropism of a targeted formation's permeability (i.e., vertical permeability, $K_v \neq$horizontal permeability, $K_h$), formation heterogeneity, and the electrolytic fluid injection procedure used for establishing the e-zone also affect the geometric shape of the e-zone.

These effects are discussed more fully below with reference to FIGS. 5A–5F and FIGS. 6A–6G. FIGS. 5A–5E illustrate electrodes with generally cylindrical, disc, elliptical cylinder, conical bowl and conical cylinder shaped e-zones, respectively. And FIG. 5F illustrates an example of how the generally conical cylinder shaped e-zone in FIG. 5E can be modified to increase its lower curvature. FIGS. 6A–6G illustrate example electrode pair orientations of the electrodes illustrated in FIGS. 5A–5F. For convenience, the conductor is referred to as a well in the following discussion. However, the discussion below also applies to other types of conductors.

When we refer to a cylindrical, elliptical cylinder, disc, conical bowl, conical cylinder, spherical or other geometric shape for an e-zone, we mean that the e-zone most nearly approximates that general geometric shape. But, as will be understood by those skilled in the art, in practice, an e-zone will not necessarily have an ideal cylindrical, elliptical cylinder, disc, conical bowl, conical cylinder, spherical or some other predetermined geometric shape. Instead, in practice, these and other geometric shapes will generally approximate some predetermined geometry in accordance with the targeted formation's properties and the electrolytic fluid injection procedure employed, among other formation fluid flow factors known to those skilled in the art. For example, a disc-shaped e-zone will most likely have rounded side faces, so that in cross-section, the disc may have a generally elliptical or ovoid shape.

Figure 5A:
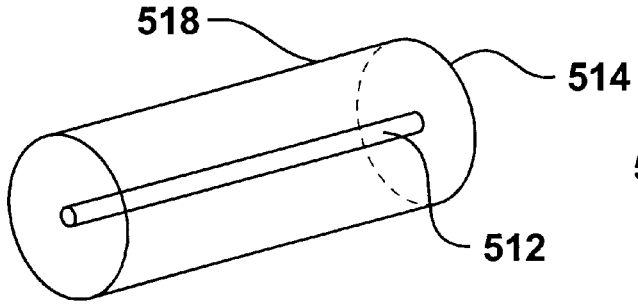
FIG. 5A illustrates a perspective view of a cylindrical-shaped electrode zone established around a substantially horizontal well.

Accordingly, as shown in FIG. 5A, which momentarily ignores factors such as the permeability anisotropism, formation heterogeneity and the electrolytic fluid injection procedure, the e-zone around a substantially horizontal well 512 will tend to form a horizontal substantially cylindrically-shaped e-zone 514 along and around at least the injection portion of the horizontal well 512. By contrast, for a substantially vertical well 522, the e-zone theoretically could be a spherical shape (not shown).

Figure 5B:
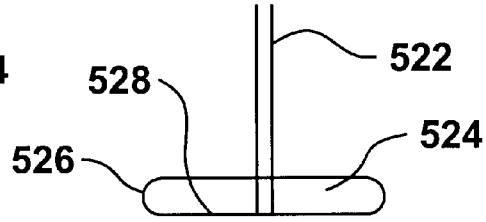
FIG. 5B illustrates side plan view of a disc-shaped electrode zone established around a substantially vertical well.

But, as shown in FIG. 5B, because $K_v$ is typically less that $K_h$, a disc-shaped e-zone 524 is produced. More specifically, the e-zone will tend to extend radially outward from the well in a substantially disc-shaped e-zone 524, having a vertical face 526 and a horizontal substantially circular-shaped base 528. The height of the vertical face 526 is substantially equal to the length of the injection portion of the vertical well 522.

Typically, the horizontal well's e-zone 514 will be longer in the horizontal direction than the height of a vertical well's e-zone 524. This is the typical case because hydrocarbon deposits span distances in the targeted formation that are generally wider than they are deep. Accordingly, the injection portion of a substantially horizontal well 512 will generally be longer than that of a substantially vertical well 522. Hence, the effective electric field of a horizontal well's e-zone will, on average, tend to be larger than the effective electric field of a vertical well's e-zone. Put another way, horizontal e-zones can often be longer than vertical e-zones are tall simply because hydrocarbon deposits in a target formation are usually wider than they are deep, thus a horizontal well's injection section is typically longer than a vertical well's injection section accordingly.

FIGS. 6A, 6B, 6C and 6D illustrate the effect of just a few possible electrode pair orientations on the electric field generated when an electric potential difference is applied between the electrodes illustrated in FIGS. 5A and 5B.

Figure 6A:
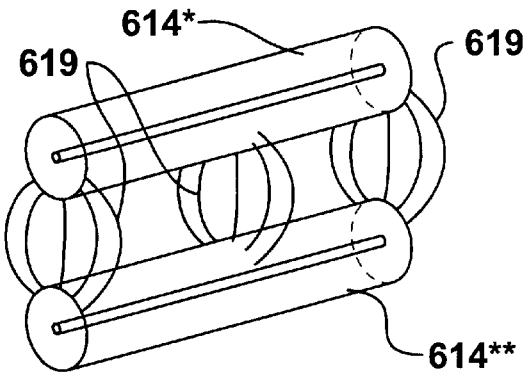
FIG. 6A illustrates a perspective view of an electric field generated between a pair of parallel horizontal cylindrical-shaped electrode zones.
Figure 6B:
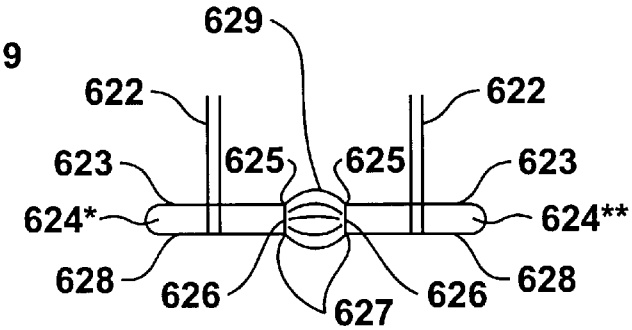
FIG. 6B illustrates a side plan view of an electric field generated between a pair of disc-shaped electrode zones established around two substantially vertical wells, respectively.
Figure 6C:
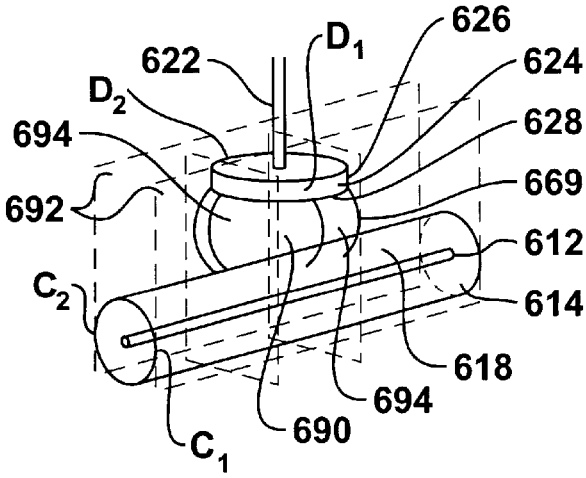
FIG. 6C illustrates a perspective view of an electric field generated between a horizontal cylindrical-shaped electrode zone and a disc-shaped electrode zone.

Comparing the electric fields generated between a pair of electrodes in FIG. 6A and FIG. 6B, as discussed above, a greater portion of a formation is electrically heated by the electric field 619 generated between two substantially parallel horizontal cylindrically-shaped e-zones 614*/614 (FIG. 6A) than between two vertical disc-shaped e-zones 624*/624** (FIG. 6B). As shown in FIG. 6B, the electric field 629 between vertical disc-shaped e-zones 624*/624** is effectively generated between each substantially vertical e-zone face 626 of its respective disc-shaped e-zone 624*/624**. Therefore, the heated portion of the formation is limited by the height of each vertical e-zone face 626. Also, the respective edges 625, 627 between the vertical e-zone face 626 and the top 623 and bottom 628 surfaces of the disc-shaped e-zones 624 generate edge effects that will be more dominant as the height of each vertical e-zone face 626 is reduced. Consequently, premature overheating and hot spots can occur near each vertical e-zone face 626, which in turn significantly reduces the amount of electric heat generated in the balance of the target region between the wells 622**.

Edge effects generally will also occur at the ends of cylindrically-shaped e-zones 614. But, because horizontal cylindrically-shaped e-zones 614 tend to be significantly longer than the height of vertical disc-shaped e-zones 624, the edge effects are substantially less significant for horizontal cylindrically-shaped e-zones 614 than for vertical disc-shaped e-zones 624.

However, as shown in FIG. 6C, electric heating between a vertical disc-shaped e-zone 624 and a horizontal cylindrically-shaped e-zone 614 is more effective than the heating between a pair of disc-shaped e-zones 624 (FIG. 6B). This is primarily due to a larger surface area between the respective opposing e-zone faces 628 and 618, most particularly due to the larger surface area of the cylindrical e-zone face 618. Specifically, the target region volume between opposing e-zone faces is larger because the disc-shaped e-zone's substantially circular e-zone face 628 (with larger surface area vs. the disc-shaped e-zones' vertical face 626) faces the cylindrically-shaped e-zone's opposing face 618. Thus, in combination, these two significantly broader surface areas provide a significantly larger surface area for distributing heat and supporting the electric field 669 generated between the two opposing e-zone faces 628 and 618. Moreover, the edge effects are lower for the substantially circular e-zone face 628 than for the vertical e-zone face 626 because the distance between edges is larger. Furthermore, the curvature of a substantially circular e-zone face 628 is significantly less than the curvature of a vertical e-zone face 626.

Therefore, as illustrated by comparing FIGS. 6A and 6C to FIG. 6B, for example, it will be apparent to those skilled in the art that the inventive WEH process generates more uniform heating relative to conventional electric heating processes, by generating larger surface areas along opposing e-zone faces, as well as less significant edge effects and lower curvature, for supporting a larger electric field versus the fields generated by conventional electric heating processes.

Figure 6D:
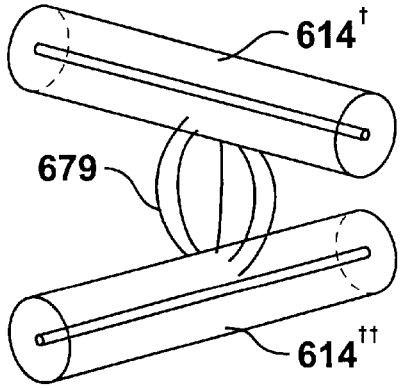
FIG. 6D illustrates a perspective view of an electric field generated between a pair of orthogonal horizontal cylindrical-shaped electrode zones.
Figure 6E:
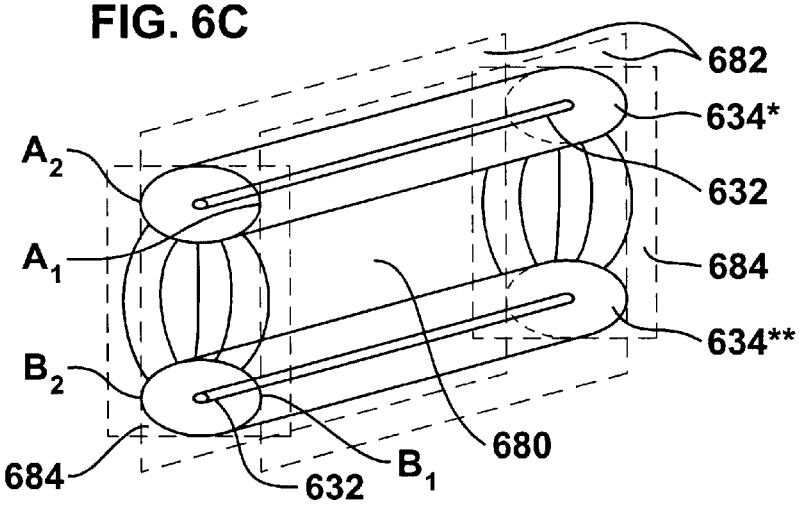
FIG. 6E illustrates a perspective view of an electric field generated between a pair of parallel horizontal elliptic cylindrical-shaped electrode zones.

Accordingly, electric heating between a pair of orthogonal horizontal cylindrically-shaped e-zones 614†/614††, as shown in FIG. 6D, is also less effective than the electric heating between two parallel horizontal cylindrically-shaped e-zones 614*/614 (FIG. 6A), but still more effective than the electric heating generated by two vertical disc-shaped e-zones 624*/624** (FIG. 6B). Specifically, the surface area of opposing e-zone faces and, therefore, the target region volume between orthogonal cylindrically-shaped e-zones 614†/614†† (FIG. 6D) is smaller than for substantially parallel cylindrically-shaped e-zones 614*/614** (FIG. 6A). Accordingly, the heating is less effective because the exposed target region volume is smaller. However, because the electric field 679 between the two orthogonal cylindrically-shaped e-zones 614†/614†† is larger than the electric field 629 between vertical disc-shaped e-zones 624/624 (FIG. 6B), a greater portion of a formation would be electrically heated with the orthogonal horizontal well orientation shown in FIG. 6D than for the orientation shown in FIG. 6**B.

We now turn to the effect of the difference between vertical permeability, $K_v$ and horizontal permeability, $K_h$ on e-zone geometric shape.

Figure 5C:
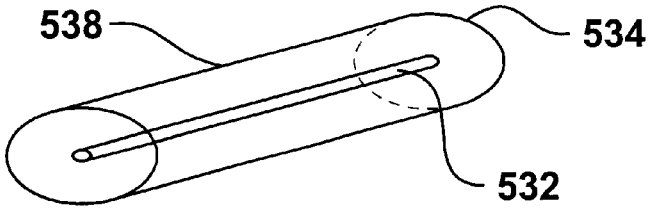
FIG. 5C illustrates a perspective view of an elliptic cylinder-shaped electrode zone established around a substantially horizontal well.

As shown in FIG. 5A, in the case where the formation's $K_v$ is substantially equal to its $K_h$, a horizontal e-zone will be cylindrically-shaped around the well, assuming formation homogeneity. However, as a general rule, $K_v$ tends to be less than $K_h$. Accordingly, as shown in FIG. 5C, the e-zone around a substantially horizontal well 532 will generally be an elliptical cylinder-shaped e-zone 534. Accordingly, the surface area will be larger and the curvature will be lower for the elliptical e-zone face 538 than for the cylindrical e-zone face 518. Likewise, because $K_v$ tends to be less than $K_h$, as illustrated in FIG. 5B, the height of a disc-shaped e-zone's vertical face 526 will tend to be significantly less than the diameter of the disc-shaped e-zone's horizontal face 528. Accordingly, the surface area of a vertical e-zone face 526 will be significantly less than the surface area of a horizontal substantially circular e-zone face 528.

In any case, $K_v$ and $K_h$ may vary along the length of a well. Consequently, the e-zone curvature generated by injecting electrolytic fluid along the perforated length of the well will not likely be ideally uniform due to, among other factors, heterogeneity of formation properties. But, provided the average curvature between the e-zones is kept substantially uniform, then the benefits of improved heating rate and distribution with the inventive WEH process will likely be obtained, depending on formation and operating conditions.

As illustrated in FIG. 6E, elliptical cylinder-shaped e-zones 634*/634 increase the electric heating effectiveness, as compared to the cylindrically-shaped e-zones 614 (FIG. 6A or 6D), because the elliptical cylinder-shaped e-zones 634*/634** have a lower curvature and significantly larger surface area for supporting a more uniform and larger electric field. Similarly, electric heating effectiveness can be increased by using, for example, elliptical cylinder-shaped e-zones 634, rather than using the horizontal disc-shaped/cylindrical-shaped e-zones, 624/614, as oriented in FIG. 6C or the orthogonally oriented cylindrically-shaped e-zones 614†/614†† shown in FIG. 6**D.

Figure 5D:
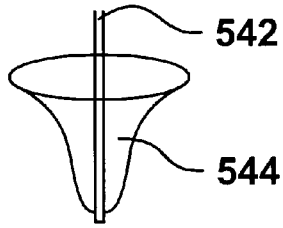
FIG. 5D illustrates a perspective view of a conical bowl-shaped electrode zone established around a substantially vertical well.
Figure 5E:
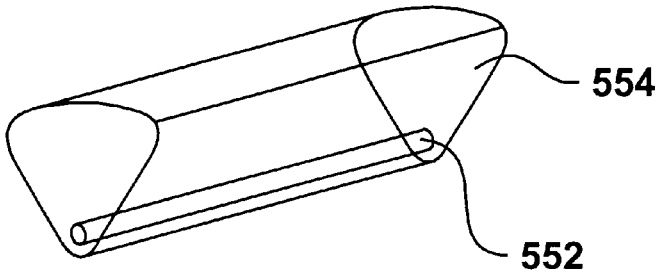
FIG. 5E illustrates a perspective view of a conical cylinder-shaped electrode zone established around a substantially horizontal well.
Figure 5F:
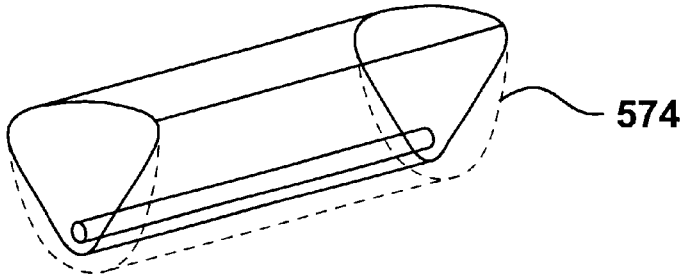
FIG. 5F illustrates a perspective view of an extended cylindrical-shaped electrode zone established around a substantially horizontal well.

Now regarding the effect of the electrolytic fluid injection procedure on e-zone geometric shape, FIGS. 5D and 5E illustrate two contrasting example e-zone geometric shapes typically generated after electrolytic fluid is injected into a produced oil region following cyclic steam stimulation ("CSS") using a vertical well (FIG. 5D) or horizontal well (FIG. 5E). As shown in FIG. 5D, for a vertical well, rising steam injected through a vertical well 542 will tend to form a conical bowl-shaped zone 544. Such conical bowl-shaped e-zones 544 are formed when using CSS as described in US '809. And, as shown in FIG. 5E, typically, when steam is injected in a formation, it will rise above a horizontal well 552 in a conical cylinder-shaped zone 554.

Figure 6F:
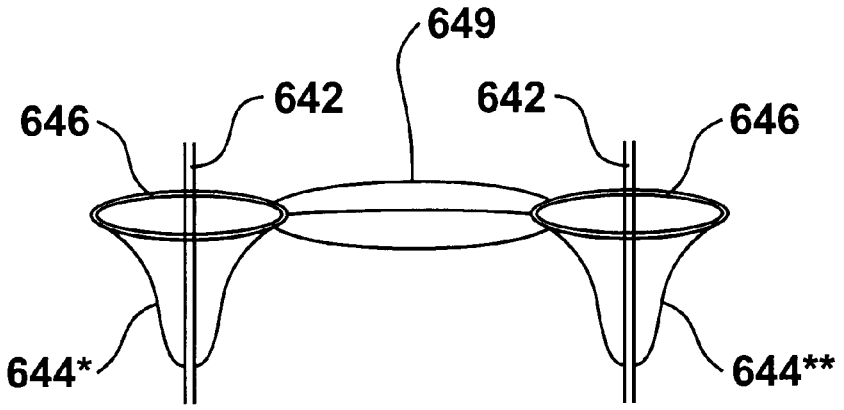
FIG. 6F PRIOR ART
FIG. 6F illustrates a perspective view of an electric field generated between a prior art pair of conical bowl-shaped electrode zones established in the substantially oil produced regions around two vertical wells, respectively, following a cyclic steam stimulation ("CSS") process.

Accordingly, with respect to the type of electric field generated with the e-zone geometric shapes shown in FIGS. 5D and 5E, FIGS. 6F and 6G, respectively, depict examples of typical electric fields that would be generated with those e-zone geometric shapes. For example, FIG. 6F illustrates the electric field generated when electric heating is applied to a pair of conical bowl-shaped e-zones 644*/644. This illustrates the condition created in US '809 where high electrical conductivity fluid is injected to displace water condensed from steam in the CSS heated zone without displacing connate water from the unheated portion of the formation (col. 5,I. 66- col. 6,I. 4). Also, as shown in FIG. 6F, the edge effect, discussed above in reference to disc-shaped e-zones 624 (FIG. 6B), can be even more pronounced between a conical bowl-shaped e-zone pair 644*/644** than a simple vertical disc-shaped e-zone pair 624*/624** (FIG. 6B), because much more of the current load carried by the comparatively larger conical bowl-shaped e-zones 644*/644** is diverted to the conical bowl's e-zone top edge 646 where the electrical conductance is highest. Accordingly, the benefit of the larger volume conical bowl-shaped e-zones 644*/644** is substantially lost due to this dramatic edge effect arising from both e-zones having relatively high curvature and a substantial degree of deviation in the spacing between opposing faces of each e-zone 644 along the length and between each conical bowl-shaped e-zone 644. In fact, the e-zone faces at the top edge 646 of each conical bowl-shaped e-zone 644 more closely approximate horizontal large curvature bare conductors. Accordingly, the larger e-zone size, which provides more electrolytic fluid to support more current load, further exacerbates focused electric heating due to edge effects, as a significant percentage of the current load follows the path of least resistance through each e-zone's top edge 646. Therefore, the portion of the target region affected by electric field 649 between conical bowl-shaped e-zones 644*/644** is relatively small, which significantly reduces the amount of heat generated in the balance of the target region between the wells 642**.

Figure 6G:
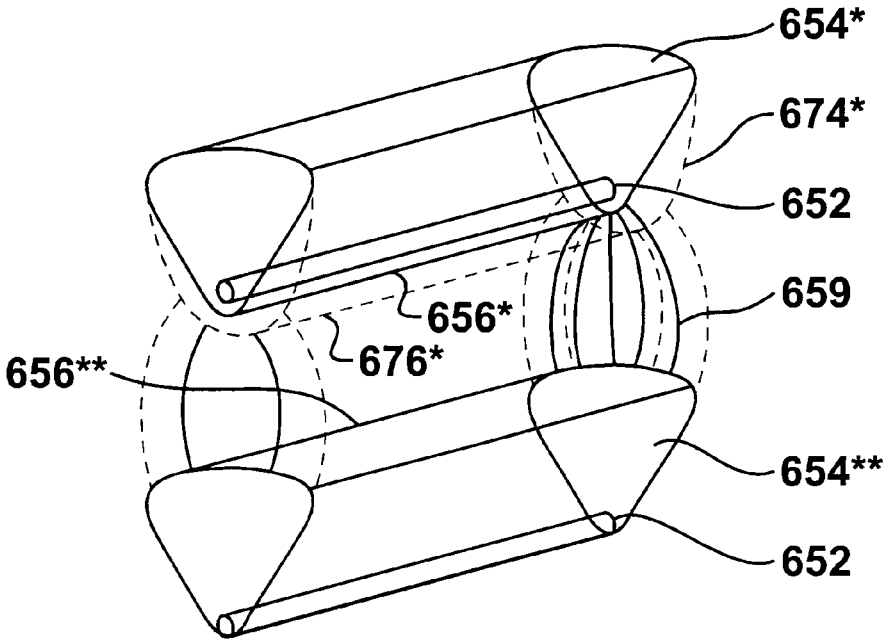
FIG. 6G illustrates a perspective view of an electric field generated between a pair of parallel horizontal conical cylinder-shaped electrode zones.

A somewhat similar, but nonetheless significant, reduction in the adverse focused heating due to edge effects is shown in FIG. 6G with two e-zones created in oil produced regions following CSS around two parallel horizontal wells. FIG. 6G illustrates the electric field 659 generated when electric heating is applied to a pair of conical cylinder-shaped e-zones 654*/654. The electric field 659 generated in this orientation heats a significantly larger volume of the formation than the comparatively smaller electric field 649 shown in FIG. 6**F.

However, even though both conical cylinder-shaped e-zones 654*/654 are larger than their respective conductors, the effect of the upper conical cylinder-shaped e-zone 654* is underutilized because the curvature of the upper conical cylinder-shaped e-zone face 656* is comparatively significantly larger than the curvature of the lower conical cylinder-shaped e-zone face 656**. Accordingly, if CSS is used to establish an e-zone around a horizontal well 652, it is preferable to inject an additional volume of electrolytic fluid to further modify the shape of the upper conical cylinder-shaped e-zone 654*, for example, as illustrated more clearly in FIG. 5F. Modified e-zone 574 has a larger curvature at the base, as depicted by dashed lines, than does e-zone 552 (FIG. 5E). In FIG. 6G, additional electrolytic fluid can modify the e-zone geometric shape, for example, from a pre-supplemental upper conical cylinder-shaped e-zone 654* versus the post-supplemental upper conical cylinder-shaped e-zone 674*. In turn, this shape modification reduces the curvature of the e-zone face designated 656* before and 676*** after the supplemental electrolytic fluid injection.

If a solvent is used to establish the e-zone, the effect seen for CSS can also occur. In particular, when the solvent has a low boiling point, there is an increased likelihood that a CSS type shape will develop. However, establishing an e-zone with hot water and/or hot electrolytic fluid will more likely result in substantially elliptical cylinder shaped e-zones contiguous with horizontal conductors and disc-shaped e-zones contiguous with vertical conductors.

We turn now to examples of the target region created by e-zones. FIG. 6E illustrates a target region 680 created between a pair of parallel conductors 632. A first pair of opposing planes 682 bounding the target region 680 is substantially parallel with the length of the conductors 632 . Each plane 682 of the first pair is substantially tangent to and interconnecting the average e-zone side perimeter of each e-zone 634*/634 at the outermost points. In FIG. 6E, the outermost points of e-zone 634* are $A_1$ and $A_2$, while the outermost points of e-zone 634** are $B_1$ and $B_2$. Thus, points $A_1$ and $B_1$ are connected by one tangential plane 682 and points $A_2$ and $B_2$ are connected by the other tangential plane 682. And each plane of a second pair of opposing planes 684 is, independently, substantially tangent to and interconnecting the average e-zone end perimeter of each e-zone 634*, 634****.

FIG. 6C illustrates a target region 690 created between a pair of non-parallel conductors, in this case a horizontal conductor 612 and a vertical conductor 622. A first pair of opposing planes 692 bounding the target region 690 is substantially parallel with the length of the horizontal conductor 612. Each plane 692 of the first pair is substantially tangent to the average e-zone side perimeter at the outermost points on the e-zone side perimeter of the horizontal elliptical cylinder-shaped e-zone 614. In FIG. 6C, the outermost points of e-zone 614 are $C_1$ and $C_2$. Each plane 692 is substantially tangent to the average e-zone side perimeter at the outermost points on the e-zone perimeter of the vertical disc-shaped e-zone 624. In FIG. 6C, the outermost points of e-zone 624 are $D_1$ and $D_2$. Thus, points $C_1$ and $D_1$ are connected by one tangential plane 692 and points $C_2$ and $D_2$ are connected by the other tangential plane 692. A second pair of opposing planes 694 is substantially parallel to the length of the vertical conductor 622. Each plane 694 of the second pair is substantially tangent to the average e-zone side perimeter of the vertical disc-shaped e-zone 624 and dissects the horizontal elliptical cylinder-shaped e-zone 614 into three parts, which parts may have equal or unequal lengths.

WEH Applications

The inventive WEH process may be used exclusive of any other thermal and/or non-thermal enhanced oil recovery ("EOR") process that may be used to produce hydrocarbons over a wide range of viscosities from a few centipoise (cp) to about 1,000,000 cp or even greater. But, more likely, the inventive WEH process will be more economically beneficial when used to help produce heavier viscosity hydrocarbons in a range from about 500 cp to about 1,000,000 cp or even greater. Furthermore, the inventive WEH process can often be most beneficial from a cost-benefit standpoint when used in combination with one or more other thermal and/or non-thermal EOR processes, including without limitation, SAGD (steam-assisted gravity drainage), wet and/or dry Vapex, CSS and assorted steam processes. However, the WEH process may also be strategically beneficial when used alone or in combination with other processes used to produce hydrocarbons with viscosities below about 500 cp.

More particularly, with respect to a SAGD process, the inventive WEH process could be used, for instance, as a means for starting or "initializing" the SAGD process. For example, it could be used to help generate heat build-up important in the initialization phase of a SAGD process like that generally described, for example, by Butler in U.S. Pat. No. 4,344,485, where the SAGD process is practiced below fracture pressure, or Edmunds in CA 1,304,287, where the SAGD process is practiced above fracture pressure.

With respect to a CSS process, depending on the viscosity of hydrocarbons and the targeted formation's properties, the inventive WEH process may be used before, after or both before and after a CSS process to further enhance the oil produced from the formation. Likewise, the inventive WEH process could be used cooperatively with a dry Vapex process, generally described, for example, in U.S. Pat. No. 5,407,009 (Butler et al., Apr. 18, 1995) and U.S. Pat. No. 5,607,016 (Butler, Mar. 4, 1997), and/or a wet Vapex process, which is generally described in the SPE paper "In-Situ Upgrading of Heavy Oils and Bitumen by Propane Deasphalting: The Vapex Process" (SPE 25452 I. J. Mokrys and R. M. Butler, presented Mar. 21–23, 1993 at the Production Operations Symposium, Oklahoma City, Okla.).

Also, the inventive WEH process could even be used to assist in the primary recovery stage of hydrocarbon production. For example, assuming a natural gas "cap" deposit resides over an oil deposit in the targeted formation, the WEH process could be used to heat the gas cap region so that additional pressure is built up in that region. In turn, this additional pressure can aid in accelerating the rate and/or increasing the total amount of oil recovered from the oil deposit below due to the downward pressure exerted from the heated and hence, more highly pressurized, natural gas cap situated above the oil deposit.

EXAMPLES

The following non-limiting examples of embodiments of the invention claimed herein are provided strictly for illustrative purposes only. WEH and Comparative Examples 1.x through 3.x are simulation examples and Example 4 is a laboratory model experiment. Further embodiments of the claimed invention will be apparent to those skilled in the art of oil recovery processes in view of the detailed description provided above and/or the following examples.

WEH & Comparative Examples 1.x to 3.x

WEH and Comparative Examples 1.x through 3.x are reservoir simulation examples for illustrating various advantages of the inventive WEH process. The effects of the inventive WEH process were simulated for a number of different well (i.e., conductor) orientations, including pairs of parallel horizontal wells, parallel vertical wells, orthogonal horizontal wells and a vertical/horizontal well pair. Selected comparative examples provide performance results for well pairs without e-zones and thereby demonstrate the substantial improvement in the degree of heating uniformity generated using the inventive WEH process generally described above. Likewise, Comparative Example C2.0/Conical (abbreviated "Cone" hereinafter) illustrates the process described in U.S. Pat. No. 3,946,809 ("US '809" by Hagedorn). As noted above, the process described in US '809 completely neglects e-zone spacing, geometric shape and spatial orientation so that a target region could be heated substantially diffusely. Instead, the e-procedure disclosed in US '809 for forming an e-zone pair invariably generates a single pair of focused hot spots in a single target region layer to such an extent that a target region cannot be heated in a substantially uniform manner. By contrast, the inventive WEH process accounts for e-zone factors, such as, e-zone spacing, geometric shape relative to each other and/or spatial orientation relative to each other, that generate a localized heating zone and/or one or more hot spot pairs distributed between two or more target region layers, so that heat distribution is more diffuse and the target region is heated substantially more uniformly.

Figure 7:
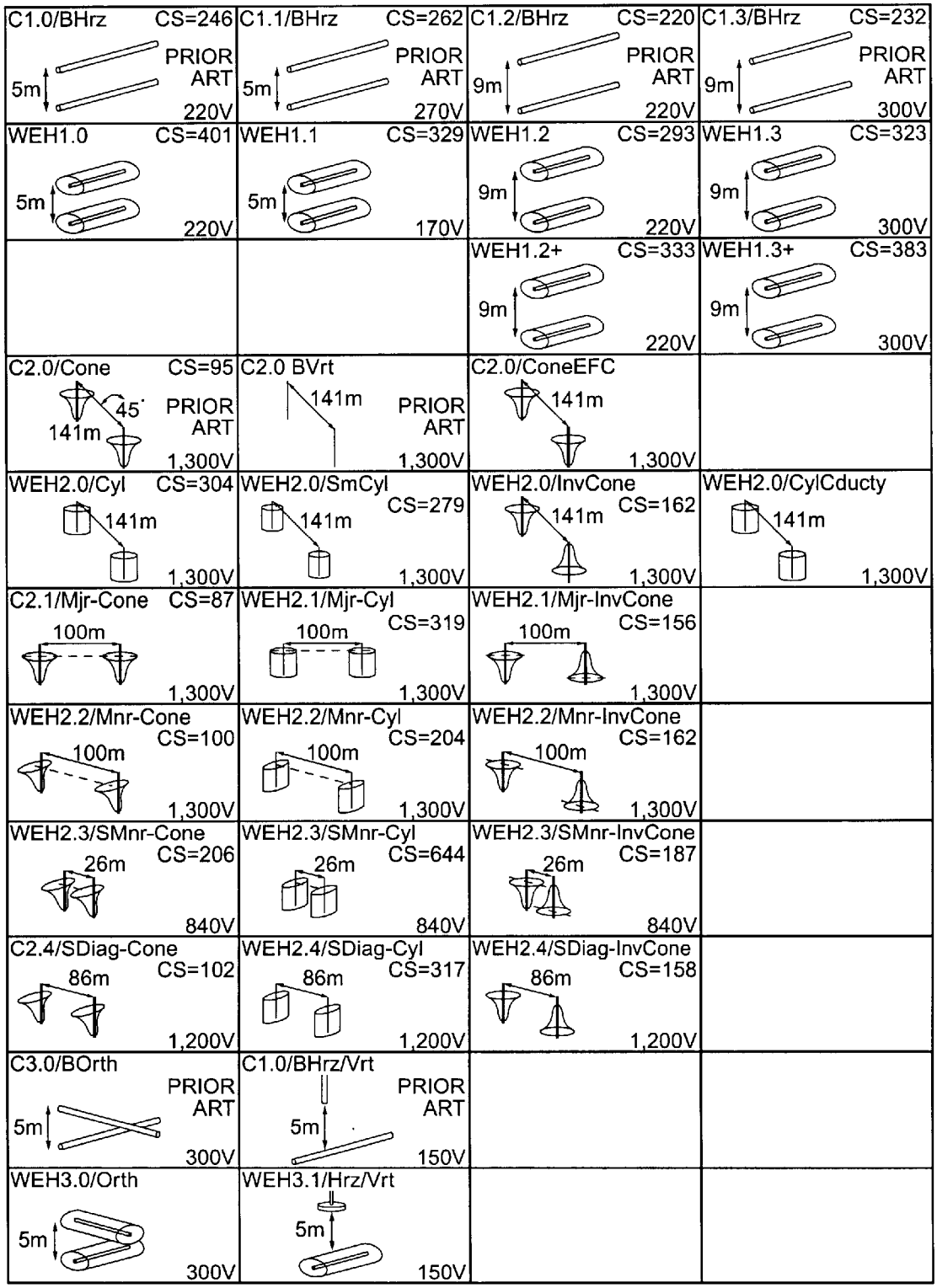
FIG. 7 is a pictorial guide to the WEH and Comparative Examples 1.x to 3.x discussed more fully below, listing the composite score for the respective heating performance where calculated.

FIG. 7 is a pictorial guide to the conductor and e-zone orientations simulated in WEH and Comparative Examples 1.x to 3.x discussed more fully below. In the discussions below, the examples have been compared with other examples having the same well configuration, applied voltage and e-zone spatial orientation.

In summary, the examples discussed in more detail below and summarized in Table 1 demonstrate that the volume of the target region heated during a given period of time increases when contiguous e-zones are established around the conductors, as compared with the volume heated by "bare" conductors (i.e., conductors without contiguous e-zones and/or with discontiguous e-zones). Moreover, heat is more uniformly distributed throughout the targeted hydrocarbon deposit using the inventive WEH process.

For a given voltage, the average heating power delivered to the targeted formation is increased by establishing e-zones around the conductor (see WEH1.0 (with e-zones) vs. C1.0/BHrz (without e-zones)). Accordingly, with an increase in heating power, more of the applied electric energy is converted to heating the targeted formation. And even when the applied voltage is increased for a bare conductor so that the same average heating power, as that obtained with contiguous e-zones, is generated, the heated volume of the target region is still significantly less. Moreover, heating with a bare conductor is focused on a smaller volume of the targeted formation and water vaporization occurs earlier (see WEH1.0 (with e-zones) vs. C1.1/BHrz (without e-zones)). Meanwhile, for conductors with e-zones, when the applied voltage is decreased, so that power delivered to the formation is the same as for bare conductors, heat is distributed more uniformly and the onset of the water vaporization stage is significantly delayed (see WEH1.1 (with e-zones) vs. C1.0/BHrz (without e-zones)).

Also, increased applied voltage increases the heating rate and, often, can result in hot spots. However, hot spots can be diffused into localized heating zones and/or redistributed between multiple layers of a target region when the e-zone curvature, e-zone spatial orientation and/or e-zone spacing are properly accounted for in general accordance with the detailed description provided herein.

The examples also show that decreasing the applied voltage increases the total formation volume heated prior to water vaporization, albeit at a lower heating rate. Accordingly, depending on the application of the inventive WEH process, it may be desirable to start with a higher voltage to increase the heating rate and later drop the voltage to allow for longer electric heating interval.

Larger e-zones generally increase the heating rate and heated volume. But e-zone curvature uniformity, e-zone spatial orientation and e-zone spacing should be accounted for to ensure the electric heating process is reasonably beneficial. For example, in C2.0/Cone (US '809), the e-zone volume was large, providing a very large electrode. But the e-zones were in the shape of conical bowls, which have non-uniform curvature and non-uniform spacing (e-zone spacing gradient of about 1:1). Accordingly, the heating was focused at hot spots at the top edges of the conical bowl-shaped e-zone in a single layer of the target region (i.e., asymmetric unidirectional hot spots). These asymmetric unidirectional hot spots in turn cause premature electrical connectivity failure, thereby generating a lower heated volume. Specifically, any heating occurred primarily only in the top portion of the target region that was between the opposing facing top edges of the conical bowl-shaped e-zones, approximating the effect of a short "bare" horizontal conductor pair.

C2.0/ConeEFC was conducted to show that increasing the electrical conductivity of electrolytic fluid in the lower portion of the conical bowl-shaped e-zones from C2.0/Cone could not overcome the non-uniform e-zone curvature. However, WEH 2.0/InvCone demonstrates that electric heating can be distributed more uniformly throughout the target region by providing, for example, curvature complementarity between opposing e-zone faces, so that the spacing between opposing e-zone faces is more uniform. Specifically, while a pair of hot spots was generated in WEH2.0/InvCone, each hot spot was vertically spaced apart in two different target region layers (i.e., symmetric multidirectional hot spots), rather than horizontally spaced apart within a single target region layer. Therefore, the hot spots sandwiched the majority of the relatively cooler target region therebetween. So, the inverted conical bowl-shaped e-zone generated increased effective contact area for heating the target region disposed between the two layers, thereby generating more diffuse, multidirectional heat distribution from both sides of the target region, rather than substantially unidirectional heating from a single upper layer in the target region.

TABLE 1

| Example Description | TABLE 1A | | | | |
|---|---|---|---|---|---|
| And Operating Parameters<br>TTFV: Total Targeted Formation Volume ($m^3$)<br>$P_R$: Formation Pressure (MPa) | Average Conductance (S) | $\Gamma_{initial}$ | $\Gamma_{10\%}$ (days in 10% electric heating interval) | TCG Factor ($\Gamma_{initial} - \Gamma_{10\%}$) ÷ (days) | Avg. Ohm-Heating Power (MW) |
| C1.0/BHrz: Bare Conductors (no e-zone); Parallel horizontal pair of wells, 1000 m long, 5 m apart. TTFV: 102,000 $m^3$; $P_R$ = 2.1 MPa; 220 V | 28.70 | 20.1 | 3.2 (20) | 0.85 | 1.46 |
| C1.1/BHrz: Bare Conductors (no e-zone); Parallel horizontal pair of wells, 1000 m long, 5 m apart. TTFV: 102,000 $m^3$; $P_R$ = 2.1 MPa; 270 V | 28.76 | 20.0 | 5.2 (10) | 1.48 | 2.18 |
| C1.2/BHrz: Bare conductors (no e-zone); Parallel horizontal pair of wells, 1000 m long, 9 m apart. TTFV: 170,000 $m^3$; $P_R$ = 2.1 MPa; 220 V | 24.47 | 56.1 | 3.4 (80) | 0.66 | 1.20 |
| C1.3/BHrz: Bare conductors (no e-zone); Parallel horizontal pair of wells, 1000 m long, 9 m apart. TTFV: 170,000 $m^3$; $P_R$ = 2.1 MPa; 300 V | 23.77 | 55.7 | 12.1 (15) | 2.91 | 2.21 |
| WEH1.0: Elliptical cylinder-shaped e-zones around parallel horizontal pair of wells, 1000 m long, 5 m apart. E-zones: each 0.6 m high × 1 m wide. TTFV: 102,000 $m^3$; $P_R$ = 2.1 MPa; 220 V | 47.61 | 3.8 | 1.7 (10) | 0.21 | 2.40 |
| WEH1.1: Elliptical cylinder-shaped e-zones around parallel horizontal pair of wells, 1000 m long, 5 m apart. E-zones: each 0.6 m high × 1 m wide. TTFV: 102,000 $m^3$; $P_R$ = 2.1 MPa; 170 V | 48.74 | 3.8 | 1.2 (35) | 0.07 | 1.47 |
| WEH1.2: Elliptical cylinder-shaped e-zones around parallel horizontal pair of wells, 1000 m long, 9 m apart. E-zones: each 0.6 m high × 1 m wide. TTFV: 170,000 $m^3$; $P_R$ = 2.1 MPa; 220 V | 36.47 | 10.1 | 2.2 (50) | 0.16 | 1.82 |
| WEH1.2+: Elliptical cylinder-shaped e-zones around parallel horizontal pair of wells, | 45.43 | 5.5 | 1.6 (40) | 0.10 | 2.25 |

TABLE 1-continued

| | | | | | |
|---|---|---|---|---|---|
| 1000 m long, 9 m apart. E-zones: each 1 m high × 1.8 m wide. TTFV: 170,000 $m^3$; $P_R$ = 2.1 MPa; 220 V | | | | | |
| WEH1.3: Elliptical cylinder-shaped e-zones around parallel horizontal pair of wells, 1000 m long, 9 m apart. E-zones: each 0.6 m high × 1 m wide. TTFV: 170,000 $m^3$; $P_R$ = 2.1 MPa; 300 V | 34.96 | 10.1 | 3.9 (15) | 0.41 | 3.28 |
| WEH1.3+: Elliptical cylinder-shaped e-zones around parallel horizontal pair of wells, 1000 m long, 9 m apart. E-zones: each 1 m high × 1.8 m wide. TTFV: 170,000 $m^3$; $P_R$ = 2.1 MPa; 300 V | 43.17 | 5.6 | 2.4 (15) | 0.21 | 4.03 |
| C2.0/Cone: US'809: Conical bowl-shaped e-zones around parallel vertical pair of wells, 32 m long, 141 m apart. E-zones: each 54 m × 10 m ellipse at top, 2 m circle at bottom. E-zones diagonally-oriented. TTFV: 320,000 $m^3$; $P_R$ = 3.1 MPa; 1,300 V | 0.56 | 143.1 | 103.2 (10) | 3.99 | 0.96 |
| C2.0/BVrt: Bare conductors (no e-zone). Parallel vertical pair of wells, 32 m long, 141 m apart. TTFV: 320,000 $m^3$; $P_R$ = 3.1 MPa; 1,300 V | 0.22 | 17,151 | 17,151 (1) | 0 | 0.37 |
| C2.0/ConeEFC: Conical bowl-shaped e-zones around parallel vertical pair of wells, 32 m long, 141 m apart. E-zones: each 54 m × 10 m ellipse at top, 2 m circle at bottom. E-zones diagonally oriented. $P_R$ = 3.1 MPa; Electrolytic fluid conductivity increased at bottom of conical bowl-shaped e-zones. TTFV: 320,000 $m^3$; $P_R$ = 3.1 MPa; 1,300 V | 0.56 | 145.4 | 104.8 (10) | 4.07 | 0.96 |
| WEH2.0/Cyl: Elliptical cylinder-shaped e-zones generated from C2.0/Cone around parallel vertical pair of wells, 32 m long, 141 m apart. E-zones: each 54 m × 10 m × 32 m deep. E-zones diagonally oriented as in US '809. TTFV: 320,000 $m^3$; $P_R$ = 3.1 MPa: 1,300 V | 0.82 | 24.9 | 18.5 (30) | 0.21 | 1.49 |
| WEH2.0/SmCyl: Same parameters as WEH2.0/Cyl with smaller volume elliptical cylinder-shaped e-zones each 20 m × 8 m × 32 m deep. Vertical wells 141 m apart. TTFV: 320,000 $m^3$; $P_R$ = 3.1 MPa; 1,300 V | 0.54 | 68.8 | 55.0 (20) | 0.69 | 0.92 |
| WEH2.0/InvCone: Inverted conical bowl-shaped e-zones around parallel vertical pair of wells, 32 m long, 141 m apart. E-zones: one 54 m × 10 m ellipse at top, 2 m circle at bottom; the other inverted with 54 m × 10 m ellipse at bottom, 2 m circle at top. E-zones diagonally oriented as in US '809. TTFV: 320,000 $m^3$; $P_R$ = 3.1 MPa; 1,300 V | 0.57 | 140.9 | 101.7 (10) | 3.92 | 0.97 |
| WEH2.0/CylCducty: Elliptical cylinder-shaped e-zones generated from C2.0/Cone around parallel vertical pair of wells, 32 m long, 141 m apart. E-zones: each 54 m × 10 m × 32 m deep. E-zones diagonally oriented as in US '809. Reduced formation electrical conductivity. TTFV: 320,000 $m^3$; $P_R$ = 3.1 MPa; 1,300 V | 0.56 | 25.7 | 16.8 (50) | 0.18 | 0.94 |
| C2.1/Mjr-Cone: Conical bowl-shaped e-zones around parallel vertical pair of wells, 32 m long, 100 m apart. E-zones oriented with major axes aligned; E-zones: each 54 m × 10 m ellipse at top, 2 m circle at bottom. TTFV: 128,000 $m^3$; $P_R$ = 3.1 MPa; 1,300 V | 0.54 | 27.2 | 23.2 (6) | 0.67 | 0.92 |
| WEH2.1/Mjr-Cyl: Elliptical cylinder-shaped e-zones generated from C2.0/Cone around parallel vertical pair of wells, 32 m long; 100 m apart. E-zones oriented with major axes aligned. E-zones: each 54 m × 10 m × 32 m deep. TTFV: 128,000 $m^3$; $P_R$ = 3.1 MPa; 1,300 V | 0.83 | 5.7 | 5.0 (10) | 0.07 | 1.40 |
| WEH2.1/Mjr-InvCone: Inverted and upright | 0.55 | 32.3 | 26.3 | 1.01 | 0.92 |

TABLE 1-continued

| | | | | | |
|---|---|---|---|---|---|
| conical bowl-shaped e-zones around parallel vertical pair of wells, 32 m long, 100 m apart. E-zones: one 54 m × 10 m ellipse at top, 2 m circle at bottom; the other inverted with 54 m × 10 m ellipse at bottom, 2 m circle at top. E-zones oriented with major axes aligned. TTFV: 128,000 $m^3$; $P_R$ = 3.1 MPa; 1,300 V | | | (6) | | |
| WEH2.2/Mnr-Cone: Conical bowl-shaped e-zones around parallel vertical pair of wells, 32 m long, 100 m apart. E-zones oriented with minor axes aligned. E-zones: each 54 m × 10 m ellipse at top, 2 m circle at bottom. TTFV: 236,800 $m^3$; $P_R$ = 3.1 MPa: 1,300 V | 0.59 | 43.5 | 31.1 (10) | 1.23 | 1.01 |
| WEH2.2/Mnr-Cyl: Elliptical cylinder-shaped e-zones generated from C2.0/Cone around parallel vertical pair of wells, 32 m long, 100 m apart. E-zones oriented with minor axes aligned. E-zones: each 54 m × 10 m × 32 m deep. TTFV: 236,800 $m^3$; $P_R$ = 3.1 MPa; 1,300 V | 0.89 | 8.3 | 6.1 (30) | 0.07 | 1.48 |
| WEH2.2/Mnr-InvCone: Inverted conical bowl-shaped e-zones around parallel vertical pair of wells, 32 m long, 100 m apart. E-zones oriented with minor axes aligned. E-zones: one 54 m × 10 m ellipse at top, 2 m circle at bottom; the other inverted with 54 m × 10 m ellipse at bottom, 2 m circle at top. TTFV: 236,800 $m^3$; $P_R$ = 3.1 MPa; 1,300 V | 0.59 | 43.8 | 31.4 (10) | 1.24 | 1.01 |
| WEH2.3/SMnr-Cone: Conical bowl-shaped e-zones around parallel vertical pair of wells, 32 m long, 26 m apart. E-zones oriented with minor axes aligned. E-zones: each 54 m × 10 m ellipse at top, 2 m circle at bottom. TTFV: 60,621 $m^3$; $P_R$ = 3.1 MPa; 840 V | 1.42 | 2.2 | 2.1 (4) | 0.03 | 1.01 |
| WEH2.3/SMnr-Cyl: Elliptical cylinder-shaped e-zones generated from C2.0/Cone around parallel vertical pair of wells, 32 long, 26 m apart. E-zones oriented with minor axes aligned. E-zones: each 54 m × 10 m × 32 m deep. TTFV: 60,621 $m^3$; $P_R$ = 3.1 MPa; 840 V | 2.26 | 1.1 | 1.0 (12) | 0.01 | 1.17 |
| WEH2.3/SMnr-InvCone: Inverted conical bowl-shaped e-zones around parallel vertical pair of wells, 23 m long, 26 m apart. E-zones oriented with minor axes aligned. E-zones: one 54 m × 10 m ellipse at top, 2 m circle at bottom; the other inverted with 54 m × 10 m ellipse at bottom, 2 m circle at top. TTFV: 60,621 $m^3$; $P_R$ = 3.1 MPa; 840 V | 1.30 | 5.2 | 5.1 (2) | 0.04 | 0.92 |
| C2.4/SDiag-Cone: Conical bowl-shaped e-zones around parallel vertical pair of wells, 32 m long, 86 m apart. E-zones diagonally oriented. E-zones: each 54 m × 10 m ellipse at top, 2 m circle at bottom. TTFV: 101,824 $m^3$; $P_R$ = 3.1 MPa; 1,200 V | 0.69 | 39.7 | 34.4 (4) | 1.32 | 1.00 |
| WEH2.4/SDiag-Cyl: Elliptical cylinder-shaped e-zones generated from C2.0/Cone around parallel vertical pair of wells, 32 m long, 86 m apart. E-zones diagonally oriented. E-zones: each 54 m × 10 m × 32 m deep. TTFV: 101,824 $m^3$; $P_R$ = 3.1 MPa; 1,200 V | 1.18 | 8.7 | 8.0 (6) | 0.11 | 1.70 |
| WEH2.4/SDiag-InvCone: Inverted conical bowl-shaped e-zones around parallel vertical pair of wells, 32 m long, 86 m apart. E-zones diagonally oriented. E-zones: one 54 m × 10 m ellipse at top, 2 m circle at bottom; the other inverted with 54 m × 10 m ellipse at bottom, 2 m circle at top. TTFV: 101,824 $m^3$; $P_R$ = 3.1 MPa; 1,200 V | 0.69 | 45.5 | 39.5 (4) | 1.50 | 0.77 |
| C3.0/BOrth: Bare Conductors (no e-zone); Orthogonal horizontal pair of wells, 5 m apart. | 0.73 | 30.2 | 11.3 (5) | 3.78 | 0.067 |

TABLE 1-continued

| | | | | | |
|---|---|---|---|---|---|
| TTFV: 7,350 $m^3$; $P_R$ = 3.1 MPa; 300 V<br>C3.1/BHrz/Vrt: Bare Conductors (no e-zone); Vertical and horizontal well pair; Vertical well 5 m above horizontal well.<br>TTFV: 7,350 $m^3$; $P_R$ = 3.1 MPa; 150 V | 0.06 | 4,280 | 552.5<br>(10) | 372.8 | 0.001 |
| WEH3.0/Orth: Elliptical cylinder-shaped e-zones around orthogonal horizontal pair of wells, 5 m apart. E-zones: each 1 m high × 3 m wide.<br>TTFV: 7,350 $m^3$; $P_R$ = 3.1 MPa; 300 V | 1.53 | 2.8 | 1.6<br>(5) | 0.24 | 0.140 |
| WEH3.1/Hrz/Vrt: Disc-shaped e-zone and cylinder-shaped e-zone around vertical and horizontal wells, respectively; Vertical well 5 m above horizontal well. E-zones: disc-shaped e-zone around vertical well, 1 m high × 1 m diameter; circular cylinder-shaped e-zone around horizontal well, 1 m diameter.<br>TTFV: 7,350 $m^3$; $P_R$ = 3.1 MPa; 150 V | 0.17 | 799.4 | 207.7<br>(5) | 118.3 | 0.004 |

TABLE 1A

| Example Description<br>And Operating Parameters<br>TTFV: Total Targeted Formation Volume ($m^3$)<br>$P_R$: Formation Pressure (MPa) | Total Heat Generated (MJ) | % Heated Vol. & $m^3$ Heated at 20 days | % Heated Vol. & $m^3$ Heated at 60 days | % Heated Vol. & $m^3$ Heated, Final | Days to $H_2O$ Vaporization |
|---|---|---|---|---|---|
| C1.0/BHrz: Bare Conductors (no e-zone); Parallel horizontal pair of wells, 1000 m long, 5 m apart.<br>TTFV: 102,000 $m^3$; $P_R$ = 2.1 MPa; 220 V | $27.7 \times 10^6$ | 3.36%<br>3,422 | 21.64%<br>22,071 | 52.78%<br>53,831 | 220 |
| C1.1/BHrz: Bare Conductors (no e-zone); Parallel horizontal pair of wells, 1000 m long, 5 m apart.<br>TTFV: 102,000 $m^3$; $P_R$ = 2.1 MPa; 270 V | $15.1 \times 10^6$ | 8.54%<br>8,711 | 30.34%<br>30,942 | 36.69%<br>37,422 | 80 |
| C1.2/BHrz: Bare conductors (no e-zone); Parallel horizontal pair of wells, 1000 m long, 9 m apart.<br>TTFV: 170,000 $m^3$; $P_R$ = 2.1 MPa; 220 V | $79.8 \times 10^6$ | 0.31%<br>524 | 3.90%<br>6,622 | 100%<br>170,000 | 770 |
| C1.3/BHrz: Bare conductors (no e-zone); Parallel horizontal pair of wells, 1000 m long, 9 m apart.<br>TTFV: 170,000 $m^3$; $P_R$ = 2.1 MPa; 300 V | $32.4 \times 10^6$ | 3.34%<br>5,671 | 15.28%<br>25,982 | 51.05%<br>86,782 | 170 |
| WEH1.0: Elliptical cylinder-shaped e-zones around parallel horizontal pair of wells, 1000 m long, 5 m apart.<br>E-zones: each 0.6 m high × 1 m wide.<br>TTFV: 102,000 $m^3$; $P_R$ = 2.1 MPa; 220 V | $24.9 \times 10^6$ | 12.00%<br>12,240 | 34.27%<br>34,960 | 51.61%<br>52,640 | 120 |
| WEH1.1: Elliptical cylinder-shaped e-zones around parallel horizontal pair of wells, 1000 m long, 5 m apart.<br>E-zones: each 0.6 m high × 1 m wide.<br>TTFV: 102,000 $m^3$; $P_R$ = 2.1 MPa; 170 V | $41.9 \times 10^6$ | 0.00%<br>0.00 | 22.51%<br>22,960 | 72.00%<br>73,440 | 330 |
| WEH1.2: Elliptical cylinder-shaped e-zones around parallel horizontal pair of wells, 1000 m long, 9 m apart.<br>E-zones: each 0.6 m high × 1 m wide.<br>TTFV: 170,000 $m^3$; $P_R$ = 2.1 MPa; 220 V | $78.5 \times 10^6$ | 0.00%<br>0.00 | 10.02%<br>17,040 | 100%<br>170,000 | 500 |
| WEH1.2+: Elliptical cylinder-shaped e-zones around parallel horizontal pair of wells, 1000 m long, 9 m apart.<br>E-zones: each 1 m high × 1.8 m wide.<br>TTFV: 170,000 $m^3$; $P_R$ = 2.1 MPa; 220 V | $75.9 \times 10^6$ | 0.00%<br>0.00 | 18.96%<br>32,240 | 100%<br>170,000 | 390 |
| WEH1.3: Elliptical cylinder-shaped e-zones around parallel horizontal pair of wells, 1000 m long, 9 m apart.<br>E-zones: each 0.6 m high × 1 m wide.<br>TTFV: 170,000 $m^3$; $P_R$ = 2.1 MPa; 300 V | $39.6 \times 10^6$ | 5.41%<br>9,200 | 33.08%<br>56,240 | 61.08%<br>103,840 | 140 |
| WEH1.3+: Elliptical cylinder-shaped e-zones around parallel horizontal pair of wells, 1000 m long, 9 m apart.<br>E-zones: each 1 m high × 1.8 m wide.<br>TTFV: 170,000 $m^3$; $P_R$ = 2.1 MPa; 300 V | $45.3 \times 10^6$ | 7.29%<br>12,400 | 41.74%<br>70,960 | 69.18%<br>117,600 | 130 |
| C2.0/Cone: US'809: Conical bowl-shaped e-zones around parallel vertical pair of wells, 32 m long, 141 m apart.<br>E-zones: each 54 m × 10 m ellipse at top, 2 m circle at bottom. E-zones | $9.11 \times 10^6$ | 0.17%<br>544 | 2.45%<br>7,824 | 5.26%<br>16,816 | 110 |

TABLE 1-continued

| | | | | | |
|---|---|---|---|---|---|
| diagonally-oriented. | | | | | |
| TTFV: 320,000 $m^3$; $P_R$ = 3.1 MPa; 1,300 V C2.0/BVrt: Bare conductors (no e-zone). Parallel vertical pair of wells, 32 m long, 141 m apart. | $0.0825 \times 10^6$ | 0.04%<br>141 | 0.04%<br>141 | 0.04%<br>141 | 2.6 |
| TTFV: 320,000 $m^3$; $P_R$ = 3.1 MPa; 1,300 V C2.0/ConeEFC: Conical bowl-shaped e-zones around parallel vertical pair of wells, 32 m long, 141 m apart. E-zones: each 54 m × 10 m ellipse at top, 2 m circle at bottom. E-zones diagonally oriented. $P_R$ = 3.1 MPa; Electrolytic fluid conductivity increased at bottom of conical bowl-shaped e-zones. | $9.93 \times 10^6$ | 0.18%<br>576 | 2.46%<br>7,872 | 5.58%<br>17,848 | 120 |
| TTFV: 320,000 $m^3$; $P_R$ = 3.1 MPa; 1,300 V WEH2.0/Cyl: Elliptical cylinder-shaped e-zones generated from C2.0/Cone around parallel vertical pair of wells, 32 m long, 141 m apart. E-zones: each 54 m × 10 m × 32 m deep. E-zones diagonally oriented as in US '809. | $36.0 \times 10^6$ | 0.00%<br>0.00 | 1.08%<br>3,456 | 26.82%<br>85,824 | 280 |
| TTFV: 320,000 $m^3$; $P_R$ = 3.1 MPa: 1,300 V WEH2.0/SmCyl: Same parameters as WEH2.0/Cyl with smaller volume elliptical cylinder-shaped e-zones each 20 m × 8 m × 32 m deep. Vertical wells 141 m apart. | $17.6 \times 10^6$ | 0.08%<br>256 | 2.44%<br>7,808 | 10.96%<br>35,072 | 220 |
| TTFV: 320,000 $m^3$; $P_R$ = 3.1 MPa; 1,300 V WEH2.0/InvCone: Inverted conical bowl-shaped e-zones around parallel vertical pair of wells, 32 m long, 141 m apart. E-zones: one 54 m × 10 m ellipse at top, 2 m circle at bottom; the other inverted with 54 m × 10 m ellipse at bottom, 2 m circle at top. E-zones diagonally oriented as in US '809. | $11.7 \times 10^6$ | 0.18%<br>568 | 2.60%<br>8,328 | 7.17%<br>22,942 | 140 |
| TTFV: 320,000 $m^3$; $P_R$ = 3.1 MPa; 1,300 V WEH2.0/CylCducty: Elliptical cylinder-shaped e-zones generated from C2.0/Cone around parallel vertical pair of wells, 32 m long, 141 m apart. E-zones: each 54 m × 10 m × 32 m deep. E-zones diagonally oriented as in US '809. Reduced formation electrical conductivity. | $38.3 \times 10^6$ | 0.00%<br>0.00 | 0.44%<br>1,408 | 35.20%<br>112,640 | 470 |
| TTFV: 320,000 $m^3$; $P_R$ = 3.1 MPa; 1,300 V C2.1/Mjr-Cone: Conical bowl-shaped e-zones around parallel vertical pair of wells, 32 m long, 100 m apart. E-zones oriented with major axes aligned; E-zones: each 54 m × 10 m ellipse at top, 2 m circle at bottom. | $5.10 \times 10^6$ | 0.42%<br>536 | 5.77%<br>7,384 | 6.78%<br>8,672 | 64 |
| TTFV: 128,000 $m^3$; $P_R$ = 3.1 MPa; 1,300 V WEH2.1/Mjr-Cyl: Elliptical cylinder-shaped e-zones generated from C2.0/Cone around parallel vertical pair of wells, 32 m long; 100 m apart. E-zones oriented with major axes aligned. E-zones: each 54 m × 10 m × 32 m deep. | $11.6 \times 10^6$ | 0.90%<br>1,152 | 13.70%<br>17,536 | 26.00%<br>33,280 | 96 |
| TTFV: 128,000 $m^3$; $P_R$ = 3.1 MPa; 1,300 V WEH2.1/Mjr-InvCone: Inverted and upright conical bowl-shaped e-zones around parallel vertical pair of wells, 32 m long, 100 m apart. E-zones: one 54 m × 10 m ellipse at top, 2 m circle at bottom; the other inverted with 54 m × 10 m ellipse at bottom, 2 m circle at top. E-zones oriented with major axes aligned. | $5.27 \times 10^6$ | 0.43%<br>556 | 5.98%<br>7,648 | 7.23%<br>9,260 | 66 |
| TTFV: 128,000 $m^3$; $P_R$ = 3.1 MPa; 1,300 V WEH2.2/Mnr-Cone: Conical bowl-shaped e-zones around parallel vertical pair of wells, 32 m long, 100 m apart. E-zones oriented with minor axes aligned. E-zones: each 54 m × 10 m ellipse at top, 2 m circle at bottom. | $10.5 \times 10^6$ | 0.24%<br>576 | 3.94%<br>9,328 | 9.21<br>21,816 | 120 |
| TTFV: 236,800 $m^3$; $P_R$ = 3.1 MPa: 1,300 V WEH2.2/Mnr-Cyl: Elliptical cylinder-shaped e-zones generated from C2.0/Cone around | $42.2 \times 10^6$ | 0.00%<br>0.00 | 1.41%<br>3,328 | 58.05%<br>137,472 | 330 |

TABLE 1-continued

| | | | | | |
|---|---|---|---|---|---|
| parallel vertical pair of wells, 32 m long, 100 m apart. E-zones oriented with minor axes aligned. E-zones: each 54 m × 10 m × 32 m deep. | | | | | |
| TTFV: 236,800 $m^3$; $P_R$ = 3.1 MPa; 1,300 V WEH2.2/Mnr-InvCone: Inverted conical bowl-shaped e-zones around parallel vertical pair of wells, 32 m long, 100 m apart. E-zones oriented with minor axes aligned. E-zones: one 54 m × 10 m ellipse at top, 2 m circle at bottom; the other inverted with 54 m × 10 m ellipse at bottom, 2 m circle at top. | $8.73 \times 10^6$ | 0.24%<br>576 | 4.03%<br>9,552 | 7.53%<br>17,828 | 100 |
| TTFV: 236,800 $m^3$; $P_R$ = 3.1 MPa; 1,300 V WEH2.3/SMnr-Cone: Conical bowl-shaped e-zones around parallel vertical pair of wells, 32 m long, 26 m apart. E-zones oriented with minor axes aligned. E-zones: each 54 m × 10 m ellipse at top, 2 m circle at bottom. | $2.97 \times 10^6$ | 9.50%<br>5,757 | 17.79%<br>10,787 | 17.79%<br>10,787 | 34 |
| TTFV: 60,621 $m^3$; $P_R$ = 3.1 MPa; 840 V WEH2.3/SMnr-Cyl: Elliptical cylinder-shaped e-zones generated from C2.0/Cone around parallel vertical pair of wells, 32 long, 26 apart. E-zones oriented with minor axes aligned. E-zones: each 54 m × 10 m × 32 m deep. | $12.2 \times 10^6$ | 24.49%<br>14,848 | 45.95%<br>27,853 | 53.04<br>32,154 | 120 |
| TTFV: 60,621 $m^3$; $P_R$ = 3.1 MPa; 840 V WEH2.3/SMnr-InvCone: Inverted conical bowl-shaped e-zones around parallel vertical pair of wells, 23 m long, 26 m apart. E-zones oriented with minor axes aligned. E-zones: one 54 m × 10 m ellipse at top, 2 m circle at bottom; the other inverted with 54 m × 10 m ellipse at bottom, 2 m circle at top. | $2.06 \times 10^6$ | 8.65%<br>525 | 12.64%<br>7,661 | 12.6%<br>7,661 | 26 |
| TTFV: 60,621 $m^3$; $P_R$ = 3.1 MPa; 840 V C2.4/SDiag-Cone: Conical bowl-shaped e-zones around parallel vertical pair of wells, 32 m long, 86 m apart. E-zones diagonally oriented. E-zones: each 54 m × 10 m ellipse at top, 2 m circle at bottom. | $3.46 \times 10^6$ | 0.04%<br>960 | 6.14%<br>6,256 | 6.14%<br>6,6256 | 40 |
| TTFV: 101,824 $m^3$; $P_R$ = 3.1 MPa; 1,200 V WEH2.4/SDiag-Cyl: Elliptical cylinder-shaped e-zones generated from C2.0/Cone around parallel vertical pair of wells, 32 m long, 86 m apart. E-zones diagonally oriented. E-zones: each 54 m × 10 m × 32 m deep. | $9.09 \times 10^6$ | 2.26%<br>2,304 | 25.64%<br>26,112 | 27.72%<br>28,224 | 62 |
| TTFV: 101,824 $m^3$; $P_R$ = 3.1 MPa; 1,200 V WEH2.4/SDiag-InvCone: Inverted conical bowl-shaped e-zones around parallel vertical pair of wells, 32 m long, 86 m apart. E-zones diagonally oriented. E-zones: one 54 m × 10 m ellipse at top, 2 m circle at bottom; the other inverted with 54 m × 10 m ellipse at bottom, 2 m circle at top. | $2.93 \times 10^6$ | 1.02%<br>1,040 | 7.42%<br>7,552 | 7.42%<br>7,552 | 44 |
| TTFV: 101,824 $m^3$; $P_R$ = 3.1 MPa; 1,200 V C3.0/BOrth: Bare Conductors (no e-zone); Orthogonal horizontal pair of wells, 5 m apart. | $0.346 \times 10^6$ | 2.05%<br>150 | 8.67%<br>638 | 8.67%<br>638 | 60 |
| TTFV: 7,350 $m^3$; $P_R$ = 3.1 MPa; 300 V C3.1/BHrzNrt: Bare Conductors (no e-zone); Vertical and horizontal well pair; Vertical well 5 m above horizontal well. | $0.0124 \times 10^6$ | 0.01%<br>1.00 | 0.05%<br>3.66 | 0.08%<br>6.00 | 110 |
| TTFV: 7,350 $m^3$; $P_R$ = 3.1 MPa; 150 V WEH3.0/Orth: Elliptical cylinder-shaped e-zones around orthogonal horizontal pair of wells, 5 m apart. E-zones: each 1 m high × 3 m wide. | $0.726 \times 10^6$ | 6.06%<br>445 | 19.81%<br>1,456 | 19.81%<br>1,456 | 60 |

TABLE 1-continued

| | | | | | |
|---|---|---|---|---|---|
| TTFV: 7,350 $m^3$; $P_R$ = 3.1 MPa; 300 V | | | | | |
| WEH3.1/Hrz/Vrt: Disc-shaped e-zone and cylinder-shaped e-zone around vertical and horizontal wells, respectively; Vertical well 5 m above horizontal well. E-zones: disc-shaped e-zone around vertical well, 1 m high × 1 m diameter; circular cylinder-shaped e-zone around horizontal well, 1 m diameter. TTFV: 7,350 $m^3$; $P_R$ = 3.1 MPa; 150 V | $0.0084 \times 10^6$ | 0.10% 7.33 | 0.19% 14.00 | 0.19% 14.00 | 25 |

TABLE 1B

| Example Description And Operating Parameters TTFV: Total Targeted Formation Volume ($m^3$) $P_R$: Formation Pressure (MPa) | % Γ Deviation (Effective, if req'd) | % $T_{max}$ Deviation (Effective, if req'd) | HV Factor (Eq. 11) | HTP Factor (Eq. 8) | Composite Score (Eq. 12) |
|---|---|---|---|---|---|
| C1.0/BHrz: Bare Conductors (no e-zone); Parallel horizontal pair of wells, 1000 m long, 5 m apart. TTFV: 102,000 $m^3$; $P_R$ = 2.1 MPa; 220 V | 0 | 0 | 23 | 0 | 246 |
| C1.1/BHrz: Bare Conductors (no e-zone); Parallel horizontal pair of wells, 1000 m long, 5 m apart. TTFV: 102,000 $m^3$; $P_R$ = 2.1 MPa; 270 V | 0 | 0 | 31 | 0 | 262 |
| C1.2/BHrz: Bare conductors (no e-zone); Parallel horizontal pair of wells, 1000 m long, 9 m apart. TTFV: 170,000 $m^3$; $P_R$ = 2.1 MPa; 220 V | 0 | 0 | 10 | 0 | 220 |
| C1.3/BHrz: Bare conductors (no e-zone); Parallel horizontal pair of wells, 1000 m long, 9 m apart. TTFV: 170,000 $m^3$; $P_R$ = 2.1 MPa; 300 V | 0 | 0 | 16 | 0 | 232 |
| WEH1.0: Elliptical cylinder-shaped e-zones around parallel horizontal pair of wells, 1000 m long, 5 m apart. E-zones: each 0.6 m high × 1 m wide. TTFV: 102,000 $m^3$; $P_R$ = 2.1 MPa; 220 V | 0 | 0 | 54 | 93 | 401 |
| WEH1.1: Elliptical cylinder-shaped e-zones around parallel horizontal pair of wells, 1000 m long, 5 m apart. E-zones: each 0.6 m high × 1 m wide. TTFV: 102,000 $m^3$; $P_R$ = 2.1 MPa; 170 V | 0 | 0 | 18 | 93 | 329 |
| WEH1.2: Elliptical cylinder-shaped e-zones around parallel horizontal pair of wells, 1000 m long, 9 m apart. E-zones: each 0.6 m high × 1 m wide. TTFV: 170,000 $m^3$; $P_R$ = 2.1 MPa; 220 V | 0 | 0 | 17 | 59 | 293 |
| WEH1.2+: Elliptical cylinder-shaped e-zones around parallel horizontal pair of wells, 1000 m long, 9 m apart. E-zones: each 1 m high × 1.8 m wide. TTFV: 170,000 $m^3$; $P_R$ = 2.1 MPa; 220 V | 0 | 0 | 25 | 83 | 333 |
| WEH1.3: Elliptical cylinder-shaped e-zones around parallel horizontal pair of wells, 1000 m long, 9 m apart. E-zones: each 0.6 m high × 1 m wide. TTFV: 170,000 $m^3$; $P_R$ = 2.l MPa; 300 V | 0 | 0 | 32 | 59 | 323 |
| WEH1.3+: Elliptical cylinder-shaped e-zones around parallel horizontal pair of wells, 1000 m long, 9 m apart. E-zones: each 1 m high × 1.8 m wide. TTFV: 170,000 $m^3$; $P_R$ = 2.1 MPa; 300 V | 0 | 0 | 50 | 83 | 383 |
| C2.0/Cone: US'809: Conical bowl-shaped e-zones around parallel vertical pair of wells, 32 m long, 141 m apart. E-zones: each 54 m × 10 m ellipse at top, 2 m circle at bottom. E-zones diagonally-oriented. TTFV: 320,000 $m^3$; $P_R$ = 3.1 MPa; 1,300 V | 73 | 42 | 2 | 6 | 95 |
| C2.0/BVrt: Bare conductors (no e-zone). Parallel vertical pair of wells, 32 m long, 141 m apart. TTFV: 320,000 $m^3$; $P_R$ = 3.1 MPa; 1,300 V | — | — | — | — | — |
| C2.0/ConeEFC: Conical bowl-shaped e-zones around parallel vertical pair of wells, 32 m long, 141 m apart. E-zones: each 54 m × 10 m ellipse at top, 2 m circle | — | — | — | — | — |

TABLE 1-continued

| | | | | | |
|---|---|---|---|---|---|
| at bottom. E-zones diagonally oriented. $P_R$ = 3.1 MPa; Electrolytic fluid conductivity increased at bottom of conical bowl-shaped e-zones. TTFV: 320,000 $m^3$; $P_R$ = 3.1 MPa; 1,300 V | | | | | |
| WEH2.0/Cyl: Elliptical cylinder-shaped e-zones generated from C2.0/Cone around parallel vertical pair of wells, 32 m long, 141 m apart. E-zones: each 54 m × 10 m × 32 m deep. E-zones diagonally oriented as in US '809. TTFV: 320,000 $m^3$; $P_R$ = 3.1 MPa: 1,300 V | 0 | 0 | 4 | 96 | 304 |
| WEH2.0/SmCyl: Same parameters as WEH2.0/Cyl with smaller volume elliptical cylinder-shaped e-zones each 20 m × 8 m × 32 m deep. Vertical wells 141 m apart. TTFV: 320,000 $m^3$; $P_R$ = 3.1 MPa; 1,300 V | 0 | 0 | 4 | 71 | 279 |
| WEH2.0/InvCone: Inverted conical bowl-shaped e-zones around parallel vertical pair of wells, 32 m long, 141 m apart. E-zones: one 54 m × 10 m ellipse at top, 2 m circle at bottom; the other inverted with 54 m × 10 m ellipse at bottom, 2 m circle at top. E-zones diagonally oriented as in US '809. TTFV: 320,000 $m^3$; $P_R$ = 3.1 MPa; 1,300 V | 70 (35) | 38 (19) | 2 | 12 | 162 |
| WEH2.0/CylCducty: Elliptical cylinder-shaped e-zones generated from C2.0/Cone around parallel vertical pair of wells, 32 m long, 141 m apart. E-zones: each 54 m × 10 m × 32 m deep. E-zones diagonally oriented as in US '809. Reduced formation electrical conductivity. TTFV: 320,000 $m^3$; $P_R$ = 3.1 MPa; 1,300 V | — | — | — | — | — |
| C2.1/Mjr-Cone: Conical bowl-shaped e-zones around parallel vertical pair of wells, 32 m long, 100 m apart. E-zones oriented with major axes aligned; E-zones: each 54 m × 10 m ellipse at top, 2 m circle at bottom. TTFV: 128,000 $m^3$; $P_R$ = 3.1 MPa; 1,300 V | 77 | 46 | 2 | 6 | 87 |
| WEH2.1/Mjr-Cyl: Elliptical cylinder-shaped e-zones generated from C2.0/Cone around parallel vertical pair of wells, 32 m long; 100 m apart. E-zones oriented with major axes aligned. E-zones: each 54 m × 10 m × 32 m deep. TTFV: 128,000 $m^3$; $P_R$ = 3.1 MPa; 1,300 V | 0 | 9 | 0 | 101 | 319 |
| WEH2.1/Mjr-InvCone: Inverted and upright conical bowl-shaped e-zones around parallel vertical pair of wells, 32 m long, 100 m apart. E-zones: one 54 m × 10 m ellipse at top, 2 m circle at bottom; the other inverted with 54 m × 10 m ellipse at bottom, 2 m circle at top. E-zones oriented with major axes aligned. TTFV: 128,000 $m^3$; $P_R$ = 3.1 MPa; 1,300 V | 78 (39) | 44 (22) | 2 | 13 | 156 |
| WEH2.2/Mnr-Cone: Conical bowl-shaped e-zones around parallel vertical pair of wells, 32 m long, 100 m apart. E-zones oriented with minor axes aligned. E-zones: each 54 m × 10 m ellipse at top, 2 m circle at bottom. TTFV: 236,800 $m^3$; $P_R$ = 3.1 MPa: 1,300 V | 70 | 40 | 2 | 6 | 100 |
| WEH2.2/Mnr-Cyl: Elliptical cylinder-shaped e-zones generated from C2.0/Cone around parallel vertical pair of wells, 32 m long, 100 m apart. E-zones oriented with minor axes aligned. E-zones: each 54 m × 10 m × 32 m deep. TTFV: 236,800 $m^3$; $P_R$ = 3.1 MPa; 1,300 V | 0 | 0 | 5 | 99 | 204 |
| WEH2.2/Mnr-InvCone: Inverted conical bowl-shaped e-zones around parallel vertical pair of wells, 32 m long, 100 m apart. E-zones oriented with minor axes aligned. E-zones: one 54 m × 10 m ellipse at top, | 68 (34) | 44 (22) | 3 | 12 | 162 |

TABLE 1-continued

| | | | | | |
|---|---|---|---|---|---|
| 2 m circle at bottom; the other inverted with 54 m × 10 m ellipse at bottom, 2 m circle at top. TTFV: 236,800 $m^3$; $P_R$ = 3.1 MPa; 1,300 V | | | | | |
| WEH2.3/SMnr-Cone: Conical bowl-shaped e-zones around parallel vertical pair of wells, 32 m long, 26 m apart. E-zones oriented with minor axes aligned. E-zones: each 54 m × 10 m ellipse at top, 2 m circle at bottom. TTFV: 60,621 $m^3$; $P_R$ = 3.1 MPa; 840 V | 73 | 16 | 41 | 13 | 206 |
| WEH2.3/SMnr-Cyl: Elliptical cylinder-shaped e-zones generated from C2.0/Cone around parallel vertical pair of wells, 32 long, 26 apart. E-zones oriented with minor axes aligned. E-zones: each 54 m × 10 m × 32 m deep. TTFV: 60,621 $m^3$; $P_R$ = 3.1 MPa; 840 V | 0 | 0 | 122 | 200 | 644 |
| WEH2.3/SMnr-InvCone: Inverted conical bowl-shaped e-zones around parallel vertical pair of wells, 23 m long, 26 m apart. E-zones oriented with minor axes aligned. E-zones: one 54 m × 10 m ellipse at top, 2 m circle at bottom; the other inverted with 54 m × 10 m ellipse at bottom, 2 m circle at top. TTFV: 60,621 $m^3$; $P_R$ = 3.1 MPa; 840 V | 52 (26) | 26 (13) | 4 | 18 | 187 |
| C2.4/SDiag-Cone: Conical bowl-shaped e-zones around parallel vertical pair of wells, 32 m long, 86 m apart. E-zones diagonally oriented. E-zones: each 54 m × 10 m ellipse at top, 2 m circle at bottom. TTFV: 101,824 $m^3$; $P_R$ = 3.1 MPa; 1,200 V | 76 | 32 | 2 | 6 | 102 |
| WEH2.4/SDiag-Cyl: Elliptical cylinder-shaped e-zones generated from C2.0/Cone around parallel vertical pair of wells, 32 m long, 86 m apart. E-zones diagonally oriented. E-zones: each 54 m × 10 m × 32 m deep. TTFV: 101,824 $m^3$; $P_R$ = 3.1 MPa; 1,200 V | 0 | 0 | 8 | 101 | 317 |
| WEH2.4/SDiag-InvCone: Inverted conical bowl-shaped e-zones around parallel vertical pair of wells, 32 m long, 86 m apart. E-zones diagonally oriented. E-zones: one 54 m × 10 m ellipse at top, 2 m circle at bottom; the other inverted with 54 m × 10 m ellipse at bottom, 2 m circle at top. TTFV: 101,824 $m^3$; $P_R$ = 3.1 MPa; 1,200 V | 76 (38) | 42 (21) | 2 | 13 | 158 |
| C3.0/BOrth: Bare Conductors (no e-zone); Orthogonal horizontal pair of wells, 5 m apart. TTFV: 7,350 $m^3$; $P_R$ = 3.1 MPa; 300 V | — | — | — | — | — |
| C3.1/BHrzNrt: Bare Conductors (no e-zone); Vertical and horizontal well pair; Vertical well 5 m above horizontal well. TTFV: 7,350 $m^3$; $P_R$ = 3.1 MPa; 150 V | — | — | — | — | — |
| WEH3.0/Orth: Elliptical cylinder-shaped e-zones around orthogonal horizontal pair of wells, 5 m apart. E-zones: each 1 m high × 3 m wide. TTFV: 7,350 $m^3$; $P_R$ = 3.1 MPa; 300 V | — | — | — | — | — |
| WEH3.1/Hrz/Vrt: Disc-shaped e-zone and cylinder-shaped e-zone around vertical and horizontal wells, respectively; Vertical well 5 m above horizontal well. E-zones: disc-shaped e-zone around vertical well, 1 m high × 1 m diameter; circular cylinder-shaped e-zone around horizontal well, 1 m diameter. TTFV: 7,350 $m^3$; $P_R$ = 3.1 MPa; 150 V | — | — | — | — | — |

Summary Comparison for Selected Simulation Examples

For most of the WEH and comparative examples, the %Γ and $\%T_{max}$ deviations were calculated from the simulation results, according to Equations (5) and (6) and the method described above, to provide two indicators of the extent of heating uniformity in the target region arising from an electric field generated between two electrodes. The results are summarized in Table 1B above. For those examples, a "highest temperature projection factor" ("HTP factor") and a "heated volume factor" ("HV factor") was also calculated, as discussed more fully below, and summarized in Table 1B.

A HTP factor provides an indicator for assessing the extent of heating in the target region where the heating is in the vicinity of the hydrocarbon deposit. So, electric heating confined to or near the conductor, producing a hot conductor, even though very uniform, is of little to no value for heating those portions of the formation further removed from the conductor where significant hydrocarbon deposits are located. Thus, a HTP factor accounts for the extent to which the heat is projected away from a conductor and toward the area around a mid-point between two conductors and/or their respective e-zones, to the extent a conductor has a contiguous e-zone.

The HTP factor is based, in part, on two normalized distances, $r_c$ and $r_m$, of the target region's highest temperature value from the conductor and the nearest geographic mid-point on a line of geographic mid-points ("mid-points line") between two conductors, respectively, where the mid-points line is parallel to at least one conductor. So, when a highest temperature region ("HT region") is located at the mid-point between two conductors, either at a focused hot spot at the mid-point or in a localized heating zone located along the mid-points line extending through the target region, $r_m=0$ and $r_c=1$. Meanwhile, when a HT region is focused at the conductor, producing a hot conductor in part or in whole, $r_c=0$ and $r_m=1$. The HTP factor also accounts for the extent of the HT region by normalizing the length of the relevant HT region, $d_{HTR}$, with the length of the target region, $d_{TR}$. So, when electric heating is distributed in a localized heating zone along the entire length of the target region then $d_{HTR}/d_{TR}=1$, since the respective lengths of the localized heating zone and target region are co-extensive. And when the HT region is focused at a hot spot then $d_{HTR}/d_{TR}$ is significantly less than one since the hot spot is significantly shorter length than the target region. For example, in C2.0/Cone, $d_{HTR}/d_{TR}=2/32=0.06$. Accordingly, better heating performance is indicated by a higher HTP factor.

The HTP factor is defined in Equation (8):

$$HTP\ Factor = [[1-(1-r_c)A^{-r_c}]+[(1-r_m)A^{-r_m}]]\times\frac{d_{HTR}}{d_{TR}}\times 100 \tag{8}$$

where:

A is $2^{10}=1024$;

$r_c$ is a normalized distance from the conductor for the highest temperature value within a target region, calculated according to Equation (9);

$r_m$ is a normalized distance from the mid-point between two conductors for the highest temperature value within a target region, calculated according to Equation (10);

$d_{HTR}$ is the length of the relevant highest temperature region, whether a localized heating zone or one or more hot spots; and $d_{TR}$ is the length of the target region.

The normalized distances, $r_c$ and $r_m$, for the highest temperature value in a target region are defined by Equations (9) and (10):

$$r_c = \frac{\text{Distance of Highest Temperature Value in Target Region from Conductor}}{(\text{Shortest Distance Between Two Conductors}\div 2)} \tag{9}$$

-continued $$r_m = \frac{\text{Distance of Highest Temperature Value in Target Region from Midpoint Between Conductors}}{(\text{Shortest Distance Between Two Conductors}\div 2)} \tag{10}$$

The function described in Equation (8) is not a linear function because the difference in heating performance is more significant when the highest temperature value is moved an incremental distance outward from the conductor than if the highest temperature value is moved the same incremental distance outward from the mid-point between two conductors. Therefore, in Equation (8), the A value of 1024 or $2^{10}$ was based on dividing an imaginary line extending orthogonally between a conductor and it nearest mid-point into 10 equal parts and further assuming that the heating performance is increased by a factor of two when the highest temperature region is moved $1/10^{th}$ of the distance from the conductor towards the mid-point.

A heated volume ("HV") factor provides an indicator for assessing thermal diffusion in the target region. The HV factor is a normalized volume factor that accounts for the volume of target region heated to a temperature of at least 50° C., $V_{50}$, and the volume of target region heated to a temperature of at least 70° C., $V_{70}$, at about the initial 10% of some predetermined continuous electric heating interval. Accordingly, the HV factor is higher when the target region is more uniformly heated by better heat distribution. But the HV factor is lower when focused heating at a hot spot causes a relatively small volume of the target region to heat very quickly, with little thermal diffusion into the target region. The HV factor is also lowered accordingly as the predetermined electric heating interval becomes larger. This time factor for the heating process was included to better distinguish slower and less efficient electric heating processes that might be able to heat a larger volume of a target region, but take significantly more time to electrically heat the same volume heated by a faster and more efficient electric heating process. Therefore, the HV factor is defined in Equation (11) as:

$$HV\ Factor = \left[\left(\frac{V_{50}-V_{70}}{TotalVolume}\right)\times 1000\right]\div t_{10\%} \tag{11}$$

where:

$V_{50}$ is the volume of the target region heated to at least 50° C., as measured at about the initial 10% of a continuous electric heating time interval (in $m^3$);

$V_{70}$ is the volume of the target region heated to at least 70° C., as measured at about the initial 10% of a continuous electric heating time interval (in $m^3$);

Total Volume is the volume of the targeted formation, including the target region, used as a reference volume in the simulations (in $m^3$); and $t_{10\%}$ is the number of days in the initial 10% of a continuous electric heating interval (dimensionless).

To provide one additional indicator for comparing how different electric heating processes perform, the %Γ deviation, $\%T_{max}$ deviation, HTP factor and HV factor were compiled to provide a composite "score" of heating performance according to Equation (12):

$$\text{Composite Score}=(100-\%\Gamma\text{Dev})+(100-\%T_{max}\text{Dev})+2\text{HV Factor}+\text{HTPFactor} \tag{12}$$

With one exception (WEH2.3/SMnr-Cyl), the HV factor calculated for the simulation examples was in a range from about 2 to about 50. However, all other components of the composite score generally had a scale of 0 to about 100. Accordingly, to provide equal weighting for the HV factor, the composite score doubles the HV factor calculated according to Equation (11). The composite score ("CS") is provided in the pictorial guide in FIG. 7 and summarized in Table 1B, together with its component factors.

Because it is generally desirable to have: (a) as little Γ and $T_{max}$ deviation as possible, (b) the highest temperature value as close to the nearest mid-point between conductors as possible, and (c) better thermal diffusion into a larger volume of the target region, better heating rates and distribution are generally demonstrated by higher composite scores. Generally, the composite score is preferably greater than or equal to about 150, with a HTP factor greater than zero. More preferably, the composite score is greater than or equal to about 250, with a HTP factor greater than or equal to about 5. Most preferably, the composite score is greater than or equal to about 300, with a HTP factor greater than or equal to about 10. However, as noted below, other indicators of more diffuse heat distribution in the target region, such as Γ deviation and/or $T_{max}$ deviation, among others, can also be used to compare electric heating performance of the inventive WEH process to a conventional electric heating process. Also, qualitative indicators, such as, for example, the graphic 3-D image generated by a simulation program, can provide another indication of more diffuse heat distribution in a target region. Accordingly, a higher composite score arising from an electric heating process should not be considered an exclusive indicator of improved thermal diffusion.

The composite score for elliptical cylinder-shaped e-zones (WEH1.0, WEH1.1, WEH1.2, WEH 1.3, WEH1.2+, WEH1.3+, WEH2.0/Cyl, WEH2.0/SmCyl, WEH2.1/Mjr-Cyl, WEH2.2/Mnr-Cyl and WEH 2.3/SMnr-Cyl) was in the range 279 to 644, where heating was substantially uniform in the target region coextensive with the conductor and the HT region was projected outward from the conductor in a localized heating zone.

But, for the bare conductor examples (C1.0/BHrz, C1.1/BHrz, C1.2/BHrz, C1.3/BHrz), where the HT region was at the conductor, i.e., hot conductor, the composite score was 220–262, but with all HTP factors equal to zero. Accordingly, each of these composite values with HTP factors equal to zero more quantitatively describes the lack of heating performance inside a hypothetical target region that a bare conductor generates.

Meanwhile, although the highest temperature value in C2.0/Cone was projected outward from the conductor, the composite score was 95 because the HT region was focused at a hot spot and, therefore, most of the electric energy was directed to heating a single upper layer within the target region, i.e., substantially unidirectional, non-uniform heating. Moreover, the hot spot was not located along an imaginary plane connecting the two conductors because of the spatial orientation of the e-zones. Accordingly, heat was not distributed effectively to and/or around the target region's mid-points line.

But, in WEH2.0/Cyl, where the conical bowl-shaped e-zones of C2.0/Cone were converted to elliptical cylinder-shaped e-zones, the %Γ and %$T_{max}$ deviations were zero, thereby indicating significantly improved heating uniformity vs. C2.0/Cone. Also, heating was more diffuse in a localized heating zone extending along the length of the target region. Accordingly, the composite score for WEH2.0/Cyl was 304.

In another example of the inventive WEH process, the volume of the elliptical cylinder-shaped e-zones in WEH2.0/Cyl was reduced in WEH2.0/SmCyl. In WEH2.0/SmCyl, the volume of the e-zones was equal to the volume of the conical bowl-shaped e-zones in C2.0/Cone, whereas the elliptical cylinder-shaped e-zones in WEH2.0/Cyl had the same diameter as the top of the conical bowl-shaped e-zones in C2.0/Cone. Again, the %Γ and %$T_{max}$ deviations were zero, thereby indicating significantly improved heating uniformity vs. C2.0/Cone. Also, heating was more diffuse in a localized heating zone extending along the length of the target region. Accordingly, the composite score for WEH2.0/SmCyl was 279.

And, in WEH2.0/InvCone, where the e-zone spacing was made more uniform by inverting one of the conical bowl-shaped e-zones from C2.0/Cone, heat was more uniformly distributed between the e-zones. The more uniform heat distribution in WEH2.0/InvCone is illustrated by a higher composite score of 162 vs. 95 for C2.0/Cone.

Simulation Parameters Overview

As mentioned above, the simulation results for each example are summarized in Table 1A. To better appreciate the data compiled in Table 1A, the relevance of each term to evaluating the effectiveness of electric heating processes will be considered in the simulation parameter overview discussion below.

The reservoir simulation software used for all examples was STARS (version 2000 and version 2001) from Computer Modeling Group, Inc., Calgary, Alberta, Canada.

Typically, the diameter of wells used in SAGD and CSS applications is about 18 cm (7 inches). However, because of limitations in the version of simulation software used in the examples and the increased computational time required to create a circular cross-section, the circular well was approximated using a square well with a 20 cm×20 cm square cross-section. Also, for smaller elliptical cylinder e-zones, such as in WEH1.0, the e-zone cross-section was approximated by a rectangular e-zone cross-section. For larger e-zones, such as in C2.0/Cone, it was possible to create a more accurate representation of the e-zone geometric shape. Accordingly, where the electrode shape was approximated, for example by a rectangular cross-section, the simulations may be less accurate in simulation blocks next to the electrode. However, generally data obtained farther from the electrode will tend to be more accurate relative to data obtained closer to the electrode. But, in any event, the general trend in the heating pattern is reasonably ascertained from the simulation results.

Table 1A provides a column for comparing the average conductance (in Siemens, S) for each example. The average conductance is the reciprocal of a formation's electrical resistance between a pair of conductors, prior to electrical connectivity disruption due to water vaporization. Accordingly, a higher average conductance demonstrates better electric current flow through the formation. While a 0 formation's resistance will change with fluid movement, such changes are typically small when there is no concurrent injection, production and/or fluid phase change. Accordingly, in the simulation examples, the average conductance was calculated from the average resistance, determined in the numerical simulations. The average conductance is also linearly proportional to formation electrical conductivity, which reflects rock properties and indigenous fluid (e.g., water, oil) properties. However, the formation's resistance and, therefore, its conductance is also affected by electrode pair geometry factors, including, without limitation, e-zone curvature, e-zone size, distance between electrodes, e-zone spacing, e-zone spatial orientation and well pair orientation.

Table 1A also lists the initial $\Gamma_{initial}$ when thermal conductivity effects are negligible at the beginning of the electric heating interval. $\Gamma_{initial}$ was measured after 1 day of electric heating. Table 1A also lists $\Gamma$ at 10% of the electric heating interval ("$\Gamma_{10\%}$"). $\Gamma_{10\%}$ was measured at 10% of the electric heating interval to water vaporization, to show the influence of thermal conductivity effects on heating. Accordingly, the relative difference between $\Gamma_{initial}$ and $\Gamma_{10\%}$ is one indicator of the contributing effect thermal conductivity has in helping dissipate heat in the target region. In all cases, $\Gamma$ is ideal at $\Gamma$ less than or equal to about 1. Specifically, when $\Gamma=1$, the effective mid-point between electrodes is heated at the same rate as the HT region. Of course, when the electric heating is focused at an asymmetric unidirectional hot spot or hot spot pair and/or at a hot conductor, the mid-point is ineffectively heated, if at all. Consequently, there is little to no diffuse, multidirectional heat distribution through a substantial portion of the target region. But, when the electric heating is in a localized heating zone projected outward from the conductor and co-extensive with at least a portion of the conductor or a symmetric multidirectional hot spot pair(s) is(are) produced, then the mid-point is more effectively heated. Accordingly, there is more symmetrical and diffuse multidirectional heat distribution through a substantial portion of the target region.

As noted above, the thermal conduction gradient ("TCG") factor is one comparative indicator useful for assessing the relative contribution the thermal conduction effect makes to producing a more diffuse heat distribution of electrically generated heat in a targeted formation or target region. So, using the TCG factor, different electric heating processes can be compared on their respective electric field's ability to generate and more diffusely distribute a current that thereby generates and distributes heat accordingly in the target region, at least in an initial phase of the electric heating interval.

But to make such a comparison more meaningful, it is preferable to keep the thermal diffusion coefficient (i.e., thermal conductivity) constant or substantially constant from example to example. Consequently, a typical thermal conductivity found for many oil-bearing subterranean formations was selected and used for all simulation examples. So, for the simulation examples described below, the thermal conductivity used was $1.5\times10^5$ J/m day K.

Meanwhile, the TCG factor for each electric heating process discussed in the examples below was based on taking the difference between $\Gamma_{initial}$ and $\Gamma_{10\%}$ and dividing it by the number of days covering the first 10% of the electric heating time interval. The difference between $\Gamma_{initial}$ and $\Gamma_{10\%}$ was divided by the duration, in days, of the first 10% of the electric heating time interval since there were significant variations in the total length of the electric heating time interval for many of the different processes considered, particularly between the inventive WEH process vs. a conventional electric heating process. Effectively then, this produces an average rate at which $\Gamma$ changes per day 3 over the first 10% of the electric heating interval. In turn, this average rate of $\Gamma$ change per day in the initial 10% of the electric heating interval produces a TCG factor for one electric heating process that can be objectively and consistently compared with the TCG factor for another process, despite significant differences that may exist in the length of each process' total electric heating interval. So again, more specifically, the TCG factor is calculated according to Equation (13):

$$TCGFactor = \frac{(\Gamma_{initial} - \Gamma_{10\%})}{\text{(No. of days in first 10\% of electricheating interval)}} \tag{13}$$

In the simulation examples, the formation electrical conductivity was 0.05 S/m (corresponding to water conductivity of 0.833 S/m) for all examples, except for WEH2.0/CylCducty. In WEH2.0/CylCducty, the formation electrical conductivity was adjusted so as to produce an average conductance equal to that of C2.0/Cone (0.56 S) to illustrate that the e-zone geometric shape has a greater effect on heating pattern than does the formation electrical conductivity. Thus, the formation electrical conductivity was reduced to 0.034 S/m (corresponding to water conductivity of 0.56 S/m) for WEH2.0/CylCducty. The electrical conductivity for the e-zone was 2.5 S/m for all examples, except for C2.0/ConeEFC, where the electrolytic fluid electrical conductivity ("EFC") was different in different layers of the e-zones, as discussed more fully below.

The average ohm-heating power generated by applying voltage across a pair of electrodes was calculated as an average of electric power data from numerical simulation over a period of time prior to onset of water vaporization. The average ohm-heating power (megawatts, MW) for each example is shown in Table 1A. Alternatively, the average heating power may also be approximated by the average conductance multiplied by the voltage squared. However, the numerical simulation method for calculating the average heating power is the preferred method. As discussed above, substantially all of the heating power is converted into heat in an ohm-heated process. Therefore, for convenience, the total heat generated, in MJ, was calculated for each example and the results are tabulated in a column adjacent the average ohm-heating power column in Table 1A.

The heated volume achieved for each e-zone configuration was derived from reservoir simulation results. A "block" in a formation was considered heated when it reached a threshold temperature of 70° C. The threshold temperature of 70° C. was selected, for the purposes of the simulations, as a desirable temperature for reducing the viscosity, thereby mobilizing, Cold Lake bitumen. The volume of the heated blocks, i.e., blocks achieving 70° C., were then added to obtain the Heated Volume listed in Table 1A. The block size was selected to be small enough to be accurate and large enough to keep simulation run time reasonably acceptable. Accordingly, where temperatures were uniform for relatively larger portions of the target region, a relatively larger block size was selected and where the temperature gradients were relatively high in a relatively smaller portion of the target region, a relatively smaller block size was selected. Therefore, the block volume was not necessarily the same across the simulated formation, but in general the block size was in a range from about 0.2 m×0.2 m×0.2 m to about 2 m×2 m×1000 m.

The total volume between electrodes in each pair included at least the target region. Once the simulation was run for a conductor pair having e-zones, additional formation volume outside the target region where there was evidence of heating was added to the total volume. The same total volume was then used for bare conductors so that heated volumes could be more easily compared. However, in the Series 2, examples, the targeted formation volume was defined by the volume used in US '809, which was a rectangular cube having wells at a pair of diagonally opposing corners. For example, in the C2.0/Cone, WEH2.0/Cyl, WEH2.0/SmCyl and WEH2.0/InvCone simulations, the targeted formation volume was 320,000 $m^3$.

The starting temperature ($T_{initial}$) for all reservoir simulation examples was 30° C. As mentioned above, the heated volume in Table 1A represents the volume of targeted formation heated to a temperature of at least 70° C. Accordingly, in the discussions below, reference to heated volume means the formation volume heated to a temperature greater than or equal to 70° C. However, in most cases, simulation was stopped when the onset of water vaporization was detected, indicating potential or actual electrical connectivity failure. Water vaporization was indicated in the simulations by appearance of a significant steam saturation value in one or more blocks. The only vapor phase in the simulations was steam, since, for example, no methane was present under simulation conditions. Accordingly, the simulations were monitored for blocks having a steam saturation value greater than zero, indicating the presence of steam, and therefore water vaporization. The simulation was then halted. Usually the blocks having a steam saturation greater than zero were HT regions prior to water vaporization. The far right-hand column of Table 1A lists the days until electric heating was halted due to water vaporization.

The water vaporization temperature in the formation is dependent on the formation pressure. The simulation examples were conducted with an initial formation pressure of either 2.1 MPa or 3.1 MPa, corresponding to a water vaporization temperature of 214° C. or 235° C., respectively. However, due to thermal expansion, reservoir pressure could be further increased after heating and hence water vaporization temperature could increase accordingly. The basis for selecting one formation pressure over another in the reservoir simulation examples is as follows. A typical formation pressure for SAGD heavy oil processes in Alberta, Canada is 2.1 MPa. Accordingly, the horizontal well pair simulations were conducted at 2.1 MPa. And the remaining examples were conducted at 3.1 MPa, based on the formation pressure used in US '809. But, it should be understood that other well orientations, such as a vertical/horizontal well pair could also be used for SAGD at the appropriate formation pressure.

Because the water vaporization temperature was higher for examples conducted at 3.1 MPa, simulations conducted at that pressure, all other factors being equal, could continue longer than simulations conducted at 2.1 MPa. Therefore, one can expect a larger final heated volume for a formation pressure of 3.1 MPa, all other factors being equal.

Comparative Examples-Series 1

C1.0/BHrz, C1.1/BHrz, C1.2/BHrz and C1.3/BHrz are simulations of conventional electric heating processes using a pair of bare horizontal wells in a parallel orientation with respect to each other. No e-zones were established around either well. The wells were 1000 m long. The wells in C1.0/BHrz and C1.1/BHrz were vertically spaced apart by 5 m, typical for a SAGD operation, while the wells in C1.2/BHrz and C1.3/BHrz were spaced 9 m apart. The voltage applied to the wells in C1.0/BHrz and C1.2/BHrz was 220 V, while the voltage applied in C1.1/BHrz was 270 V and the voltage applied in C1.3/BHrz was 300 V. The formation pressure was 2.1 MPa, typical for SAGD heavy oil processes in Alberta, Canada. The results of the conventional heating process for the bare conductors are discussed below, followed by corresponding simulation results for WEH processes applied to the same conductors, but with e-zones contiguous with each conductor, respectively (i.e., WEH1.0, WEH1.1, WEH1.2, WEH1.3, WEH1.2+, and WEH1.3+).

Comparative Example C1.0/BHrz

C1.0/BHrz is a simulation of electric heating between a pair of 1000 m long horizontal wells (bare conductors) spaced 5 m vertically apart.

The average conductance for the electrode geometry in C1.0/BHrz was 28.7 Siemens (S) and the average heating power was 1.46 MW. As discussed more fully below, even though the same voltage was applied in WEH1.0, the average heating power, 2.40 MW, was greater for WEH1.0 because more of the applied energy was converted to heating the targeted formation (i.e., target region plus portions of the formation adjacent the target region).

After 20 days of conventional electric heating, 3.4% of the targeted formation volume between the two wells was heated to a temperature of at least 70° C. and, after 60 days, the heated formation volume was 21.6%. The onset of water vaporization occurred at 220 days from the start, which signaled potential disrupted electrical connectivity. At that point, 52.8% of the targeted formation volume between the two wells was heated to a temperature of at least 70° C.

The HT region was focused at and along the length of the top well, producing a hot conductor. Heating was also focused at and along the length of the bottom well, but the temperature was slightly lower than the top well. Because the HT region was focused at the hot conductor, electrical connectivity was immediately disrupted between the two wells when water vaporization occurred. Vaporization occurred first at the top well, rather than the bottom well, because the formation pressure at the top well was slightly lower than the formation pressure at the deeper bottom well.

Two benefits arising from using e-zones in accordance with the inventive WEH process are demonstrated by comparing the Γ values of the comparative and WEH examples, C1.0/BHrz and WEH1.0, respectively.

First, with respect to the absolute Γ values generated, $\Gamma_{initial}$ was 20.1 for the bare conductor pair in C1.0/BHrz and $\Gamma_{10\%}$ (measured at 20 days for this example) was 3.2. In contrast, as discussed below, when e-zones were established around the wells in WEH1.0, $\Gamma_{initial}$ was 3.8 and $\Gamma_{10\%}$ (measured at 10 days for that example) was 1.7. So, in comparing these two examples, we compare $\Gamma_{initial}$ with e-zones, 3.2, which is much closer to the ideal value of 1 or less, versus 20.1 for $\Gamma_{initial}$ without e-zones, which is much greater than 1. Accordingly, the inventive WEH process is able to deliver more heat, more quickly at and/or around the mid-point vicinity versus a conventional electric heating process without e-zones.

Second, the inventive WEH process is less dependent on the thermal conduction effect, which again, takes more time to generate a more diffuse heat distribution through the target region. As discussed above, $\Gamma_{initial}$ is primarily an indicator of heating due to electric heating, while the difference between $\Gamma_{initial}$ and $\Gamma_{10\%}$ illustrates, among other things, the effect that thermal conduction has on helping with distributing heat generated by an electric field, while the thermal conduction gradient ("TCG") factor, calculated according to Equation (13), approximates, the average rate at which Γ changes per day over the first 10% of the electric heating interval. Consequently, the extent to which each process relies on the thermal conduction effect is illustrated, at least in part, by the magnitude of the TCG factor listed in Table 1A, since comparing TCG factor values can provide one basis for assessing the relative contribution thermal conduction makes to producing more diffuse heat distribution.

So again, in comparing these two examples, in C1.0/BHrz, the TCG factor was an average rate of Γ change per day=0.85, compared with an average rate of Γ change per day=0.21 for WEH1.0. Therefore, a bare conductor pair's reliance on thermal conduction, in this particular comparison, was about four times greater versus a pair of conductors with an e-zone contiguous to each conductor. Or, put another way, the electric field's ability to generate and distribute heat through the target region (i.e., the electric heating distribution effect), in this particular comparison, was about four times more efficient when e-zones were used in accordance with the inventive WEH process vs. when none were used.

Moreover, the heated volume ("HV") factor calculated according to Equation (11), which is a normalized volume heated to a temperature in the range of 50° C. to 70° C., was 23 for C1.0/BHrz, while for WEH1.0, the HV factor was 54, almost twice the HV factor for C1.0/BHrz. Accordingly, even though the $\Gamma_{10\%}$ for C1.0/BHrz indicated an improved heating rate due to thermal conduction, the normalized volume heated to 50° C. to 70° C. was 50% less than for WEH1.0. This further demonstrates that the inventive WEH process delivered more electric heating power (i.e., more heat generated per V applied) throughout the targeted formation (i.e., target region plus portions of the formation adjacent to the target region) without heavily relying on the TC effect, as compared to the conventional electric heating process in C1.0/BHrz, which, again, significantly relies on thermal conduction to distribute heat into the target region. In turn, this significant TC contribution increases the time required to heat a larger portion of the target region and decreases the percentage of the target region that is ultimately heated to some predetermined temperature threshold (e.g., T≧70° C., in this case). Therefore, the HV factor is generally lower for a conventional electric heating process relative to a WEH process for a similar well configuration.

Furthermore, in C1.0/BHrz, the %Γ deviation was zero and the $T_{max}$ deviation was also zero because the entire length of the well was heated to the same degree. But, electric heating for C1.0/BHrz was not projected outward from the well. Instead, heating was focused at the wells. Therefore, the highest temperature values were located at the hot conductor, resulting in an HTP factor of zero, calculated according to Equation (8). Again, this HTP measurement is significant technical evidence that the conventional electric heating process distributed little to no heat at and/or around the target region's mid-points line.

Accordingly, C1.0/BHrz's composite score for heating performance was 246, calculated according to Equation (12), which is significantly less than 401, the WEH1.0's composite score, demonstrating WEH1.0's comparatively more diffuse heat distribution generated with e-zones. For more detail, the composite scores for these and other examples below, as well as their respective component factors, are summarized in Table 1B.

Comparative Example C1.1/BHrz

The well orientation and electrode size and shape, as well as formation pressure, used in the C1.1/BHrz simulation was the same as in C1.0/BHrz. However, in C1.1/BHrz, the voltage applied between the wells was increased to 270 V, from 220 V, so that the average heating power delivered to the targeted formation would be approximately equal to the average power in WEH1.0 (2.40 MW). However, C1.1/BHrz demonstrates that a faster initial heating rate provided by increased voltage does not necessarily result in a greater heated volume nor does it improve heating distribution.

The average conductance was 28.8 S, similar to that of C1.0/BHrz (28.7 S). Any difference between the average conductance in the two examples was due to a slight change in formation electrical conductivity as a result of fluid movement during the period prior to water vaporization.

After 20 days of conventional electric heating, the heated volume (T≧70° C.) in C1.1/BHrz was 8.5%, more than twice the heated volume for C1.0/BHrz. However, the onset of water vaporization occurred at 80 days from the start after only 36.7% of the targeted formation was heated, as compared with 52.8% heated volume after 220 days in C1.0/BHrz. Electric heating at the conductor surface was intensified by the higher average heating power (2.4 MW), as compared with 1.46 MW in C1.0/BHrz.

And, as compared with WEH1.0, the heated volume after 20 days was about 25% less in C1.1/BHrz, even though the applied voltage was about 23% higher for C1.1/BHrz vs. either C1.0/BHrz or WEH1.0. Also, the final heated volume was 29% less in C1.1/BHrz. The fact that increased applied voltage initially increased the heated volume, as compared to C1.0/BHrz, but was still less than the WEH1.0 heated volume, demonstrates that e-zone geometric shape and size has a greater effect on heat distribution than increased voltage.

The HT region in C1.1/BHrz was focused at and along the length of both wells, producing hot conductors. Because the HT region was focused at the hot conductors, electrical connectivity was immediately disrupted between the two wells when water vaporization occurred. Again, water vaporization occurred first at the top well, rather than the bottom well, because the formation pressure at the top well was slightly lower than the formation pressure at the deeper bottom well.

Even though the applied voltage was higher for C1.1/BHrz (270 V), compared to WEH1.0 (220 V) discussed below, substantially the same average heating power was delivered to the targeted formation for both C1.1/BHrz and WEH1.0. But, even though the same average heating power was delivered, the heat distribution was significantly more diffused in WEH1.0, demonstrated by the final heated volume and the longer time interval to water vaporization vs. C1.1/BHrz. In WEH1.0 (with e-zones), the final heated volume was 52%, compared to 37% for C1.1/BHrz (without e-zones). Also, the electric heating interval, which substantially terminated with onset of water vaporization, was 50% longer in WEH1.0. Again, this demonstrates that the electric energy delivered to the target region at the same power was more uniformly distributed in WEH1.0.

Like C1.0/BHrz, with respect to the absolute Γ values generated, $\Gamma_{initial}$ was 20.0 for C1.1/BHrz. $\Gamma_{10\%}$ (measured at 10 days for this example) was 5.2, slightly higher than the 3.2 $\Gamma_{initial}$ value for C1.0/BHrz. In contrast, as discussed below, when e-zones were established around the wells in WEH1.0, $\Gamma_{initial}$ was 3.8 and $\Gamma_{10\%}$ (measured at 10 days for that example) was 1.7. Accordingly, the inventive WEH process is able to deliver more heat, more quickly at and/or around the mid-point vicinity versus a conventional electric heating process without e-zones. Moreover, even though the applied voltage was larger in C1.1/BHrz, heat distribution to the target region mid-point vicinity was not significantly improved as compared to C1.0/BHrz. Accordingly, even though a higher voltage was applied in C1.1/BHrz, generating the same average power as in WEH1.0, heat was distributed to the target region's mid-point at a higher rate in WEH1.0.

In C1.1/BHrz, the TCG factor was an average rate of Γ change per day=1.48, compared with an average rate of Γ change per day=0.21 for WEH/1.0 and an average rate of Γ change per day=0.85 for C1.0/BHrz, calculated according to Equation (13). Therefore, a bare conductor pair's reliance on thermal conduction, in this particular comparison, was about seven times greater versus a pair of conductors with an e-zone contiguous to each conductor. Or, put another way, the electric field's ability to generate and distribute heat through the target region (i.e., the electric heating distribution effect), in this particular comparison, was about seven times more efficient when e-zones were used in accordance with the inventive WEH process vs. when none were used, and moreover, even when the applied voltage was higher for the bare conductor pair.

Furthermore, the HV factor for C1.1/BHrz was 31, calculated according to Equation (11), while the WEH1.0's HV factor was 54, about 75% greater than for C1.1/BHrz. Accordingly, even though the $\Gamma_{10\%}$ for C1.1/BHrz indicated an improved heating rate, in great part, if not entirely, due to the thermal conduction effect, the normalized volume heated to 50° C. to 70° C. was significantly less than for WEH1.0. Again, this is significant technical evidence that the inventive WEH process delivered more electric heating power throughout the targeted formation, as compared to the conventional electric heating process in C1.1/BHrz, even though more voltage was applied in C1.1/BHrz.

Moreover, in C1.0/BHrz, the %Γ deviation was zero and the $\%T_{max}$ deviation was also zero because the entire length of the well was heated to the same degree. But electric heating for C1.1/BHrz was not projected out from the well. Instead, again, heating was focused at the well. Therefore, the highest temperature values were located at the hot conductors, resulting in a HTP factor of zero, calculated according to Equation (8). So, once again, this HTP measurement is significant technical evidence that the conventional electric heating process distributed little to no heat at and/or around the target region's mid-point lines.

Accordingly, the composite score for heating performance was 262, calculated according to Equation (12), which is slightly improved over C1.0/BHrz's composite score (246), but significantly less than 401, WEH1.0's composite score. The composite scores for these and other examples, as well as their respective component factors, are summarized in Table 1B.

Comparative Example C1.2/BHrz

C1.2/BHrz was performed to determine the effect of increasing the distance between wells on heating performance. The well orientation, electrode size and shape and applied voltage, as well as formation pressure, used in the C1.2/BHrz simulation was the same as in C1.0/BHrz. However, the distance between wells was increased by 80% from 5 m to 9 m.

By increasing the distance between wells, the average conductance dropped to 24.5 S for C1.2/BHrz, about 15% less than the average conductance of 28.7 S for C1.0/BHrz.

And, while 100% of the targeted formation volume was ultimately heated in C1.2/BHrz (compared to 52.8% in C1.0/BHrz), the heating rate was significantly lower (i.e., 770 days to reach 100% heated volume). After 20 days of conventional electric heating, only 0.3% of the formation volume was heated to a temperature of at least 70° C. and after 60 days, only 3.9% of the formation volume was heated, compared to 3.4% and 34.3%, respectively, for C1.0/BHrz. Also, it took 770 days (2.1 years) to heat 100% of the targeted formation volume to a temperature greater than or equal to 70° C. In contrast, when e-zones were established around the wells, even though the applied voltage was the same, the time required to heat 100% of the targeted formation volume to the same temperature threshold was reduced significantly to 500 days (WEH1.2) and 390 days (WEH1.2+, larger e-zones), representing, respectively, a 35% and 49% time reduction to heat 100% of the targeted formation volume.

Also, as expected, the HT region in C1.2/BHrz was focused at and along the length of both wells, producing hot conductors. However, in this case, the HT region did not reach water vaporization temperature. Accordingly, up to 770 days, there was no water vaporization. Nonetheless, the highest temperature value in the HT region at the top well was higher than the highest temperature in the HT region at the bottom well, because the formation pressure at the top well was slightly lower than the formation pressure at the deeper bottom well.

With respect to the absolute Γ values generated, $\Gamma_{initial}$ was 56.1 for the bare conductor pair in C1.2/BHrz and $\Gamma_{10\%}$ (measured at 80 days for this example) was 3.4. In contrast, as discussed below, when e-zones were established around the wells in WEH1.2, $\Gamma_{initial}$ was 10.1 and $\Gamma_{10\%}$ (measured at 50 days for that example) was 2.2. And, when larger e-zones were established around the wells in WEH1.2+, $\Gamma_{initial}$ was 5.5 and $\Gamma_{10\%}$ (measured at 40 days for that example) was 1.6. So in comparing these three examples, we compare $\Gamma_{initial}$ with e-zones, 10.1 and 5.5 for WEH1.2 and WEH1.2+, respectively, which are much closer to the ideal value of 1 or less, versus 56.1 for $\Gamma_{initial}$ without e-zones, which is comparatively much greater than 1. Accordingly, the inventive WEH process is able to deliver more heat, more quickly at and/or around the mid-point vicinity versus a conventional electric heating process without e-zones.

In C1.2/BHrz, the TCG factor was an average rate of Γ change per day=0.66, compared with an average rate of Γ change per day=0.16 for WEH 1.2 and an average rate of Γ change per day=0.10 forWEH1.2+, calculated according to Equation (13). Therefore, a bare conductor pair's reliance on thermal conduction, in this particular comparison, was about four to seven times greater versus using a pair of conductors with an e-zone contiguous to each conductor. Or, put another way, the electric field's ability to generate and distribute heat through the target region (i.e., the electric heating distribution effect), in this particular comparison, was about four to seven times more efficient when e-zones were used in accordance with the inventive WEH process vs. when none were used.

Furthermore, the HV factor for C1.2/BHrz was 10, calculated according to Equation (11), while the HV factors for WEH1.2 and WEH/1.2+were 17 and 25, respectively. Accordingly, even though the $\Gamma_{10\%}$ for C1.2/BHrz indicated an improved heating rate due, in great part, if not entirely, to the thermal conduction effect, the normalized volume heated to 50° C. to 70° C. was significantly less than for WEH1.2 and WEH1.2+. Again, this further demonstrates that the inventive WEH process delivered more electric heating power throughout the targeted formation, as compared to the conventional electric heating process in C1.2/BHrz, which, again, significantly relies on thermal conduction to distribute heat into the target region, thereby increasing the time required to heat a larger portion of the target region and decreasing the portion of the target region that is ultimately heated to some predetermined temperature threshold (e.g., T≧70° C. in this case).

Moreover, in C1.2/BHrz, the %Γ deviation was zero and the $\%T_{max}$ deviation was also zero because the entire length of the well was heated to the same degree. But electric heating in C1.2/BHrz was not projected out from the well. Instead, again, heating was focused at the well. Therefore, the highest temperature values were located at the hot conductors, resulting in a HTP factor of zero, calculated according to Equation (8). So, once again, this HTP measurement is significant technical evidence that the conventional electric heating process distributed little to no heat at and/or around the target region's mid-point lines.

Accordingly, C1.2/BHrz's composite score for heating performance was 220, calculated according to Equation (12), which is significantly less than 293 and 333, the composite scores for WEH1.2 and WEH1.2+, respectively, which were similar conductor configurations, also used under the same applied voltage of 220 V as was used for C1.2/BHrz. The composite scores for these and other examples, as well as their respective component factors, are summarized in Table 1B.

Comparative Example C1.3/BHrz

The well orientation and distance between wells in C1.3/BHrz were the same as C1.2/BHrz. However, the voltage applied during electric heating was increased to 300 volts in C1.3/BHrz, as compared to 220 volts in C1.2/BHrz.

The average conductance was 23.8 S, which is about the same as in C1.2/BHrz. Any difference between the average conductance in the two examples was due to a slight change in formation electrical conductivity as a result of fluid movement during the period prior to water vaporization.

The heating rate was significantly higher with increased voltage in C1.3/BHrz. The heated volume after 20 days of conventional electric heating was about 10 times greater and after 60 days was about 4 times greater than in C1.2/BHrz.

The onset of water vaporization occurred at 170 days from the start, which signaled potential disrupted electrical connectivity. At that point, 51% of the targeted formation volume between the two wells was heated to a temperature of at least 70° C. In contrast, in WEH1.3, where e-zones were established around the wells, even though the applied voltage was the same, namely 300 V, 61% of the targeted formation volume was heated to at least 70° C. in 140 days, rather than 170 days. And, in WEH1.3+ (also at 300 V) where larger e-zones were established around the wells, 69% of the targeted formation volume was heated to the same temperature threshold in 130 days vs. the 170 days required in C1.3/BHrz.

Also, as expected, the HT region in C1.3/BHrz was focused at and along the length of both wells, producing two hot conductors. Because the HT region was focused at the hot conductors, electrical connectivity was immediately disrupted between the two wells when water vaporization occurred. Again, water vaporization occurred first at the top well, rather than the bottom well, because the formation pressure at the top well was slightly lower than the formation pressure at the deeper bottom well.

With respect to the absolute Γ values generated, in C1.3/BHrz $\Gamma_{initial}$ was 55.7 for the bare conductor pair and $\Gamma_{10\%}$ (measured at 15 days for this example) was 12.2. In contrast, as discussed below, in WEH1.3, where e-zones were established around the wells, $\Gamma_{initial}$ was 10.1 and $\Gamma_{10\%}$ (measured at 15 days for that example) was 3.9. And in WEH1.3+, where larger e-zones were established around the wells $\Gamma_{initial}$ was 5.6 and $\Gamma_{10\%}$ (measured at 15 days for that example) was 2.4. So in comparing these three examples, we compare $\Gamma_{initial}$ with e-zones, 10.1 and 5.6 for WEH1.3 and WEH1.3+, respectively, which are much closer to the ideal value of 1 or less, versus 55.7 for $\Gamma_{initial}$ without e-zones, which is comparatively much greater than 1. Accordingly, the inventive WEH process is able to deliver more heat, more quickly at and/or around the mid-point vicinity versus a conventional electric heating process without e-zones.

In C1.3/BHrz, conducted at 300 V, the TCG factor was an average rate of Γ change per day=2.91, compared to WEH1.3 (at 300 V) with an average rate of Γ change per day=0.41 and WEH1.3+ (also at 300 V) with an average rate of Γ change per day=0.21 for WEH1.3+, calculated according to Equation (13). Therefore, a bare conductor pair's reliance on thermal conduction, in this particular comparison, was about seven to 14 times greater versus using a pair of conductors with an e-zone contiguous to each conductor. Or, put another way, the electric field's ability to generate and distribute heat through the target region (i.e., the electric heating distribution effect), in this particular comparison, was about seven to 14 times more efficient when e-zones were used in accordance with the inventive WEH process vs. when none were used.

Furthermore, the HV factor for C1.3/BHrz was 16, calculated according to Equation (11), while the HV factors were 32 and 50 for WEH1.3 and WEH1.3+, respectively. Accordingly, even though the $\Gamma_{10\%}$ for C1.3/BHrz indicated an improved heating rate due, in great part, if not entirely, to the thermal conduction effect, the normalized volume heated to 50° C. to 70° C. was significantly less than for WEH1.3 and WEH1.3+. So, once again, this further demonstrates that the inventive WEH process delivered more electric heating power throughout the targeted formation, as compared to the conventional electric heating process in C1.3/BHrz, which, again, significantly relies on thermal conduction to distribute heat into the target region, thereby increasing the time required to heat a larger portion of the target region and decreasing the portion of the target region that is ultimately heated to some predetermined temperature threshold (e.g., T≧70° C., in this case).

Moreover, in C1.3/Hrz, the %Γ deviation was zero and the $\%T_{max}$ deviation was also zero because the entire length of the well was heated to the same degree. But electric heating for C1.3/BHrz was not projected out from the well. Instead, again, heating was focused at the wells. Therefore, the highest temperature values were located at the hot conductors, resulting in a HTP factor of zero, calculated according to Equation (8). So, once again, this HTP measurement is significant technical evidence that the conventional electric heating process distributed little to no heat at and/or around the target region's mid-point lines.

Accordingly, C1.3/BHrz's composite score for heating performance was 232, calculated according to Equation (12), which is significantly less than 323 and 383, the composite scores for WEH1.3 and WEH1.3+, respectively, which were similar conductor configurations also used under the same applied voltage of 300 V as was used for C1.2/BHrz. The composite scores for these and other examples, as well as their respective component factors, are summarized in Table 1B.

WEH Examples—Series 1

WEH1.0, WEH1.1, WEH1.2, WEH 1.2+, WEH 1.3 and WEH 1.3+ are simulations of WEH processes using e-zones contiguous with the bare parallel horizontal wells from the Series 1 Comparative Examples. The wells in WEH1.0 and WEH1.1 were vertically spaced apart by 5 m, typical for a SAGD operation, while the wells in WEH1.2, WEH 1.2+, WEH 1.3 and WEH1.3+ were spaced 9 m apart.

The e-zones in WEH1.0, WEH1.1, WEH1.2 and WEH1.3 were elliptical cylinder-shaped e-zones with a minor axis of 0.6 m and a major axis of 1 m. In WEH1.2+ and WEH1.3+, the elliptical cylinder-shaped e-zones were larger with a minor axis of 1 m and a major axis of 1.8.

The voltage applied to the wells in WEH1.0, WEH1.2 and WEH1.2+ was 220 V, while the voltage applied in WEH1.1 was 170 V and the voltage applied in WEH1.3 and WEH1.3+ was 300 V. The formation pressure was 2.1 MPa, typical for SAGD heavy oil processes in Alberta, Canada. The results of the WEH process simulations are discussed below.

Example WEH1.0

WEH1.0 is a simulation of WEH between the pair of wells in C1.0/BHrz. However, in this case, a horizontal elliptical cylinder-shaped e-zone was established around each well. Each elliptical cylinder-shaped e-zone had a horizontal major axis of 1 m and a vertical minor axis of 0.6 m. Accordingly, the electrode's curvature was reduced as compared to C1.0/BHrz.

The average conductance for the e-zone geometry in WEH1.0 was 47.6 S, representing about a 66% increase in average conductance, as compared to C1.0/BHrz. The increase in conductance (i.e., lower resistance to current flow) was due to the elliptical cylinder-shaped e-zones, which improved current flow through the formation.

The average heating power delivered to the formation was 2.40 MW, representing about a 64% increase in average heating power, as compared to C1.0/BHrz (1.46 MW), for the same applied voltage. This means that the heating rate was increased by establishing e-zones around the conductors.

After 20 days of WEH, 12% of the targeted formation volume between the two wells was heated to at least 70° C. and, after 60 days, 34.4% of the targeted formation volume was heated to a temperature of at least 70° C. The onset of water vaporization occurred at 120 days from the start. At that point, 51.6% of the targeted formation volume was heated to the same temperature threshold. Even though the heated volume was slightly less than the final heated volume in C1.0/BHrz, the formation was heated at a significantly faster rate with better heat distribution, with the same voltage, than C1.0/BHrz. Specifically, in C1.0/BHrz, 52.8% of the targeted formation volume was heated in 220 days. But after only 120 days in WEH1.0, 51.6% formation volume was heated to a temperature of at least 70° C. Also, the formation volume heated after 20 days was about 4 times greater for WEH1.0 than for C1.0/BHrz.

The HT region was projected outward from the well to a localized heating zone 0.8 m below the top well, coextensive with the well. As a result, water vaporization did not immediately disrupt electrical connectivity between the wells. This is a significant improvement over C1.0/BHrz, where a hot conductor was generated at the top well disrupting electrical connectivity immediately. Surprisingly, the localized heating zone generated in WEH1.0 did not occur right at the e-zone perimeter (where r=0.3 m). Instead, the localized heating zone was projected outward from the well at a distance approximately equal to about 2.7r (0.8 m). This is surprising because those skilled in the art would have expected the localized heating zone to move only to the new electrode perimeter, since the electric heating for the bare conductor in C1.0/BHrz was located at the well perimeter.

$\Gamma_{initial}$ for WEH1.0 was 3.8, compared with the respective $\Gamma_{initial}$ of 20.1 for C1.0/BHrz. And $\Gamma_{10\%}$ (measured at 10 days for this example) was reduced to 1.7, corresponding to a TCG factor of 0.21, versus $\Gamma_{10\%}$ =3.2 (measured at 20 days for that example) for C1.0/BHrz, corresponding to a TCG factor of 0.85. As discussed more fully above under C1.0/BHrz, a comparison of the absolute Γ values and the TCG factors demonstrates that the inventive WEH process is able to deliver more heat, more quickly at and/or around the mid-point vicinity versus a conventional electric heating process without e-zones. Also, a bare conductor pair's reliance of thermal conduction, in this particular comparison, was about four times greater versus a pair of conductors with an e-zone contiguous to each conductor. Accordingly, the electric field's ability to generate and distribute heat through the target region (i.e., the electric heating distribution effect), in this particular comparison, was about four times more efficient when e-zones were used in accordance with the inventive WEH process vs. when none were used.

Moreover, the HV factor was 54 for WEH1.0, calculated according to Equation (11), which was more than double the HV factor for C1.0/BHrz. This further demonstrates that the inventive WEH process delivered more electric heating power (i.e., more heat generated per V applied) throughout the targeted formation (i.e., target region plus portions of the formation adjacent to the target region), as compared to the conventional electric heating process in C1.0/BHrz, which, again, significantly relies on thermal conduction to distribute heat into the target region. In turn, this significant TC contribution increases the time required to heat a larger portion of the target region and decreases the percentage of the target region that is ultimately heated to some predetermined temperature threshold (e.g., T≧70° C., in this case). Therefore, the HV factor is generally higher for a WEH process relative to a conventional electric heating process for a similar well configuration.

Furthermore, the %Γ deviation was zero and the $\%T_{max}$ deviation was also zero because the temperature profile in the target region was substantially uniform parallel to the conductors. And, because the localized heating zone was located 0.8 m from the top well and along the shortest line between the wells, the HTP factor was 93, calculated according to Equation (8).

Accordingly, WEH1.0's composite score for heating performance was 401, calculated according to Equation (12), which is significantly higher than the 246, C1.0/BHrz's composite score. The composite scores for these and other examples, as well as their respective component factors, are summarized in Table 1B.

Example WEH1.1

The well orientation and e-zone size and geometric shape, as well as formation pressure, used in the WEH1.1 simulation was the same as in WEH1.0. However, in WEH1.1, the voltage applied between the wells was dropped to 170 V, from 220 V, so that the average heating power delivered to the targeted formation was similar to C1.0/BHrz. As illustrated in Table 1A, the initial heating rate was reduced when the voltage was dropped, but the final heated volume was increased because the heat distribution was more diffuse in WEH1.1 and water vaporization did not occur as quickly.

The average conductance was 48.7 S, which is about the same as in WEH1.0 (47.6 S). Any difference between the average conductance in the two examples was due to a slight change in formation electrical conductivity as a result of fluid movement during the period prior to water vaporization.

After 20 days of WEH, no portion of the formation was heated to a temperature greater than or equal to 70° C. However, at 60 days, the heated volume was 22.5%, which is about the same as the 21.6% heated volume after 60 days in C1.0/BHrz. Moreover, WEH continued for 330 days, when the onset of water vaporization occurred, resulting in 72% of the targeted formation volume being heated. In contrast, 52.8% of the targeted formation volume was heated in 220 days. This comparison at different heating intervals is strong technical evidence that heating in WEH1.1 was more uniformly distributed than in C1.0/BHrz, since the average heating power delivered to the targeted formation was about the same.

Just as in WEH1.0, the HT region was projected outward from the well to a localized heating zone 0.8 m below the top well, coextensive with the well. As a result, water vaporization did not immediately disrupt electrical connectivity between the wells. This is a significant improvement over the bare conductor pair in C1.0/BHrz, where the HT region was focused at the top well disrupting electrical connectivity immediately. Again, surprisingly, the localized heating zone generated in WEH1.1 did not occur right at the e-zone perimeter (r=0.3 m). Instead, the localized heating zone was projected outward from the well at a distance approximately equal to about 2.7r (0.8 m). This is surprising because those skilled in the art would have expected the localized heating zone to move only to the new electrode perimeter, since the HT region for the bare conductor in C1.0/BHrz was located at the well perimeter.

The average heating power in WEH1.1 (1.47 MW) is similar to the average heating power in C1.0/BHrz (1.46 MW), even though the applied voltage was lower in WEH1.1 (170 V vs. 220 V). However, as discussed below, the results show that the same average heating power, and therefore heating, was more evenly distributed in WEH1.1 than in C1.0/BHrz.

With respect to the absolute Γ values generated, $\Gamma_{initial}$ for WEH1.1 was 3.8 and $\Gamma_{10\%}$ (measured at 35 days for this example) was 1.2. The Γ values were similar to those for WEH1.0 ($\Gamma_{initial}$=3.8, $\Gamma_{10\%}$=1.7, measured at 10 days for that example). So, even though the applied voltage was reduced in WEH1.1, the $\Gamma_{initial}$ value was still significantly less than the $\Gamma_{initial}$ value of 20.1 in C1.0/BHrz. Again, this demonstrates that the inventive WEH process is able to deliver more heat, more quickly at and/or around the midpoint vicinity versus a conventional electric heating process without e-zones.

Also, the inventive WEH process is less dependent on the thermal conduction effect, which again, takes more time to generate a more uniform heat distribution through the target region. In WEH 1.1, the TCG factor was an average rate of Γ change per day=0.07, compared with an average rate of Γ change per day=0.85 for C1.0/BHrz, calculated according to Equation (13). Therefore, even though the applied voltage was lower in WEH1.1 (170V vs. 220 V for C1.0/BHrz), a bare conductor pair's reliance on thermal conduction, in this particular comparison, was about 12 times greater versus a pair of conductors with an e-zone contiguous to each conductor. Accordingly, the electric field's ability to generate and distribute heat through the target region (i.e., the electric heating distribution effect), in this particular comparison, was about 12 times more efficient when e-zones were used in accordance with the inventive WEH process vs. when none were used.

Moreover, the HV factor was 18 for WEH1.1, which was similar to the HV factor of 23 for C1.0/BHrz. However, recall that the applied voltage was less than in WEH1.1 (170 V) compared with C1.0/BHrz (220 V).

Furthermore, the %Γ deviation was zero and the $\%T_{max}$ deviation was also zero because the temperature profile in the target region was substantially uniform parallel to the conductors. And, because the localized heating zone was located 0.8 m from the top well and along the shortest line between the wells, the HTP factor was 93, calculated according to Equation (8).

Accordingly, WEH1.1's composite score for heating performance was 329, calculated according to Equation (12), which is significantly higher than 246, C1.0/BHrz's composite score. The composite scores for these and other examples, as well as their respective component factors, are summarized in Table 1B.

WEH1.0 and WEH1.1 also demonstrate that, where desired, it is possible to have both (a) a higher initial heating rate by applying a higher voltage at the beginning of the electric heating time interval and (b) a longer heating period with a larger heated volume by later applying a reduced voltage.

Example WEH1.2

WEH1.2 is a simulation of WEH between the pair of wells in C1.2/BHrz, spaced 9 m apart. However, in this case, a horizontal elliptical cylinder-shaped e-zone was established around each well. The elliptical cylinder-shaped e-zone had a horizontal major axis of 1 m and a vertical minor axis of 0.6 m. The voltage applied across the two wells was 220 V. The parameters for the WEH1.2 simulation were therefore the same as for WEH1.0, except for the distance between wells, which was 80% larger in WEH1.2 (9 m vs. 5 m in WEH1.0).

Comparing the results from WEH1.2 first with C1.2/BHrz, the average conductance was increased by about 49% by establishing elliptical cylinder-shaped e-zones around the wells.

After 20 days of WEH, no portion of the formation was heated to a temperature greater than 70° C. But after 60 days, the heated formation volume was 10% in WEH1.2, 3 times greater than in C1.2/BHrz, at the same applied voltage. This demonstrates that heating was more uniform in WEH1.2 because the electric energy was more uniformly diffused by the electric field generated between the two elliptical cylinder-shaped e-zones. The onset of water vaporization occurred at 500 days from the start. At that point, 100% of the targeted formation volume between the two wells was heated to a temperature greater than or equal to 70° C. As compared with C1.2/BHrz, the total formation volume was heated to the same temperature threshold in 35% less time. Accordingly, the elliptical cylinder-shaped e-zones around the wells significantly improved the heating rate and heated volume.

Now comparing the WEH1.2 results to the WEH1.0 results, the average conductance was about 23% less in WEH1.2 because of the larger distance between wells. Although the heating rate was significantly less than in WEH1.0, 100% of the formation volume between the two wells was heated to a temperature greater than or equal to 70° C. in WEH1.2, vs. 51.6% in WEH1.0. At 60 days from the start, the heated volume in WEH1.2 (17,040 $m^3$ representing 10% of its total) was about 50% of the heated volume (34,960 $m^3$ representing 34% of its total) in WEH1.0.

Just as in WEH1.0, the HT region was projected outward from the well to a localized heating zone. In WEH1.2, the localized heating zone was 0.5 m below the top well, coextensive with the well. As a result, water vaporization did not immediately disrupt electrical connectivity between the wells. This is a significant improvement over C1.2/BHrz, where the HT region was focused at the top well disrupting electrical connectivity immediately. Again, surprisingly, the localized heating zone generated in WEH1.2 did not occur right at the e-zone perimeter (r=0.3 m). Instead, the localized heating zone was projected outward from the well at a distance approximately equal to 1.7r (0.5 m). This is surprising because those skilled in the art would have expected the localized heating zone to move only to the new electrode perimeter, since the HT region for the bare conductor in C1.2/BHrz was located at the well perimeter.

With respect to the absolute Γ values, $\Gamma_{initial}$ for WEH1.2 was 10.1, compared with the respective $\Gamma_{initial}$ values of 3.8 for WEH1.0 and 56.1 for C1.2/BHrz, and $\Gamma_{10\%}$ (measured at 50 days for this example) was 2.2, versus $\Gamma_{10\%}$=1.7 (measured at 10 days for that example) for WEH1.0 and $\Gamma_{10\%}$=3.4 (measured at 80 days for that example) for C1.2/BHrz. Also, in WEH1.2, the TCG factor was an average rate of Γ change per day=O0.16, compared with an average rate of Γ change per day=0.21 for WEH1.0 and an average rate of Γ change per day=0.66 for C1.2/BHrz, calculated according to Equation (13).

As discussed more fully above under C1.2/BHrz, a comparison of the absolute Γ values and the TCG factors for WEH1.2 and C1.2/BHrz demonstrates that the inventive WEH process is able to deliver more heat, more quickly at and/or around the mid-point vicinity versus a conventional electric heating process without e-zones. Also, a bare conductor pair's reliance on thermal conduction, in this particular comparison, was four times greater versus a pair of conductors with an e-zone contiguous to each conductor. Accordingly, the electric field's ability to generate and distribute heat through the target region (i.e., the electric heating distribution effect), in this particular comparison, was about four times more efficient when e-zones were used in accordance with the inventive WEH process vs. when none were used.

And, even though the distance between wells was significantly greater in WEH1.2 (9 m) vs. WEH1.0 (5 m), the absolute Γ values and TCG factors demonstrate effective heating in WEH1.2. This is a surprising result because typical SAGD operations for recovering super heavy oil (i.e., 1,000 cp to about 1,000,000 cp or greater) using parallel horizontal wells placed 5 m apart because it has generally been understood that there would be insufficient fluid communication generated between wells with a larger distance between wells within an economically practical time period (e.g., less than half a year). But WEH1.2 demonstrates that when WEH is used, the distance between wells can be significantly increased to at least about 9 m and fluid communication can be established with a significantly shorter period of time.

Moreover, the HV factor for WEH1.2 was 17, calculated according to Equation (11), as compared to an HV factor of 10 for C1.2/BHrz. This further demonstrates that the inventive WEH process delivered more electric heating power throughout the target region, as compared to the conventional electric heating process in C1.2/BHrz, which, again, significantly relies on thermal conduction to distribute heat into the target region. In turn, this significant TC contribution increases the time required to heat a larger portion of the target region and decreases the percentage of the target region that is ultimately heated to some predetermined temperature threshold (e.g., T≧70° C., in this case). Therefore, the HV factor is generally higher for a WEH process relative to a conventional electric heating process for a similar well configuration.

Furthermore, the %Γ deviation was zero and the $\%T_{max}$ deviation was also zero in WEH1.2 because the temperature profile in the target region was substantially uniform parallel to the conductors. And, because the localized heating zone was located 0.5 m from the top well and along the shortest line between the wells, the HTP factor was 59 calculated according to Equation (8).

Accordingly, WEH1.2's composite score for heating performance was 293, calculated according to Equation (12), which is significantly higher than 220, C1.2/BHrz's composite score. The composite scores for these and other examples, as well as their respective component factors, are summarized in Table 1B.

Example WEH1.3

WEH1.3 is a simulation of WEH between the pair of wells in C1.3/BHrz, spaced 9 m apart. However, in this case, a horizontal cylinder-shaped e-zone was established around each well. The e-zone used in WEH1.3 had a horizontal major axis of 1 m and a vertical minor axis of 0.6 m, the same as for WEH1.2. However, the voltage applied during electric heating was 300 volts for WEH1.3, compared with the applied voltage of 220 volts in WEH1.2.

The average conductance was 35 S, which is about the same as in WEH1.2. Any difference between the average conductance in the two examples was due to a slight change in formation electrical conductivity as a result of fluid movement during the period prior to water vaporization. And, compared to C1.3/BHrz, the average conductance was increased by about 47% in WEH1.3 by establishing elliptical cylinder-shaped e-zones around the wells.

The heating rate was significantly higher with increased voltage. The heated volume after 60 days in WEH1.3 (300 V) was 33.1%, which is about 3 times greater than the value of 10.0% in WEH1.2 (220 V). At the onset of water vaporization, 61% of the targeted formation volume was heated to at least 70° C. in WEH1.3, while 100% of the formation volume was heated to a temperature greater than or equal to 70° C. in WEH1.2. However, the length of time to the onset of water vaporization was 140 days in WEH1.3, about 3.6 times less than for WEH1.2 (500 days).

The heating rate in WEH1.3 was also significantly higher than the bare conductor pair in C1.3/BHrz, conducted at the same applied voltage of 300 V. At 60 days in WEH1.3, the 33.1% heated volume was more than twice that of C1.3/BHrz (15.3%). At the onset of water vaporization, 61% of the targeted formation volume was heated to at least 70° C. in WEH 1.3, while 51% of the formation volume was heated to a temperature greater than or equal to 70° C. in C1.3/BHrz. So, 10% more of the targeted formation was heated in WEH1.3, in 24% less time (130 days) than for C1.3/BHrz (170 days).

Just as in WEH1.2, the HT region was projected outward from the well to a localized heating zone 0.5 m below the top well, coextensive with the well. As a result, water vaporization did not immediately disrupt electrical connectivity between the wells. This is a significant improvement over C1.3/BHrz, where the HT region was focused at the top well so that water vaporization disrupted electrical connectivity immediately. Again, surprisingly, the localized heating zone generated in WEH1.3 did not occur right at the e-zone perimeter (r=0.3 m). Instead, the localized heating zone was projected outward from the well at a distance approximately equal to 1.7r (0.5 m). This is surprising because those skilled in the art would have expected the localized heating zone to move only to the new electrode perimeter, since the HT region for the bare conductor in C1.2/BHrz was located at the well perimeter.

With respect to the absolute Γ values, $\Gamma_{initial}$ for WEH1.3 (300 V) was 10.1, which is significantly lower than the $\Gamma_{initial}$ of 55.7 for C1.3/BHrz (300 V), but the same as the $\Gamma_{initial}$ for WEH 1.2 (same e-zone size/shape, 220 V). Meanwhile, $\Gamma_{10\%}$ was 3.9 (measured at 15 days for this example) in WEH1.3, as compared with a $\Gamma_{10\%}$ of 12.1 (measured at 15 days) for C1.3/BHrz and a $\Gamma_{10\%}$ of 2.2 (measured at 50 days) for WEH1.2.

As discussed more fully above under C1.3/BHrz, the inventive WEH process is able to deliver more heat, more quickly at and/or around the mid-point vicinity versus a conventional electric heating process without e-zones. So, in comparing these two examples, we compare $\Gamma_{initial}$ with e-zones, 10.1, which is much closer to the ideal value of 1 or less, versus 55.7 for $\Gamma_{initial}$ without e-zones, which is comparatively much greater than 1.

And comparing the absolute Γ values for WEH1.3 and WEH1.2 illustrates the advantage of starting with a higher applied voltage in a WEH process and subsequently reducing the applied voltage to maintain electrical connectivity for a longer period of time.

In WEH1.3, the TCG factor was an average rate of Γ change per day=0.41, compared with an average rate of Γ change per day=2.91 for C1.3/BHrz, calculated according to Equation (13). Therefore, a bare conductor pair's reliance on thermal conduction, in this particular comparison, was about seven times greater versus the pair of conductors with contiguous e-zones. Or, put another way, the electric field's ability to generate and distribute heat through the target region (i.e., the electric heating distribution effect), in this particular comparison, was about seven times more efficient when e-zones were used in accordance with the inventive WEH process vs. when none were used.

Moreover, the HV factor for WEH1.3 was 32, calculated according to Equation (11), as compared to an HV factor of 16 for C1.3/BHrz. This further demonstrates that the inventive WEH process delivered more electric heating power throughout the targeted formation, as compared to the conventional electric heating process in C1.3/BHrz, which, again, significantly relies on thermal conduction to distribute heat into the target region. In turn, this significant TC contribution increases the time required to heat a larger portion of the target region and decreases the percentage of the target region that is heated to some predetermined temperature threshold (e.g., T≧70° C., in this case). Therefore, the HV factor is generally higher for a WEH process relative to a conventional electric heating process for a similar well configuration.

Furthermore, the %Γdeviation was zero and the $\%T_{max}$ deviation was also zero in WEH1.3 because the temperature profile in the target region was substantially uniform parallel to the conductors. And, because the localized heating zone was located 0.5 m from the top well and along the shortest line between the wells, the HTP factor was 59 calculated, according to Equation (8).

Accordingly, WEH1.3's composite score for heating performance was 323, calculated according to Equation (12), which is significantly higher than 232, the C1.3/BHrz's composite score. The composite scores for these and other examples, as well as their respective component factors, are summarized in Table 1B.

Example WEH1.2+

WEH1.2+ is a simulation of WEH between the pair of wells in WEH1.2. However, in this case, the horizontal elliptical cylinder-shaped e-zone established around each well was enlarged by about 3 times (from 417 $m^3$ to 1414 $m^3$) as compared to WEH1.2. The elliptical cylinder-shaped e-zone had a horizontal major axis of 1.8 m (vs. 1 m in WEH1.2) and a vertical minor axis of 1 m (vs. 0.6 m in WEH1.2). The voltage applied across the two wells was 220 V. The parameters for the WEH1.2+ simulation were therefore the same as for WEH1.2, except that the e-zone volume was 3 times larger in WEH1.2+.

The average conductance in WEH1.2+ was 45.4 S, about 25% greater than the average conductance of 36.5 S for WEH 1.2.

In both WEH1.2 and WEH1.2+, 100% formation volume was heated to a temperature greater than or equal to 70° C. between the two wells before water vaporization. However, the larger e-zones in WEH1.2+ decreased the length of time to the onset of water vaporization (390 days) by 22%, as compared to WEH1.2 (500 days). And the volume heated at 60 days from the start was about 90% greater with the larger e-zone volume in WEH1.2+.

Just as in WEH1.2, the HT region was projected outward from the well to a localized heating zone. In WEH1.2+, the localized heating zone was 1 m below the top well and 1 m above the bottom well, coextensive with the well. As a result, water vaporization did not immediately disrupt electrical connectivity between the wells. This is a significant improvement over C1.2/BHrz, where the HT region was focused at the top well, so that water vaporization disrupted electrical connectivity immediately. Again, surprisingly, the localized heating zone generated in WEH1.2+ did not occur right at the e-zone perimeter (r=0.5 m). Instead, the localized heating zone was projected outward from the well at a distance approximately equal to 2r (1 m). This is surprising because those skilled in the art would have expected the localized heating zone to move only to the new electrode perimeter, since the HT region for the bare conductor in C1.2/BHrz was located at the well perimeter.

With respect to the absolute Γ values, $\Gamma_{initial}$ for WEH1.2+ was 5.5, compared with the respective $\Gamma_{initial}$ values of 10.1 in WEH1.2 and 56.1 for C1.2/BHrz. And $\Gamma_{10\%}$ (measured at 40 days for this example) was 1.6 versus 2.2 in WEH1.2 (measured at 50 days) and 3.4 in C1.2/BHrz (measured at 80 days).

As discussed more fully above under C1.2/BHrz, the inventive WEH process is able to deliver more heat, more quickly at and/or around the mid-point vicinity versus a conventional electric heating process without e-zones. So, in comparing these two examples, we compare $\Gamma_{initial}$ with e-zones, 5.5, which is much closer to the ideal value of 1 or less, versus 56.1 for $\Gamma_{initial}$ without e-zones, which is comparatively much greater than 1.

Again, for the reasons discussed under WEH1.2, this is a surprising result because typical SAGD operations for recovering super heavy oil using parallel horizontal wells placed 5 m apart because it has generally been understood that there would be insufficient fluid communication between wells with a larger distance between wells. But WEH1.2+ demonstrates that when WEH is used, the distance between wells can be significantly increased to at least about 9 m.

In WEH1.2+, the TCG factor was an average rate of Γ change per day=0.10, compared with an average rate of Γ change per day=0.66 for C1.2/BHrz, calculated according to Equation (13). Therefore, a bare conductor pair's reliance on thermal conduction, in this particular comparison, was about seven times greater versus the pair of conductors with an e-zone contiguous to each conductor. Or, put another way, the electric field's ability to generate and distribute heat through the target region (i.e., the electric heating distribution effect), in this particular comparison, was about seven times more efficient when e-zones were used in accordance with the inventive WEH process vs. when none were used.

Moreover, the HV factor for WEH1.2+ was 25, calculated according to Equation (11), as compared to an HV factor of 10 for C1.2/BHrz. This further demonstrates that the inventive WEH process delivered more electric heating power throughout the targeted formation, as compared to the conventional electric heating process in C1.2/BHrz, which, again, significantly relies on thermal conduction to distribute heat into the target region. In turn, this significant TC contribution increases the time required to heat a larger portion of the target region and decreases the percentage of the target region that is ultimately heated to some predetermined temperature threshold (e.g., T≧70° C.). Therefore, the HV factor is generally higher for a WEH process relative to a conventional electric heating process for a similar well configuration.

Furthermore, %Γ deviation was zero and the $\%T_{max}$ deviation was also zero in WEH1.2+ because the temperature profile in the target region was substantially uniform parallel to the conductors. And, because the localized heating zone was located 1 m from the top well and along the shortest line between the wells, the HTP factor was 83 calculated according to Equation (8).

Accordingly, WEH1.2+'s composite score for heating performance was 333, calculated according to Equation (12), which is significantly larger than 220, C1.2/BHrz's composite score. The composites score for these and other examples, as well as their component factors, are summarized in Table 1B.

Example WEH1.3+

The e-zone used in WEH1.3+ was the same as in WEH1.2+. However, the voltage applied during electric heating was 300 volts for WEH1.3+, as compared with the applied voltage of 220 volts for WEH1.2+.

The average conductance was 43.2 S, which is about the same as in WEH1.2+. Any difference between the average conductance in the two examples was due to a slight change in formation conductivity as a result of fluid movement during the period prior to water vaporization.

The heating rate was significantly higher with increased voltage. The heated volume after 60 days in WEH1.3+ (300 V) was 41.7% about 2 times greater than in WEH1.2+.

At the onset of water vaporization, 69% of the targeted formation volume was heated to a temperature greater than or equal to 70° C. in WEH 1.3+, while 100% of the targeted formation volume was heated to 70° C. or greater in WEH1.2+. However, the length of time to the onset of water vaporization was 3 times less for WEH1.3+ (130 days) than for WEH1.2+ (390 days). This represents a significant improvement as compared with C1.3/BHrz where 51% of the formation volume was heated to at least 70° C. in 170 days.

Just as in WEH1.2+, the HT region was projected outward from the well to a localized heating zone 1 m below the top well and 1 m above the bottom well, coextensive with the well. As a result, water vaporization did not immediately disrupt electrical connectivity between the wells. This is a significant improvement over C1.3/BHrz, where the HT region was focused at the top well so that water vaporization disrupted electrical connectivity immediately. Again, surprisingly, the localized heating zone generated in WEH1.3+ did not occur right at the e-zone perimeter (r=0.5 m). Instead, the localized heating zone was projected outward from the well at a distance approximately equal to 2r (1 m). This is surprising because those skilled in the art would have expected the localized heating zone to move only to the new electrode perimeter, since the HT region for the bare conductor in C1.3/BHrz was located at the well perimeter.

With respect to the absolute Γ values, $\Gamma_{initial}$ was 5.6, which is significantly lower than the $\Gamma_{initial}$ =55.7 for C1.3/BHrz, but about the same as the $\Gamma_{initial}$=5.5 for WEH1.2+ (same e-zone size/shape, but lower voltage). And $\Gamma_{10\%}$ 2.4 (measured at 15 days for this example), compared with the respective $\Gamma_{10\%}$=12.1 for C1.3/BHrz (measured at 15 days for that example).

As discussed more fully above under C1.3/BHrz, the inventive WEH process is able to deliver more heat, more quickly at and/or around the mid-point vicinity versus a conventional electric heating process without e-zones. So, in comparing these two examples, we compare $\Gamma_{initial}$ with e-zones, 5.6, which is much closer to the ideal value of 1 or less, versus 55.7 for $\Gamma_{initial}$ without e-zones, which is much greater than 1.

And comparing the absolute Γ values for WEH1.3+ and WEH 1.2+ illustrates the advantage of starting with a higher applied voltage in a WEH process and subsequently reducing the applied voltage to maintain electrical connectivity for a longer period of time.

In WEH1.3+, the TCG factor was an average rate of Γ change per day=0.21, compared with an average rate of Γ change per day=2.91 for C1.3/BHrz, calculated according to Equation (13). Therefore, a bare conductor pair's reliance on thermal conduction, in this particular comparison, was about 14 times greater versus the pair of conductors with an e-zone contiguous to each conductor. Or, put another way, the electric field's ability to generate and distribute heat through the target region (i.e., the electric heating distribution effect), in this particular comparison, was about 14 times more efficient when e-zones were used in accordance with the inventive WEH process vs. when none were used.

Moreover, the HV factor for WEH1.3+, calculated according to Equation (11), was 50, as compared to an HV factor of 16 for C1.3/BHrz. This further demonstrates that the inventive WEH process delivered more electric heating power throughout the targeted formation, as compared to the conventional electric heating process in C1.3/BHrz, which, again, significantly relies on thermal conduction to distribute heat into the target region, thereby increasing the time required to heat a larger portion of the target region and decreasing the portion of the target region that is ultimately heated to some predetermined temperature threshold (e.g., T≧70° C., in this case).

Because the temperature profile in the target region was substantially uniform parallel to the conductors, the %Γ deviation was zero and the $\%T_{max}$ deviation was also zero. And, because the localized heating zones were located 1 m from the top and bottom wells, along the shortest line between the wells, the HTP factor was 83 calculated according to Equation (8).

Accordingly, the composite score for heating performance was 383, calculated according to Equation (12), which is significantly greater than 232, the C1.3/BHrz's composite score. The composite scores for these and other examples, as well as their respective component factors, are summarized in Table 1B.

Comparative & WEH Examples—Series 2

C2.0/Cone is a simulation using the conventional electric heating process described in U.S. Pat. No. 3,946,809 (US'809), which failed to account for e-zone shape, e-zone spacing and/or spatial orientation. The Series 2 WEH examples (i.e., WEH2.0/Cyl, WEH2.0/SmCyl, WEH2.0InvCone and WEH2.0/CylCducty) demonstrate how the deficiencies in the US'809 conventional process can be overcome by properly accounting for e-zone geometric shape, e-zone spacing and/or spatial orientation. The remaining Series 2 comparative examples (i.e., C2.0/ConeEFC) further illustrate the deficiencies in the conventional US'809 process.

Comparative Example C2.0/Cone

C2.0/Cone is a simulation illustrating that the US '809 conventional electric heating process generates an asymmetric, unidirectional hot spot pair. Accordingly, the heat generated with the US'809 electric heating process, despite using e-zones with relatively large volumes was not substantially diffused in the target region. So, even though the US '809 electrode volume was large and the effective radius was large, Hagedorn failed to recognize the importance of e-zone geometric shape, e-zone spacing and spatial orientation. As discussed above, Hagedorn suggests the following process for electric heating in US '809:

1. CSS, which is terminated when there is interconnection of CSS heated zones between wells;
2. producing oil and water;
3. injecting high conductivity fluid into CSS heated zones to displace water condensed from steam without displacing connate water outside the CSS heated zone and, as explained more fully below, thereby producing a substantially conically shaped pair of e-zones with non-uniform spacing between them; and
4. completing wells as electrodes and allowing current to flow between wells to increase the temperature of oil not heated in CSS.

Other than the elliptical top plan view, there is no explicit discussion of the shape of the CSS heated zone in US '809. But, US '809's explicit directions for forming an e-zone clearly produce a conical bowl-shaped e-zone. As discussed above, it is well understood by those skilled in the art that when steam is injected into a formation, it will rise to form a conical bowl-shaped steam zone, as illustrated in FIG. 5D. Therefore, when higher electrical conductivity fluid is injected into the CSS steam zone, in the manner explicitly described and emphasized in US '809, so as not to displace connate water outside the CSS steam zone, the injected fluid will necessarily form a conical bowl-shaped e-zone around each vertical well.

Because high conductivity fluid is injected only into the conical bowl shape of the CSS heated zone, US '809's e-zones are therefore conical bowl-shaped. Accordingly, the facing edges of the top elliptical surface of the conical bowl-shaped e-zones are significantly closer than the bottom of the conical bowl-shaped e-zones, which are only slightly larger than the wellbore diameter. But, as demonstrated by the reservoir simulation discussed below, when a current flows between the electrodes, point sources are created between facing edges of the top elliptical surface of the conical bowl-shaped e-zones. And little to no heating occurs between the e-zones below the top surfaces of the conical bowl-shaped e-zones. Moreover, heating is focused at the point sources, thereby overheating the formation liquid around the point sources. When water is overheated, vaporization ultimately occurs and electrical connectivity may be disrupted between the wells, depending on the location of the water vaporization.

The dimensions of the conical bowl-shaped e-zone used in the C2.0/Cone simulation, based on information provided in US '809 Example I, are as follows:

Top: Ellipse with major axis of 54 m and minor axis of 10 m (see US'809 at col. 7:17–19)

Bottom: 2 m×2 m square to approximate a 2 m diameter circle

Depth of conical bowl: 32 m (see US '809 at col. 6:58)

Distance between wells: 141 m based on wells placed at diagonally opposing corners of 100m×100m square plot (US '809 at col. 7:39–41)

E-zone Spatial Orientation: Major axes parallel and diagonal as illustrated in US '809 FIG. 3

E-zone Spacing: 110 m

The formation pressure was 3.1 MPa, in accordance with US '809 Example I (col. 6:62). Electric heating was conducted in US '809 with 1 MW power (see US '809 col. 7:45). Accordingly, the voltage required to apply 1 MW power, for the e-zone shape and selected reservoir conductivity value was estimated to be 1,300 V.

The results of the simulation are provided under C2.0/Cone in Table 1A. The simulation results for C2.0/Cone will initially be compared to the results for WEH2.0/Cyl and WEH2.0/SmCyl. The WEH2.0/Cyl example was produced by converting the C2.0/Cone conical bowl-shaped e-zones to elliptical cylinder-shaped e-zones having the same major and minor axis dimensions, along their entire length, as the ellipse at the top of the conical bowl-shaped e-zone in C2.0/Cone. Meanwhile, in the WEH2.0/SmCyl example, a pair of elliptical cylinder-shaped e-zones with uniform major and minor axis dimensions along their entire length was also used, however, the total volume of the e-zones in WEH2.0/SmCyl was kept equal to the volume of the conical bowl-shaped e-zones in C2.0/Cone, but which has major and minor axis dimensions that significantly decrease to near zero moving from the top to bottom of each e-zone. So, the elliptical cylinder-shaped e-zones in WEH2.0/Cyl had the same ellipse dimensions, but uniform along each e-zone's length, thereby producing an overall larger e-zone volume vs. C2.0/Cone. Meanwhile, WEH2.0/SmCyl had the same overall e-zone volume as C2.0/Cone, but smaller and uniform ellipse dimensions vs. C2.0/Cone. But, in both WEH2.0/Cyl and WEH/2.0/SmCyl, the distance (141 m) between wells (i.e., the conductors) and the applied voltage (1,300 V) was kept the same as in C2.0/Cone.

In C2.0/Cone, the average conductance generated by the e-zone configuration (i.e., e-zone geometric shape, spacing, and/or spatial orientation) was 0.56 S, while the average heating power delivered to the targeted formation was 0.96 MW, with an applied voltage of 1,300 V.

In contrast, as discussed more fully below, in WEH2.0/Cyl, the average conductance generated by the e-zone configuration was 0.82 S, while the average heating power delivered to the targeted formation was 1.49 MW, a 50% increase in average heating power, even though the applied voltage was the same. Accordingly, with the increased heating power, more of the applied electric energy is converted to heating the targeted formation.

And in WEH2.0/SmCyl, the average conductance generated by the e-zone configuration was 0.54 S, while the average heating power delivered to the formation was 0.92 MW. These values were similar to the corresponding values for C2.0/Cone. However, as discussed more fully below, WEH2.0/SmCyl generated and distributed heating power substantially diffusely in the target region, while C2.0/Cone generated ineffective asymmetric unidirectional hot spots, which produce non-diffuse heating.

Figure 8:
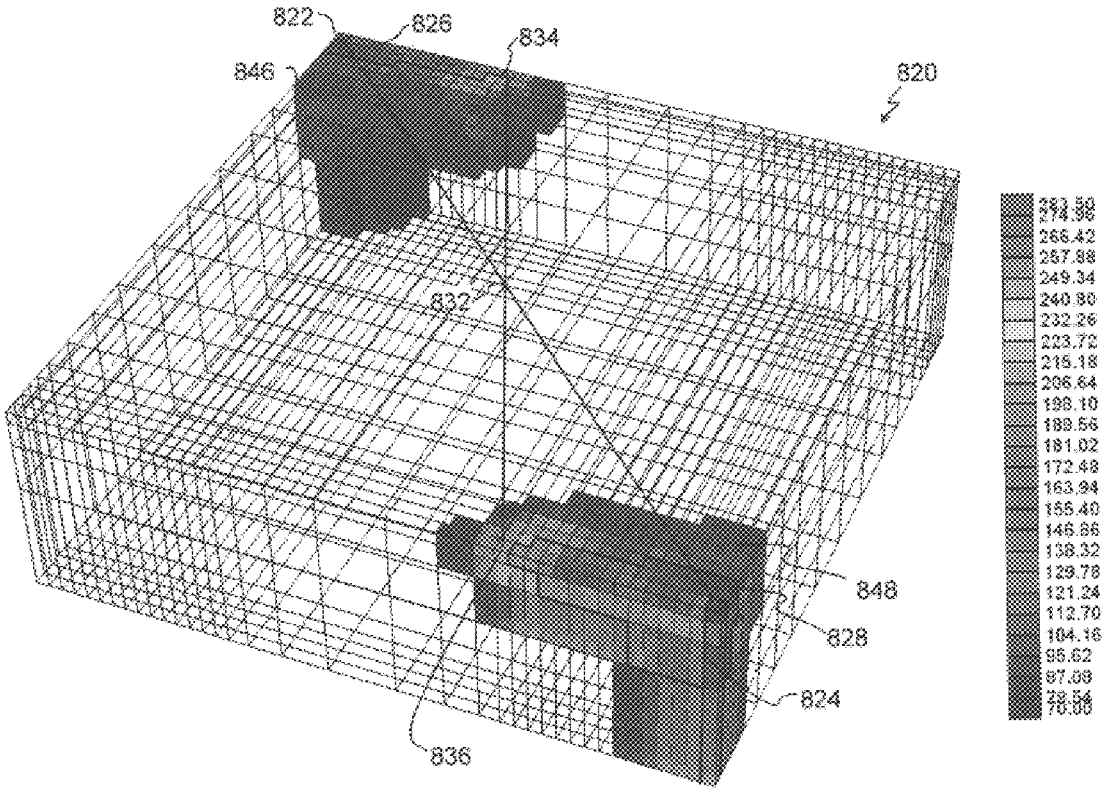
FIG. 8 PRIOR ART
FIG. 8 is a perspective view of a three-dimensional simulated formation used in Comp. Ex. C2.0/Cone illustrating the temperature in blocks of the heated targeted formation volume with color-coding.

Accordingly, after 110 days of conventional electric heating in C2.0/Cone, the onset of water vaporization occurred at a pair of hot spots located in a top layer of the target region. Each hot spot was located near the edge of the ellipse at the top of the conical bowl-shaped e-zone (27 m from the well). But, as illustrated in FIG. 8, because of the spatial orientation of the conical bowl-shaped e-zones, the hot spots were not located along an imaginary well:well line extending between the two wells, 822 and 824. Instead, two hot spots, 834 and 836, were located 55 m from the imaginary well:well line.

More specifically, the spatial orientation of the conical bowl-shaped e-zones and the hot spot location illustrated in FIG. 8 will be described and its concomitant effect on electrically heating the target region discussed accordingly. The simulated formation 820 has a first well 822 at one corner and a second well 824 at a diagonally opposing corner. One quarter of each conical bowl-shaped e-zone 826, 828 is depicted with a bold black boundary in FIG. 8. The geographic mid-point 832 between the two conductors is on an imaginary diagonal well:well line 822–824, extending from each e-zone well 822, 824. Relative to the target region's length, a pair of asymmetric unidirectional hot spots 834, 836 were generated in the top layer of each e-zone 826, 828, i.e., the hot spot pair reside in a single layer of the target region.

As illustrated in FIG. 8, the highest temperature ("HT") region generated by the conventional electric heating was focused in a relatively thin layer of the target region because neither e-zone geometric shape, spacing nor spatial orientation was accounted for in US '809. Accordingly, heat was not evenly distributed at and/or around the mid-point vicinity and, by the onset of water vaporization at 110 days, only 5.3% of the targeted formation volume between the two e-zones was heated to at least 70° C. The heated targeted formation volume 846, 848 at 110 days is color-coded according to temperature in FIG. 8, with its HT region being a relatively small number of orange-zone blocks (about five 2 m×2 m×2 m blocks per e-zone) illustrating the approximate vicinity of each hot spot. But, unlike WEH2.0/Cyl and WEH2.0/SmCyl, no red-zone blocks were generated.

Figure 9A:
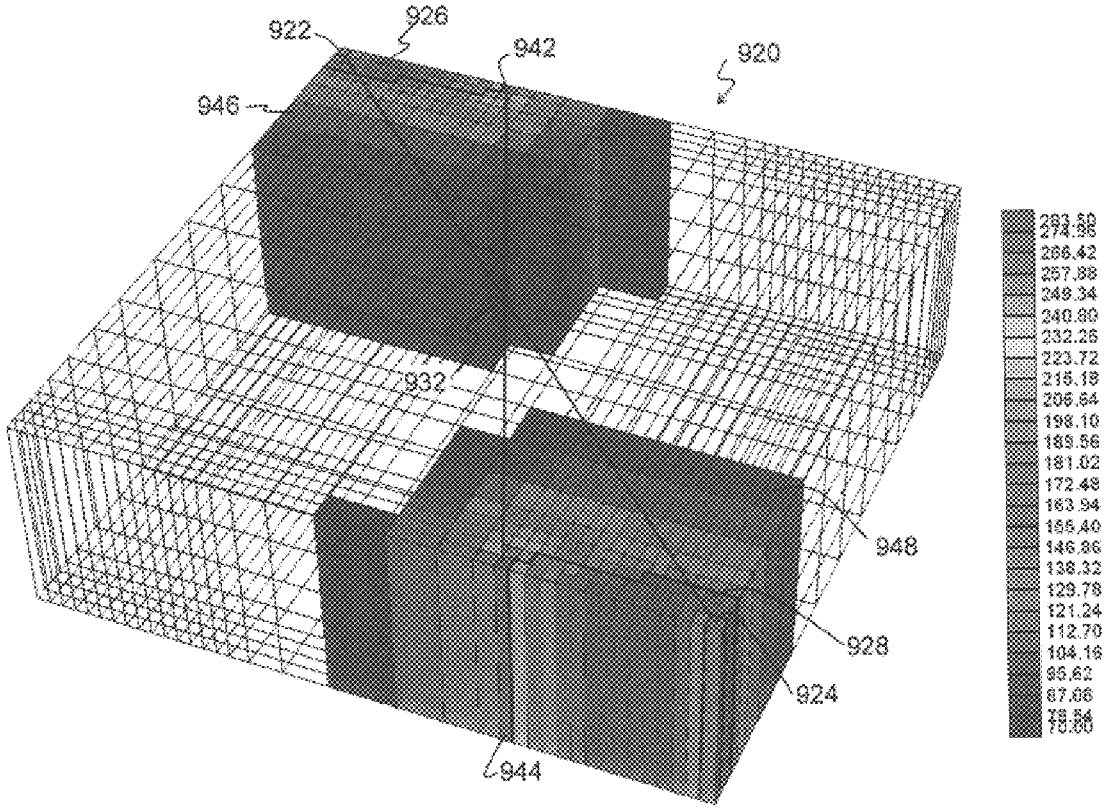
FIG. 9A is a perspective view of a three-dimensional simulated formation used in Ex. WEH2.0/Cyl illustrating the temperature in blocks of the heated targeted formation volume with color-coding.

In contrast, as illustrated in FIG. 9A, discussed more fully below, in WEH2.0/Cyl where the conical bowl-shaped e-zones were converted to elliptical cylinder-shaped e-zones with the same ellipse dimensions, the HT region was located in a localized heating zone coextensive with the target region's length. Accordingly, in WEH2.0/Cyl, by the onset of water vaporization at 280 days, 26.8% of the targeted formation volume between the two e-zones was heated to at least 70° C., more than 5 times the final heated volume in C2.0/Cone. WEH2.0/Cyl's larger heated targeted formation volume 946, 948 at 280 days is color-coded according to temperature in FIG. 9A, with its HT region being illustrated by the equivalent of 162 m×2 m×2 m red-zone blocks per e-zone. Moreover, WEH2.0/Cyl generated an additional equivalent of 642 m×2 m×2 m orange-zone blocks. Accordingly, WEH2.0/Cyl generated a combined total of 80 red-zone and orange-zone 2 m×2 m×2 m blocks, compared with C2.0/Cone's total of five 2 m×2 m×2 m orange-zone blocks.

Figure 9B:
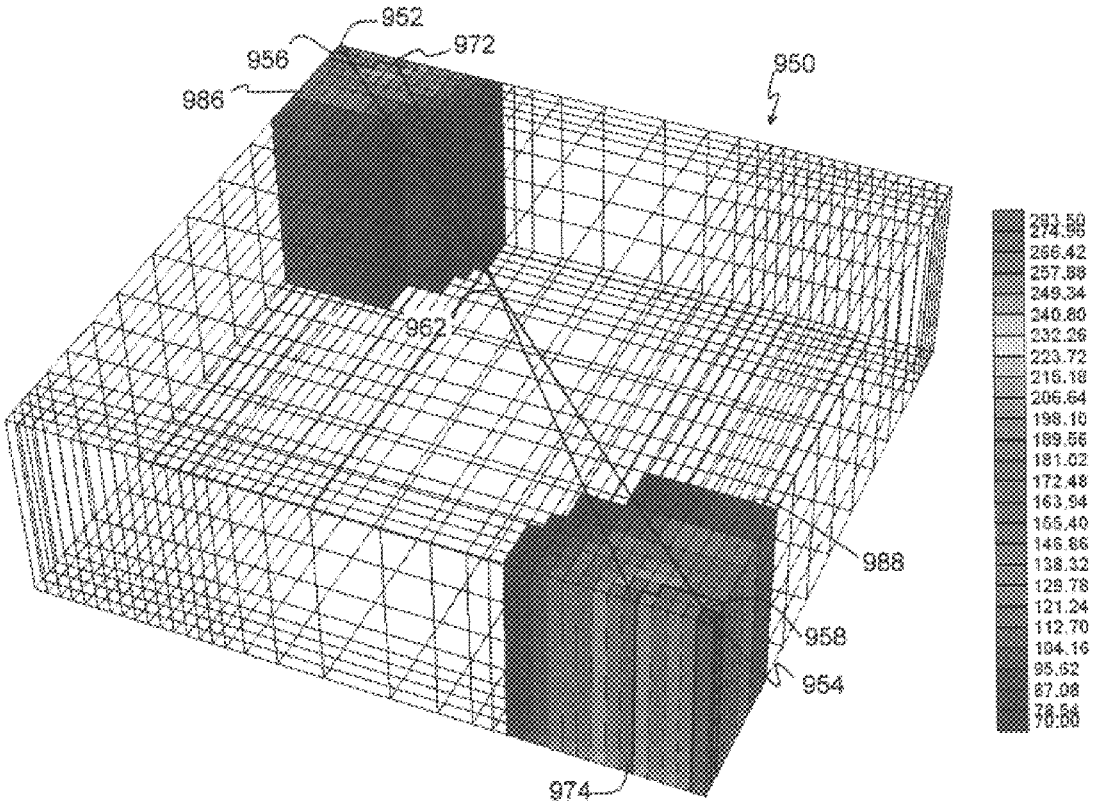
FIG. 9B is a perspective view of a three-dimensional simulated formation used in Ex. WEH2.0/SmCyl illustrating the temperature in blocks of the heated targeted formation volume with color-coding.

And, also in contrast, as illustrated in FIG. 9B, discussed more fully below, in WEH2.0/SmCyl where the conical bowl-shaped e-zones were converted to elliptical cylinder-shaped e-zones having the same volume, the HT region was also located in a localized heating zone coextensive with the target region's length. Accordingly, in WEH2.0/SmCyl, by the onset of water vaporization at 220 days, 11% of the targeted formation volume between the two e-zones was heated to at least 70° C., more than double the final heated volume in C2.0/Cone. WEH2.0/SmCyl's larger heated targeted formation volume 986, 988 at 280 days is color-coded according to temperature in FIG. 9B, with its HT region being illustrated by the equivalent of 162 m×2 m×2 m red-zone blocks per e-zone. Moreover, WEH2.0/SmCyl generated an additional equivalent of 482 m×2 m×2 m orange-zone blocks. Accordingly, WEH2.0/SmCyl generated a combined total of 64 red-zone and orange-zone 2 m×2 m×2 m blocks, compared with C2.0/Cone's total of five 2 m×2 m×2 m orange-zone blocks.

Also, two additional benefits arising from more diffuse heating produced by accounting for e-zone geometric shape, spacing and/or spatial orientation in accordance with the inventive WEH process are demonstrated by comparing the Γ values of the comparative and WEH examples, C2.0/Cone, WEH2.0/Cyl and WEH2.0/SmCyl, respectively.

First, with respect to the absolute Γ values generated in C2.0/Cone with conical bowl-shaped e-zones, the overall $\Gamma_{initial}$ was 143 and the overall $\Gamma_{10\%}$ (measured at 10 days for this example) was 103. In contrast, as discussed below, in WEH2.0/Cyl where the e-zones were converted into elliptical cylinder-shaped e-zones having uniform ellipse dimensions based on C2.0/Cone's maximum ellipse dimensions at the top of its cone, $\Gamma_{initial}$ was 24.9 and $\Gamma_{10\%}$ (measured at 30 days for that example) was 18.5. And, also in contrast, in WEH2.0/SmCyl, where the e-zones were converted into elliptical cylinder-shaped e-zones having the same e-zone volume as C2.0/Cone, $\Gamma_{initial}$ was 68.8 and $\Gamma_{10\%}$ (measured at 20 days for that example) was 55.0. So, in comparing these three examples, we compare $\Gamma_{initial}$ with cylindrical e-zones, 24.9 for same ellipse dimensions as C2.0/Cone's maximum ellipse dimension and 68.8 for same e-zone volume as C2.0/Cone's e-zone volume, which are much closer to the ideal value of 1 or less, versus 143 for $\Gamma_{initial}$ using C2.0/Cone's conical bowl-shaped e-zones, which is comparatively much greater than 1. Accordingly, the inventive WEH process is able to deliver more heat, more quickly at and/or around the mid-point vicinity versus a conventional electric heating process with conical bowl-shaped e-zones.

Second, the inventive WEH process is less dependent on the thermal conduction effect, which again, takes more time to generate a more diffuse heat distribution through the target region. As discussed above, $\Gamma_{initial}$ is primarily an indicator of heating due to electric heating, while the difference between $\Gamma_{initial}$ and $\Gamma_{10\%}$ illustrates, among other things, the effect that thermal conduction has on helping with distributing heat generated by an electric field, while the TCG factor approximates the average rate at which Γ changes per day over the first 10% of the electric heating interval. Consequently, since comparing TCG factor values can provide one basis for assessing the relative contribution thermal conduction makes to producing more diffuse heat distribution, the extent to which each process relies on the thermal conduction effect is illustrated, at least in part, by the magnitude of the TCG factor listed in Table 1A.

So again, in comparing these three examples, in C2.0/Cone, the TCG factor was an average rate of overall Γ change per day=3.99, compared with WEH2.0/Cyl's average rate of Γ change per day=0.21 and WEH2.0/SmCyl's average rate of Γ change per day=0.69, calculated according to Equation (13). Therefore, the US '809 electric heating process relies significantly more on thermal conduction to facilitate its heat distribution as the heat was generated. For this particular comparison, this reliance on thermal conduction was about 6 to 19 times greater versus a pair of conductors with e-zones accounting for e-zone geometric shape and spacing. Or, put another way, the electric field's ability to generate and distribute heat through the target region (i.e., the electric heating distribution effect), in this particular comparison, was about 6 to 19 times more efficient when e-zones were used in accordance with the inventive WEH process, which takes into account e-zone geometric shape, spacing and/or spatial orientation.

Also, the overall Γ values for C2.0/Cone fail to accurately represent the different rates of temperature increase throughout the target region because the HT region was focused in a single top layer of the target region. Accordingly, to more accurately illustrate the non-diffuse heating pattern, the simulated formation in C2.0/Cone was divided into 4 horizontal imaginary layers, by the method described above.

The $\Gamma_{10\%}$ (measured at 10 days for this example) was independently calculated for each of the four layers, according to Equation (7), based on an initial formation temperature of 30° C. The $\Gamma_{10\%}$ values for each layer are presented for C2.0/Cone, as well as other Series 2 conical bowl-shaped e-zone examples, in Table 2.

The maximum and mid-point temperatures ($T_{max}$, $T_{mid}$) for each layer were also determined for each layer at the same time interval. The $T_{max}$ and $T_{mid}$ values for each layer are presented for C2.0/Cone, as well as other Series 2 conical bowl-shaped e-zone examples, in Table 3.

TABLE 3-continued

| Examples | Maximum $T_{max}$, ° C., in Layer (Mid-point $T_{mid}$, ° C., in Layer) $T_{max}$ and $T_{mid}$ measured at 1st 10% of electric heating interval Layers (Thickness) #1 (2 m) | #2 (4 m) | #3 (8 m) | #4 (18 m) | % $T_{max}$ Deviation |
|---|---|---|---|---|---|
| C2.1/Mjr-Cone | 76.6 (31.9) | 54.3 (32.2) | 41.3 (32.0) | 44.4 (31.4) | 46% |
| WEH2.2/Mnr-Cone | 82.0 (31.3) | 60.3 (31.7) | 49.5 (31.7) | 60.0 (31.5) | 40% |
| WEH2.3/SMnr-Cone | 57.6 (49.4) | 62.0 (52.1) | 52.0 (45.0) | 59.2 (35.8) | 16% |
| C2.4/SDiag-Cone | 72.2 (31.2) | 50.7 (31.4) | 40.5 (31.2) | 44.1 (30.8) | 32% |

Γ and temperature values for each layer in C2.0/Cone are presented in Tables 2 and 3, respectively. As discussed above and illustrated in FIG. 9A and 9B, in WEH2.0/Cyl and WEH2.0/SmCyl respectively, heating was uniform parallel to the wells. Accordingly, the %Γ and $\%T_{max}$ deviations were zero for both WEH2.0/Cyl and WEH2.0/SmCyl. Tables 2 and 3 present data for other conical bowl-shaped examples as well. As discussed more fully below, C2.1/Mjr-Cone, WEH2.2/Mnr-Cone, WEH2.3/SMnr-Cone and C2.4/SDiag-Cone are simulations for different spatial orientations and are presented here for completeness. But, as discussed above, %Γ and $\%T_{max}$ deviations are just two indicators of how diffuse heating is in a target region.

For instance, %Γ deviation, standing alone, cannot always indicate how diffuse the heat distribution is for a given e-zone configuration relative to another. For example, although C2.0/Cone and one example of the invention suited for comparison, WEH2.2/Mnr-Cone, have about the same %Γ deviation (73% and 70%, respectively). Nonetheless, the absolute $\Gamma_{10\%}$ range of values for WEH2.2/Mnr-Cone are about 2.5 to about 3.5 times better than C2.0/Cone's absolute $\Gamma_{10\%}$ values. And moreover, as shown in Table 1A, the final heated volume for WEH2.2/Mnr-Cone is about two times the heated volume for C2.0/Cone in approximately the same electric heating time interval.

Likewise, in comparing C2.4/SDiag-Cone versus another example of the invention suited for comparison, WEH2.3/SMnr-Cone, again they have about the same %Γ deviation (76% and 73%, respectively). But, once again, the absolute $\Gamma_{10\%}$ range of values for WEH2.3/SMnr-Cone are about 3.3 to about 26 times better than C2.4/SDiag-Cone's absolute $\Gamma_{10\%}$ values. And, furthermore, as shown in Table 1A, the final heated volume for WEH2.3/SMnr-Cone was about 3

TABLE 2

| Examples | $\Gamma_{10\%}$ in Layer Layers (Thickness) #1 (2 m) | #2 (4 m) | #3 (8 m) | #4 (18 m) | % Γ Deviation |
|---|---|---|---|---|---|
| C2.0/Cone | $\Gamma_{initial}$ = 142.2 $\Gamma_{10\%}$ = 130.6 TCG = 1.16 | $\Gamma_{initial}$ = 65.7 $\Gamma_{10\%}$ = 60.6 TCG = 0.52 | $\Gamma_{initial}$ = 40.4 $\Gamma_{10\%}$ = 35.6 TCG = 0.48 | $\Gamma_{initial}$ = 63.2 $\Gamma_{10\%}$ = 55.1 TCG = 0.81 | 73% |
| WEH2.0/Cyl | $\Gamma_{10\%}$ = 18.5 | $\Gamma_{10\%}$ = 18.5 | $\Gamma_{10\%}$ = 18.5 | $\Gamma_{10\%}$ = 18.5 | 0% |
| WEH2.0/SmCyl | $\Gamma_{10\%}$ = 55.0 | $\Gamma_{10\%}$ = 55.0 | $\Gamma_{10\%}$ = 55.0 | $\Gamma_{10\%}$ = 55.0 | 0% |
| C2.1/Mjr-Cone | $\Gamma_{10\%}$ = 25.1 | $\Gamma_{10\%}$ = 10.9 | $\Gamma_{10\%}$ = 5.1 | $\Gamma_{10\%}$ = 9.9 | 77% |
| WEH2.2/Mnr-Cone | $\Gamma_{10\%}$ = 39.5 | $\Gamma_{10\%}$ = 17.9 | $\Gamma_{10\%}$ = 11.7 | $\Gamma_{10\%}$ = 20.2 | 70% |
| WEH2.3/SMnr-Cone | $\Gamma_{10\%}$ = 1.4 | $\Gamma_{10\%}$ = 1.4 | $\Gamma_{10\%}$ = 1.5 | $\Gamma_{10\%}$ = 5.1 | 73% |
| C2.4/SDiag-Cone | $\Gamma_{10\%}$ = 36.0 | $\Gamma_{10\%}$ = 15.1 | $\Gamma_{10\%}$ = 8.6 | $\Gamma_{10\%}$ = 16.9 | 76% |

TABLE 3

| Examples | Maximum $T_{max}$, ° C., in Layer (Mid-point $T_{mid}$, ° C., in Layer) $T_{max}$ and $T_{mid}$ measured at 1st 10% of electric heating interval Layers (Thickness) #1 (2 m) | #2 (4 m) | #3 (8 m) | #4 (18 m) | % $T_{max}$ Deviation |
|---|---|---|---|---|---|
| C2.0/Cone | 82.3 (30.4) | 60.7 (30.5) | 48.0 (30.5) | 56.3 (30.4) | 42% |
| WEH2.0/Cyl | 83.8 (32.9) | 83.8 (32.9) | 83.8 (32.9) | 83.8 (32.9) | 0% |
| WEH2.0/SmCyl | 77.3 (30.9) | 77.3 (30.9) | 77.3 (30.9) | 77.3 (30.9) | 0% |

times the heated volume for C2.4/SDiag-Cone in approximately the same electric heating time interval.

Therefore, there are a number of factors, both qualitative and quantitative, beyond %Γ and $\%T_{max}$ deviations, that should be assessed to evaluate heating performance and, most particularly, the relative differences in how diffuse the heat distribution is for different choices of e-zone geometric shape, spacing and/or spatial orientation.

So, with this point in mind, the results provided in Table 2 help demonstrate the asymmetric unidirectional heating in C2.0/Cone generated by a pair of hot spots in a single top layer of the target region. Specifically, as shown in Table 2, based on the temperature distribution data from the simulation study for C2.0/Cone, the highest $\Gamma_{10\%}$, $\Gamma_{max}$, was 131 in Layer #1 (2 m thick) and the lowest $\Gamma_{10\%}$, $\Gamma_{min}$, was 55 in Layer #3 (8 m thick). Accordingly, the %Γ deviation was 73%, calculated according to Equation (5).

Meanwhile, as discussed above, in WEH2.2/Mnr-Cone, the $\Gamma_{10\%}$ values were improved by about 2.5 to about 3.5 times, by modifying the spatial orientation, that is aligning the minor axes of each e-zone cone's ellipse, even though the %Γ deviation only decreased slightly to about 70%. Nonetheless, the substantial and consistent decrease of $\Gamma_{10\%}$ values across all four layers is one indication of how e-zone spatial orientation can positively and significantly effect electric heating performance. And certainly, the heating performance can be even more significantly improved to produce a truly surprising and unexpected result when the conical shape is modified to an elliptical cylinder-shaped e-zone, as in the case of WEH2.0/Cyl and WEH2.0/SmCyl. In each of those cases not only are the $\Gamma_{10\%}$ values significantly improved, excepting layer #4 for WEH2.0/SmCyl where it remained about the same, but the %Γ deviation goes to zero. This heating performance result is both material and most significant.

Table 3 also further demonstrates the asymmetric unidirectional heating in C2.0/Cone generated by a pair of hot spots in a single top layer of the target region. Specifically, this is illustrated by the significantly lower $T_{max}$ temperatures in Layers #2, #3 and #4 ranging from 48° C. to 61° C. versus 82° C. in Layer #1. Also, as demonstrated in Table 3, the mid-point temperatures in each layer were 30.4° C. and 30.5° C., substantially unchanged from the initial temperature of 30° C. Also, as shown in Table 3, the highest $T_{max}$ value, $T_{max-high}$=82° C., was located in Layer #1 and the lowest $T_{max}$ value, $T_{max-low}$=48° C., was located in Layer #3. Accordingly, the $\%T_{max}$ deviation for C2.0/Cone was 42%, calculated according to Equation (6).

In contrast, in both WEH2.0/Cyl and WEH2.0/SmCyl, the $\%T_{max}$ deviation was zero. In another comparison to C2.0/Cone ($\%T_{max}$ deviation=42%), when the spatial orientation was modified in WEH2.3/Mnr-Cone to align the minor axes of each e-zone cone's ellipse, the $\%T_{max}$ deviation only decreased slightly to about 40%. And there was slight improvement in WEH2.3/Mnr-Cone's absolute $T_{max}$ and $T_{mid}$ values, particularly in the lower layers.

But, in comparing C2.4/SDiag-Cone and one of its WEH counterpart examples, WEH2.3/SMnr-Cone, the $\%T_{max}$ deviation was reduced by half from 32% for C2.4/SDiag-Cone to 16% for WEH2.3/SMnr-Cone. Moreover, by modifying the spatial orientation, the mid-point temperature in all layers increased significantly. Most significantly, for WEH2.3/SMnr-Cone, the mid-point temperature in Layer #1 was 49.4° C., while for C2.4/SDiag-Cone the mid-point temperature in Layer #1 was 31.2° C. Accordingly, the heat distribution was more diffuse in WEH2.3/SMnr-Cone where e-zone spatial orientation was accounted for. This is substantial evidence of how spatial orientation of e-zones can significantly affect the electric heating distribution effect.

Turning now to the HV factor (Equation 11), which is a normalized volume heated to a temperature in the range of 50° C. to 70° C., C2.0/Cone's HV factor was 2, while for WEH2.0/Cyl and WEH2.0/SmCyl, the HV factor was 4 in both cases, twice the HV factor for C2.0/Cone. Accordingly, even though the $\Gamma_{10\%}$ values for C2.0/Cone indicated an improved heating rate due to thermal conduction, the normalized volume heated to 50° C. to 70° C. was 50% less than for WEH2.0/Cyl and WEH2.0/SmCyl. Thus, in view of this significant improvement in HV factor, WEH2.0/Cyl demonstrates that the inventive WEH process delivered more electric heating power (i.e., more heat generated per V applied), and both WEH2.0/Cyl and WEH2.0/SmCyl each independently demonstrate more diffuse heat distribution throughout the targeted formation, as compared to the conventional electric heating process in C2.0/Cone. Again, conventional electric heating processes generate heat in a much smaller volume and then rely significantly more on thermal conduction to distribute heat into and/or around the target region. In turn, this significant TC contribution increases the time required to heat a larger portion of the target region and decreases the percentage of the target region that is ultimately heated to some predetermined temperature threshold (e.g., T≧70° C., in this case). Therefore, the HV factor is generally lower for a conventional electric heating process relative to a WEH process for a similar well configuration.

Turning now to the %Γ and $\%T_{max}$ deviations, the %Γ deviation for C2.0/Cone was 73% and the $\%T_{max}$ deviation was 42% because the heating was focused at hot spots in the top layer, which interfaced with overburden, and thereby further contributed to significant heat loss to the overburden, beyond providing primarily asymmetric unidirectional heating of the target region from the top downward. In contrast, in WEH2.0/Cyl and WEH2.0/SmCyl, both the %Γdeviation and $\%T_{max}$ deviation were zero for both examples and provided more symmetric multidirectional heating of the target region.

Also, because C2.0/Cone's hot spots were located in the same layer of the target region, the HTP factor was 6. In contrast, in WEH2.0/Cyl and WEH2.0/SmCyl, the HT regions were in localized heating zones co-extensive with the target region. Accordingly, WEH2.0/Cyl's HTP factor was 96 and WEH2.0/SmCyl's HTP factor was 71. These HTP measurements are significant technical evidence that the conventional electric heating process distributed little or no heat at and/or around the target region's mid-points line, while the inventive WEH process provides substantially more heat to the target region's mid-points line.

Accordingly, C2.0/Cone's composite score for heating performance was 95, calculated according to Equation (12), which is significantly less than 304 and 279, the composite scores for WEH2.0/Cyl and WEH2.0/SmCyl, respectively, further demonstrating the comparatively more diffuse heat distribution generated with e-zones in accordance with the inventive WEH process. The composite scores for these and other examples, as well as their respective component factors, are summarized in Table 1B.

C2.0/Cone, therefore, illustrates how conventional electric heating processes, like that described in US '809, have failed to appreciate the importance of using a suitable combination of e-zone spacing, geometric shape and/or spatial orientation to generate significantly improved electric heating rates and distribution between e-zones vs. the heating rates and distribution generated by conventional electric heating methods. Moreover, C2.0/Cone also illustrates the asymmetric unidirectional heating provided by a pair of hot spots located in a single layer of the target region.

Finally, we now turn to an explanation for the difference in C2.0/Cone's overall TCG factor vs. the TCG factors calculated for each of its respective layers. As discussed above, the TCG factor is the average rate at which Γ changes ($\Gamma_{initial}-\Gamma_{10\%}$) per day over the first 10% of the electric heating interval, calculated according to Equation (13). In Table lA, C2.0/Cone's overall TCG factorwas 3.99. But, as shown in Table 2, the TCG factor for each layer in C2.0/Cone was in a range from 0.48 (Layer #3) to 1.16 (Layer #1), significantly lower than its overall TCG factor=3.99. The difference in values for the target region's overall TCG factor (3.99) versus the TCG factor for Layer#1 of the same target region (1.16) can be explained as follows.

Each TCG factor requires the respective $\Gamma_{initial}$ and $\Gamma_{10\%}$ values and, in turn, each type of Γ value is calculated based on $T_{max}$, $T_{mid}$ and $T_{initial}$ values, specifically recall, $\Gamma=(T_{max}-T_{initial})\div(T_{mid}-T_{initial})$. So, in calculating C2.0/Cone's overall $\Gamma_{10\%}$ used for determining its overall TCG factor, $T_{max}$ (82.3° C.) was at the hot spot in Layer #1 and $T_{mid}$ (30.5° C.) was obtained from the target region's mid-point in Layer #3 (although not necessarily coincident with Layer #3's mid-point). Meanwhile, when calculating the Layer #1 TCG factor, $T_{mid}$ (30.4° C.) was obtained from Layer #1's mid-point, instead of the target region's mid-point, which happens to be in Layer #3. But, even though there was more heating in Layer #1, albeit at hot spots, heat loss to the overburden above the target region became more pronounced in Layer #1 than in Layer #3 because Layer #1 directly contacts the overburden. Therefore, $T_{mid}$ at Layer #1's mid-point was lower than $T_{mid}$ at the target region's mid-point. So, even though the $T_{max}$ used in calculating $\Gamma_{10\%}$ for both the target region overall and its Layer #1 was the same, the target region's overall $\Gamma_{10\%}$ (103) is smaller vs. Layer #1's $\Gamma_{10\%}$ (131), due to a higher overall $T_{mid}$ value (30.5° C.) vs. Layer #1's lower $T_{mid}$ value (30.4° C.). And although this difference appears to be slight, its significance is magnified since the $T_{mid}$ value is offset by the $T_{initial}$ value (30° C.) in the denominator of the Γ calculation noted above. Hence, the relative TCG factor is less for Layer #1 than the target region's overall TCG factor, since $\Gamma_{initial}$ for both Layer #1 and the target region overall are about equal, 142 and 143, respectively.

Comparative Example C2.0/BVrt

The conductor orientation for C2.0/BVrt was the same as for C2.0/Cone. But no e-zones were established around the C2.0/BVrt conductors. Accordingly, the bare conductors were 32 m long and spaced 141 m apart.

The average conductance in C2.0/BVrt was 0.22 S, which is 61% less than the average conductance in C2.0/Cone (0.56 S). The average heating power delivered to the targeted formation was 0.37 MW.

$\Gamma_{initial}$ measured at 1 day as standard procedure, was 17,151. As shown in Table 1A, Plo% was the same. The same values were recorded for both $\Gamma_{initial}$ and $\Gamma_{10\%}$ because water vaporization occurred at 2.6 days. Therefore, $\Gamma_{10\%}$ should have been determined from data at 10% of the electric heating interval, i.e., 0.26 days. But then $\Gamma_{10\%}$ would have to be determined from data obtained prior to the data used to calculate $\Gamma_{10\%}$. Accordingly, the values for both $\Gamma_{initial}$ and $\Gamma_{10\%}$ were shown to be the same and the TCG factor was zero in Table 1A.

The heating rate was significantly faster in C2.0/BVrt than in C2.0/Cone. For example, in C2.0/BVrt, it took only 2.6 days to vaporize water at the wells. But the heating was focused at the conductors (i.e., hot conductors), thereby immediately disrupting electrical connectivity. By the time connectivity was disrupted, only 0.04% of the formation volume was heated to a temperature greater than or equal to 70° C. But, in C2.0/Cone, the final heated volume was 5.26% at 110 days. Accordingly, some improvement was realized by the conical bowl-shaped e-zones generated in C2.0/Cone. However, as demonstrated below, the inventive WEH process provides a much more significant improvement than the process described in US '809.

Comparative Example C2.0/ConeEFC

C2.0/ConeEFC was conducted to determine whether non-uniformities in e-zone geometric shape could be offset by increasing the electrolytic fluid electrical conductivity ("EFC") in the portion of the e-zone where e-zone spacing is larger. C2.0/ConeEFC was run with the same well configuration and conical bowl-shaped e-zones as in C2.0/Cone. The applied voltage was also the same.

However, the electrolytic fluid electrical conductivity in the C2.0/ConeEFC e-zone was different for four horizontal layers in the C2.0/ConeEFC e-zone, while in C2.0/Cone, the electrolytic fluid electrical conductivity was 2.5 S/m throughout the conical bowl-shaped e-zones. Specifically, in C2.0/ConeEFC, the electrical conductivity for the top layer (2 m deep) was 2.55 S/m, 3.09 S/m in an upper intermediate layer (4 m deep) below the top layer, 3.63 S/m in a lower intermediate layer (8 m deep) and 4.20 S/m in the bottom layer (18 m deep). The change in the electrical conductivity was produced in the e-zone only, not in the target region between the e-zones.

The average conductance was the same for both C2.0/Cone and C2.0/ConeEFC. The 20-day, 60-day and final heated volumes, as well as the days to water vaporization, were similar for both C2.0/Cone and C2.0/ConeEFC.

As well, in C2.0/ConeEFC, the HT region was focused at a pair of hot spots, each located approximately at the same location as in C2.0/Cone (27 m from the well, 55 m from mid-point), illustrated in FIG. 8. Again, the pair of hot spots was located in a single layer at the top of the target region. Therefore, the higher electrolytic fluid electrical conductivity at the bottom of the C2.0/ConeEFC conical bowl-shaped e-zones did not affect the heating rate or distribution in the bottom part of the target region, as compared with C2/Cone.

Also, in C2.0/ConeEFC, $\Gamma_{initial}$ was 145.4 and $\Gamma_{10\%}$ (measured at 10 days for this example) was 104.8. The C2.0/ConeEFC Γ values were similar to those for C2.0/Cone ($\Gamma_{initial}$=143.1 and $\Gamma_{10\%}$ (also measured at 10 days for that example) was 103.2. Accordingly, the TCG factors for C2.0/Cone (3.99) and C2.0/ConeEFC (4.07) were also similar.

C2.0/ConeEFC illustrates that the e-zone geometry has a greater effect on heating than does the electrolytic fluid conductivity. In other words, an increase in electrolytic fluid conductivity in a portion of an e-zone does not overcome non-uniformities in e-zone size or geometric shape at that portion. This is a surprising result because a person skilled in the art would have expected that increased electrolytic fluid electrical conductivity would have resulted in a more effective electrode. Accordingly, a person skilled in the art would have expected the bottom layer having higher electrolytic fluid electric conductivity in C2.0/ConeEFC to behave as a better electrode than the top layer where fluid electric conductivity was lower. But, the increased fluid electric conductivity was not sufficient to overcome the e-zone geometric shape, e-zone spacing and spatial orientation deficiencies in C2.0/Cone.

Example WEH2.0/Cyl

The conical bowl-shaped e-zones in C2.0/Cone were converted to elliptical cylinder-shaped e-zones in WEH2.0/Cyl with the same ellipse dimensions as the ellipse at the top of the C2.0/Cone conical bowl-shaped e-zones to illustrate the benefits of accounting for e-zone geometric shape and spacing. Because the top of Hagedorn's conical bowl CSS steam zone had a major axis of 54 m and a minor axis of 10 m at the top of the conical bowl, the elliptical cylinder-shaped e-zones for WEH2.0/Cyl had a 54 m major axis and a 10 m minor axis for the entire length of the e-zone (32 m). Therefore, the spacing between e-zones was the same at the top of both pairs of e-zones. But, in WEH2.0/Cyl, the e-zone spacing was uniform along the length of the target region, whereas, in C2.0/Cone, the e-zone spacing was not uniform. The distance between wells (141 m), formation pressure (3.1 MPa) and applied voltage (1,300 V) was the same as in C2.0/Cone.

The average conductance in WEH2.0/Cyl was 0.8 S, representing an increase of about 46%, as compared with C2.0/Cone (0.56 m). The increased conductance resulted from changing the e-zone geometric shape from a non-uniform conical bowl shape to a more uniform substantially elliptical cylinder shape.

Initially, no portion of the formation in WEH2.0/Cyl reached 70° C. after 20 days. At first glance, this would appear to suggest that the heating rate for the pair of substantially elliptical cylinder-shaped e-zones was lower than for the pair of conical bowl-shaped e-zones in C2.0/Cone. But, as demonstrated by the final heated volume, the heating was more diffuse and more uniform in the target region between the elliptical cylinder-shaped e-zones in WEH2.0/Cyl, as compared with C2.0/Cone where any heating was focused near the point sources at the facing elliptical top surfaces of the conical bowl-shaped e-zones. So, although the initial heating rate appeared to be faster in C2.0/Cone, the heating power was less and the heating was focused at a pair of asymmetric unidirectional hot spots in a single layer of the target region.

But, in WEH2.0/Cyl, the HT region was located in a localized heating zone coextensive with the target region, as illustrated in FIG. 9A. The simulated formation 920 has a first well 922 at one corner and a second well 924 at a diagonally opposing corner. One quarter of each elliptical cylinder-shaped e-zone 926, 928 is depicted in FIG. 9A. The geographic mid-point 932 between the two conductors is on an imaginary diagonal well:well line 922–924 connecting the two conductors 922, 924. Localized heating zones 942, 944 were generated symmetrically at the perimeter of each e-zone 926, 928 and coextensive with the target region.

The more diffuse and uniform heating in WEH2.0/Cyl is further evident by comparing the 26.8% final heated volume for WEH2.0/Cyl with the 5.3% final heated volume for C2.0/Cone. This final heated volume comparison is also graphically illustrated by comparing FIG. 8 for C2.0/Cone with FIG. 9A for WEH2.0/Cyl. Thus, by converting the conical bowl-shaped e-zone (C2.0/Cone) to a substantially elliptical cylinder-shaped e-zone (WEH2.0/Cyl), the final heated volume was increased by about 5 times and the days to onset of water vaporization increased from 110 days to 280 days.

The average heating power was 1.49 MW in WEH2.0/Cyl, compared with 0.96 MW in C2.0/Cone, even though the applied voltage was the same (1,300 V). Moreover, the lower volume heated to at least 70° C. at 20 days and 60 days, combined with the significantly higher final heated volume in WEH2.0/Cyl demonstrates that the heating power was more diffusely distributed in WEH2.0/Cyl than it was in C2.0/Cone. And, even though the localized heating zone in WEH2.0/Cyl was still 27 m from the well and 55 m from the mid-point, the localized heating zone was coextensive with the well, instead of being focused at a pair of hot spots located in single layer, namely Layer #1 in C2.0/Cone.

With respect to the absolute values generated, in WEH2.0/Cyl, $\Gamma_{initial}$ was 24.9 and $\Gamma_{10\%}$ (measured at 30 days for this example) was 18.5. In contrast, as discussed above, in C2.0/Cone, $\Gamma_{initial}$ was 143.1 and $\Gamma_{10\%}$ (measured at 10 days for that example) was 103.2. So, in comparing these two examples, we compare $\Gamma_{initial}$ with elliptical cylinder-shaped e-zones having the same ellipse dimensions, 24.9, which is much closer to the ideal value of 1 or less, versus 143.1 for $\Gamma_{initial}$ for conical bowl-shaped e-zones, which is comparatively much greater than 1. Accordingly, the inventive WEH process is able to deliver more heat, more quickly at and/or around the mid-point vicinity versus a conventional electric heating process that fails to account for e-zone geometric shape, spacing and spatial orientation.

And, with respect to the TCG factors, in WEH2.0/Cyl, the TCG factor was an average rate of Γ change per day=0.21, compared with an average rate of Γ change per day=3.99 for C2.0/Cone. Therefore, the US '809 process3 reliance on thermal conduction, in this particular comparison, was about 19 times greater versus a pair of conductors with e-zones accounting for e-zone geometric shape and spacing. Or, put another way, the electric field's ability to generate and distribute heat through the target region (i.e., the electric heating distribution effect), in this particular comparison, was about 19 times more efficient when e-zones were used in accordance with the inventive WEH process, which takes into account e-zone geometric shape, spacing and/or spatial orientation.

Moreover, the HV factor calculated according to Equation (11), was 4 in WEH2.0/Cyl, while for C2.0/Cone, the HV factor was 2, 50% less than for WEH2.0/Cyl. This further demonstrates that the inventive WEH process delivered more electric heating power throughout the targeted formation, as compared to the conventional electric heating process in C2.0/Cone, which, again, significantly relies on thermal conduction to distribute heat into the target region. Therefore, the HV factor is generally higher for a WEH process relative to a conventional electric heating process for a similar well configuration.

Furthermore, in WEH2.0/Cyl, the %Γ deviation was zero and the $\%T_{max}$ deviation was also zero because the temperature profile in the target region was substantially uniform parallel to the conductors. the localized heating zone was located 27 m from the well (distance between wells=141 m). However, the localized heating zone was off-set from the well:well line, so that the hot spot was located 55 m from the mid-point. Therefore, the HTP factor was 96, calculated according to Equation (8), significantly higher than the HTP factor of 6 for C2.0/Cone.

Accordingly, WEH2.0/Cyl's composite score for heating performance was 304, calculated according to Equation (12), which is significantly greater than 95, the C2.0/Cone's composite score, demonstrating WEH2.0/Cyl's comparatively more diffuse heat distribution generated with e-zones accounting for e-zone geometric shape and spacing. The composite score for these and other examples, as well as their respective composite factors, are summarized in Table 1B.

Example WEH2.0/SmCyl

The conical bowl-shaped e-zones in C2.0/Cone were converted to elliptical cylinder-shaped e-zones in WEH2.0/SmCyl with the same e-zone volume as the C2.0/Cone conical bowl-shaped e-zones to further illustrate the benefits of accounting for e-zone geometric shape and spacing. Because Hagedorn's conical bowl CSS steam zone had a volume of 2,176 $m^3$, the elliptical cylinder-shaped e-zones for WEH2.0/SmCyl had a major axis of 20 m and a minor axis of 8 m for the entire length of the e-zone (32 m). Accordingly, the e-zone spacing was uniform throughout the target region in WEH2.0/SmCyl. However, the e-zone spacing at the top of the C2.0/Cone e-zones was significantly less (54 m major axis, 10 m minor axis at top). The distance between wells (141 m), formation pressure (3.1 MPa) and applied voltage (1,300 V) was the same as in C2.0/Cone.

The average conductance in WEH2.0/SmCyl was 0.54 S, similar to the average conductance for C2.0/Cone (0.56 m). The average heating power was 0.92 MW in WEH2.0/SmCyl, also similar to 0.96 MW in C2.0/Cone.

In WEH2.0/SmCyl, only 0.08% of the targeted formation was heated to at least 70° C. after 20 days of heating, whereas 0.17% of the targeted volume was heated in C2.0/Cone. And, after 60 days, 2.44% of the targeted formation was heated to at least 70° C. in WEH2.0/SmCyl, similar to the heated volume of 2.45% in C2.0/Cone. But the final heated volume in WEH2.0/SmCyl was 10.96%, compared to 5.26% for C2.0/Cyl, demonstrating that heating was more diffuse and more uniform in the target region between the elliptical cylinder-shaped e-zones in WEH2.0/SmCyl, as compared with C2.0/Cone where any heating was focused near the point sources at the facing elliptical top surfaces of the conical bowl-shaped e-zones.

In WEH2.0/SmCyl, the HT region was located in a localized heating zone coextensive with the target region, as illustrated in FIG. 9B. The simulated formation 950 has a first well 952 at one corner and a second well 954 at a diagonally opposing corner. One quarter of each elliptical cylinder-shaped e-zone 956, 958 is depicted in FIG. 9B. The geographic mid-point 962 between the two conductors is on an imaginary diagonal well:well line 952–954 connecting the two conductors 952, 954. Localized heating zones 972, 974 were generated symmetrically at the perimeter of each e-zone 956, 958 and coextensive with the target region.

The more uniform heating in WEH2.0/SmCyl is further evident by comparing FIG. 8 for C2.0/Cone with FIG. 9B for WEH2.0/SmCyl. Thus, by converting the conical bowl-shaped e-zone (C2.0/Cone) to a substantially elliptical cylinder-shaped e-zone (WEH2.0/SmCyl), the final heated volume was about double and the days to onset of water vaporization increased from 110 days to 220 days.

In WEH2.0/SmCyl, the HT region was projected outward from the well in a localized heating zone 11 m from the well and 63 m from the mid-point, coextensive with the well, instead of being focused at a pair of hot spots located in single layer, namely Layer #1, in C2.0/Cone.

With respect to the absolute values generated, in WEH2.0/SmCyl, $\Gamma_{initial}$ was 68.8 and $\Gamma_{10\%}$ (measured at 20 days for this example) was 55.0. In contrast, as discussed above, in C2.0/Cone, $\Gamma_{initial}$ was 143.1 and $\Gamma_{10\%}$ (measured at 10 days for that example) was 103.2. So, in comparing these two examples, we compare $\Gamma_{initial}$ with elliptical cylinder-shaped e-zones having the same e-zone volume, 68.8, which is much closer to the ideal value of 1 or less, versus 143.1 for $\Gamma_{initial}$ for conical bowl-shaped e-zones, which is comparatively much greater than 1. Accordingly, the inventive WEH process is able to deliver more heat, more quickly at and/or around the mid-point vicinity versus a conventional electric heating process that fails to account for e-zone geometric shape, spacing and spatial orientation.

And, with respect to the TCG factors, in WEH2.0/SmCyl, the TCG factor was an average rate of Γ change per day=0.69, compared with an average rate of Γ change per day=3.99 for C2.0/Cone. Therefore, the US '809 process' reliance on thermal conduction, in this particular comparison, was about 6 times greater versus a pair of conductors with e-zones accounting for e-zone geometric shape and spacing. Or, put another way, the electric field's ability to generate and distribute heat through the target region (i.e., the electric heating distribution effect), in this particular comparison, was about 6 times more efficient when e-zones were used in accordance with the inventive WEH process, which takes into account e-zone geometric shape, spacing and/or spatial orientation.

Moreover, the HV factor calculated according to Equation (11), was 4 in WEH2.0/SmCyl, while for C2.0/Cone, the HV factor was 2, 50% less than for WEH2.0/SmCyl. This further demonstrates that, even at the same heating power, the inventive WEH process generated a more diffuse heat distribution, as compared to the conventional electric heating process in C2.0/Cone, which, again, significantly relies on thermal conduction to distribute heat into the target region. Therefore, the HV factor is generally higher for a WEH process relative to a conventional electric heating process for a similar well configuration.

Furthermore, in WEH2.0/SmCyl, the %Γ deviation was zero and the $\%T_{max}$ deviation was also zero because the temperature profile in the target region was substantially uniform parallel to the conductors. The localized heating zone was located 11 m from the well (distance between wells=141 m). However, the localized heating zone was off-set from the diagonal well:well line, so that the hot spot was located 63 m from the mid-point. Therefore, the HTP factor was 71, calculated according to Equation (8), significantly higher than the HTP factor of 6 for C2.0/Cone.

Accordingly, WEH2.0/SmCyl's composite score for heating performance was 279, calculated according to Equation (12), which is significantly greater than 95, the C2.0/Cone's composite score, demonstrating WEH2.0/SmCyl's comparatively more diffuse heat distribution generated with e-zones accounting for e-zone geometric shape and spacing. The composite score for these and other examples, as well as their respective composite factors, are summarized in Table 1B.

Example WEH2.0/InvCone

WEH2.0/InvCone was conducted to determine whether non-uniformities in e-zone geometric shape could be overcome by changing the relative geometry between two e-zones. The vertical pair of conical bowl-shaped e-zones from C2.0/Cone were used in this reservoir simulation. But in WEH2.0/InvCone, one of the conical bowl-shaped e-zones was inverted so that the top of the first conical bowl-shaped e-zone faced the bottom of the second conical bowl-shaped e-zone and vice versa.

Figure 10:
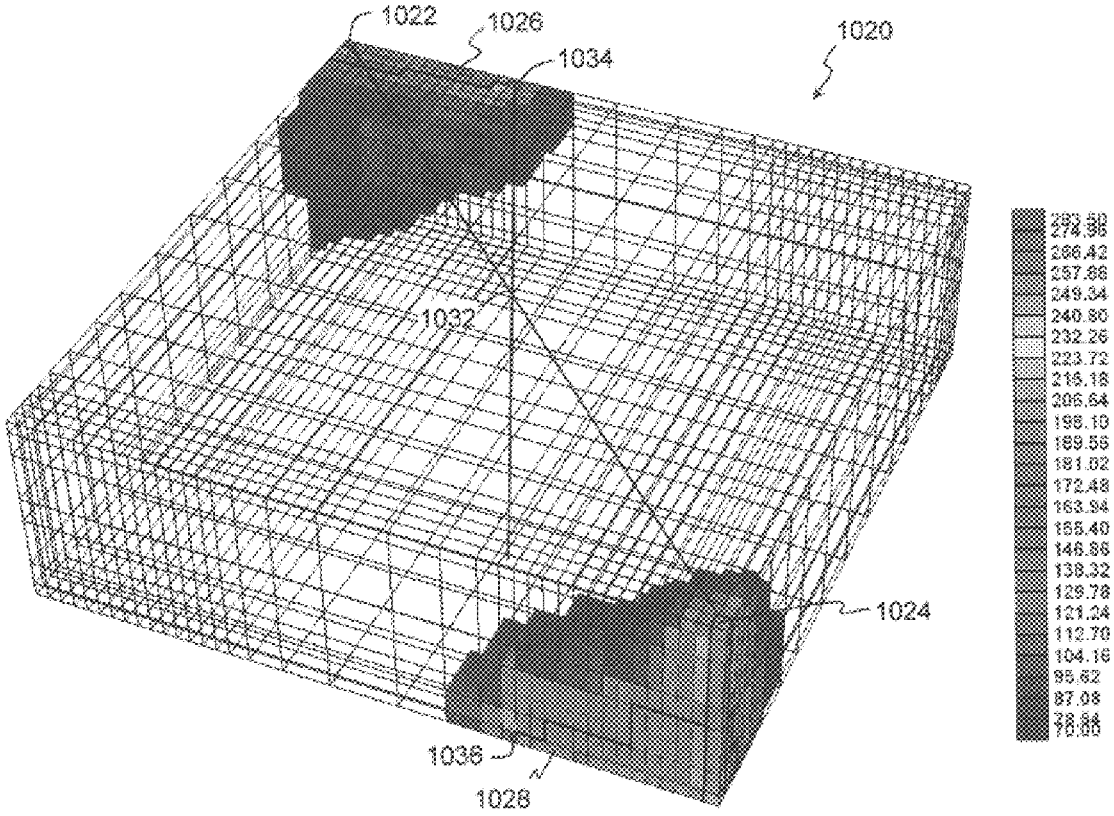
FIG. 10 is a perspective view of a three-dimensional simulated formation used in Ex. WEH2.0/InvCone illustrating the temperature in blocks of the heated targeted formation volume with color-coding.

Accordingly, the relative e-zone geometric shape provided some curvature complementarity between opposing e-zone faces. Although the e-zone spacing was more uniform than in C2.0/Cone, the e-zone spacing was still larger in the middle portion of the e-zones where the conical bowl shapes were concave, as shown in FIG. 10.

The average conductance was 0.57 S and the average power was 0.97 MW, similar to C2.0/Cone (0.56 S, 0.96

MW). And the heated formation volume was about the same for 20 days (0.18% for WEH2.0/InvCone, 0.17% for C2.0/Cone) and 60 days (2.6% for WEH2.0/InvCone, 2.5% for C2.0/Cone). But the days to onset of water vaporization increased from 110 days (C2.0/Cone) to 140 days (WEH2.0/InvCone). So heating continued for a longer period of time, thereby increasing the final heated volume by 36% to 7.2%, compared to 5.3% for C2.0/Cone.

One significant improvement provided by the inverted cone in WEH2.0/InvCone was symmetric multidirectional heating provided by redistributed hot spots. In contrast, C2.0/Cone generated asymmetric unidirectional heating.

As discussed above, C2.0/Cone generated a pair of hot spots in a single layer of the target region. Accordingly, electric heating was focused in relatively smaller portions of the top layer of the target region and any heating in other layers was caused primarily by thermal conduction from one direction, i.e., from the top of the target region.

But, while two hot spots were generated in WEH2.0/InvCone, each 27 m from the well and 55 m from mid-point between wells, one hot spot was located in the top layer of the target region and the other hot spot was located in the bottom layer of the target region, as illustrated in FIG. 10. The simulated formation 1020 has a first well 1022 at one corner and a second well 1024 at a diagonally opposing corner. One quarter of the conical bowl-shaped e-zone 1026 and one quarter of the inverted conical bowl-shaped e-zone 1028 are depicted in FIG. 10. The geographic mid-point 1032 between the two conductors is on an imaginary well-:well line 1022–1024 connecting the two conductors 1022, 1024. One hot spot 1034 was generated at the top perimeter of e-zone 1026 and the other hot spot 1036 was symmetrically generated at the bottom perimeter of e-zone 1028. Accordingly, the hot spots 1034, 1036 sandwiched the majority of the relatively cooler target region therebetween.

So, even though electric heating was focused at the pair of hot spots in WEH2.0/InvCone, the geometry of the inverted conical bowl-shaped e-zone relative to the upright conical bowl-shaped e-zone redistributed the hot spots to provide symmetric multidirectional heating. Accordingly, thermal conduction from the hot spots was multidirectional, i.e., from both the top and the bottom of the target region. In effect, the two heated layers containing hot spots "sandwiched" the relatively cooler target region. This is an improvement over C2.0/Cone because heating is more diffuse by redistributing the hot spots on either side of the relatively cooler target region. In this way, thermal conduction during and after the electric heating interval will distribute heat more symmetrically and uniformly from two hot spots in two layers of the target region, rather than from two spots in one layer of the target region.

With respect to the absolute Γ values generated, in WEH2.0/InvCone, the overall $\Gamma_{initial}$ was 140.9 and $\Gamma_{10\%}$ (measured at 10 days for this example) was 101.7. These Γ values were similar to the overall $\Gamma_{initial}$ for C2.0/Cone (143.1) and the overall $\Gamma_{10\%}$ for C2.0/Cone (103.2). The overall TCG factors were also similar for WEH2.0/InvCone (3.92) and C2.0/Cone (3.99). But, just as in C2.0/Cone, the overall Γ values for WEH2.0/InvCone were not representative of the temperature increase rates throughout the target region.

Accordingly, the simulated target region was divided into 7 horizontal imaginary layers, by the method described above. As discussed below, the more uniform heating provided by e-zone shape complementarity in WEH2.0/InvCone, as compared to C2.0/Cone, was more evident by comparing Γ values of each of the imaginary layers.

The $\Gamma_{10\%}$ (measured at 10 days for this example) was calculated for each layer, according to Equation (7), based on an initial formation temperature of 30° C. The $\Gamma_{10\%}$ values for each layer are presented for WEH2.0/InvCone, as well as other Series 2 WEH/InvCone examples, in Table 4.

The maximum and mid-point temperatures ($T_{max}$, $T_{mid}$) for each layer were also determined 25 for each layer at the same time interval. The $T_{max}$ values for each layer are presented for WEH2.0/InvCone, as well as other Series 2 WEH/InvCone examples, in Table 5.

TABLE 4

| | $\Gamma_{10\%}$ in Layer Layers (Thickness) | | | | | | | | Effective |
|---|---|---|---|---|---|---|---|---|---|
| Examples | #1 (2 m) | #2 (4 m) | #3 (8 m) | #4 (4 m) | #5 (8 m) | #6 (4 m) | #7 (2 m) | % Γ Deviation | % Γ Deviation |
| WEH2.0/InvCone: | | | | | | | | | |
| $\Gamma_{initial}$ | 141.1 | 88.6 | 57.6 | 45.6 | 58.2 | 87.4 | 140.0 | 69% | 35% |
| $\Gamma_{10\%}$ | 129.6 | 80.8 | 52.6 | 39.7 | 51.8 | 80.0 | 128.7 | | |
| TCG Factor | 1.15 | 0.77 | 0.50 | 0.59 | 0.63 | 0.75 | 1.13 | | |
| WEH2.1/Mjr-InvCone | 30.7 | 13.6 | 8.9 | 7.0 | 8.8 | 13.4 | 30.5 | 77% | 39% |
| WEH2.2/Mnr-InvCone | 41.6 | 28.3 | 18.4 | 13.5 | 18.1 | 28.0 | 41.3 | 68% | 34% |
| WEH2.3/SMnr-InvCone | 4.6 | 4.4 | 4.0 | 2.2 | 4.0 | 4.5 | 4.6 | 52% | 26% |
| WEH2.4/Diag-InvCone | 45.6 | 21.5 | 14.1 | 11.1 | 13.9 | 21.3 | 45.3 | 76% | 38% |

TABLE 5

| | Maximum $T_{max}$, ° C., in Layer (Mid-point $T_{mid}$, ° C., in Layer) Layers (Thickness) | | | | | | | | Effective |
|---|---|---|---|---|---|---|---|---|---|
| Examples | #1 (2 m) | #2 (4 m) | #3 (8 m) | #4 (4 m) | #5 (8 m) | #6 (4 m) | #7 (2 m) | % $T_{max}$ Deviation | % $T_{max}$ Deviation |
| WEH2.0/InvCone | 80.3 (30.4) | 69.9 (30.5) | 56.2 (30.5) | 49.8 (30.5) | 55.9 (30.5) | 69.9 (30.5) | 80.7 (30.4) | 38% | 19% |

TABLE 5-continued

| Examples | Maximum $T_{max}$, ° C., in Layer (Mid-point $T_{mid}$, ° C., in Layer) Layers (Thickness) #1 (2 m) | #2 (4 m) | #3 (8 m) | #4 (4 m) | #5 (8 m) | #6 (4 m) | #7 (2 m) | % $T_{max}$ Deviation | Effective % $T_{max}$ Deviation |
|---|---|---|---|---|---|---|---|---|---|
| WEH2.1/Mjr-InvCone | 74.8 (31.5) | 54.1 (31.8) | 45.4 (31.7) | 42.1 (31.7) | 45.3 (31.7) | 54.1 (31.8) | 75.1 (31.5) | 44% | 22% |
| WEH2.2/Mnr-InvCone | 79.9 (31.2) | 73.8 (31.5) | 58.9 (31.6) | 51.7 (31.6) | 58.6 (31.6) | 73.8 (31.6) | 80.2 (31.2) | 36% | 18% |
| WEH2.3/SMnr-InvCone | 50.4 (34.5) | 52.4 (35.1) | 48.5 (34.6) | 39.8 (34.5) | 48.7 (34.6) | 52.8 (35.1) | 50.8 (34.5) | 25% | 13% |
| WEH2.4/Diag-InvCone | 70.1 (30.9) | 52.4 (31.0) | 44.4 (31.0) | 41.4 (31.0) | 44.3 (31.0) | 52.4 (31.0) | 70.4 (30.9) | 41% | 21% |

By comparing the results presented in Table 4 (WEH2.0/InvCone) with those in Table 2 (C2.0/Cone) above, we see that the e-zone shape complementarity in WEH2.0/InvCone generated more symmetric multidirectional heating in the target region, compared with the US '809 process in C2.0/Cone. In C2.0/Cone, the $\Gamma_{10\%}$ was highest in Layer #1. But in WEH2.0/InvCone, the $\Gamma_{10\%}$ was substantially the same for the top (#1, 128.5) and bottom (#7, 129.8) layers. While the $\Gamma_{10\%}$ dropped from Layer #1 (2 m thick) to Layer #2 (4 m thick) in both WEH2.0/InvCone and C2.0/Cone, th was less significant in WEH2.0/InvCone (%Γ deviation between Layers #1 and #2=38% vs. 54% deviation between Layers #1 and #2 in C2.0/Cone).

And the heating distribution throughout the target region was more diffuse in WEH2.0/InvCone, as evidenced by the $T_{max}$ temperatures for the 7 layers in WEH2.0/InvCone (see Table 5). The improvement achieved in WEH2.0/InvCone by inverting one of the conical bowl-shaped e-zones from C2.0/Cone is expected to increase significantly by providing even more uniform e-zone spacing. While e-zones in the top and bottom layers were uniformly spaced (123 m), the middle portion of each conical bowl-shaped e-zone was concave. Accordingly, the opposing e-zone faces at the middle portion (Layer #4) were spaced 140 m apart. So the spacing gradient was about 1:1, whereas the preferred average e-zone spacing gradient is less than or equal to about 1:5 (i.e., spacing increase or decrease of less than 1 m per 5 m e-zone face length). Therefore, it is believed that the heating distribution would be even more uniform in the target region if the opposing e-zone faces were more uniformly spaced in the middle portion of the conical bowl-shaped e-zones.

Because the hot spots in WEH2.0/InvCone were redistributed between two layers in the target region, the Γ deviation was divided by 2 to provide an effective Γ deviation of 35% in Table 4. And the $T_{max}$ deviation was divided by 2 to provide an effective $T_{max}$ deviation of 19% in Table 5. The effective Γ and $T_{max}$ deviations were used for calculating the composite score according to Equation (12).

The hot spots were located in Layers #1 and #7, 27 m from the well (distance between wells=141 m) and 55 m from the mid-point. Accordingly, the HTP factor calculated according to Equation (8) was 12.

Also as shown in Table 4, the average rate at which 1 changes per day over the first 10% of the electric heating interval (i.e., TCG factor) was in a range from 0.50 (Layer #3) to 1.15 (Layer #1), significantly lower than the overall TCG factor =3.92 for WEH2.0/InvCone, calculated according to Equation (13). But again, the TCG factors were symmetric about the target region in WEH2.0/InvCone. Accordingly, the TCG factor for Layer #7 was 1.13, similar to that for Layer #1.

WEH2.0/InvCone's HV factor was 2 calculated according to Equation (11), the same as C2.0/Cone's HV factor.

As discussed above, the effective %Γ deviation for WEH2.0/InvCone was 35% and the %$T_{max}$ deviation was 19% because heating was focused at symmetric hot spots in the top and bottom layers of the target region. In contrast, in C2.0/Cone, the %Γ deviation was 73% and %$T_{max}$ deviation was 42% because heating was focused at asymmetric hot spots in the top layer of the target region.

Accordingly, WEH2.0/InvCone's composite score for heating performance was 162, calculated according to Equation (12), which is significantly greater than 95, C2.0/Cone's composite score, demonstrating WEH2.0/InvCone's comparatively more diffuse heat distribution generated with e-zones. The composite scores for these and other examples, as well as their respective component factors, are summarized in Table 1B.

Example WEH2.0/CylCducty

WEH2.0/CylCducty was run for the same well orientation and e-zone geometric shape and size as in WEH2.0/Cyl. However, the WEH2.0/CylCducty formation electrical conductivity was dropped from 0.05 S/m (used in all examples, including C2.0/Cone) to 0.034 S/m so that the average conductance would be the same as in C2.0/Cone (0.56 S). Of course, as discussed above, average conductance is affected by a number of factors including formation electrical conductivity, e-zone spacing, geometric shape and spatial orientation. So, by reducing the formation electrical conductivity to provide a similar average conductance, those skilled in the art would expect lower heating rates and narrower heat distribution. But, as illustrated by the simulation results, the e-zone geometry effects influence heating more than does the formation electrical conductivity.

The average conductance and average power were, therefore, the same as for C2.0/Cone. Just as in WEH2.0/Cyl, the localized heating zone in WEH2.0/CylCducty was located 27 m from the well and 55 m from the mid-point, offset from the mid-point line between the two wells. Moreover, the localized heating zone in WEH2.0/CylCducty was coextensive with the well, just as in WEH2.0/Cyl. Accordingly, heating was more evenly distributed through the target region, as compared to C2.0/Cone.

After 20 days, no portion of the formation was heated to a temperature of at least 70° C. in WEH2.0/CylCducty, whereas 0.2% of the formation was heated in C2.0/Cone. But the final heated volume was about 7 times greater and the inventive WEH process could continue for about 4 times longer before water vaporized in WEH2.0/CylCducty (35%, 470 days) than C2.0/Cone (5%, 110 days). The comparison of heated volumes (@20 days and final) are good indicators that heating was more uniformly distributed in WEH2.0/CylCducty, as compared with C2.0/Cone. Specifically, the HT region was focused at a pair of asymmetric hot spots in a single layer of the target region in C2.0/Cone, whereas the localized heating zone distributed heat coextensive with the target region in WEH2.0/CylCducty, so the heated volume at 20 days was larger for C2.0/Cone. And, because the heat was more uniformly distributed in WEH2.0/CylCducty, water vaporization did not occur as quickly and electric heating could be continued for a longer period of time, thereby ultimately heating a larger volume.

So, even though the formation electrical conductivity was reduced in WEH2.0/CylCducty to provide the same average conductance as C2.0/Cone, heat was more evenly distributed using elliptical cylinder-shaped e-zones (WEH2.0/CylCducty) than conical bowl-shaped e-zones (C2.0/Cone).

The influence of e-zone geometry on the WEH process is further illustrated by comparing the results of WEH2.0/Cyl, C2.0/Cone, and WEH2.0/CylCducty. The formation electrical conductivity (0.05 S/m) was the same for WEH2.0/Cyl (elliptical cylinder-shaped e-zones) and C2.0/Cone (conical bowl-shaped e-zones), but, as discussed above, riniuja was significantly lower in WEH2.0/Cyl (24.9) than in C2.0/Cone (143.1). Moreover, the final heated volume was about 5 times greater in WEH2.0/Cyl (26.8% vs. 5.3% in C2.0/Cone).

Then, in WEH2.0/CylCducty, the formation electrical conductivity was reduced to 0.034 S/m. But $\Gamma_{initial}$ was still significantly lower in WEH2.0/CylCducty (25.7) than in C2.0/Cone (143.1). Moreover, the final heated volume was about 7 times greater in WEH2.0/CylCducty (35.2% vs. 5.3% in C2.0/Cone). The increased final heated volume was surprising because the same average heating power was delivered to the target region was the same for both WEH2.0/CylCducty and C2.0/Cone and those skilled in the art would have expected a similar heating pattern for the same power delivered to the targeted formation.

Finally, comparing WEH2.0/Cyl with WEH2.0/CylCducty, the e-zone geometric shape was the same for both simulations, but the formation electrical conductivity was lower in WEH2.0/CylCducty (0.034 S/m vs. 0.05 S/m in WEH2.0/Cyl). The WEH process in WEH2.0/CylCducty was conducted for 470 days with a final heated volume of 35.2%, instead of 280 days with a final heated volume of 26.8% in WEH2.0/Cyl. And, surprisingly, $\Gamma_{initial}$ was similar for WEH2.0/CylCducty (25.7) and WEH2.0/Cyl (24.9). This is a surprising result because those skilled in the art would have expected a lower heating rate and narrower heat distribution with a lower formation electrical conductivity because lower electrical conductivity generally reduces heating power. But, surprisingly, even though the average heating power was lower in WEH2.0/CylCducty (0.94 MW) than in WEH2.0/Cyl (1.49 MW), the final heated volume and $\Gamma$ were approximately the same for both WEH2.0/Cyl and WEH2.0/CylCducty. This demonstrates that the e-zone geometric shape has a greater effect on heating rate and distribution.

Comparative & WEH Examples-Spatial Orientation

As discussed above, C2.0/Cone is a simulation using the conventional electric heating process described in US '809, which failed to account for e-zone geometric shape, e-zone spacing and/or spatial orientation. The following comparative and WEH examples illustrate the effects of e-zone spatial orientation on heating rate and distribution.

For each of the following Series 2 examples, the voltage required to provide an average power value of about 1 MW (as suggested in US '809, see C2.0/Cone above) in the conical bowl-shaped e-zone examples (i.e., C2.1/Mjr-Cone, WEH2.2Mnr-Cone, WEH2.3/SMnr-Cone and C2.4/SDiag-Cone) was estimated. Then the remaining examples for that same spatial orientation were conducted at the same voltage. Accordingly, the Series 2.1 and 2.2 examples were conducted at 1,300 V (same as for C2.0/Cone). The Series 2.3 examples were conducted at 840 V and the Series 2.4 examples were conducted at 1,200 V.

In Series 2.1, the conical bowl-shaped e-zones from C2.0/Cone, the elliptical cylinder-shaped e-zones from WEH2.0/Cyl and the inverted conical bowl-shaped e-zones from WEH2.0/InvCone were spatially oriented so that the major axes of the ellipses were aligned. Simulations using the major ("Mjr") axis-aligned e-zones were conducted under C2.1/Mjr-Cone, WEH2.1/Mjr-Cyl and WEH2.1/Mjr-InvCone, respectively. The simulations for the Series 2.1 examples were accomplished by moving one of the e-zones along an imaginary line extending from its respective minor axis until the major axes were aligned. Accordingly, the distance between wells was 100 m. As illustrated in the pictorial guide in FIG. 7, the ellipse curvature was largest at the e-zone perimeter's intersection with the major axis.

In Series 2.2, the conical bowl-shaped e-zones from C2.0/Cone, the elliptical cylinder-shaped e-zones from WEH2.0/Cyl and the inverted conical bowl-shaped e-zones from WEH2.0/InvCone were spatially oriented so that the minor axes of the ellipses were aligned. Simulations using the minor ("Mnr") axis-aligned e-zones were conducted under WEH2.2/Mnr-Cone, WEH2.2/Mnr-Cyl and WEH2.2/Mnr-InvCone, respectively. The simulations for the Series 2.2 examples were accomplished by moving one of the e-zones along an imaginary line extending from its respective major axis. Accordingly, the distance between wells was 100 m. As illustrated in the pictorial guide in FIG. 7, the ellipse curvature was smallest at the e-zone perimeter's intersection with the minor axis.

In Series 2.3, the e-zones from WEH2.2/Mnr-Cone, WEH2.2/Mnr-Cyl and WEH2.2/Mnr-InvCone were moved closer together along the minor axis. Simulations using the shorter minor ("SMnr") axis between e-zones were conducted under WEH2.3/SMnr-Cone, WEH2.3/SMnr-Cyl and WEH2.3/SMnr-InvCone, respectively. The distance between the wells was reduced to 26 m from 100 m in Series 2.2.

In Series 2.4, the distance between wells in C2.0/Cone was reduced to 86 m by moving the second e-zone 828 (see FIG. 8) towards the first e-zone 826 along the line 834–836 interconnecting the hot spots 834, 836. By moving, the e-zones along the line 834–836, rather than the well:well line 822–824 interconnecting the conductors, the relative curvature between opposing e-zone faces was similar to that for 2.0/Cone. WEH2.0/Cyl and WEH2.0/InvCone were then repeated at the shorter distance. Simulations using the shorter diagonal distance ("SDiag") between wells were conducted under C2.4/SDiag-Cone, WEH2.4/SDiag-Cyl and WEH2.4/SDiag-InvCone, respectively.

Series 2.1

The e-zones for the Series 2.1 examples were aligned along the major ("Mjr") axis of their respective ellipses. Accordingly, the curvature of the opposing e-zone faces was largest at the e-zone perimeter's intersection with the major axis. The average conductance for each of C2.1/Mjr-Cone (0.54 S), WEH2.1/Mjr-Cyl (0.83 S) and WEH2.1/Mjr-InvCone (0.55 S) was similar to the average conductance for C2.0/Cone (0.56 S), WEH2.0/Cyl (0.82 S) and WEH2.0/InvCone (0.57 S), respectively. The voltage applied across the two wells was 1,300 V, the same as for C2.0/Cone.

However, the $\Gamma_{initial}$ was more than 4 times less and the $\Gamma_{10\%}$ was about 4 times less for C2.1/Mjr-Cone, WEH2.1/Mjr-Cyl and WEH2.1/Mjr-InvCone, as compared with the respective diagonally oriented e-zones in C2.0/Cone, WEH2.0/Cyl and WEH2.0/InvCone. The lower Γ values would appear to suggest that the heating rate at the mid-point would be significantly better for C2.1/Mjr-Cone, WEH2.1/Mjr-Cyl and WEH2.1/Mjr-InvCone. However, Tables 2–5 show that the $T_{max}$ values generated in C2.1/Mjr-Cone and WEH2.1/Mjr-InvCone were slightly less than those generated in C2.1/Mjr-Cone and WEH2.1/Mjr-InvCone, respectively. Furthermore, the %Γ deviation and $\%T_{max}$ deviation were greater for the major axis aligned e-zones than for the diagonally oriented e-zones.

Moreover, the final heated volume was similar for each pair of examples. Specifically, the final heated volume for C2.1/Mjr-Cone was 6.8% (64 days), compared to 5.3% (110 days) for C2.0/Cone. And the final heated volume for WEH2.1/Mjr-Cyl was 26.0% (96 days), compared to 26.8% (280 days) for WEH2.0/Cyl. Finally, the final heated volume for WEH2.1/Mjr-InvCone was 7.2% (66 days), compared to 7.2% (140 days) for WEH2.0/InvCone.

The WEH inventors, recognizing the effect of spatial orientation, expected simulations for e-zones aligned along the major axes to produce results similar to those for e-zones oriented as described in US '809 because the WEH inventors recognized that the curvature of opposing e-zone faces was larger for these spatial orientations. Therefore, the Series 2.1 examples using a spatial orientation where e-zones are aligned along the major axes of their respective ellipses illustrate that spatial orientation, among other factors, was not accounted for in US '809. Specifically, the orientation of the e-zones in US '809 did not provide any significant improvement over the worst case scenario for spatial orientation, i.e., such that major axes were aligned with largest curvature opposing e-zone faces.

Series 2.2

The e-zones for the Series 2.2 examples were aligned along the minor ("Mnr") axis of their respective ellipses. Accordingly, the curvature of the opposing e-zone faces was smallest at the e-zone perimeter's intersection with the minor axis. The average conductance for each of WEH2.2/Mnr-Cone (0.59 S), WEH2.2/Mnr-Cyl (0.89 S) and WEH2.2/Mnr-InvCone (0.59 S) was similar to the average conductance for C2.0/Cone (0.56 S), WEH2.0/Cyl (0.82 S) and WEH2.0/InvCone (0.57 S), respectively. The voltage applied across the two wells was 1,300 V, the same as for C2.0/Cone.

However, the $\Gamma_{initial}$ was 3–3.4 times lower for WEH2.2/Mnr-Cone, WEH2.2/Mnr-Cyl and WEH2.2/Mnr-InvCone, as compared with the diagonally oriented e-zones in C2.0/Cone, WEH2.0/Cyl and WEH2.0/InvCone. The lower Γ values would appear to suggest that the heating rate at the mid-point would be significantly better for C2.1/Mjr-Cone, WEH2.1/Mjr-Cyl and WEH2.1/Mjr-InvCone.

In fact, the final heated volume was significantly improved when the minor axes were aligned. Specifically, the final heated volume for WEH2.2/Mnr-Cone was 9.2% (120 days), compared to 5.3% (110 days) for C2.0/Cone. And the final heated volume for WEH2.2/Mnr-Cyl was 58.0% (330 days), compared to 26.8% (280 days) for WEH2.0/Cyl. Finally, the final heated volume for WEH2.2/Mnr-InvCone was 7.5% (100 days), compared to 7.2% (140 days) for WEH2.0/InvCone.

The reservoir simulation examples using a spatial orientation where e-zones are aligned along the minor axes of their respective ellipses illustrates that spatial orientation can improve thermal diffusion of electric heat in a target region. The improvement is even more significant when the relative e-zone geometric shape is also accounted for, such as, for example in WEH2.2/Mnr-Cyl.

Series 2.3

The e-zones for the Series 2.3 examples were aligned along the minor ("Mnr") axis of their respective ellipses, in the same manner as for Series 2.2. Accordingly, the curvature of the opposing e-zone faces was smallest at the e-zone perimeter's intersection with the minor axis. However, in this series of simulations, the distance between conductors was reduced by 74% to 26 m ("SMnr"). The voltage applied across the two wells was 840 V, so that the average power for WEH2.3/SMnr-Cone was about 1 MW, the same as for C2.0/Cone.

The average conductance for each of WEH2.3/SMnr-Cone (1.42 S), WEH2.3/SMnr-Cyl (2.26 S) and WEH2.3/SMnr-InvCone (1.30 S) was more than double the average conductance for WEH2.2/Mnr-Cone (0.59 S), WEH2.2/Mnr-Cyl (0.89 S) and WEH2.2/Mnr-InvCone (0.59 S), respectively.

The $\Gamma_{initial}$ values for WEH2.3/SMnr-Cone, WEH2.3/SMnr-Cyl and WEH2.3/SMnr-InvCone were significantly lower than either the Series 2.0 diagonally oriented e-zones or the Series 2.2 minor axis aligned e-zones. Specifically, $\Gamma_{initial}$ for WEH2.3/SMnr-Cone was 2.2, indicating that the mid-point was heating at just 50% of the hot spot heating rate. And the $\Gamma_{initial}$ for WEH2.3/SMnr-InvCone was 5.2. Tables 2–5 for layers in the WEH2.3/SMnr-Cone and WEH2.3/SMnr-InvCone target regions demonstrate much lower $T_{max}$ values than other spatial orientations for the same e-zones. But the $T_{mid}$ values were significantly higher than other spatial orientations. Accordingly, the heating was more diffuse by accounting for the spatial orientation.

Moreover, the $\Gamma_{initial}$ for WEH2.3/SMnr-Cyl was 1.1, suggesting that the heating in the localized heating zone was almost equal to the heating rate at the mid-point. The Γ value at 10% of the heating interval was 1, which is the ideal heating. In fact, there was some water vaporization in the localized heating zone at the mid-point at 36 days. But, the localized heating zone then grew towards the electrode zone perimeter so that the heating could continue for 120 days. Surprisingly, the localized heating zone did not invade the e-zone as it grew to the e-zone perimeter.

In fact, the final heated volume was significantly improved in the minor-axis aligned examples. Specifically, the final heated volume for WEH2.3/SMnr-Cone was 17.8% (34 days), compared to 5.3% (110 days) for C2.0/Cone. And the final heated volume for WEH2.3/SMnr-Cyl was 53.0% (120 days), compared to 26.8% (280 days) for WEH2.0/Cyl. Finally, the final heated volume for WEH2.3/SMnr-InvCone was 12.6% (26 days), compared to 7.2% (140 days) for WEH2.0/InvCone.

The reservoir simulation examples using a spatial orientation where e-zones are aligned along the minor axes of their respective ellipses again illustrates that spatial orientation can improve thermal diffusion of electric heat in a target region. The improvement is even more significant when the relative e-zone geometric shape is also accounted for, such as, for example in WEH2.3/SMnr-Cyl.

Series 2.4

In Series 2.4, the distance between wells in C2.0/Cone was reduced to 86 m by moving the second e-zone 828 (see FIG. 8) towards the first e-zone 826 along the line 834–836 interconnecting the hot spots 834, 836. By moving, the e-zones along the line 834–836, rather than the well:well line 822–824 interconnecting the conductors, the relative curvature between opposing e-zone faces was similar to that for 2.0/Cone. WEH2.0/Cyl and WEH2.0/InvCone were then repeated at the shorter distance. Simulations using the shorter diagonal ("SDiag") between e-zones were conducted under C2.4/SDiag-Cone, WEH2.4/SDiag-Cyl and WEH2.4/SDiag-InvCone, respectively.

The voltage applied across the two wells was 1,200 V, so that the average power for C2.4/SDiag-Cone was about 1 MW, the same as for C2.0/Cone.

The average conductance for each of C2.4/SDiag-Cone (0.69 S), WEH2.4/SDiag-Cyl (1.18 S) and WEH2.4/SDiag-InvCone (0.69 S) was slightly higher than the average conductance for WEH2.2/Mnr-Cone (0.59 S), WEH2.2/Mnr-Cyl (0.89 S) and WEH2.2/Mnr-InvCone (0.59 S), respectively.

The $\Gamma_{initial}$ values for C2.4/SDiag-Cone, WEH2.4/SDiag-Cyl and WEH2.4/SDiag-InvCone were more than three times less than the further apart Series 2.0 diagonally oriented e-zones. Specifically, $\Gamma_{initial}$ for WEH2.4/SDiag-Cone was 39.7 and the $\Gamma_{initial}$ for WEH2.4/SDiag-InvCone was 45.5. However, there was only slight improvement in final heated volume. Specifically, the final heated volume for C2.4/SDiag-Cone was 6.14% (40 days), compared to 5.3% (110 days) for C2.0/Cone. And the final heated volume for WEH2.4/SDiag-InvCone was 7.42% (44 days), compared to 7.2% (140 days) for WEH2.0/InvCone. Finally, the final heated volume for WEH2.4/SDiag-Cyl was 27.7% (62 days), compared to 26.8% (280 days) for WEH2.0/Cyl. This demonstrates that a larger volume was heated in a shorter period of time by reducing the e-zone spacing. However, the improvement between the Series 2.4 examples and their corresponding Series 2.0 examples was not as great as the improvement gained by reducing the distance when the e-zones were aligned along the minor axis.

Comparative & WEH Examples—Series 3

C3.0/BOrth is a simulation of a conventional electric heating process using a pair of bare horizontal wells in an orthogonal orientation with respect to each other. The wells were vertically spaced apart by 5 m. No e-zones were established around either well. The voltage applied to the wells was 300 V, for numerical stability. The formation pressure for all Series 3 examples was 3.1 MPa.

C3.1/BHrz/Vrt is also a simulation of a conventional heating process between a pair of bare conductors. But, in C3.1/BHrz/Vrt, one well was a vertical well and the other well was a horizontal well. The vertical well was vertically spaced apart from the horizontal well by 5 m. The voltage applied to the wells 150 V, because water vaporized almost immediately at 300 V.

In WEH3.0/Orth and WEH3.1/HrzfVrt, e-zones were established around the bare conductors in C3.0/BOrth and C3.1/BHrz/Vrt, respectively.

C3.0/BOrth vs. WEH3.0/Orth

C3.0/BOrth is a simulation of electric heating between a pair of bare horizontal wells placed in an orthogonal orientation with respect to each other. In WEH3.0/Orth, a 1 m high×3 m wide elliptical cylinder-shaped e-zone was established around each well of C3.0/BOrth. The voltage applied across the two wells in the two examples was 300 V to avoid premature termination of the software's numerical calculation by the computer's operating system.

The average conductance for the electrode geometry in C3.0/BOrth was 0.7 S, compared with 1.5 S for WEH3.0/Orth, about double the average conductance for C3.0/BOrth. The increased conductance in WEH3.0/Orth was due to the elliptical cylinder-shaped e-zones.

In C3.0/BOrth, after 20 days of conventional electric heating, 2% of the targeted formation volume was heated and, after 60 days, the heated formation volume was 8.7%. The onset of water vaporization occurred at 60 days from the start, which disrupted electrical connectivity between the two wells.

In contrast, by providing e-zones around the orthogonal wells in WEH3.0/Orth, the targeted formation volume heated to at least 700C after 20 days was 6%, three times that of C3.0/BOrth. And, after 60 days, the portion of the formation heated to at least 70° C. in WEH3.0/Orth was 19.8%, about 2.3 times greater than C3.0/BOrth. In both examples, electrical connectivity was disrupted at 60 days.

In C3.0/BOrth, the HT region was focused at a hot spot located at the top well at a point directly above the bottom well, thereby disrupting conductivity immediately when water vaporization occurred. In contrast, in WEH3.0/Orth, the first water vaporization occurred at 30 days. However, the HT region was located in localized heating zones originally located 0.5 m below the top well and 0.5 m above the bottom wells and later moved, at 30 days, to 1.3 m below the top well and 1.3 m above the bottom well. Therefore, although electrical connectivity was disrupted at the first localized heating zone, the overall electrical connectivity in the target region in WEH3.0/Orth was not disrupted at that time. So, even though the first electrical connectivity was disrupted at the first localized heating zone at 30 days, the resistance in the formation was almost constant for an additional 30 days of electric heating. During that additional 30 day period, the localized heating zones expanded between opposing e-zone faces. The localized heating zone was in the form of a column with a diameter of about 1.2 m. Within the column, the temperature was almost constant.

With respect to absolute Γ values, in C3.0/BOrth, $\Gamma_{initial}$ was 30.2 and $\Gamma_{10\%}$ (measured at 5 days in this example) was 11.3. In contrast, with e-zones in WEH3.0/Orth, $\Gamma_{initial}$ was 2.8 and $\Gamma_{10\%}$ (also measured at 5 days in that example) was 1.6. Accordingly, the inventive WEH process is able to deliver more heat, more quickly at and/or around the mid-point vicinity versus a conventional electric heating process without e-zones.

And the TCG factor for C3.0/BOrth was an average Γ change per day=3.78, compared with an average Γ change per day=0.24 for WEH3.0/Orth. Therefore, a bare conductor's reliance on thermal conduction, in this particular comparison, was about 16 times greater versus a pair of conductors with an e-zone contiguous to each conductor. Or, put another way, the electric field's ability to generate and distribute heat through the target region (i.e., the electric heating distribution effect), in this particular comparison, was about 16 times more efficient when e-zones were used in accordance with the inventive WEH process vs. when none are used.

Even though the orthogonal well pair orientation does not provide as great a heated volume, compared with a parallel well pair orientation, the WEH3.0/Orth simulation provided a good example of moving the HT region toward the mid-point, the ideal location for a HT region, if any. It also provided a good example of faster fluid communication between two wells. However, it should be noted that, under different conditions, the e-zone geometric shape and well configurations described in WEH examples described above could also shift localized heating zones further towards the mid-point.

C3.1/BHrz/Vrt vs. WEH3.1/Hrz/Vrt

C3.1/BHrz/Vrt is a simulation of electric heating between a vertical/horizontal bare well pair. WEH3.1/Hrz/Vrt is a simulation of WEH between the pair of wells in C3.1/BHrz/Vrt. However, in WEH3.1/Hrz/Vrt, a 1 m diameter horizontal cylindrical-shaped e-zone was established around the horizontal well and a 1 m diameter×1 m high disk-shaped e-zone was established around the bottom of the vertical well.

The average conductance for the electrode geometry in C3.1/BHrz/Vrt was 0.06 S. In contrast, the average conductance for WEH3.1/Hrz/Vrt was 0.17 S, representing about a 3-fold increase over C3.1/BHrz/Vrt due to the e-zones.

In C3.1/BHrz/Vrt, after 20 days of conventional electric heating, 0.01% of the formation volume between the two wells was heated and, after 60 days, the heated formation volume was 0.05%. The onset of water vaporization occurred at 110 days from the start, which immediately disrupted electrical connectivity. At that point, 0.08% of the formation volume between the two wells was heated to at least 70° C. In contrast, in WEH3.1/Hrz/Vrt, after 20 days of WEH, 0.1% of the formation volume was heated to at least 70° C., representing an increase of about 10 times over C3.1/BHrz/Vrt. The onset of water vaporization occurred at 25 days in WEH3.1/Hrz/Vrt, at which time, the 0.19% of the targeted formation was heated to at least 70° C.

In both C3.1/BHrz/Vrt and WEH3.1/Hrz/Vrt, the HT region was focused at a hot spot located at the tip of the vertical well. But, as illustrated by the improved $\Gamma_{10\%}$ value, compared to C3.1/BHrz/Vrt, the heating was more diffuse by establishing e-zones around the conductors.

With respect to the absolute Γ values, for a bare conductor pair in C3.1/BHrz/Vrt, $\Gamma_{initial}$ was 4280 and $\Gamma_{10\%}$ (measured at 10 days in this example) was 552.5. In contrast, with e-zones in WEH3.1/Hrz/Vrt, $\Gamma_{initial}$ was 799.4 and the $\Gamma_{10\%}$ (measured at 5 days in that example) was 207.7. Accordingly, the inventive WEH process is able to deliver more heat, more quickly at and/or around the mid-point vicinity versus a conventional electric heating process without e-zones.

And the TCG factor for C3.1/BHrz/Vrt was an average Γ change per day=372.8, compared with an average Γ change per day=118.3 for WEH3.1/Hrz/Vrt. Therefore, a bare conductor's reliance on thermal conduction, in this particular comparison, was about 3 times greater versus a pair of conductors with an e-zone contiguous to each conductor. Or, put another way, the electric field's ability to generate and distribute heat through the target region (i.e., the electric heating distribution effect), in this particular comparison, was about 3 times more efficient when e-zones were used in accordance with the inventive WEH process vs. when none are used.

Example 4

The use of WEH for SAGD initialization was evaluated experimentally in Example 4.

Figure 11:
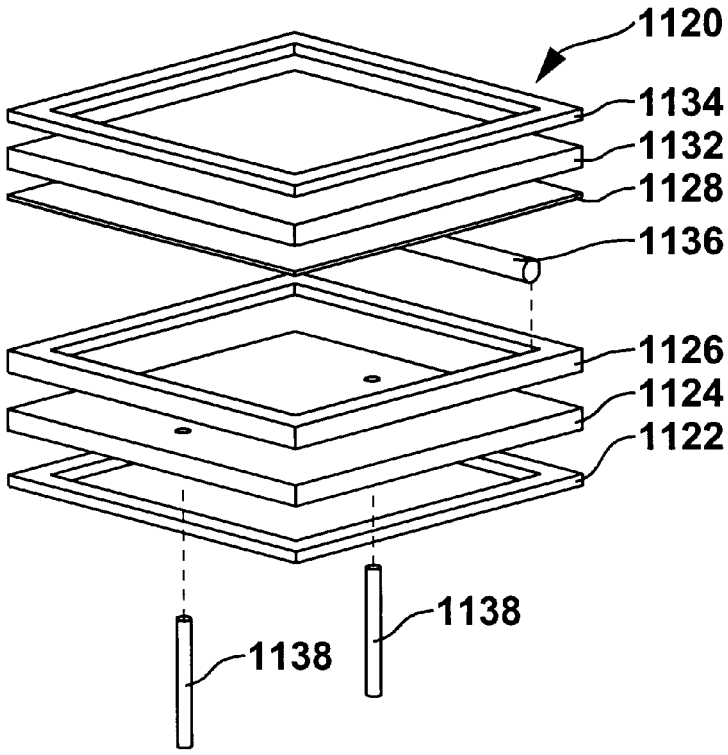
FIG. 11 is an exploded perspective view of the cell used in Example 4.

Cell Design:

A subterranean formation and two horizontal SAGD wells were simulated in an experimental Cell, illustrated in FIG. 11.

The cell 1120 was 58 cm×43 cm×10 cm (23"×17"×4"), simulating a vertical slice of the formation. The cell 1120 was constructed from phenolic and acrylic materials because of their insulating properties. Starting from the bottom of the cell 1120, the first cell housing component 1122 was a 1.3 cm (½") thick acrylic sheet with a 53 cm×38 cm (21"×15") rectangular cut-out. The second cell housing component 1124 was a 2.5 cm (1") thick phenolic sheet without a cut-out. A spacer component 1126 was a 2.5 cm (1") thick phenolic sheet with a 51 cm×38 cm (20"×15") rectangular cut-out. The third cell housing component 1128 was a 0.3 cm (⅛") thick acrylic sheet without a cut-out to provide a small gap between the sand pack and the fourth cell housing component 1132. Air pressure in the gap provided by the third cell housing component 1128 was controlled to provide a controlled simulated overburden pressure. The fourth cell housing component 1132 was a 2.5 cm (1") acrylic sheet without a cut-out and the fifth cell housing component 1134 was a 1.3 cm (½") thick acrylic sheet with a 53 cm×38 cm (21"×15") rectangular cut-out. Once the cell 1120 was assembled, as discussed more fully below, sand was packed between the second cell housing component 1124 and the third cell housing component 1128 in a thickness defined by the spacer component 1126.

A distributor 1136 was placed in the cut-out provided in the spacer component 1126 along one of its long inside edges for distribution of injected fluids during preparation of the cell 1120. The distributor 1136 was a 38 cm (15") long, 1.9 cm (¾") diameter, hydrophilic porous plastic (GENPORE) cylindrical prism with a 0.15 cm (1/16") radius hole through the entire length thereof. As described more fully below, water and oil were injected into the sand pack by trickling through the distributor 1136.

The cell 1120 was sealed with a 0.3 cm (⅛") thick gasket (not shown) placed above and below the spacer component 1126. Another 0.3 cm (⅛") thick gasket (not shown) was placed between the third and fourth cell housing components 1128, 1132. In addition to providing a seal, the gaskets also provide spacing for the overburden pressure gap.

Connector fittings were placed along the outside edge of spacer component 1126 so as not to influence the electric field pattern. Where possible, nylon fittings were used instead of stainless steel fittings. Fittings were provided for (1) a pressure gauge, (2) a pressure relief valve and (3) for each end of the distributors 136. The gauge and valve holes, along with one other hole, were also used for sand packing. For ease of discussion, the connector fittings are not shown in FIG. 11.

Two 0.6 cm (¼") o.d. stainless steel tubes 1138 were used to simulate two horizontal wells. The tubes 1138 were perforated with small holes and screened to allow for brine injection, while preventing sand from falling into the holes. The tubes 1138 extended through the spacer component 1126 and the second cell housing component 1124. The perpendicular distance between the two tubes 1138 was 36 cm (14"), corresponding to a distance between wells of 10 m, if the wells are 18 cm (7") in diameter. The tubes 1138 were wired to a 60 Hz A.C. voltage source.

Figure 12:
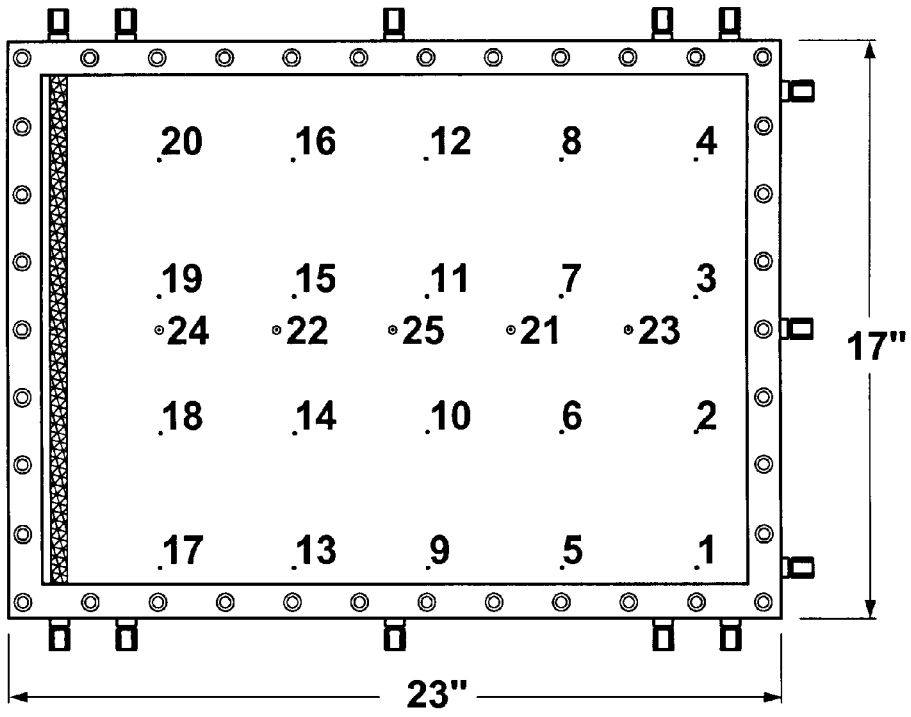
FIG. 12 is a top plan view of the cell in FIG. 11, illustrating the arrangement of thermocouples and conductors used in Example 4.

25 ungrounded thermocouples were used to measure the temperature in the cell 1120. Two thermocouples (TC#23, TC#24) were placed inside the tubes 1138, with their tips contacting the bottom of the tubes 1138, to monitor temperature at the simulated wells. The remaining 23 thermocouples were inserted from the bottom of the cell through the second cell housing component 1124 and extended halfway (1.3 cm, ½") through the sand pack. The arrangement of thermocouples 1 through 25 and wells (i.e., tubes 38) is illustrated in FIG. 12. TC#25 was placed at the mid-point between the two wells (tubes 1138). For clarity, the thermocouples are not shown in FIG. 11.

The cell 1120 was assembled with spaced-apart bolts extending through the cell housing components around the perimeter of the cell 1120. For clarity, the bolts are not shown in FIG. 11. To test for leaks, the cell 1120 was subjected to a pressure of 20 psi(g) and a vacuum of −28 psi(g). The cell's empty weight was 25,297 g.

Sand Pack Preparation:

4 Darcy Ottawa Sand (F110™) obtained from US Silica was packed into the cell 1120 in the space defined by the second and third cell housing components 1124, 1128 and the spacer component 1126. The space was first partially filled with water and then wetted sand was slowly added through three of the holes, while vibrating the cell 1120. The sand-packed cell weight with water was 37,550 g.

The porosity of the sand pack was 35%, as determined by the total sand weight and the density of the sand.

A 4 wt. % NaCl solution was injected into the cell and then displaced by oil. The oil used in this example was Hillmond heavy oil having a viscosity of 23,400 at 20.8° C. and a mass density of about 0.97 g/mL. The electric conductivity of the oil was negligibly small.

Oil displacement was conducted with the cell 1120 positioned so that the distributor 1136 was at the bottom and the removal line was at the top. The cell 1120 was placed in a 45° C. oven during oil injection to improve oil flow by reducing oil viscosity. The residual NaCl solution in the cell was about 11% (vol.) after oil injection. The residual NaCl solution simulated connate water and provided electrical connectivity between the wells.

The overburden pressure of the cell 1120 was about 13.5 psig after oil injection.

Bare Conductor Heating:

A 300 volt A.C. was applied between the two tubes 1138 to simulate heating across two bare conductors (i.e., without contiguous e-zones). The heating was conducted with the cell 1120 in a horizontal position for safety reasons. The voltage source was turned off after 20 minutes.

The temperature and current were monitored during the electric heating interval. The initial temperature at the wells (TC#23, TC#24) and the mid-point (TC#25) was 23.5° C., 22.5° C. and 21.9° C., respectively. The cell's average initial temperature was 21.2° C. The initial current was 14.8 mA and slowly increased during heating to 56 mA. Without being bound by theory, it is believed that the increase in current flow was due to heat-mobilized pore level fluid. The mobilized fluid improves electrical connectivity between wells.

The temperature change at each thermocouple at 1 minute and at 20 minutes is listed in Table 6 below under the heading "Bare Conductor." Each minute simulated about 12 hours in the field.

Establishing First E-Zone:

The cell 1120 was allowed to cool for about ½ hour and 12 mL of 25 wt. % NaCl solution was injected into each tube 1138 to theoretically establish a 2.1 cm (0.8") radius e-zone around each tube 1138 conductor, simulating an e-zone radius of about 0.6 m (22"). Accordingly, the effective radius of the electrode was increased from 0.3 cm (⅛") to 2 cm (0.82"). The valves on the sides of the cell 1120 across from the tubes 1138 were opened to release any pressure build-up during injection.

The pressure in the cell 1120 was about 1 atm(a) (14.7 psia) after NaCl solution injection. The overburden pressure of the cell 1120 was about 13.5 psig after NaCl solution injection.

WEH with First E-Zone:

A 300 volts A.C. was applied between the two tubes 1138 to illustrate WEH across two conductors having e-zones. As mentioned above, the heating was conducted with the cell 1120 in a horizontal position for safety reasons. The voltage source was turned off after 60 minutes.

The temperature and current were monitored during the electric heating interval. The initial temperature at the wells (TC#23, TC#24) and the mid-point (TC#25) was 21.4° C., 21.4° C. and 21.6° C., respectively. The cell's average initial temperature was 21.4° C. The initial current was 74 mA and slowly increased during heating to 93 mA. The higher initial current, relative to the bare conductor heating interval, was due to the presence of the e-zones around the wells 1138. Without being bound by theory, it is believed that the increase in current flow during the electric heating interval was due to heat-mobilized pore level fluid. The mobilized fluid improves electrical connectivity between wells.

The temperature change at each thermocouple at 1 minutes, 20 minutes and 60 minutes is listed in Table 6 below under the heading "First E-Zone." Each minute simulated about 12 hours in the field.

Establishing Second Larger E-Zones:

The cell 1120 was allowed to cool for about ½ hour and an additional 18 mL of 25 wt. % NaCl solution was injected into each tube 1138 to theoretically establish a 3.3 cm (1.3") radius e-zone around each tube 1138 conductor, simulating an e-zone radius of about 0.9 m (36"). Accordingly, the effective radius of the electrode was increased from 2.0 cm (0.82") to 3.3 cm (1.3"). The valves on the sides of the cell 1120 across from the tubes 1138 were opened to release any pressure build-up during injection.

The pressure in the cell 1120 was about 1 atm(a) (14.7 psia) after NaCl solution injection. The overburden pressure of the cell 1120 was about 13.5 psig after NaCl solution injection.

WEH with Second Larger E-Zones:

A 300 volts A.C. was applied between the two tubes 26 to illustrate WEH across two conductors having larger e-zones. As mentioned above, the heating was conducted with the cell 1120 in a horizontal position to avoid or reduce possible gravity effects. The voltage source was turned off after 60 minutes.

The temperature and current were monitored during the electric heating interval. The initial temperature at the wells (TC#23, TC#24) and the mid-point (TC#25) was 22.5° C., 22.5° C. and 23.3° C., respectively. The cell's average initial temperature was 22.5° C. The initial current was 120 mA and slowly increased during heating to 146 mA. The higher initial current, relative to the first e-zone heating interval, was due to the presence of the larger e-zones around the wells 1138. Without being bound by theory, it is believed that the increase in current flow during the electric heating interval was due to heat-mobilized pore level fluid. The mobilized fluid improves electrical connectivity between wells.

The temperature change at each thermocouple at 1 minutes, 20 minutes and 60 minutes is listed in Table 6 below under the heading "Second Larger E-Zone." Each minute simulated about 12 hours in the field.

Analysis:

The temperature change at each thermocouple, versus the thermocouple's initial temperature, was recorded for the bare conductor, first e-zone and second larger e-zone heating. Γ was estimated for the bare conductor heating interval at 1 min (simulating 12 hours in field) and 20 min (simulating 10 days in field). Γ was also estimated for the 1$^{st}$ e-zone and 2$^{nd}$ larger e-zone WEH intervals at 1 min (simulating 12 hrs in field), 20 min (simulating 10 days in field) and 60 min (simulating 30 days in field). Because the thermocouples could not be moved during the heating intervals, the estimated Γ values were calculated using the temperature change values at the two wells and at the mid-point, as follows:

$$\Gamma = \frac{TC\#23 + TC\#24}{2 \times TC\#25}$$

The results are listed in Table 6.

TABLE 6

| Thermocouple (see FIG. 12 for relative position in cell) | Bare Conductor 1 min (12 hrs) | Bare Conductor 20 min (10 days) | 1st E-Zone 1 min (12 hrs) | 1st E-Zone 20 min (10 days) | 1st E-Zone 60 min (30 days) | 2nd Larger E-Zone 1 min (12 hrs) | 2nd Larger E-Zone 20 min (10 days) | 2nd Larger E-Zone 60 min (30 days) |
|---|---|---|---|---|---|---|---|---|
| TC#1 | 0.06 | 0.14 | 0.06 | 0.17 | 0.55 | 0.00 | 0.11 | 0.67 |
| TC#2 | 0.01 | 0.47 | 0.01 | 0.48 | 1.70 | 0.00 | 0.30 | 1.73 |
| TC#3 | 0.06 | 1.44 | 0.04 | 0.70 | 2.45 | 0.00 | 0.54 | 2.67 |
| TC#4 | 0.00 | 0.12 | 0.03 | 0.29 | 0.99 | 0.05 | 0.13 | 0.94 |
| TC#5 | 0.03 | 0.37 | 0.09 | 1.04 | 2.52 | 0.11 | 1.89 | 4.53 |
| TC#6 | 0.06 | 1.31 | 0.10 | 2.52 | 6.18 | 0.24 | 3.97 | 9.88 |
| TC#7 | 0.14 | 3.08 | 0.24 | 3.97 | 8.45 | 0.17 | 5.30 | 12.73 |
| TC#8 | 0.00 | 0.57 | 0.02 | 1.35 | 3.48 | 0.15 | 2.34 | 5.89 |
| TC#9 | 0.08 | 0.69 | 0.10 | 1.65 | 3.99 | 0.11 | 2.72 | 6.62 |
| TC#10 | 0.06 | 1.09 | 0.13 | 2.63 | 6.79 | 0.21 | 5.69 | 13.76 |
| TC#11 | 0.12 | 1.29 | 0.13 | 2.92 | 7.54 | 0.28 | 6.28 | 15.46 |
| TC#12 | 0.06 | 0.95 | 0.12 | 2.23 | 5.19 | 0.14 | 3.67 | 8.77 |
| TC#13 | 0.00 | 0.70 | 0.07 | 1.66 | 3.78 | 0.10 | 1.68 | 4.10 |
| TC#14 | 0.05 | 1.22 | 0.19 | 2.93 | 6.92 | 0.25 | 3.58 | 9.22 |
| TC#15 | 0.06 | 1.37 | 0.20 | 3.41 | 7.92 | 0.23 | 3.84 | 10.37 |
| TC#16 | 0.07 | 0.89 | 0.22 | 2.25 | 4.99 | 0.10 | 2.43 | 5.95 |
| TC#17 | 0.00 | 0.15 | 0.00 | 0.24 | 1.07 | 0.00 | 0.14 | 0.56 |
| TC#18 | 0.06 | 0.75 | 0.00 | 1.19 | 3.26 | 0.00 | 0.55 | 2.25 |
| TC#19 | 0.18 | 3.49 | 0.10 | 2.43 | 5.19 | 0.07 | 2.40 | 4.87 |
| TC#20 | 0.00 | 0.17 | 0.00 | 0.43 | 1.49 | 0.00 | 0.21 | 0.99 |
| TC#21 | 0.02 | 1.72 | 0.16 | 3.49 | 8.23 | 0.33 | 6.72 | 15.67 |
| TC#22 | 0.08 | 1.52 | 0.16 | 3.54 | 8.14 | 0.05 | 2.79 | 9.06 |
| TC#23 - 1st Well | 4.92 | 14.67 | 5.66 | 5.50 | 9.92 | 2.94 | 8.49 | 14.20 |
| TC#24 - 2nd Well | 2.84 | 7.67 | 2.83 | 5.09 | 8.45 | 1.75 | 7.79 | 10.87 |
| TC#25 - Cell Mid-point | 0.09 | 1.20 | 0.10 | 2.95 | 7.64 | 0.27 | 6.70 | 16.22 |
| Γ | 45.3 | 9.3 | 43.2 | 1.8 | 1.2 | 8.6 | 1.2 | 0.8 |

At 20 min, simulating 10 days in the field, the temperature change at the first well (TC#23) was 14.7 for the bare conductor. However, when WEH heating was conducted with e-zones around the wells, the temperature increase at the first well was significantly less at 20 min for the first e-zone (5.5) and the second larger e-zone (8.5). Meanwhile, the temperature change at the mid-point (TC#25) was significantly greater for the first e-zone (3.0) and second larger e-zone (6.7) than for the bare conductor (1.2).

Figure 13:
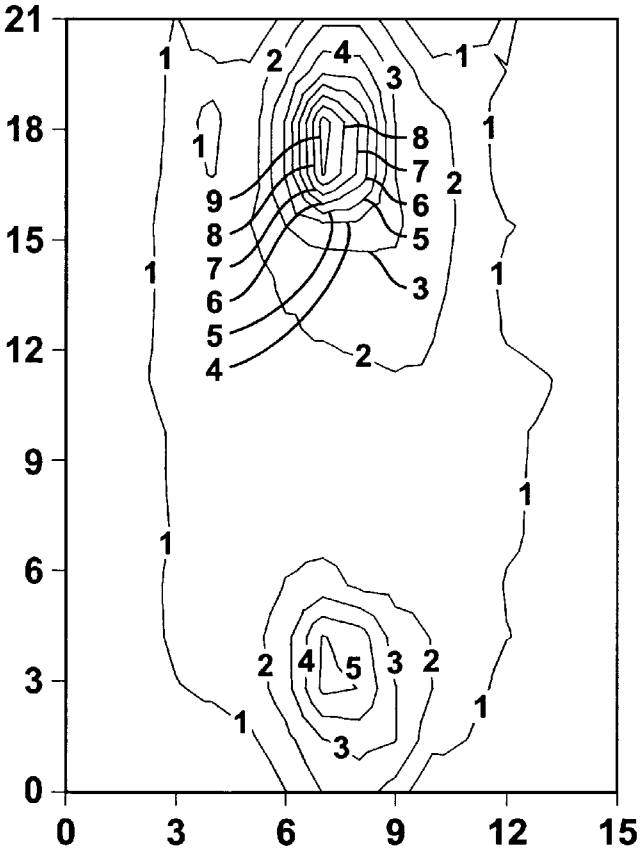
FIG. 13 (PRIOR ART)
FIG. 13 is a temperature change contour diagram illustrating the temperature change at 20 min for the conventional electric heating process illustrated in Example 4.
Figure 14B:
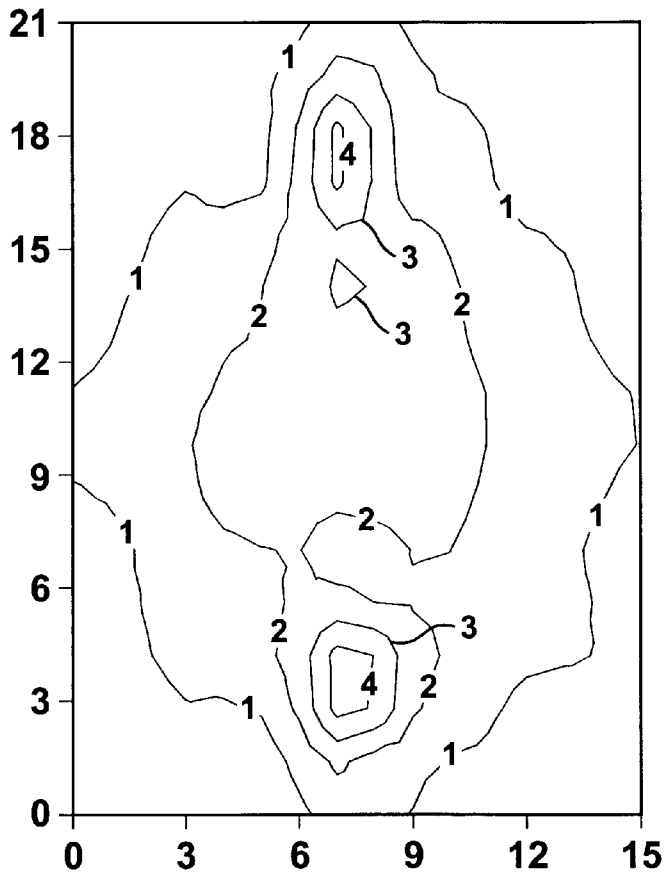
FIG. 14B is a temperature change contour diagram illustrating the temperature change at 60 min for the first WEH process illustrated in Example 4.
Figure 14A:
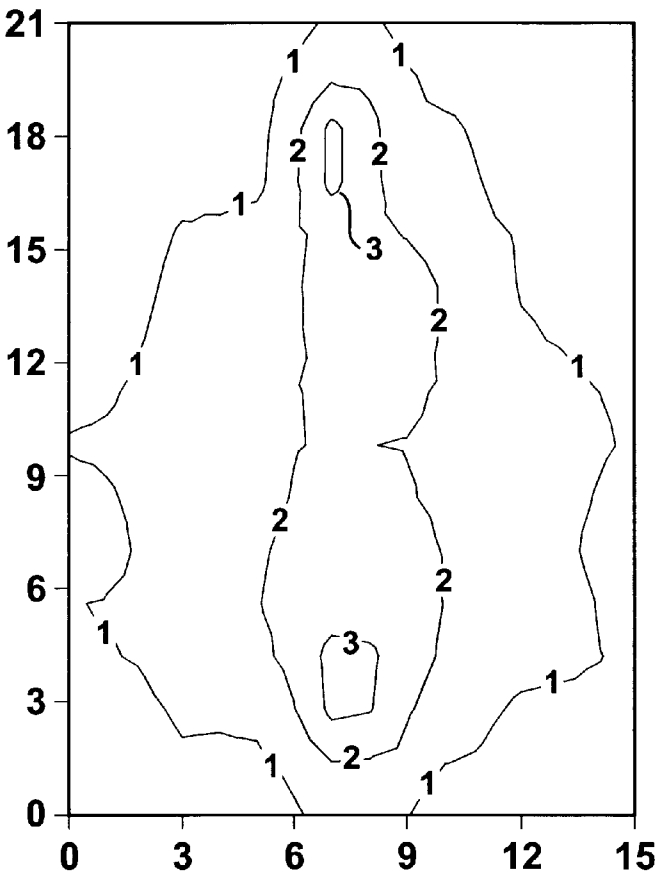
FIG. 14A is a temperature change contour diagram illustrating the temperature change at 20 min for a first WEH process illustrated in Example 4.
Figure 15B:
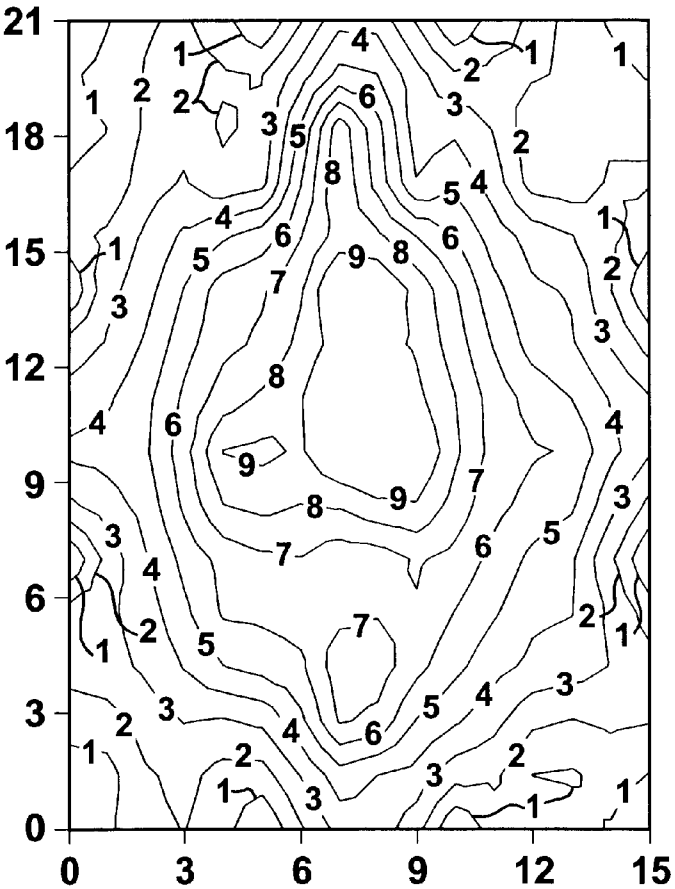
FIG. 15B is a temperature change contour diagram illustrating the temperature change at 60 min for the second WEH process illustrated in Example 4.
Figure 15A:
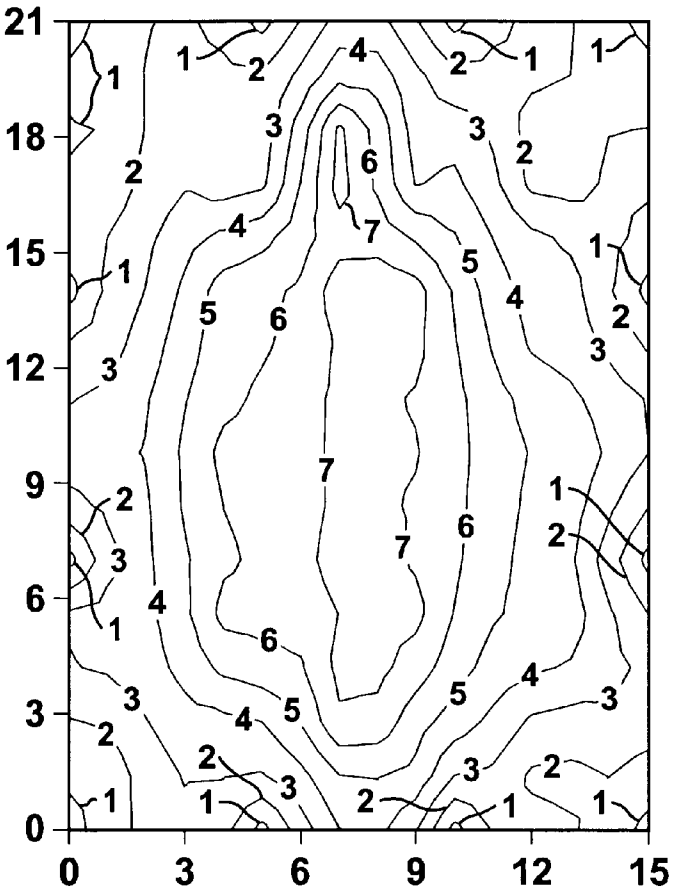
FIG. 15A is a temperature change contour diagram illustrating the temperature change at 20 min for a second WEH process illustrated in Example 4.

These results are illustrated graphically in temperature change contour diagrams for the bare conductor at 20 min (FIG. 13), for the first e-zone at 20 min (FIG. 14A) and 60 min (FIG. 14B), and for the second e-zone at 20 min (FIG. 1 5A) and at 60 min (FIG. 1 5B). The contour lines show where the temperature was increased by 1°, 2°, 3°, . . . 10°. The temperature contour diagrams illustrate graphically how the WEH process provides more uniform heating rates and distribution. The temperature contour diagrams also illustrate how WEH provides more diffuse heating than conventional electric heating processes.

The temperature change differences are also illustrated in the estimated Γ values provided in Table 6. At 20 min, simulating 10 days in the field, the Γ value for the bare conductor heating interval was 9.3. But the Γ value was significantly less for the first e-zone (1.8) and second larger e-zone (1.2) WEH intervals. This demonstrates how the WEH process provides more diffuse heating than conventional electric heating processes. And by 60 min, simulating 30 days in the field, the WEH interval for the second larger e-zone provided more heating at the mid-point than at the conductors, as illustrated by Γ=0.8. However, it should be noted that there was some heat loss at the wells 1138, which were exposed to the atmosphere. Accordingly, the estimated Γ values in Table 6 may be lower than they should be. But, under the same conditions, the Γ values for the WEH runs were significantly lower than the Γ values for the conventional electric heating process.

Figure 16:
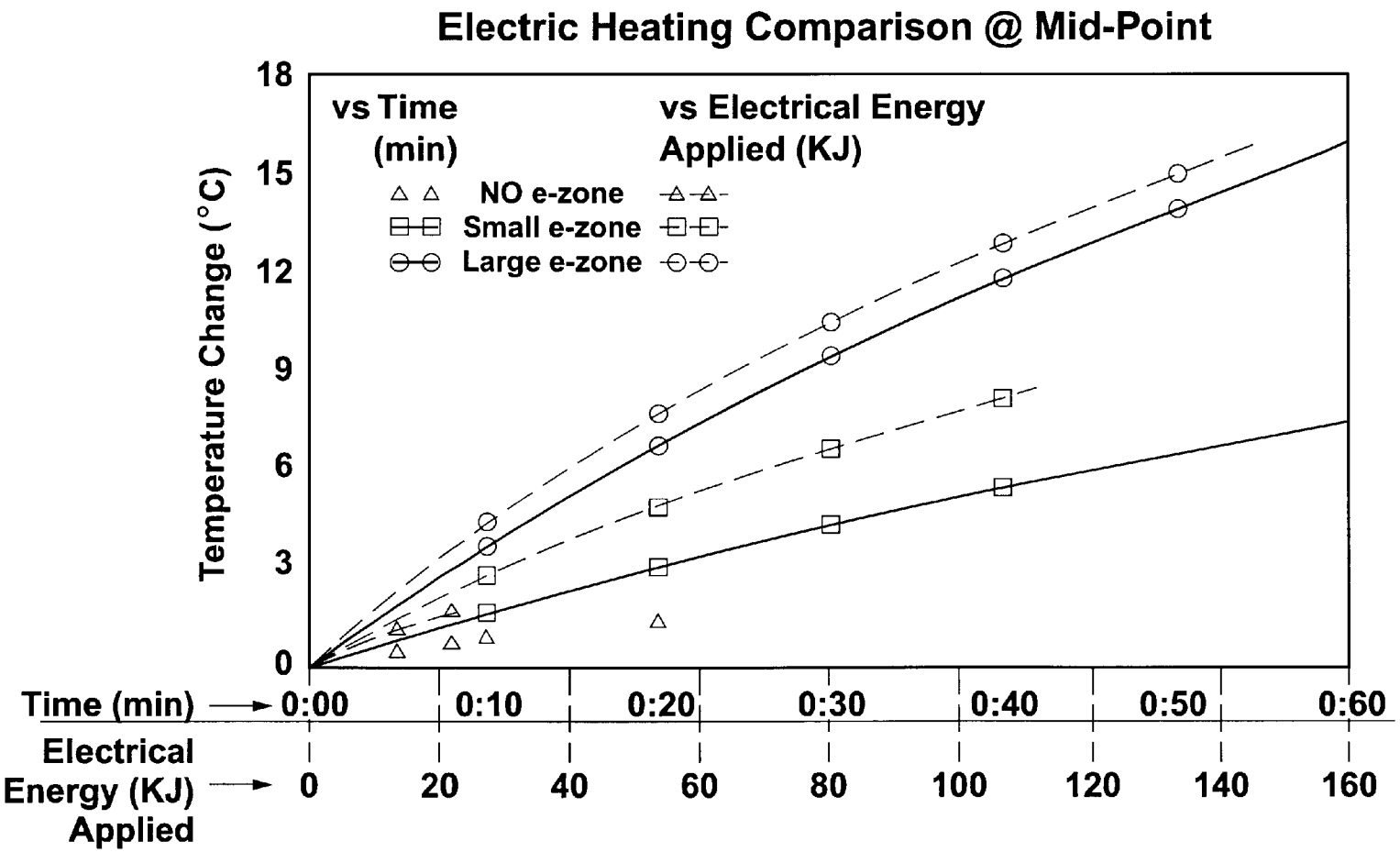
FIG. 16 is a graphical representation illustrating the temperature change at the mid-point between two conductors versus the electric energy applied.

FIG. 16 graphically illustrates how applied energy is more effectively used in the inventive WEH process. FIG. 16 shows the temperature change versus time and versus electric energy applied (kJ). Electric energy applied is a equal to the voltage multiplied by the current for a specified time interval. The electric energy applied shown in FIG. 16 is a cumulative electric energy for the specified time intervals and the preceding time intervals.

In each case, 300 V was applied to the conductors. However, the WEH intervals with the first e-zone and the second larger e-zone converted the energy into heat more effectively than the conventional electric heating process.

Preferred processes for practicing the invention have been described. It will be understood that the foregoing is illustrative only and that other embodiments of the process can be employed without departing from the true scope of the invention defined in the following claims.

We claim:

1. A method for heating a subterranean formation having hydrocarbons, the method comprising:

(a) providing at least a first conductor and a second conductor, wherein (i) the first and second conductors are spaced-apart in the formation, and (ii) there is electrical connectivity between the first and second conductors;

(b) establishing at least a first electrode zone and a second electrode zone, each electrode zone having electrolyte, around the first and second conductors, respectively, and thereby creating a target region, having a center point, between opposing faces of the first and second electrode zones, wherein each electrode zone has an average effective radius that is at least about 2.3% of the distance between the centerline of the first conductor and the centerline of the second conductor; and (c) establishing at least about a 50% difference in electrical conductivity between the target region and independently each of the first and second electrode zones, wherein the electrical conductivity of the first and second electrode zones are each independently greater than an initial electrical conductivity of the target region, wherein the initial electrical conductivity of the target region is the average electrical conductivity, prior to applying an electric potential difference between the first and second electrode zones, in a substantially spherical portion centered around the center point of the target region, the substantially spherical portion of the target region having a radius of about 15% of the average spacing between opposing faces of the first and second electrode zones;

so that when an electric potential difference is applied between the first and second electrode zones, a substantially diffuse distribution of increased temperature values, arising substantially from ohm-heating, is generated within the target region during at least the first 10% of a time interval when the electric potential difference is applied.

2. The method of claim 1, wherein the substantially diffuse distribution of increased temperature values in the target region is generated by a localized heating zone.

3. The method of claim 2, wherein the target region is heated substantially uniformly.

4. The method of claim 1, wherein the substantially diffuse distribution of increased temperature values in the target region is generated by at least one set of at least two hot spots, wherein the hot spots in each set are extended radially outward frorn the average electrode zone perimeter and are spaced apart from each other along the length of the target region so that at least a portion of the target region's volume is disposed between a pair of imaginary lines, each line extending orthogonally between each hot spot to the conductor corresponding to the electrode zone nearest the hot spot.

5. The method of claim 4, wherein the target region is heated substantially uniformly.

6. The method of claim 4, wherein the hot spots in each set are located in different imaginary layers in the target region divided into n imaginary layers, wherein each imaginary layer has a highest temperature $T_n$ at a point radially located a distance x from the first conductor and the thickness of the imaginary layer is determined by the length of an imaginary line parallel to and a radial distance x from the first conductor, wherein the temperature values along the imaginary line fall in a range $T_n \geqq T \geqq 0.85T_n$, as measured at about the initial 10% of a continuous electric heating time interval.

7. The method of claim 1, wherein the substantially diffuse distribution of increased temperature values arises more from a electric field effect than from a thermal conduction effect.

8. The method of claim 1, wherein the at least first and second electrode zones are spaced apart so that a substantially uniform electrode zone spacing is provided between opposing and respective surfaces of the at least first and second electrode zones.

9. The method of claim 1, wherein the at least first and second electrode zones independently have a geometric shape relative to each other that generates a localized heating zone when the electric potential difference is applied between the first and second electrode zones.

10. The method of claim 1, whereinthe at least first and second electrode zones independently have a spatial orientation relative to each other that generates a localized heating zone when the electric potential difference is applied between the first and second electrode zones.

11. The method of claim 1, wherein at least one of the first and second conductors is a well.

12. The method of claim 1, wherein both the first and second conductors are wells.

13. The method of claim 12, wherein the first well is an injection well and the second well is a substantially horizontal production well.

14. The method of claim 1, wherein at about 10% of a predetermined time interval over which an electric potential difference is continuously applied between the first and second electrode zones, there is at most about a 60% deviation between the maximum and minimum values for the gamma ratio, Γ, generated within the target region, wherein the %Γ deviation is calculated as:

$$\%\Gamma\text{Deviation}=[(\Gamma_{max}-\Gamma_{min})/\Gamma_{max}]\times 100$$

where

%ΓDeviation is the deviation of Γ values determined in a target region divided into n imaginary layers, wherein each imaginary layer has a highest temperature $T_n$ at a point radially located a distance x from the first conductor and the thickness of the imaginary layer is determined by the length of an imaginary line parallel to and a radial distance x from the first conductor, wherein the temperature values along the imaginary line fall in a range $T_n \geqq T \geqq 0.85T_n$, as measured at about the initial 10% of a continuous electric heating time interval;

n is greater than or equal to 2;

$\Gamma_{max}$ is the highest Γ of the n respective Γ values determined in the n layers at about the initial 10% of the continuous electric heating time interval;

$\Gamma_{min}$ is the lowest Γ of the n respective Γ values determined in the n layers at about the initial 10% of the continuous electric heating time interval; and Γ is a ratio of a rate of temperature increase for the portion of the target region having the highest temperature value versus a rate of temperature increase at an effective mid-point between the first and second electrode zones.

15. The method of claim 1, wherein at about 10% of a predetermined time interval over which an electric potential difference is continuously applied between the first and second electrode zones, there is at most about 35% deviation between the highest and lowest maximum temperatures, $T_{max}$, generated within the target region, wherein the $\%T_{max}$ deviation is calculated as:

$$\%T_{max}\text{Deviation}=[(T_{max-high}-T_{max-low})/T_{max-high}]\times 100$$

where $\%T_{max}$ Deviation is the deviation of $T_{max}$ values determined in a target region divided into n imaginary layers, wherein each imaginary layer has a highest temperature $T_n$ at a point radially located a distance x from the first conductor and the thickness of the imaginary layer is determined by the length of an imaginary line parallel to and a radial distance x from the first conductor, wherein the temperature values along the imaginary line fall in a range $T_n \geqq T \geqq 0.85T_n$, as measured at about the initial 10% of a continuous electric heating time interval;

n is greater than or equal to 2;

$T_{max-high}$ is the highest $T_{max}$ of the n respective $T_{max}$ values determined in the n layers at about the initial 10% of the continuous electric heating time interval; and $T_{max-low}$ is the lowest $T_{max}$ of the n respective $T_{max}$ values determined in the n layers at about the initial 10% of the continuous electric heating time interval.

16. The method of claim 1, wherein each electrode zone independently has an effective radius in a range from about 1.3 times to about 200 times the radius of the respective conductor.

17. The method of claim 1, wherein at least one of the first and second electrode zone is established by injecting a supplemental electrolytic fluid into the formation around the respective conductors.

18. The method of claim 17, wherein the supplemental electrolytic fluid comprises an ion producing substance selected from the group consisting of a substantially water soluble salt, a substantially water soluble ionic surfactant, a conductive substantially water soluble polymer, a substantially water soluble zwitterion, and combinations thereof.

19. The method of claim 18, wherein the substantially water soluble salt is selected from the group consisting of NaCl, KCl, $MgCl_2$, $CaCl_2$, $Na_3(PO_4)$, $K_3(PO_4)$, $NaNO_3$, $KNO_3$, $Na_2SO_4$, $K_2SO_4$, $MgSO_4$, $CaSO_4$, $Na_2CO_3$, $K_2CO_3$, $NaC_2H_3O_2$, $KC_2H_3O_2$, NaBr, KBr and combinations thereof.

20. The method of claim 18, wherein the salt concentration in the supplemental electrolytic fluid is in a range from about 0.1 wt % to about 30 wt %.

21. The method of claim 18, wherein the conductive substantially water soluble polymer is selected from the group consisting of styrene/maleic anhydride copolymers, polyvinylpyridium, polyvinylacetates, vinylmethyether/maleic anydride copolymers, polyacrylic acid, polyacrylamide, polyacrylonitrile, carboxymethylcellulose, poly(1,4-anhydro-β-D-mannuronic acid), poly(1,3(1,4)-D-galactose-2-sulfate), poly(1,4-D-galacturonic acid), polyethylene-polypropylene block copolymers, polyethoxylated alkylalcohols, high and low molecular weight lignosulfates, and high and low molecular weight Kraft lignins, and sulfonates, hydrolysates and salts thereof, and combinations thereof.

22. The method of claim 18, wherein the conductive substantially water soluble ionic surfactant is selected from the group consisting of (a) alkali monocarboxylate, alkali polycarboxylate, alkali sulfocarboxylate, alkali phosphocarboxylate, alkali sulfocarboxylic ester, alkali phosphono ester, alkali sulfate, alkali polysulfate, alkali thiosulfate, alkali alkyl sulfonate, alkali hydroxyalkyl sulfonate, alkali sulfosuccinate diester, alkali alkaryl sulfonate, alkali oxypropylsulfate, alkali oxyethylene sulfate, aliphatic amine, alkyl ammonium halide, alkyl quinolinium, and (b) ionic surfactants having the general formula C-A where C is a cation selected from the group consisting of N-alkyl-pyridinium and 1,3-dialkylimidazolium and A is an anion selected from the group consisting of bromide, iodide, chloride, fluoride, trifluoroalkylsulfonate, tetrachloroaluminate, hexafluorophosphate, tetrafluoroborate, nitrate, triflate, nonaflate, bis(trifyl)amide, trifluoroacetate, and h,eptafluorobutanoate, and (c) combinations thereof.

23. The method of claim 18, wherein the substantially water soluble ionic surfactant concentration in the supplemental electrolytic fluid is in a range from about 0.5 wt % to about 10 wt %.

24. The method of claim 18, wherein the conductive substantially water soluble zwitterion is selected from the group consisting of aminoethanoic acid, amino acid and combinations thereof.

25. The method of claim 18, wherein the zwitterion concentration in the supplemental electrolytic fluid is in a range from about 1 wt % to about 30 wt %.

26. The method of claim 1, wherein at least one of the first and second electrode zone is established by placing the at least one of the first and second conductor in a region of the formation having indigenous electrolytic fluid that provides an electrode zone with a desired size and geometric shape around the at least one of the first and second conductor.

27. The method of claim 1, wherein the first and second electrodes are substantially parallel to each other.

28. The method of claim 27, wherein $\Gamma_p$, the ratio of the rate of temperature increase for the heated portion of at least one electrode zone versus the rate of temperature increase for the heated portion at an effective mid-point between the first and second electrode zones, is greater than or equal to about 0.2, where $\Gamma_p$ is defined by:

$$\Gamma_p = \frac{D^2 - r_a^2 + r_b^2}{16D^2 r_b^2}\sqrt{D^4 - 2D^2(r_a^2 + r_b^2) + (r_a^2 - r_b^2)^2}$$

where D is the distance from the centerline of the first electrode zone to the centerline of the second electrode zone;

$r_a$ is the radius of one of the first and second electrode zones;

$r_b$ is the radius of the other of the first and second electrode zones; and $r_a$ is greater than or equal to $r_b$.

29. The method of claim 28, wherein $\Gamma_p$ is in a range from about 0.5 to about 30.

30. The method of claim 27, wherein at least the first and second electrodes are each substantially horizontal and in a parallel arrangement with respect to each other.

31. The method of claim 1, wherein the electric potential difference is generated by an electric current selected from the group consisting of alternating current, direct current and combinations thereof.

32. The method of claim 31, wherein the frequency of the alternating current is in a range from about 20 hertz to about 1000 hertz.

33. The method of claim 31, wherein the electric current is reduced after a pre-determined time interval.

34. A use of the method of claim 1 for initializing a steam-assisted gravity drainage process for recovering hydrocarbons.

35. A method for heating a subterranean formation having hydrocarbons, the method comprising:

(a) providing at least a first conductor and a second conductor, wherein (i) the first and second conductor are spaced-apart in the formation, and (ii) there is electrical connectivity between the first and second conductors;

(b) establishing at least a first electrode zone and a second electrode zone, each electrode zone having electrolyte, around the first and second conductors, respectively, and thereby creating a target region, having a center point, between opposing faces of the first and second electrode zones, wherein each electrode zone has an average effective radius that is at least about 2.3% of the distance between the centerline of the first conductor and the centerline of the second conductor; and (c) establishing at least about a 50% difference in electrical conductivity between the target region and independently each of the first and second electrode zones, wherein the electrical conductivity of the first and second electrode zones are each independently greater than an initial electrical conductivity of the target region, wherein the initial electrical conductivity of the target region is the average electrical conductivity, prior to applying an electric potential difference between the first and second electrode zones, in a substantially spherical portion centered around the center point of the target region, the substantially spherical portion of the target region having a radius of about 15% of the average spacing between opposing faces of the first and second electrode zones;

so that at about 10% of a predetermined time interval over which an electric potential difference is continuously applied between the first and second electrode zones, there is at most about 60% deviation between the maximum and minimum values for a gamma ratio, Γ, generated within the target region, wherein %Γ deviation is calculated as:

$$\%\Gamma\text{Deviation}=[(\Gamma_{max}-\Gamma_{min})/\Gamma_{max}]\times 100$$

where

%Γ Deviation is the deviation of Γ values determined in a target region divided into n imaginary layers, wherein each imaginary layer has a highest temperature $T_n$ at a point radially located a distance x from the first conductor and the thickness of the imaginary layer is determined by the length of an imaginary line parallel to and a radial distance x from the first conductor, wherein the temperature values along the imaginary line fall in a range $T_n \geqq T \geqq 0.85T_n$, as measured at about the initial 10% of the continuous electric heating time interval;

n is greater than or equal to 2;

$\Gamma_{max}$ is the highest Γ of the n respective Γ values determined in the n layers at about the initial 10% of the continuous electric heating time interval;

$\Gamma_{min}$ is the lowest Γ of the n respective Γ values determined in the n layers at about the initial 10% of the continuous electric heating time interval; and Γ is a ratio of a rate of temperature increase for the portion of the target region having the highest temperature value versus a rate of temperature increase at an effective mid-point between the first and second electrode zones.

36. The method of claim 35, wherein the %Γ deviation is at most about 55%.

37. The method of claim 35, wherein the target region provides a substantially uniform spacing between opposing faces of the at least first and second electrode zones.

38. The method of claim 35, wherein at least one of the first and second conductors is a well.

39. The method of claim 35, wherein both the first and second conductors are wells.

40. The method of claim 39, wherein the first well is an injection well and the second well is a substantially horizontal production well.

41. The method of claim 35, wherein at about 10% of a predetermined time interval over which an electric potential difference is continuously applied between the first and second electrode zones, there is at most about 40% deviation between the highest and lowest maximum temperatures, $T_{max}$ generated within the target region, wherein the $\%T_{max}$ deviation is calculated as:

$$\%T_{max}\text{Deviation}=[(T_{max-high}-T_{max-low})/T_{max-high}]\times 100$$

where $\%T_{max}$ Deviation is the deviation of $T_{max}$ values determined in a target region divided into n imaginary layers, wherein each imaginary layer has a highest temperature $T_n$ at a point radially located a distance x from the first conductor and the thickness of the imaginary layer is determined by the length of an imaginary line parallel to and a radial distance x from the first conductor, wherein the temperature values along the imaginary line fall In a range $T_n \geqq T \geqq 0.85T_n$, as measured at about the initial 10% of the continuous electric heating time interval;

n is greater than or equal to 2;

$T_{max-high}$ is the highest $T_{max}$ of the n respective $T_{max}$ values determined in the n layers at about the initial 10% of the continuous electric heating time interval; and $T_{max-low}$ is the lowest $T_{max}$ of the n respective $T_{max}$ values determined in the n layers at about the initial 10% of the continuous electric heating time interval.

42. The method of claim 35, wherein the first and second electrodes are substantially parallel to each other.

43. The method of claim 42, wherein at least the first and second electrodes are each substantially horizontal and in a parallel arrangement with respect to each other.

44. The method of claim 35, wherein each electrode zone independently has an effective radius in a range from about 1.3 times to about 200 times the radius of the respective conductor.

45. The method of claim 35, wherein at least one of the first and second electrode zone is established by injecting a supplemental electrolytic fluid into the formation around the respective conductor.

46. The method of claim 45, wherein the supplemental electrolytic fluid comprises an ion producing substance selected from the group consisung of a substantially water soluble salt, a substantially water soluble ionic surfactant, a conductive substantially water soluble polyrner, a substantially water soluble zwitterion, and combinations thereof.

47. The method of claim 46, wherein the substantially water soluble salt is selected from the group consisting of NaCl, KCl, $MgCl_2$, $CaCl_2$, $Na_3(PO_4)$, $K_3(PO_4)$, $NaNO_3$, $KNO_3$, $Na_2SO_4$, $K_2SO_4$, $MgSO_4$, $CaSO_4$, $Na_2CO_3$, $K_2CO_3$, $NaC_2H_3O_2$, $KC_2H_3O_2$, NaBr, KBr and combinations thereof.

48. The method of claim 46, wherein the salt concentration in the supplemental electrolytic fluid is in a range from about 0.1 wt % to about 30 wt %.

49. The method of claim 46, wherein the conductive substantially water soluble polymer is selected from the group consisting of styrenelmaleic anhydride copolymers, polyvinylpyridium, polyvinylacetates, vinylmethyether/maleic anydride copolymers, polyacrylic acid, polyacrylamide, polyacrylonitrile, carboxymethylcellulose, poly(1,4-anhydro-β-D-mannuronic acid), poly(1,3(1,4)-D-galactose-2-sulfate), poly(1,4-D-galacturonic acid), polyethylene-polypropylene block copolymers, polyethoxylated alkylalcohols, high and low molecular weight lignosulfates, and high and low molecular weight Kraft lignins, and sulfonates, hydrolysates and salts thereof, and combinations thereof.

50. The method of claim 46, wherein the conductive substantially water soluble ionic surfactant is selected from the group consisting of (a) alkali monocarboxylate, alkali polycarboxylate, alkali sulfocarboxylate, alkali phosphocarboxylate, alkali sulfocarboxylic ester, alkali phosphono ester, alkali sulfate, alkali polysulfate, alkali thiosulfate, alkali alkyl sulfonate, alkali hydroxyalkyl sulfonate, alkali sulfosuccinate diester, alkali alkaryl sulfonate, alkali oxypropylsulfate, alkali oxyethylene sulfate, aliphatic amine, alkyl ammonium halide, alkyl quinolinium, and (b) ionic surfactants having the general formula C-A where C is a cation selected from the group consisting of N-alkyl-pyridinium and 1,3-dialkylimidazolium and A is an anion selected from the group consisting of bromide, iodide, chloride, fluoride, trifluoroalkylsulfonate, tetrachloroaluminate, hexafluorophosphate, tetrafluoroborate, nitrate, triflate, nonaflate, bis(trifyl)amide, trifluoroacetate, and heptafluorobutanoate, and (c) combinations thereof.

51. The method of claim 46, wherein the substantially water soluble ionic surfactant concentration in the supplemental electrolytic fluid is in a range from about 0.5 wt % to about 10 wt %.

52. The method of claim 46, wherein the conductive substantially water soluble zwitterhon is selected from the group consisting of aminoethanoic acid, amino acid and combinations thereof.

53. The method of claim 46, wherein the zwitterion concentration in the supplemental electrolytic fluid is in a range from about 1 wt % to about 30 wt %.

54. The method of claim 35, wherein at least one of the first and second electrode zone is established by placing the at least one of the first and second conductor in a region of the formation having indigenous electrolytic fluid that provides an electrode zone with a desired size and geometric shape around the at least one of the first and second conductor.

55. The method of claim 35, wherein at least one electrode zone is established by locating its respective electrode in a region of the formation comprising residual electrolytic fluid and any other fluid in place and having an electrical conductivity at least about 50% greater than the initial electrical conductivity of the target region.

56. The method of claim 35, wherein the electric potential difference is generated by an electric current selected from the group consisting of alternating current, direct current and combinations thereof.

57. The method of claim 56, wherein the frequency of the alternating current is in a range from about 20 hertz to about 1000 hertz.

58. The method of claim 56, wherein the electric current is reduced after a pre-determined time interval.

59. A method for heating a subterranean formation having hydrocarbons, the method comprising:

(a) providing at least a first conductor and a second conductor, wherein
  (i) the first and second conductor are spaced-apart in the formation, and
  (ii) there is electrical connectivity between the first and second conductors;

(b) establishing at least a first electrode zone and a second electrode zone, each electrode zone having electrolyte, around the first and second conductors, respectively, and thereby creating a target region, having a center point, between opposing faces of the first and second electrode zones, wherein each electrode zone has an average effective radius that is at least about 2.3% of the distance between the centerline of the first conductor and the centerline of the second conductor; and (c) establishing at least about a 50% difference in electrical conductivity between the target region and independently each of the first and second electrode zones, wherein the electrical conductivity of the first and second electrode zones are each independently greater than the initial electrical conductivity of the target region, wherein the initial electrical conductivity of the target region is the average electrical conductivity, prior to applying an electric potential difference between the first and second electrode zones, in a substantially spherical portion centered around the center point of the target region, the substantially spherical portion of the target region having a radius of about 15% of the average spacing between the opposing faces of the first and second electrode zones;

so that at about 10% of a predetermined time interval over which an electric potential difference is continuously applied between the first and second electrode zones, there is at most about 35% deviation between the highest and lowest maximum temperatures, $T_{max}$, generated within the target region, wherein $\%T_{max}$ deviation is calculated as:

$$\%T_{max}\text{Deviation}=[(T_{max-high}-T_{max-low})/T_{max-high}]\times 100$$

where $\%T_{max}$ Deviation is the deviation of $T_{max}$ values determined in a target region divided into n imaginary layers, wherein each imaginary layer has a highest temperature $T_n$ at a point radially located a distance x from the first conductor and the thickness of the imaginary layer is determined by the length of an imaginary line parallel to and a radial distance x from the first conductor, wherein the temperature values along the imaginary line fall in a range $T_n \geqq T \geqq 0.85T_n$, as measured at about the initial 10% of a continuous electric heating time interval;

n is greater than or equal to 2;

$T_{max-high}$ is the highest $T_{max}$ of the n respective $T_{max}$ values determined in the n layers at about the initial 10% of the continuous electric heating time interval; and $T_{max-low}$ is the lowest $T_{max}$ of the n respective $T_{max}$ values determined in the n layers at about the initial 10% of the continuous electric heating time interval.

60. The method of claim 59, wherein the $\%T_{max}$ deviation is at most about 30%.

61. The method of claim 59, wherein the target region provides a substantially uniform spacing between opposing faces of the at least first and second electrode zones.

62. The method of claim 59, wherein at least one of the first and second conductors is a well.

63. The method of claim 69, wherein both the first and second conductors are wells.

64. The method of claim 59, wherein at least one of the first and second electrode zone is established by placing the at least one of the first and second conductor in a region of the formation having indigenous electrolytic fluid that provides an electrode zone with a desired size and geometric shape around the at least one of the first and second conductor.

65. The method of claim 63, wherein the first well is an injection well and the second well is a substantially horizontal production well.

66. The method of claim 59, wherein at about 10% of a predetermined time interval over which an electric potential difference is continuously applied between the first and second electrode zones, there is at most about 60% deviation between the maximum and minimum values for a gamma, Γ, ratio generated within the target region, wherein %Γ deviation is calculated as:

$$\%\Gamma\text{Deviation}=[(\Gamma_{max}-\Gamma_{min})/\Gamma_{max}]\times 100$$

where

%Γ Deviation is the deviation of Γ values determined in a target region divided into n imaginary layers, wherein each imaginary layer has a highest temperature $T_n$ at a point radially located a distance x from the first conductor and the thickness of the imaginary layer is determined by the length of an imaginary line parallel to and a radial distance x from the first conductor, wherein the temperature values along the imaginary line fall in a range $T_n \geqq T \geqq 0.85T_n$, as measured at about the initial 10% of the continuous electric heating time interval;

n is greater than or equal to 2;

$\Gamma_{max}$ is the highest Γ of the n respective Γ values determined in the n layers at about the initial 10% of the continuous electric heating time interval;

$\Gamma_{min}$ is the lowest Γ of the n respective Γ values determined in the n layers at about the initial 10% of the continuous electric heating time interval; and Γ is a ratio of a rate of temperature increase for the portion of the target region having the highest temperature value versus a rate of temperature increase at an effective mid-point between the first and second electrode zones.

67. The method of claim 59, wherein the first and second electrodes are substantially parallel to each other.

68. The method of claim 67, wherein at least the first and second electrodes are each substantially horizontal and in a parallel arrangement with respect to each other.

69. The method of claim 59, wherein each electrode zone independently has an effective radius in a range from about 1.3 times to about 200 times the radius of the respective conductor.

70. The method of claim 59, wherein at least one of the first and second electrode zone is established by injecting a supplemental electrolytic fluid into the formation around the respective conductor.

71. The method of claim 70, wherein the supplemental electrolytic fluid comprises an ion producing substance selected from the group consisting of a substantially water soluble salt, a substantially water soluble ionic surfactant, a conductive substantially water soluble polymer, a substantially water soluble zwitterion, and combinations thereof.

72. The method of claim 71, wherein the substantially water soluble salt is selected from the group consisting of NaCl, KCl, $MgCl_2$, $CaCl_2$, $Na_3(PO_4)$, $K_3(PO_4)$, $NaNO_3$, $KNO_3$, $Na_2SO_4$, $K_2SO_4$, $MgSO_4$, $CaSO_4$, $Na_2CO_3$, $K_2CO_3$, $NaC_2H_3O_2$, $KC_2H_3O_2$, NaBr, KBr and combinations thereof.

73. The method of claim 71, wherein the salt concentration in the supplemental electrolytic fluid is in a range from about 0.1 wt % to about 30 wt %.

74. The method of claim 71, wherein the conductive substantially water soluble polymer is selected from the group consisting of styrenelmaleic anhydride copolymers, polyvinylpyridium, polyvinylacetates, vinylmethyetherimaleic anydride copolymers, polyacrylic acid, polyacrylamide, polyacrylonitrile, carboxymethylcellulose, poly(1,4-anhydro-β-D-mannuronic acid), poly(1,3(1,4)-D-galactose-2-sulfate), poly(1,4-D-galacturonic acid), polyethylene-polypropylene block copolymers, polyethoxylated alkylalcohols, high and low molecular weight lignosulfates, and high and low molecular weight Kraft lignins, and sulfonates, hydrolysates and salts thereof, and combinations thereof.

75. The method of claim 71, wherein the conductive substantially water soluble ionic surfactant is selected from the group consisting of (a) alkali monocarboxylate, alkali polycarboxylate, alkali sulfocarboxylate, alkali phosphocarboxylate, alkali sulfocarboxylic ester, alkali phosphono ester, alkali sulfate, alkali polysulfate, alkali thiosulfate, alkali alkyl sulfonate, alkali hydroxyalkyl sulfonate, alkali sulfosuccinate diester, alkali alkaryl sulfonate, alkali oxypropylsulfate, alkali oxyethylene sulfate, aliphatic amine, alkyl ammonium halide, alkyl quinolinium, and (b) ionic surfactants having the general formula C-A where C is a cation selected from the group consisting of N-alkyl-pyridinium and 1,3-dialkylimidazolium and A is an anion selected from the group consisting of bromide, iodide, chloride, fluoride, trifluoroalkylsulfonate, tetrachloroaluminate, hexafluorophosphate, tetrafluoroborate, nitrate, triflate, nonaflate, bis(trifyl)amide, trifluoroacetate, and heptafluorobutanoate, and (c) combinations thereof.

76. The method of claim 71, wherein the substantially water soluble ionic surfactant concentration in the supplemental electrolytic fluid is in a range from about 0.5 wt % to about 10 wt %.

77. The method of claim 71, wherein the conductive substantially water soluble zwitterion is selected from the group consisting of aminoethanoic acid, amino acid and combinations thereof.

78. The method of claim 71, wherein the zwitterion concentration in the supplemental electrolytic fluid is in a range from about 1 wt % to about 30 wt %.

79. The method of claim 59, wherein at least one electrode zone is established by locating its respective electrode in a region of the formation comprising residual electrolytic fluid and any other fluid in place and having an electrical conductivity at least about 50% greater than the initial electrical conductivity of the target region.

80. The method of claim 59, wherein the electric potential difference is generated by an electric current selected from the group consisting of alternating current, direct current and combinations thereof.

81. The method of claim 80, wherein the frequency of the alternatng current is in a range from about 20 hertz to about 1000 hertz.

82. The method of claim 80, wherein the electric current is reduced after a pre-determined time interval.

* * * * *